US008316936B2

(12) United States Patent
Roddy et al.

(10) Patent No.: US 8,316,936 B2
(45) Date of Patent: Nov. 27, 2012

(54) USE OF MICRO-ELECTRO-MECHANICAL SYSTEMS (MEMS) IN WELL TREATMENTS

(75) Inventors: Craig W. Roddy, Duncan, OK (US); Rick L. Covington, Frisco, TX (US); Krishna M. Ravi, Kingwood, TX (US); Clovis Bonavides, Houston, TX (US); Michael Bittar, Houston, TX (US); Gordon Moake, Houston, TX (US); Batakrishna Mandal, Missouri City, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 0 days.

(21) Appl. No.: 13/031,535

(22) Filed: Feb. 21, 2011

(65) Prior Publication Data

US 2011/0186290 A1 Aug. 4, 2011

Related U.S. Application Data

(63) Continuation-in-part of application No. 12/618,067, filed on Nov. 13, 2009, which is a continuation-in-part of application No. 11/695,329, filed on Apr. 2, 2007, now Pat. No. 7,712,527.

(51) Int. Cl.
*E21B 47/10* (2012.01)
*E21B 33/13* (2006.01)

(52) U.S. Cl. ..... 166/253.1; 166/285; 166/66

(58) Field of Classification Search ..... 166/250.01, 166/66, 285, 253.1, 292
See application file for complete search history.

(56) References Cited

U.S. PATENT DOCUMENTS 3,239,005 A 3/1966 Bodine, Jr.
3,930,220 A 12/1975 Shawhan
4,156,229 A 5/1979 Shawhan
(Continued)

FOREIGN PATENT DOCUMENTS

EP 1830035 A1 9/2007
(Continued)

OTHER PUBLICATIONS

Advanced Design Consulting USA brochure entitled "MEMS concrete monitoring system," http://www.adc9001.com/index/php?src=memsconcrete&print=1, 2006, 1 page, Advanced Design Consulting USA, Inc.

(Continued)

*Primary Examiner* — Kenneth L Thompson
(74) *Attorney, Agent, or Firm* — Craig W. Roddy; Conley Rose, P.C.

(57) ABSTRACT

A method of servicing a wellbore, comprising placing a wellbore composition comprising a plurality of Micro-Electro-Mechanical System (MEMS) sensors in the wellbore, placing a plurality of acoustic sensors in the wellbore, obtaining data from the MEMS sensors and data from the acoustic sensors using a plurality of data interrogation units spaced along a length of the wellbore, and transmitting the data obtained from the MEMS sensors and the acoustic sensors from an interior of the wellbore to an exterior of the wellbore. A method of servicing a wellbore, comprising placing a wellbore composition comprising a plurality of Micro-Electro-Mechanical System (MEMS) sensors in the wellbore, and obtaining data from the MEMS sensors using a plurality of data interrogation units spaced along a length of the wellbore, wherein one or more of the data interrogation units is powered by a turbo generator or a thermoelectric generator located in the wellbore.

19 Claims, 46 Drawing Sheets

U.S. PATENT DOCUMENTS 4,234,344 A 11/1980 Tinsley et al.
4,298,970 A 11/1981 Shawhan et al.
4,390,975 A 6/1983 Shawhan
4,512,401 A 4/1985 Bodine
4,653,587 A 3/1987 Bodine
4,736,794 A 4/1988 Bodine
5,121,795 A 6/1992 Ewert et al.
5,123,487 A 6/1992 Harris et al.
5,127,473 A 7/1992 Harris et al.
5,213,161 A 5/1993 King et al.
5,220,960 A 6/1993 Totten et al.
5,281,270 A 1/1994 Totten et al.
5,298,069 A 3/1994 King et al.
5,346,012 A 9/1994 Heathman et al.
5,437,329 A 8/1995 Brooks et al.
5,524,709 A 6/1996 Withers
5,588,488 A 12/1996 Vijn et al.
5,627,749 A 5/1997 Waterman et al.
5,839,508 A 11/1998 Tubel et al.
5,991,602 A 11/1999 Sturm
5,995,477 A 11/1999 Smith et al.
6,041,861 A 3/2000 Mandal et al.
6,063,738 A 5/2000 Chatterji et al.
6,101,447 A 8/2000 Poe, Jr.
6,125,935 A 10/2000 Shahin, Jr.
6,234,257 B1 5/2001 Ciglenec et al.
6,241,028 B1 6/2001 Bijleveld et al.
6,244,342 B1 6/2001 Sullaway et al.
6,269,685 B1 8/2001 Oden
6,324,904 B1 12/2001 Ishikawa et al.
6,367,550 B1 4/2002 Chatterji et al.
6,374,913 B1 4/2002 Robbins et al.
6,429,784 B1 8/2002 Beique et al.
6,443,228 B1 9/2002 Aronstam et al.
6,457,524 B1 10/2002 Roddy
6,485,560 B1 11/2002 Scherer et al.
6,547,871 B2 4/2003 Chatterji et al.
6,597,175 B1 7/2003 Brisco
6,664,215 B1 12/2003 Tomlinson
6,693,554 B2 2/2004 Beique et al.
6,697,738 B2 2/2004 Ravi et al.
6,702,044 B2 3/2004 Reddy et al.
6,712,138 B2 3/2004 Mandal
6,722,433 B2 4/2004 Brothers et al.
6,722,434 B2 4/2004 Reddy et al.
6,735,630 B1 * 5/2004 Gelvin et al. ..... 709/224
6,745,833 B2 6/2004 Aronstam et al.
6,775,578 B2 8/2004 Couet et al.
6,789,619 B2 9/2004 Carlson et al.
6,802,373 B2 10/2004 Dillenbeck et al.
6,802,374 B2 10/2004 Edgar et al.
6,823,940 B2 11/2004 Reddy et al.
6,834,722 B2 12/2004 Vacik et al.
6,847,034 B2 1/2005 Shah et al.
6,848,519 B2 2/2005 Reddy et al.
6,891,477 B2 * 5/2005 Aronstam ..... 340/606
6,898,529 B2 5/2005 Gao et al.
6,904,366 B2 6/2005 Patzek et al.
6,915,848 B2 7/2005 Thomeer et al.
6,920,929 B2 7/2005 Bour
6,922,637 B2 7/2005 Ravi et al.
6,925,392 B2 8/2005 McNeil, III et al.
6,976,535 B2 12/2005 Aronstam et al.
6,994,167 B2 2/2006 Ramos et al.
6,995,677 B2 * 2/2006 Aronstam et al. ..... 340/606
7,003,405 B1 * 2/2006 Ho ..... 702/32
7,004,021 B2 2/2006 Bilby et al.
7,036,363 B2 5/2006 Yogeswaren
7,036,586 B2 5/2006 Roddy et al.
7,038,470 B1 5/2006 Johnson
7,040,404 B2 5/2006 Brothers et al.
7,044,222 B2 5/2006 Tomlinson
7,046,164 B2 5/2006 Gao et al.
7,066,256 B2 6/2006 Dillenbeck et al.
7,066,284 B2 6/2006 Wylie et al.
7,077,203 B1 7/2006 Roddy et al.
7,082,993 B2 8/2006 Ayoub et al.
7,104,116 B2 9/2006 Discenzo
7,107,154 B2 9/2006 Ward
7,116,542 B2 10/2006 Lerche et al.
7,133,778 B2 11/2006 Ravi et al.
7,140,434 B2 11/2006 Chouzenoux et al.
7,140,437 B2 11/2006 McMechan et al.
7,145,473 B2 12/2006 Wisler et al.
7,152,466 B2 12/2006 Ramakrishnan et al.
7,156,174 B2 1/2007 Roddy et al.
7,174,962 B1 2/2007 Roddy et al.
7,213,647 B2 5/2007 Brothers et al.
7,225,879 B2 6/2007 Wylie et al.
7,303,014 B2 12/2007 Reddy et al.
7,357,181 B2 4/2008 Webb et al.
7,389,819 B2 6/2008 Oyeneyin et al.
7,392,697 B2 7/2008 Chikenji et al.
7,434,457 B2 10/2008 Goodwin et al.
7,455,108 B2 11/2008 Jenkins et al.
7,461,547 B2 12/2008 Terabayashi et al.
7,493,962 B2 2/2009 Sheffield
7,581,434 B1 9/2009 Discenzo et al.
7,617,879 B2 11/2009 Anderson et al.
7,631,697 B2 12/2009 Bhavsar
7,636,671 B2 12/2009 Caveny et al.
7,647,979 B2 1/2010 Shipley et al.
7,673,679 B2 3/2010 Harrison et al.
7,712,527 B2 5/2010 Roddy
7,717,180 B2 5/2010 Badalamenti et al.
7,750,808 B2 7/2010 Masino et al.
7,784,339 B2 8/2010 Cook et al.
8,168,570 B2 5/2012 Barron et al.
2002/0046147 A1 4/2002 Livesay et al.
2002/0196993 A1 * 12/2002 Schroeder ..... 385/12
2003/0029611 A1 2/2003 Owens
2003/0205376 A1 11/2003 Ayoub et al.
2005/0006020 A1 1/2005 Jose Zitha et al.
2005/0183858 A1 * 8/2005 Ayoub et al. ..... 166/250.1
2005/0224123 A1 10/2005 Baynham et al.
2006/0170535 A1 8/2006 Watters et al.
2007/0131414 A1 6/2007 Calderoni et al.
2008/0007421 A1 1/2008 Liu et al.
2008/0196889 A1 8/2008 Bour et al.
2009/0022011 A1 1/2009 Mickael et al.
2009/0033516 A1 * 2/2009 Alteirac et al. ..... 340/853.2
2009/0120168 A1 5/2009 Harrison et al.
2010/0039898 A1 2/2010 Gardner et al.
2010/0050905 A1 3/2010 Lewis et al.
2010/0051266 A1 3/2010 Roddy et al.
2010/0051275 A1 3/2010 Lewis et al.
2010/0102986 A1 4/2010 Benischek et al.
2010/0139386 A1 6/2010 Taylor

FOREIGN PATENT DOCUMENTS

EP 2129867 10/2008
EP 23336487 A1 6/2011
EP 2343434 A1 7/2011
GB 2367133 A 3/2002
GB 2391565 A 2/2004
GB 2431400 A 4/2007
WO 9966172 A1 12/1999
WO 0206628 A1 1/2002
WO 2006136635 A2 12/2006
WO 2006136635 A3 12/2006
WO 2008119963 A1 10/2008
WO 2009008735 A1 1/2009

OTHER PUBLICATIONS

Drumheller, D. S., "An overview of acoustic telemetry," 7 pages, not dated but admitted as prior art.

Foreign communication from a related counterpart application—International Search Report and Written Opinion, PCT/GB2008/001084, Jul. 8, 2008, 10 pages.

Foreign communication from a related counterpart application—Examination Report, European patent application No. 08718914.8, May 4, 2010, 5 pages.

Halliburton brochure entitled "Spherelite™ cement additive," Nov. 2006, 1 page, Halliburton.

International Road Dynamics brochure entitled "Concrete maturity monitor: wireless technology in the palm of your hand," Jun. 2002, 5 pages, International Road Dynamics Inc.
NASA, "Ultrasonic testing of aerospace materials," Preferred Reliability Practices, Practice No. PT-TE-1422, 6 pages, not dated but admitted as prior art.
Ong, Keat Ghee, et al., "A wireless, passive carbon nanotube-based gas sensor," IEEE Sensors Journal, Apr. 2002, pp. 82-88, vol. 2, No. 2, IEEE.
Ong, K. G., et al., "Design and application of a wireless, passive, resonant-circuit environmental monitoring sensor," Sensors and Actuators A, 2001, pp. 33-43, vol. 93, Elsevier Science B.V.
Patent application entitled "Use of micro-electro-mechanical systems (MEMS) in well treatments," by Craig W. Roddy, filed Feb. 21, 2011 as U.S. Appl. No. 13/031,513.
Patent application entitled "Use of micro-electro-mechanical systems (MEMS) in well treatments," by Craig W. Roddy, filed Feb. 21, 2011 as U.S. Appl. No. 13/031,515.
Patent application entitled "Use of micro-electro-mechanical systems (MEMS) in well treatments," by Craig W. Roddy, filed Feb. 21, 2011 as U.S. Appl. No. 13/031,519.
Patent application entitled "Use of micro-electro-mechanical systems (MEMS) in well treatments," by Craig W. Roddy, filed Feb. 21, 2011 as U.S. Appl. No. 13/031,524.
Patent application entitled "Use of micro-electro-mechanical systems (MEMS) in well treatments," by Craig W. Roddy, filed Feb. 21, 2011 as U.S. Appl. No. 13/031,527.
Patent application entitled "Use of micro-electro-mechanical systems (MEMS) in well treatments," by Craig W. Roddy, filed Feb. 21, 2011 as U.S. Appl. No. 13/031,536.
Patent application entitled "Use of micro-electro-mechanical systems (MEMS) in well treatments," by Craig W. Roddy, filed Feb. 21, 2011 as U.S. Appl. No. 13/031,539.
Ravi, Kris, et al., "Cementing process optimized to achieve zonal isolation," Petrotech, 2007, 6 pages, Halliburton.
Foreign communication from a related counterpart application—International Search Report and Written Opinion, PCT/GB2010001580, Apr. 21, 2011, 10 pages.
Foreign communication from a related counterpart application—International Search Report and Written Opinion, PCT/GB2010001590, Apr. 21, 2011, 10 pages.
Foreign communication from a related counterpart application—International Search Report and Written Opinion, PCT/GB2010002089, Apr. 21, 2011, 10 pages.
Foreign communication from a related counterpart application—European Search Report, European patent application No. 11159483.4, May 5, 2011, 4 pages.
Foreign communication from a related counterpart application—European Search Report, European patent application No. 11159484.2, May 6, 2011, 4 pages.
Foreign communication from a related counterpart application—European Patent Office communication, European patent application No. 08718914.8, May 31, 2011, 4 pages.
Office Action dated Mar. 9, 2012 (26 pages), U.S. Appl. No. 12/618,067, filed Nov. 13, 2009.
Office Action dated Mar. 9, 2012 (26 pages), U.S. Appl. No. 13/031,524, filed Feb. 21, 2011.
Office Action dated Mar. 12, 2012 (26 pages), U.S. Appl. No. 13/031,527, filed Feb. 21, 2011.
Office Action dated Mar. 13, 2012 (26 pages), U.S. Appl. No. 13/031,536, filed Feb. 21, 2011.
Office Action dated Mar. 14, 2012 (25 pages), U.S. Appl. No. 13/031,539, filed Feb. 21, 2011.
Foreign communication from a related counterpart application—European Search Report, EP Application No. 12167946.8, Jul. 6, 2012, 6 pages.
Foreign communication from a related counterpart application—Supplementary European Search Report, EP Application No. 12167947.6, Jul. 6, 2012, 6 pages.
Foreign communication from a related counterpart application—European Patent Office communication, EP Application No. 11159483.4, Jul. 16, 2012, 4 pages.
Office Action (Final) dated Aug. 15, 2012 (8 pages), U.S. Appl. No. 12/618,067, filed Nov. 13, 2009.
Notice of Allowance dated Aug. 17, 2012 (20 pages), U.S. Appl. No. 13/031,536, filed Feb. 21, 2011.
Notice of Allowance dated Aug. 16, 2012 (7 pages), U.S. Appl. No. 13/031,539, filed Feb. 21, 2011.

* cited by examiner

USE OF MICRO-ELECTRO-MECHANICAL SYSTEMS (MEMS) IN WELL TREATMENTS

CROSS-REFERENCE TO RELATED APPLICATIONS

This is a continuation-in-part application of U.S. patent application Ser. No. 12/618,067 filed on Nov. 13, 2009, published as U.S. Patent Application Publication No. 2010/0051266 A1, which is a continuation-in-part application of U.S. patent application Ser. No. 11/695,329, now U.S. Pat. No. 7,712,527, both entitled "Use of Micro-Electro-Mechanical Systems (MEMS) in Well Treatments," each of which is hereby incorporated by reference herein in its entirety.

BACKGROUND OF THE INVENTION

1. Field of the Invention

This disclosure relates to the field of drilling, completing, servicing, and treating a subterranean well such as a hydrocarbon recovery well. In particular, the present disclosure relates to systems and methods for detecting and/or monitoring the position and/or condition of a wellbore, the surrounding formation, and/or wellbore compositions, for example wellbore sealants such as cement, using MEMS-based data sensors. Still more particularly, the present disclosure describes systems and methods of monitoring the integrity and performance of the wellbore, the surrounding formation and/or the wellbore compositions from drilling/completion through the life of the well using MEMS-based data sensors.

2. Background of the Invention

Natural resources such as gas, oil, and water residing in a subterranean formation or zone are usually recovered by drilling a wellbore into the subterranean formation while circulating a drilling fluid in the wellbore. After terminating the circulation of the drilling fluid, a string of pipe (e.g., casing) is run in the wellbore. The drilling fluid is then usually circulated downward through the interior of the pipe and upward through the annulus, which is located between the exterior of the pipe and the walls of the wellbore. Next, primary cementing is typically performed whereby a cement slurry is placed in the annulus and permitted to set into a hard mass (i.e., sheath) to thereby attach the string of pipe to the walls of the wellbore and seal the annulus. Subsequent secondary cementing operations may also be performed. One example of a secondary cementing operation is squeeze cementing whereby a cement slurry is employed to plug and seal off undesirable flow passages in the cement sheath and/or the casing. Non-cementitious sealants are also utilized in preparing a wellbore. For example, polymer, resin, or latex-based sealants may be desirable for placement behind casing.

To enhance the life of the well and minimize costs, sealant slurries are chosen based on calculated stresses and characteristics of the formation to be serviced. Suitable sealants are selected based on the conditions that are expected to be encountered during the sealant service life. Once a sealant is chosen, it is desirable to monitor and/or evaluate the health of the sealant so that timely maintenance can be performed and the service life maximized. The integrity of sealant can be adversely affected by conditions in the well. For example, cracks in cement may allow water influx while acid conditions may degrade cement. The initial strength and the service life of cement can be significantly affected by the water content and the slurry formulation. Water content, slurry formulation and temperature are the primary drivers for the hydration of cement slurries. Thus, it is desirable to measure one or more sealant parameters (e.g., moisture content, temperature, pH and ion concentration) in order to monitor sealant integrity.

Active, embeddable sensors can involve drawbacks that make them undesirable for use in a wellbore environment. For example, low-powered (e.g., nanowatt) electronic moisture sensors are available, but have inherent limitations when embedded within cement. The highly alkali environment can damage their electronics, and they are sensitive to electromagnetic noise. Additionally, power must be provided from an internal battery to activate the sensor and transmit data, which increases sensor size and decreases useful life of the sensor. Accordingly, an ongoing need exists for improved methods of monitoring wellbore sealant condition from placement through the service lifetime of the sealant.

Likewise, in performing wellbore servicing operations, an ongoing need exists for improvements related to monitoring and/or detecting a condition and/or location of a wellbore, formation, wellbore servicing tool, wellbore servicing fluid, or combinations thereof. Such needs may be meet by the novel and inventive systems and methods for use of MEMS sensors down hole in accordance with the various embodiments described herein.

BRIEF SUMMARY

Disclosed herein is a method of servicing a wellbore, comprising placing a wellbore composition comprising a plurality of Micro-Electro-Mechanical System (MEMS) sensors in the wellbore, placing a plurality of acoustic sensors in the wellbore, obtaining data from the MEMS sensors and data from the acoustic sensors using a plurality of data interrogation units spaced along a length of the wellbore, and transmitting the data obtained from the MEMS sensors and the acoustic sensors from an interior of the wellbore to an exterior of the wellbore.

Further disclosed herein is a method of servicing a wellbore, comprising placing a wellbore composition comprising a plurality of Micro-Electro-Mechanical System (MEMS) sensors in the wellbore, and obtaining data from the MEMS sensors using a plurality of data interrogation units spaced along a length of the wellbore, wherein one or more of the data interrogation units is powered by a turbo generator or a thermoelectric generator located in the wellbore.

Also disclosed herein is a system, comprising a wellbore, a casing positioned in the wellbore, a wellbore composition positioned in the wellbore, the wellbore composition comprising a plurality of Micro-Electro-Mechanical System (MEMS) sensors, a plurality of data interrogation units spaced along a length of the wellbore, wherein one or more of the data interrogation units comprises a radio frequency (RF) transceiver configured to interrogate the MEMS sensors and receive data from the MEMS sensors regarding at least one wellbore parameter measured by the MEMS sensors, and at least one acoustic sensor configured to measure at least one further wellbore parameter.

The foregoing has outlined rather broadly the features and technical advantages of the present disclosure in order that the detailed description that follows may be better understood. Additional features and advantages of the apparatus and method will be described hereinafter that form the subject of the claims of this disclosure. It should be appreciated by those skilled in the art that the conception and the specific embodiments disclosed may be readily utilized as a basis for modifying or designing other structures for carrying out the same purposes of the present disclosure. It should also be realized by those skilled in the art that such equivalent constructions do not depart from the spirit and scope of the apparatus and method as set forth in the appended claims.

BRIEF DESCRIPTION OF THE DRAWINGS

For a detailed description of the embodiments of the apparatus and methods of the present disclosure, reference will now be made to the accompanying drawing in which.

DETAILED DESCRIPTION

Figure 1:
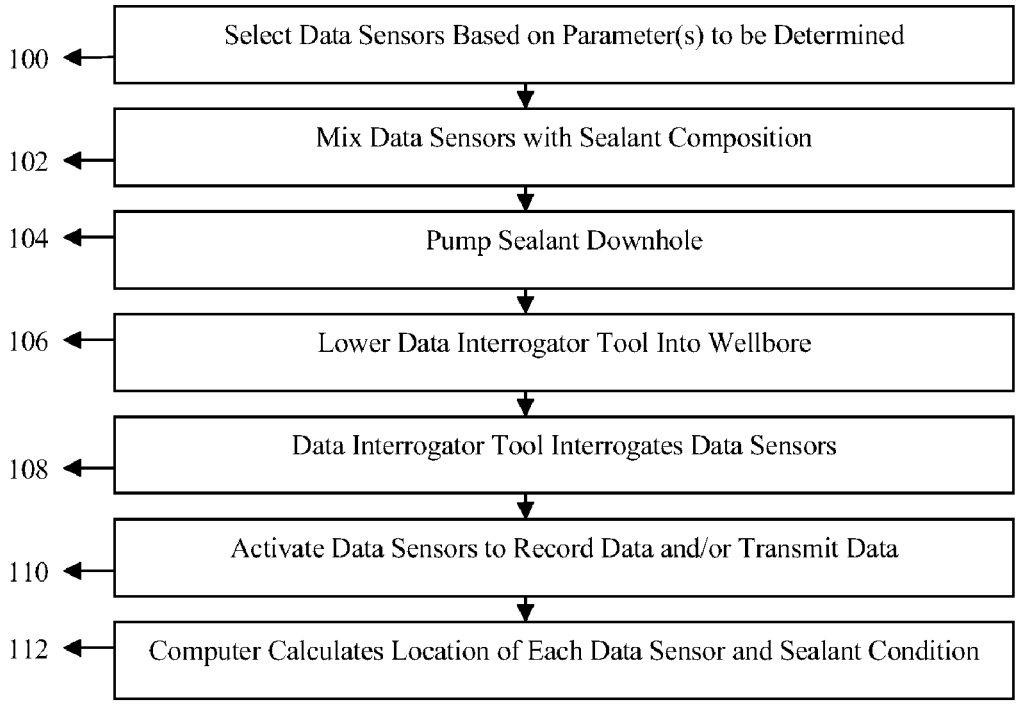
FIG. 1 is a flowchart illustrating an embodiment of a method in accordance with the present disclosure.

Disclosed herein are methods for detecting and/or monitoring the position and/or condition of a wellbore, a formation, a wellbore service tool, and/or wellbore compositions, for example wellbore sealants such as cement, using MEMS-based data sensors. Still more particularly, the present disclosure describes methods of monitoring the integrity and performance of wellbore compositions over the life of the well using MEMS-based data sensors. Performance may be indicated by changes, for example, in various parameters, including, but not limited to, moisture content, temperature, pH, and various ion concentrations (e.g., sodium, chloride, and potassium ions) of the cement. In embodiments, the methods comprise the use of embeddable data sensors capable of detecting parameters in a wellbore composition, for example a sealant such as cement. In embodiments, the methods provide for evaluation of sealant during mixing, placement, and/or curing of the sealant within the wellbore. In another embodiment, the method is used for sealant evaluation from placement and curing throughout its useful service life, and where applicable to a period of deterioration and repair. In embodiments, the methods of this disclosure may be used to prolong the service life of the sealant, lower costs, and enhance creation of improved methods of remediation. Additionally, methods are disclosed for determining the location of sealant within a wellbore, such as for determining the location of a cement slurry during primary cementing of a wellbore as discussed further hereinbelow. Additional embodiments and methods for employing MEMS-based data sensors in a wellbore are described herein.

The methods disclosed herein comprise the use of various wellbore compositions, including sealants and other wellbore servicing fluids. As used herein, "wellbore composition" includes any composition that may be prepared or otherwise provided at the surface and placed down the wellbore, typically by pumping. As used herein, a "sealant" refers to a fluid used to secure components within a wellbore or to plug or seal a void space within the wellbore. Sealants, and in particular cement slurries and non-cementitious compositions, are used as wellbore compositions in several embodiments described herein, and it is to be understood that the methods described herein are applicable for use with other wellbore compositions. As used herein, "servicing fluid" refers to a fluid used to drill, complete, work over, fracture, repair, treat, or in any way prepare or service a wellbore for the recovery of materials residing in a subterranean formation penetrated by the wellbore. Examples of servicing fluids include, but are not limited to, cement slurries, non-cementitious sealants, drilling fluids or muds, spacer fluids, fracturing fluids or completion fluids, all of which are well known in the art. While fluid is generally understood to encompass material in a pumpable state, reference to a wellbore servicing fluid that is settable or curable (e.g., a sealant such as cement) includes, unless otherwise noted, the fluid in a pumpable and/or set state, as would be understood in the context of a given wellbore servicing operation. Generally, wellbore servicing fluid and wellbore composition may be used interchangeably unless otherwise noted. The servicing fluid is for use in a wellbore that penetrates a subterranean formation. It is to be understood that "subterranean formation" encompasses both areas below exposed earth and areas below earth covered by water such as ocean or fresh water. The wellbore may be a substantially vertical wellbore and/or may contain one or more lateral wellbores, for example as produced via directional drilling. As used herein, components are referred to as being "integrated" if they are formed on a common support structure placed in packaging of relatively small size, or otherwise assembled in close proximity to one another.

Discussion of an embodiment of the method of the present disclosure will now be made with reference to the flowchart of FIG. 1, which includes methods of placing MEMS sensors in a wellbore and gathering data. At block 100, data sensors are selected based on the parameter(s) or other conditions to be determined or sensed within the wellbore. At block 102, a quantity of data sensors is mixed with a wellbore composition, for example a sealant slurry. In embodiments, data sensors are added to a sealant by any methods known to those of skill in the art. For example, the sensors may be mixed with a dry material, mixed with one more liquid components (e.g., water or a non-aqueous fluid), or combinations thereof. The mixing may occur onsite, for example addition of the sensors into a bulk mixer such as a cement slurry mixer. The sensors may be added directly to the mixer, may be added to one or more component streams and subsequently fed to the mixer, may be added downstream of the mixer, or combinations thereof. In embodiments, data sensors are added after a blending unit and slurry pump, for example, through a lateral by-pass. The sensors may be metered in and mixed at the well site, or may be pre-mixed into the composition (or one or more components thereof) and subsequently transported to the well site. For example, the sensors may be dry mixed with dry cement and transported to the well site where a cement slurry is formed comprising the sensors. Alternatively or additionally, the sensors may be pre-mixed with one or more liquid components (e.g., mix water) and transported to the well site where a cement slurry is formed comprising the sensors. The properties of the wellbore composition or components thereof may be such that the sensors distributed or dispersed therein do not substantially settle during transport or placement.

The wellbore composition, e.g., sealant slurry, is then pumped downhole at block 104, whereby the sensors are positioned within the wellbore. For example, the sensors may extend along all or a portion of the length of the wellbore adjacent the casing. The sealant slurry may be placed downhole as part of a primary cementing, secondary cementing, or other sealant operation as described in more detail herein. At block 106, a data interrogation tool (also referred to as a data interrogator tool, data interrogator, interrogator, interrogation/communication tool or unit, or the like) is positioned in an operable location to gather data from the sensors, for example lowered or otherwise placed within the wellbore proximate the sensors. In various embodiments, one or more data interrogators may be placed downhole (e.g., in a wellbore) prior to, concurrent with, and/or subsequent to placement in the wellbore of a wellbore composition comprising MEMS sensors. At block 108, the data interrogation tool interrogates the data sensors (e.g., by sending out an RF signal) while the data interrogation tool traverses all or a portion of the wellbore containing the sensors. The data sensors are activated to record and/or transmit data at block 110 via the signal from the data interrogation tool. At block 112, the data interrogation tool communicates the data to one or more computer components (e.g., memory and/or microprocessor) that may be located within the tool, at the surface, or both. The data may be used locally or remotely from the tool to calculate the location of each data sensor and correlate the measured parameter(s) to such locations to evaluate sealant performance. Accordingly, the data interrogation tool comprises MEMS sensor interrogation functionality, communication functionality (e.g., transceiver functionality), or both.

Data gathering, as shown in blocks 106 to 112 of FIG. 1, may be carried out at the time of initial placement in the well of the wellbore composition comprising MEMS sensors, for example during drilling (e.g., drilling fluid comprising MEMS sensors) or during cementing (e.g., cement slurry comprising MEMS sensors) as described in more detail below. Additionally or alternatively, data gathering may be carried out at one or more times subsequent to the initial placement in the well of the wellbore composition comprising MEMS sensors. For example, data gathering may be carried out at the time of initial placement in the well of the wellbore composition comprising MEMS sensors or shortly thereafter to provide a baseline data set. As the well is operated for recovery of natural resources over a period of time, data gathering may be performed additional times, for example at regular maintenance intervals such as every 1 year, 5 years, or 10 years. The data recovered during subsequent monitoring intervals can be compared to the baseline data as well as any other data obtained from previous monitoring intervals, and such comparisons may indicate the overall condition of the wellbore. For example, changes in one or more sensed parameters may indicate one or more problems in the wellbore. Alternatively, consistency or uniformity in sensed parameters may indicate no substantive problems in the wellbore. The data may comprise any combination of parameters sensed by the MEMS sensors as present in the wellbore, including but not limited to temperature, pressure, ion concentration, stress, strain, gas concentration, etc. In an embodiment, data regarding performance of a sealant composition includes cement slurry properties such as density, rate of strength development, thickening time, fluid loss, and hydration properties; plasticity parameters; compressive strength; shrinkage and expansion characteristics; mechanical properties such as Young's Modulus and Poisson's ratio; tensile strength; resistance to ambient conditions downhole such as temperature and chemicals present; or any combination thereof, and such data may be evaluated to determine long term performance of the sealant composition (e.g., detect an occurrence of radial cracks, shear failure, and/or de-bonding within the set sealant composition) in accordance with embodiments set forth in K. Ravi and H. Xenakis, "Cementing Process Optimized to Achieve Zonal Isolation," presented at PETROTECH-2007 Conference, New Delhi, India, which is incorporated herein by reference in its entirety. In an embodiment, data (e.g., sealant parameters) from a plurality of monitoring intervals is plotted over a period of time, and a resultant graph is provided showing an operating or trend line for the sensed parameters. Atypical changes in the graph as indicated for example by a sharp change in slope or a step change on the graph may provide an indication of one or more present problems or the potential for a future problem. Accordingly, remedial and/or preventive treatments or services may be applied to the wellbore to address present or potential problems.

In embodiments, the MEMS sensors are contained within a sealant composition placed substantially within the annular space between a casing and the wellbore wall. That is, substantially all of the MEMS sensors are located within or in close proximity to the annular space. In an embodiment, the wellbore servicing fluid comprising the MEMS sensors (and thus likewise the MEMS sensors) does not substantially penetrate, migrate, or travel into the formation from the wellbore. In an alternative embodiment, substantially all of the MEMS sensors are located within, adjacent to, or in close proximity to the wellbore, for example less than or equal to about 1 foot, 3 feet, 5 feet, or 10 feet from the wellbore. Such adjacent or close proximity positioning of the MEMS sensors with respect to the wellbore is in contrast to placing MEMS sensors in a fluid that is pumped into the formation in large volumes and substantially penetrates, migrates, or travels into or through the formation, for example as occurs with a fracturing fluid or a flooding fluid. Thus, in embodiments, the MEMS sensors are placed proximate or adjacent to the wellbore (in contrast to the formation at large), and provide information relevant to the wellbore itself and compositions (e.g., sealants) used therein (again in contrast to the formation or a producing zone at large). In alternative embodiments, the MEMS sensors are distributed from the wellbore into the surrounding formation (e.g., additionally or alternatively non-proximate or non-adjacent to the wellbore), for example as a component of a fracturing fluid or a flooding fluid described in more detail herein.

In embodiments, the sealant is any wellbore sealant known in the art. Examples of sealants include cementitious and non-cementitious sealants both of which are well known in the art. In embodiments, non-cementitious sealants comprise resin based systems, latex based systems, or combinations thereof. In embodiments, the sealant comprises a cement slurry with styrene-butadiene latex (e.g., as disclosed in U.S. Pat. No. 5,588,488 incorporated by reference herein in its entirety). Sealants may be utilized in setting expandable casing, which is further described hereinbelow. In other embodiments, the sealant is a cement utilized for primary or secondary wellbore cementing operations, as discussed further hereinbelow.

In embodiments, the sealant is cementitious and comprises a hydraulic cement that sets and hardens by reaction with water. Examples of hydraulic cements include but are not limited to Portland cements (e.g., classes A, B, C, G, and H Portland cements), pozzolana cements, gypsum cements, phosphate cements, high alumina content cements, silica cements, high alkalinity cements, shale cements, acid/base cements, magnesia cements, fly ash cement, zeolite cement systems, cement kiln dust cement systems, slag cements, micro-fine cement, metakaolin, and combinations thereof. Examples of sealants are disclosed in U.S. Pat. Nos. 6,457,524; 7,077,203; and 7,174,962, each of which is incorporated herein by reference in its entirety. In an embodiment, the sealant comprises a sorel cement composition, which typically comprises magnesium oxide and a chloride or phosphate salt which together form for example magnesium oxychloride. Examples of magnesium oxychloride sealants are disclosed in U.S. Pat. Nos. 6,664,215 and 7,044,222, each of which is incorporated herein by reference in its entirety.

The wellbore composition (e.g., sealant) may include a sufficient amount of water to form a pumpable slurry. The water may be fresh water or salt water (e.g., an unsaturated aqueous salt solution or a saturated aqueous salt solution such as brine or seawater). In embodiments, the cement slurry may be a lightweight cement slurry containing foam (e.g., foamed cement) and/or hollow beads/microspheres. In an embodiment, the MEMS sensors are incorporated into or attached to all or a portion of the hollow microspheres. Thus, the MEMS sensors may be dispersed within the cement along with the microspheres. Examples of sealants containing microspheres are disclosed in U.S. Pat. Nos. 4,234,344; 6,457,524; and 7,174,962, each of which is incorporated herein by reference in its entirety. In an embodiment, the MEMS sensors are incorporated into a foamed cement such as those described in more detail in U.S. Pat. Nos. 6,063,738; 6,367,550; 6,547,871; and 7,174,962, each of which is incorporated by reference herein in its entirety.

In some embodiments, additives may be included in the cement composition for improving or changing the properties thereof. Examples of such additives include but are not limited to accelerators, set retarders, defoamers, fluid loss agents, weighting materials, dispersants, density-reducing agents, formation conditioning agents, lost circulation materials, thixotropic agents, suspension aids, or combinations thereof. Other mechanical property modifying additives, for example, fibers, polymers, resins, latexes, and the like can be added to further modify the mechanical properties. These additives may be included singularly or in combination. Methods for introducing these additives and their effective amounts are known to one of ordinary skill in the art.

In embodiments, the MEMS sensors are contained within a wellbore composition that forms a filtercake on the face of the formation when placed downhole. For example, various types of drilling fluids, also known as muds or drill-in fluids have been used in well drilling, such as water-based fluids, oil-based fluids (e.g., mineral oil, hydrocarbons, synthetic oils, esters, etc.), gaseous fluids, or a combination thereof. Drilling fluids typically contain suspended solids. Drilling fluids may form a thin, slick filter cake on the formation face that provides for successful drilling of the wellbore and helps prevent loss of fluid to the subterranean formation. In an embodiment, at least a portion of the MEMS remain associated with the filtercake (e.g., disposed therein) and may provide information as to a condition (e.g., thickness) and/or location of the filtercake. Additionally or in the alternative at least a portion of the MEMS remain associated with drilling fluid and may provide information as to a condition and/or location of the drilling fluid.

In embodiments, the MEMS sensors are contained within a wellbore composition that when placed downhole under suitable conditions induces fractures within the subterranean formation. Hydrocarbon-producing wells often are stimulated by hydraulic fracturing operations, wherein a fracturing fluid may be introduced into a portion of a subterranean formation penetrated by a wellbore at a hydraulic pressure sufficient to create, enhance, and/or extend at least one fracture therein. Stimulating or treating the wellbore in such ways increases hydrocarbon production from the well. In some embodiments, the MEMS sensors may be contained within a wellbore composition that when placed downhole enters and/or resides within one or more fractures within the subterranean formation. In such embodiments, the MEMS sensors provide information as to the location and/or condition of the fluid and/or fracture during and/or after treatment. In an embodiment, at least a portion of the MEMS remain associated with a fracturing fluid and may provide information as to the condition and/or location of the fluid. Fracturing fluids often contain proppants that are deposited within the formation upon placement of the fracturing fluid therein, and in an embodiment a fracturing fluid contains one or more proppants and one or more MEMS. In an embodiment, at least a portion of the MEMS remain associated with the proppants deposited within the formation (e.g., a proppant bed) and may provide information as to the condition (e.g., thickness, density, settling, stratification, integrity, etc.) and/or location of the proppants. Additionally or in the alternative at least a portion of the MEMS remain associated with a fracture (e.g., adhere to and/or retained by a surface of a fracture) and may provide information as to the condition (e.g., length, volume, etc.) and/or location of the fracture. For example, the MEMS sensors may provide information useful for ascertaining the fracture complexity.

In embodiments, the MEMS sensors are contained in a wellbore composition (e.g., gravel pack fluid) which is employed in a gravel packing treatment, and the MEMS may provide information as to the condition and/or location of the wellbore composition during and/or after the gravel packing treatment. Gravel packing treatments are used, inter alia, to reduce the migration of unconsolidated formation particulates into the wellbore. In gravel packing operations, particulates, referred to as gravel, are carried to a wellbore in a subterranean producing zone by a servicing fluid known as carrier fluid. That is, the particulates are suspended in a carrier fluid, which may be viscosified, and the carrier fluid is pumped into a wellbore in which the gravel pack is to be placed. As the particulates are placed in the zone, the carrier fluid leaks off into the subterranean zone and/or is returned to the surface. The resultant gravel pack acts as a filter to separate formation solids from produced fluids while permitting the produced fluids to flow into and through the wellbore. When installing the gravel pack, the gravel is carried to the formation in the form of a slurry by mixing the gravel with a viscosified carrier fluid. Such gravel packs may be used to stabilize a formation while causing minimal impairment to well productivity. The gravel, inter alia, acts to prevent the particulates from occluding the screen or migrating with the produced fluids, and the screen, inter alia, acts to prevent the gravel from entering the wellbore. In an embodiment, the wellbore servicing composition (e.g., gravel pack fluid) comprises a carrier fluid, gravel and one or more MEMS. In an embodiment, at least a portion of the MEMS remain associated with the gravel deposited within the wellbore and/or formation (e.g., a gravel pack/bed) and may provide information as to the condition (e.g., thickness, density, settling, stratification, integrity, etc.) and/or location of the gravel pack/bed.

In various embodiments, the MEMS may provide information as to a location, flow path/profile, volume, density, temperature, pressure, or a combination thereof of a sealant composition, a drilling fluid, a fracturing fluid, a gravel pack fluid, or other wellbore servicing fluid in real time such that the effectiveness of such service may be monitored and/or adjusted during performance of the service to improve the result of same. Accordingly, the MEMS may aid in the initial performance of the wellbore service additionally or alternatively to providing a means for monitoring a wellbore condition or performance of the service over a period of time (e.g., over a servicing interval and/or over the life of the well). For example, the one or more MEMS sensors may be used in monitoring a gas or a liquid produced from the subterranean formation. MEMS present in the wellbore and/or formation may be used to provide information as to the condition (e.g., temperature, pressure, flow rate, composition, etc.) and/or location of a gas or liquid produced from the subterranean formation. In an embodiment, the MEMS provide information regarding the composition of a produced gas or liquid. For example, the MEMS may be used to monitor an amount of water produced in a hydrocarbon producing well (e.g., amount of water present in hydrocarbon gas or liquid), an amount of undesirable components or contaminants in a produced gas or liquid (e.g., sulfur, carbon dioxide, hydrogen sulfide, etc. present in hydrocarbon gas or liquid), or a combination thereof.

In embodiments, the data sensors added to the wellbore composition, e.g., sealant slurry, etc., are passive sensors that do not require continuous power from a battery or an external source in order to transmit real-time data. In embodiments, the data sensors are micro-electromechanical systems (MEMS) comprising one or more (and typically a plurality of) MEMS devices, referred to herein as MEMS sensors. MEMS devices are well known, e.g., a semiconductor device with mechanical features on the micrometer scale. MEMS embody the integration of mechanical elements, sensors, actuators, and electronics on a common substrate. In embodiments, the substrate comprises silicon. MEMS elements include mechanical elements which are movable by an input energy (electrical energy or other type of energy). Using MEMS, a sensor may be designed to emit a detectable signal based on a number of physical phenomena, including thermal, biological, optical, chemical, and magnetic effects or stimulation. MEMS devices are minute in size, have low power requirements, are relatively inexpensive and are rugged, and thus are well suited for use in wellbore servicing operations.

In embodiments, the MEMS sensors added to a wellbore servicing fluid may be active sensors, for example powered by an internal battery that is rechargeable or otherwise powered and/or recharged by other downhole power sources such as heat capture/transfer and/or fluid flow, as described in more detail herein.

In embodiments, the data sensors comprise an active material connected to (e.g., mounted within or mounted on the surface of) an enclosure, the active material being liable to respond to a wellbore parameter, and the active material being operably connected to (e.g., in physical contact with, surrounding, or coating) a capacitive MEMS element. In various embodiments, the MEMS sensors sense one or more parameters within the wellbore. In an embodiment, the parameter is temperature. Alternatively, the parameter is pH. Alternatively, the parameter is moisture content. Still alternatively, the parameter may be ion concentration (e.g., chloride, sodium, and/or potassium ions). The MEMS sensors may also sense well cement characteristic data such as stress, strain, or combinations thereof. In embodiments, the MEMS sensors of the present disclosure may comprise active materials that respond to two or more measurands. In such a way, two or more parameters may be monitored.

In addition or in the alternative, a MEMS sensor incorporated within one or more of the wellbore compositions disclosed herein may provide information that allows a condition (e.g., thickness, density, volume, settling, stratification, etc.) and/or location of the composition within the subterranean formation to be detected.

Suitable active materials, such as dielectric materials, that respond in a predictable and stable manner to changes in parameters over a long period may be identified according to methods well known in the art, for example see, e.g., Ong, Zeng and Grimes. "A Wireless, Passive Carbon Nanotube-based Gas Sensor," IEEE Sensors Journal, 2, 2, (2002) 82-88; Ong, Grimes, Robbins and Singl, "Design and application of a wireless, passive, resonant-circuit environmental monitoring sensor," Sensors and Actuators A, 93 (2001) 33-43, each of which is incorporated by reference herein in its entirety. MEMS sensors suitable for the methods of the present disclosure that respond to various wellbore parameters are disclosed in U.S. Pat. No. 7,038,470 B1 that is incorporated herein by reference in its entirety.

In embodiments, the MEMS sensors are coupled with radio frequency identification devices (RFIDs) and can thus detect and transmit parameters and/or well cement characteristic data for monitoring the cement during its service life. RFIDs combine a microchip with an antenna (the RFID chip and the antenna are collectively referred to as the "transponder" or the "tag"). The antenna provides the RFID chip with power when exposed to a narrow band, high frequency electromagnetic field from a transceiver. A dipole antenna or a coil, depending on the operating frequency, connected to the RFID chip, powers the transponder when current is induced in the antenna by an RF signal from the transceiver's antenna. Such a device can return a unique identification "ID" number by modulating and re-radiating the radio frequency (RF) wave. Passive RF tags are gaining widespread use due to their low cost, indefinite life, simplicity, efficiency, ability to identify parts at a distance without contact (tether-free information transmission ability). These robust and tiny tags are attractive from an environmental standpoint as they require no battery. The MEMS sensor and RFID tag are preferably integrated into a single component (e.g., chip or substrate), or may alternatively be separate components operably coupled to each other. In an embodiment, an integrated, passive MEMS/RFID sensor contains a data sensing component, an optional memory, and an RFID antenna, whereby excitation energy is received and powers up the sensor, thereby sensing a present condition and/or accessing one or more stored sensed conditions from memory and transmitting same via the RFID antenna.

In embodiments, MEMS sensors having different RFID tags, i.e., antennas that respond to RF waves of different frequencies and power the RFID chip in response to exposure to RF waves of different frequencies, may be added to different wellbore compositions. Within the United States, commonly used operating bands for RFID systems center on one of the three government assigned frequencies: 125 kHz, 13.56 MHz or 2.45 GHz. A fourth frequency, 27.125 MHz, has also been assigned. When the 2.45 GHz carrier frequency is used, the range of an RFID chip can be many meters. While this is useful for remote sensing, there may be multiple transponders within the RF field. In order to prevent these devices from interacting and garbling the data, anti-collision schemes are used, as are known in the art. In embodiments, the data sensors are integrated with local tracking hardware to transmit their position as they flow within a wellbore composition such as a sealant slurry.

The data sensors may form a network using wireless links to neighboring data sensors and have location and positioning capability through, for example, local positioning algorithms as are known in the art. The sensors may organize themselves into a network by listening to one another, therefore allowing communication of signals from the farthest sensors towards the sensors closest to the interrogator to allow uninterrupted transmission and capture of data. In such embodiments, the interrogator tool may not need to traverse the entire section of the wellbore containing MEMS sensors in order to read data gathered by such sensors. For example, the interrogator tool may only need to be lowered about half-way along the vertical length of the wellbore containing MEMS sensors. Alternatively, the interrogator tool may be lowered vertically within the wellbore to a location adjacent to a horizontal arm of a well, whereby MEMS sensors located in the horizontal arm may be read without the need for the interrogator tool to traverse the horizontal arm. Alternatively, the interrogator tool may be used at or near the surface and read the data gathered by the sensors distributed along all or a portion of the wellbore. For example, sensors located a distance away from the interrogator (e.g., at an opposite end of a length of casing or tubing) may communicate via a network formed by the sensors as described previously.

Generally, a communication distance between MEMS sensors varies with a size and/or mass of the MEMS sensors. However, an ability to suspend the MEMS sensors in a wellbore composition and keep the MEMS sensors suspended in the wellbore composition for a long period of time, which may be important for measuring various parameters of a wellbore composition throughout a volume of the wellbore composition, generally varies inversely with the size of the MEMS sensors. Therefore, sensor communication distance requirements may have to be adjusted in view of sensor suspendability requirements. In addition, a communication frequency of a MEMS sensor generally varies with the size and/or mass of the MEMS sensor.

In embodiments, the MEMS sensors are ultra-small, e.g., 3 $mm^2$, such that they are pumpable in a sealant slurry. In embodiments, the MEMS device is approximately 0.01 $mm^2$ to 1 $mm^2$, alternatively 1 $mm^2$ to 3 $mm^2$, alternatively 3 $mm^2$ to 5 $mm^2$, or alternatively 5 $mm^2$ to 10 $mm^2$. In embodiments, the data sensors are capable of providing data throughout the cement service life. In embodiments, the data sensors are capable of providing data for up to 100 years. In an embodiment, the wellbore composition comprises an amount of MEMS effective to measure one or more desired parameters. In various embodiments, the wellbore composition comprises an effective amount of MEMS such that sensed readings may be obtained at intervals of about 1 foot, alternatively about 6 inches, or alternatively about 1 inch, along the portion of the wellbore containing the MEMS. In an embodiment, the MEMS sensors may be present in the wellbore composition in an amount of from about 0.001 to about 10 weight percent. Alternatively, the MEMS may be present in the wellbore composition in an amount of from about 0.01 to about 5 weight percent. In embodiments, the sensors may have dimensions (e.g., diameters or other dimensions) that range from nanoscale, e.g., about 1 to 1000 nm (e.g., NEMS), to a micrometer range, e.g., about 1 to 1000 μm (e.g., MEMS), or alternatively any size from about 1 nm to about 1 mm. In embodiments, the MEMS sensors may be present in the wellbore composition in an amount of from about 5 volume percent to about 30 volume percent.

In various embodiments, the size and/or amount of sensors present in a wellbore composition (e.g., the sensor loading or concentration) may be selected such that the resultant wellbore servicing composition is readily pumpable without damaging the sensors and/or without having the sensors undesirably settle out (e.g., screen out) in the pumping equipment (e.g., pumps, conduits, tanks, etc.) and/or upon placement in the wellbore. Also, the concentration/loading of the sensors within the wellbore servicing fluid may be selected to provide a sufficient average distance between sensors to allow for networking of the sensors (e.g., daisy-chaining) in embodiments using such networks, as described in more detail herein. For example, such distance may be a percentage of the average communication distance for a given sensor type. By way of example, a given sensor having a 2 inch communication range in a given wellbore composition should be loaded into the wellbore composition in an amount that the average distance between sensors in less than 2 inches (e.g., less than 1.9, 1.8, 1.7, 1.6, 1.5, 1.4, 1.3, 1.2, 1.1, 1.0, etc. inches). The size of sensors and the amount may be selected so that they are stable, do not float or sink, in the well treating fluid. The size of the sensor could range from nano size to microns. In some embodiments, the sensors may be nanoelectromechanical systems (NEMS), MEMS, or combinations thereof. Unless otherwise indicated herein, it should be understood that any suitable micro and/or nano sized sensors or combinations thereof may be employed. The embodiments disclosed herein should not otherwise be limited by the specific type of micro and/or nano sensor employed unless otherwise indicated or prescribed by the functional requirements thereof, and specifically NEMS may be used in addition to or in lieu of MEMS sensors in the various embodiments disclosed herein.

In embodiments, the MEMS sensors comprise passive (remain unpowered when not being interrogated) sensors energized by energy radiated from a data interrogation tool. The data interrogation tool may comprise an energy transceiver sending energy (e.g., radio waves) to and receiving signals from the MEMS sensors and a processor processing the received signals. The data interrogation tool may further comprise a memory component, a communications component, or both. The memory component may store raw and/or processed data received from the MEMS sensors, and the communications component may transmit raw data to the processor and/or transmit processed data to another receiver, for example located at the surface. The tool components (e.g., transceiver, processor, memory component, and communications component) are coupled together and in signal communication with each other.

In an embodiment, one or more of the data interrogator components may be integrated into a tool or unit that is temporarily or permanently placed downhole (e.g., a downhole module), for example prior to, concurrent with, and/or subsequent to placement of the MEMS sensors in the wellbore. In an embodiment, a removable downhole module comprises a transceiver and a memory component, and the downhole module is placed into the wellbore, reads data from the MEMS sensors, stores the data in the memory component, is removed from the wellbore, and the raw data is accessed. Alternatively, the removable downhole module may have a processor to process and store data in the memory component, which is subsequently accessed at the surface when the tool is removed from the wellbore. Alternatively, the removable downhole module may have a communications component to transmit raw data to a processor and/or transmit processed data to another receiver, for example located at the surface. The communications component may communicate via wired or wireless communications. For example, the downhole component may communicate with a component or other node on the surface via a network of MEMS sensors, or cable or other communications/telemetry device such as a radio frequency, electromagnetic telemetry device or an acoustic telemetry device. The removable downhole component may be intermittently positioned downhole via any suitable conveyance, for example wire-line, coiled tubing, straight tubing, gravity, pumping, etc., to monitor conditions at various times during the life of the well.

In embodiments, the data interrogation tool comprises a permanent or semi-permanent downhole component that remains downhole for extended periods of time. For example, a semi-permanent downhole module may be retrieved and data downloaded once every few months or years. Alternatively, a permanent downhole module may remain in the well throughout the service life of well. In an embodiment, a permanent or semi-permanent downhole module comprises a transceiver and a memory component, and the downhole module is placed into the wellbore, reads data from the MEMS sensors, optionally stores the data in the memory component, and transmits the read and optionally stored data to the surface. Alternatively, the permanent or semi-permanent downhole module may have a processor to process and sensed data into processed data, which may be stored in memory and/or transmit to the surface. The permanent or semi-permanent downhole module may have a communications component to transmit raw data to a processor and/or transmit processed data to another receiver, for example located at the surface. The communications component may communicate via wired or wireless communications. For example, the downhole component may communicate with a component or other node on the surface via a network of MEMS sensors, or a cable or other communications/telemetry device such as a radio frequency, electromagnetic telemetry device or an acoustic telemetry device.

In embodiments, the data interrogation tool comprises an RF energy source incorporated into its internal circuitry and the data sensors are passively energized using an RF antenna, which picks up energy from the RF energy source. In an embodiment, the data interrogation tool is integrated with an RF transceiver. In embodiments, the MEMS sensors (e.g., MEMS/RFID sensors) are empowered and interrogated by the RF transceiver from a distance, for example a distance of greater than 10 m, or alternatively from the surface or from an adjacent offset well. In an embodiment, the data interrogation tool traverses within a casing in the well and reads MEMS sensors located in a wellbore servicing fluid or composition, for example a sealant (e.g., cement) sheath surrounding the casing, located in the annular space between the casing and the wellbore wall. In embodiments, the interrogator senses the MEMS sensors when in close proximity with the sensors, typically via traversing a removable downhole component along a length of the wellbore comprising the MEMS sensors. In an embodiment, close proximity comprises a radial distance from a point within the casing to a planar point within an annular space between the casing and the wellbore. In embodiments, close proximity comprises a distance of 0.1 m to 1 m. Alternatively, close proximity comprises a distance of 1 m to 5 m. Alternatively, close proximity comprises a distance of from 5 m to 10 m. In embodiments, the transceiver interrogates the sensor with RF energy at 125 kHz and close proximity comprises 0.1 m to 5 m. Alternatively, the transceiver interrogates the sensor with RF energy at 13.5 MHz and close proximity comprises 0.05 m to 0.5 m. Alternatively, the transceiver interrogates the sensor with RF energy at 915 MHz and close proximity comprises 0.03 m to 0.1 m. Alternatively, the transceiver interrogates the sensor with RF energy at 2.4 GHz and close proximity comprises 0.01 m to 0.05 m.

In embodiments, the MEMS sensors incorporated into wellbore cement and used to collect data during and/or after cementing the wellbore. The data interrogation tool may be positioned downhole prior to and/or during cementing, for example integrated into a component such as casing, casing attachment, plug, cement shoe, or expanding device. Alternatively, the data interrogation tool is positioned downhole upon completion of cementing, for example conveyed downhole via wireline. The cementing methods disclosed herein may optionally comprise the step of foaming the cement composition using a gas such as nitrogen or air. The foamed cement compositions may comprise a foaming surfactant and optionally a foaming stabilizer. The MEMS sensors may be incorporated into a sealant composition and placed downhole, for example during primary cementing (e.g., conventional or reverse circulation cementing), secondary cementing (e.g., squeeze cementing), or other sealing operation (e.g., behind an expandable casing).

In primary cementing, cement is positioned in a wellbore to isolate an adjacent portion of the subterranean formation and provide support to an adjacent conduit (e.g., casing). The cement forms a barrier that prevents fluids (e.g., water or hydrocarbons) in the subterranean formation from migrating into adjacent zones or other subterranean formations. In embodiments, the wellbore in which the cement is positioned belongs to a horizontal or multilateral wellbore configuration. It is to be understood that a multilateral wellbore configuration includes at least two principal wellbores connected by one or more ancillary wellbores.

Figure 2:
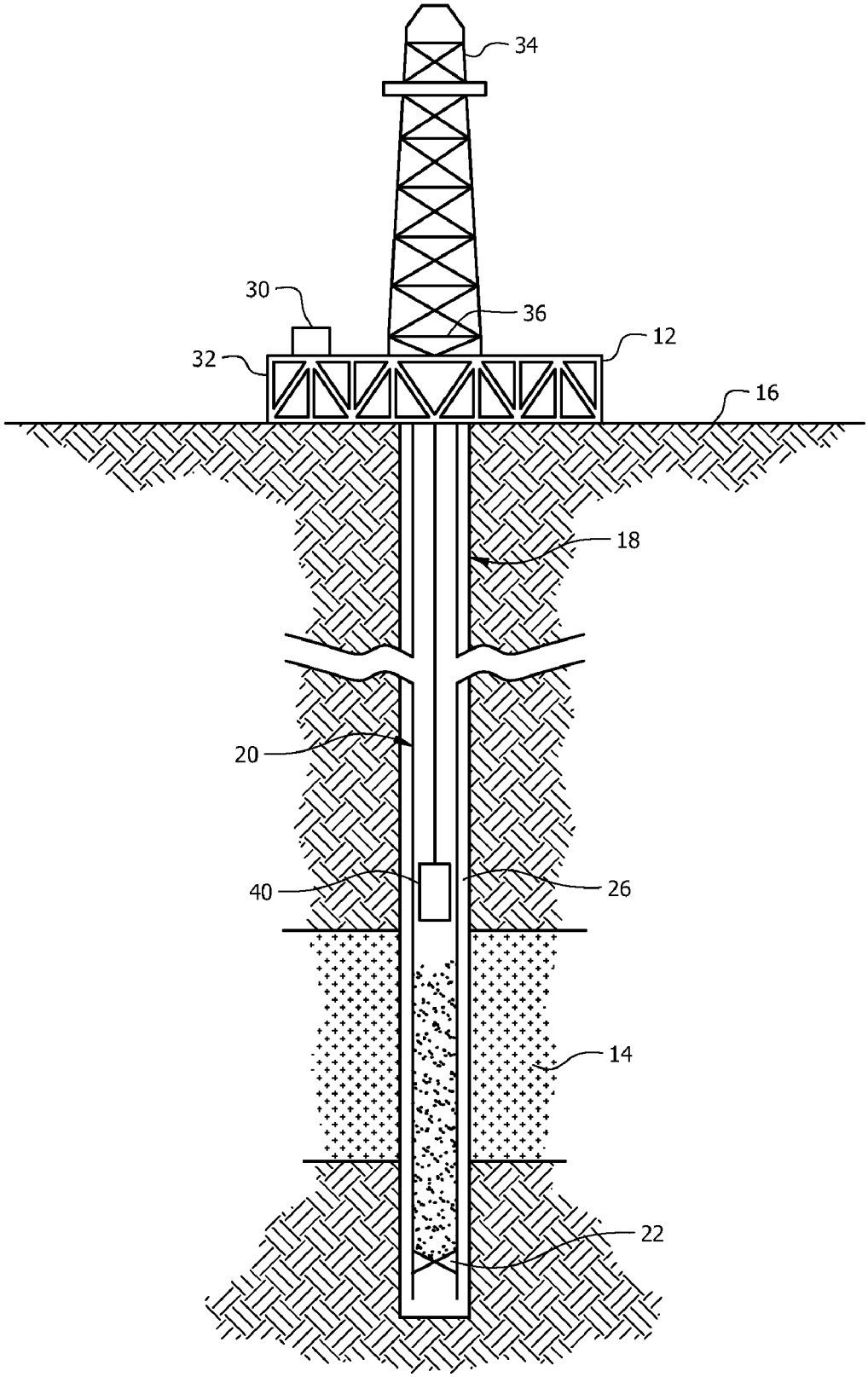
FIG. 2 is a schematic view of a typical onshore oil or gas drilling rig and wellbore.

FIG. 2, which shows a typical onshore oil or gas drilling rig and wellbore, will be used to clarify the methods of the present disclosure, with the understanding that the present disclosure is likewise applicable to offshore rigs and wellbores. Rig 12 is centered over a subterranean oil or gas formation 14 located below the earth's surface 16. Rig 12 includes a work deck 32 that supports a derrick 34. Derrick 34 supports a hoisting apparatus 36 for raising and lowering pipe strings such as casing 20. Pump 30 is capable of pumping a variety of wellbore compositions (e.g., drilling fluid or cement) into the well and includes a pressure measurement device that provides a pressure reading at the pump discharge. Wellbore 18 has been drilled through the various earth strata, including formation 14. Upon completion of wellbore drilling, casing 20 is often placed in the wellbore 18 to facilitate the production of oil and gas from the formation 14. Casing 20 is a string of pipes that extends down wellbore 18, through which oil and gas will eventually be extracted. A cement or casing shoe 22 is typically attached to the end of the casing string when the casing string is run into the wellbore. Casing shoe 22 guides casing 20 toward the center of the hole and minimizes problems associated with hitting rock ledges or washouts in wellbore 18 as the casing string is lowered into the well. Casing shoe, 22, may be a guide shoe or a float shoe, and typically comprises a tapered, often bullet-nosed piece of equipment found on the bottom of casing string 20. Casing shoe, 22, may be a float shoe fitted with an open bottom and a valve that serves to prevent reverse flow, or U-tubing, of cement slurry from annulus 26 into casing 20 as casing 20 is run into wellbore 18. The region between casing 20 and the wall of wellbore 18 is known as the casing annulus 26. To fill up casing annulus 26 and secure casing 20 in place, casing 20 is usually "cemented" in wellbore 18, which is referred to as "primary cementing." A data interrogation tool 40 is shown in the wellbore 18.

In an embodiment, the method of this disclosure is used for monitoring primary cement during and/or subsequent to a conventional primary cementing operation. In this conventional primary cementing embodiment, MEMS sensors are mixed into a cement slurry, block 102 of FIG. 1, and the cement slurry is then pumped down the inside of casing 20, block 104 of FIG. 1. As the slurry reaches the bottom of casing 20, it flows out of casing 20 and into casing annulus 26 between casing 20 and the wall of wellbore 18. As cement slurry flows up annulus 26, it displaces any fluid in the wellbore. To ensure no cement remains inside casing 20, devices called "wipers" may be pumped by a wellbore servicing fluid (e.g., drilling mud) through casing 20 behind the cement. As described in more detail herein, the wellbore servicing fluids such as the cement slurry and/or wiper conveyance fluid (e.g., drilling mud) may contain MEMS sensors which aid in detection and/or positioning of the wellbore servicing fluid and/or a mechanical component such as a wiper plug, casing shoe, etc. The wiper contacts the inside surface of casing 20 and pushes any remaining cement out of casing 20. When cement slurry reaches the earth's surface 16, and annulus 26 is filled with slurry, pumping is terminated and the cement is allowed to set. The MEMS sensors of the present disclosure may also be used to determine one or more parameters during placement and/or curing of the cement slurry. Also, the MEMS sensors of the present disclosure may also be used to determine completion of the primary cementing operation, as further discussed herein below.

Referring back to FIG. 1, during cementing, or subsequent the setting of cement, a data interrogation tool may be positioned in wellbore 18, as at block 106 of FIG. 1. For example, the wiper may be equipped with a data interrogation tool and may read data from the MEMS while being pumped downhole and transmit same to the surface. Alternatively, an interrogator tool may be run into the wellbore following completion of cementing a segment of casing, for example as part of the drill string during resumed drilling operations. Alternatively, the interrogator tool may be run downhole via a wireline or other conveyance. The data interrogation tool may then be signaled to interrogate the sensors (block 108 of FIG. 1) whereby the sensors are activated to record and/or transmit data, block 110 of FIG. 1. The data interrogation tool communicates the data to a processor 112 whereby data sensor (and likewise cement slurry) position and cement integrity may be determined via analyzing sensed parameters for changes, trends, expected values, etc. For example, such data may reveal conditions that may be adverse to cement curing. The sensors may provide a temperature profile over the length of the cement sheath, with a uniform temperature profile likewise indicating a uniform cure (e.g., produced via heat of hydration of the cement during curing) or a change in temperature might indicate the influx of formation fluid (e.g., presence of water and/or hydrocarbons) that may degrade the cement during the transition from slurry to set cement. Alternatively, such data may indicate a zone of reduced, minimal, or missing sensors, which would indicate a loss of cement corresponding to the area (e.g., a loss/void zone or water influx/washout). Such methods may be available with various cement techniques described herein such as conventional or reverse primary cementing.

Due to the high pressure at which the cement is pumped during conventional primary cementing (pump down the casing and up the annulus), fluid from the cement slurry may leak off into existing low pressure zones traversed by the wellbore. This may adversely affect the cement, and incur undesirable expense for remedial cementing operations (e.g., squeeze cementing as discussed hereinbelow) to position the cement in the annulus. Such leak off may be detected via the present disclosure as described previously. Additionally, conventional circulating cementing may be time-consuming, and therefore relatively expensive, because cement is pumped all the way down casing 20 and back up annulus 26.

One method of avoiding problems associated with conventional primary cementing is to employ reverse circulation primary cementing. Reverse circulation cementing is a term of art used to describe a method where a cement slurry is pumped down casing annulus 26 instead of into casing 20. The cement slurry displaces any fluid as it is pumped down annulus 26. Fluid in the annulus is forced down annulus 26, into casing 20 (along with any fluid in the casing), and then back up to earth's surface 16. When reverse circulation cementing, casing shoe 22 comprises a valve that is adjusted to allow flow into casing 20 and then sealed after the cementing operation is complete. Once slurry is pumped to the bottom of casing 20 and fills annulus 26, pumping is terminated and the cement is allowed to set in annulus 26. Examples of reverse cementing applications are disclosed in U.S. Pat. Nos. 6,920,929 and 6,244,342, each of which is incorporated herein by reference in its entirety.

In embodiments of the present disclosure, sealant slurries comprising MEMS data sensors are pumped down the annulus in reverse circulation applications, a data interrogator is located within the wellbore (e.g., integrated into the casing shoe) and sealant performance is monitored as described with respect to the conventional primary sealing method disclosed hereinabove. Additionally, the data sensors of the present disclosure may also be used to determine completion of a reverse circulation operation, as further discussed hereinbelow.

Secondary cementing within a wellbore may be carried out subsequent to primary cementing operations. A common example of secondary cementing is squeeze cementing wherein a sealant such as a cement composition is forced under pressure into one or more permeable zones within the wellbore to seal such zones. Examples of such permeable zones include fissures, cracks, fractures, streaks, flow channels, voids, high permeability streaks, annular voids, or combinations thereof. The permeable zones may be present in the cement column residing in the annulus, a wall of the conduit in the wellbore, a microannulus between the cement column and the subterranean formation, and/or a microannulus between the cement column and the conduit. The sealant (e.g., secondary cement composition) sets within the permeable zones, thereby forming a hard mass to plug those zones and prevent fluid from passing therethrough (i.e., prevents communication of fluids between the wellbore and the formation via the permeable zone). Various procedures that may be followed to use a sealant composition in a wellbore are described in U.S. Pat. No. 5,346,012, which is incorporated by reference herein in its entirety. In various embodiments, a sealant composition comprising MEMS sensors is used to repair holes, channels, voids, and microannuli in casing, cement sheath, gravel packs, and the like as described in U.S. Pat. Nos. 5,121,795; 5,123,487; and 5,127,473, each of which is incorporated by reference herein in its entirety.

In embodiments, the method of the present disclosure may be employed in a secondary cementing operation. In these embodiments, data sensors are mixed with a sealant composition (e.g., a secondary cement slurry) at block 102 of FIG. 1 and subsequent or during positioning and hardening of the cement, the sensors are interrogated to monitor the performance of the secondary cement in an analogous manner to the incorporation and monitoring of the data sensors in primary cementing methods disclosed hereinabove. For example, the MEMS sensors may be used to verify the location of the secondary sealant, one or more properties of the secondary sealant, that the secondary sealant is functioning properly and/or to monitor its long-term integrity.

In embodiments, the methods of the present disclosure are utilized for monitoring cementitious sealants (e.g., hydraulic cement), non-cementitious (e.g., polymer, latex or resin systems), or combinations thereof, which may be used in primary, secondary, or other sealing applications. For example, expandable tubulars such as pipe, pipe string, casing, liner, or the like are often sealed in a subterranean formation. The expandable tubular (e.g., casing) is placed in the wellbore, a sealing composition is placed into the wellbore, the expandable tubular is expanded, and the sealing composition is allowed to set in the wellbore. For example, after expandable casing is placed downhole, a mandrel may be run through the casing to expand the casing diametrically, with expansions up to 25% possible. The expandable tubular may be placed in the wellbore before or after placing the sealing composition in the wellbore. The expandable tubular may be expanded before, during, or after the set of the sealing composition. When the tubular is expanded during or after the set of the sealing composition, resilient compositions will remain competent due to their elasticity and compressibility. Additional tubulars may be used to extend the wellbore into the subterranean formation below the first tubular as is known to those of skill in the art. Sealant compositions and methods of using the compositions with expandable tubulars are disclosed in U.S. Pat. Nos. 6,722,433 and 7,040,404 and U.S. Pat. Pub. No. 2004/0167248, each of which is incorporated by reference herein in its entirety. In expandable tubular embodiments, the sealants may comprise compressible hydraulic cement compositions and/or non-cementitious compositions.

Compressible hydraulic cement compositions have been developed which remain competent (continue to support and seal the pipe) when compressed, and such compositions may comprise MEMS sensors. The sealant composition is placed in the annulus between the wellbore and the pipe or pipe string, the sealant is allowed to harden into an impermeable mass, and thereafter, the expandable pipe or pipe string is expanded whereby the hardened sealant composition is compressed. In embodiments, the compressible foamed sealant composition comprises a hydraulic cement, a rubber latex, a rubber latex stabilizer, a gas and a mixture of foaming and foam stabilizing surfactants. Suitable hydraulic cements include, but are not limited to, Portland cement and calcium aluminate cement.

Often, non-cementitious resilient sealants with comparable strength to cement, but greater elasticity and compressibility, are required for cementing expandable casing. In embodiments, these sealants comprise polymeric sealing compositions, and such compositions may comprise MEMS sensors. In an embodiment, the sealants composition comprises a polymer and a metal containing compound. In embodiments, the polymer comprises copolymers, terpolymers, and interpolymers. The metal-containing compounds may comprise zinc, tin, iron, selenium magnesium, chromium, or cadmium. The compounds may be in the form of an oxide, carboxylic acid salt, a complex with dithiocarbamate ligand, or a complex with mercaptobenzothiazole ligand. In embodiments, the sealant comprises a mixture of latex, dithio carbamate, zinc oxide, and sulfur.

In embodiments, the methods of the present disclosure comprise adding data sensors to a sealant to be used behind expandable casing to monitor the integrity of the sealant upon expansion of the casing and during the service life of the sealant. In this embodiment, the sensors may comprise MEMS sensors capable of measuring, for example, moisture and/or temperature change. If the sealant develops cracks, water influx may thus be detected via moisture and/or temperature indication.

In an embodiment, the MEMS sensor are added to one or more wellbore servicing compositions used or placed downhole in drilling or completing a monodiameter wellbore as disclosed in U.S. Pat. No. 7,066,284 and U.S. Pat. Pub. No. 2005/0241855, each of which is incorporated by reference herein in its entirety. In an embodiment, the MEMS sensors are included in a chemical casing composition used in a monodiameter wellbore. In another embodiment, the MEMS sensors are included in compositions (e.g., sealants) used to place expandable casing or tubulars in a monodiameter wellbore. Examples of chemical casings are disclosed in U.S. Pat. Nos. 6,702,044; 6,823,940; and 6,848,519, each of which is incorporated herein by reference in its entirety.

In one embodiment, the MEMS sensors are used to gather data, e.g., sealant data, and monitor the long-term integrity of the wellbore composition, e.g., sealant composition, placed in a wellbore, for example a wellbore for the recovery of natural resources such as water or hydrocarbons or an injection well for disposal or storage. In an embodiment, data/information gathered and/or derived from MEMS sensors in a downhole wellbore composition e.g., sealant composition, comprises at least a portion of the input and/or output to into one or more calculators, simulations, or models used to predict, select, and/or monitor the performance of wellbore compositions e.g., sealant compositions, over the life of a well. Such models and simulators may be used to select a wellbore composition, e.g., sealant composition, comprising MEMS for use in a wellbore. After placement in the wellbore, the MEMS sensors may provide data that can be used to refine, recalibrate, or correct the models and simulators. Furthermore, the MEMS sensors can be used to monitor and record the downhole conditions that the composition, e.g., sealant, is subjected to, and composition, e.g., sealant, performance may be correlated to such long term data to provide an indication of problems or the potential for problems in the same or different wellbores. In various embodiments, data gathered from MEMS sensors is used to select a wellbore composition, e.g., sealant composition, or otherwise evaluate or monitor such sealants, as disclosed in U.S. Pat. Nos. 6,697,738; 6,922,637; and 7,133,778, each of which is incorporated by reference herein in its entirety.

In an embodiment, the compositions and methodologies of this disclosure are employed in an operating environment that generally comprises a wellbore that penetrates a subterranean formation for the purpose of recovering hydrocarbons, storing hydrocarbons, injection of carbon dioxide, storage of carbon dioxide, disposal of carbon dioxide, and the like, and the MEMS located downhole (e.g., within the wellbore and/or surrounding formation) may provide information as to a condition and/or location of the composition and/or the subterranean formation. For example, the MEMS may provide information as to a location, flow path/profile, volume, density, temperature, pressure, or a combination thereof of a hydrocarbon (e.g., natural gas stored in a salt dome) or carbon dioxide placed in a subterranean formation such that effectiveness of the placement may be monitored and evaluated, for example detecting leaks, determining remaining storage capacity in the formation, etc. In some embodiments, the compositions of this disclosure are employed in an enhanced oil recovery operation wherein a wellbore that penetrates a subterranean formation may be subjected to the injection of gases (e.g., carbon dioxide) so as to improve hydrocarbon recovery from said wellbore, and the MEMS may provide information as to a condition and/or location of the composition and/or the subterranean formation. For example, the MEMS may provide information as to a location, flow path/profile, volume, density, temperature, pressure, or a combination thereof of carbon dioxide used in a carbon dioxide flooding enhanced oil recovery operation in real time such that the effectiveness of such operation may be monitored and/or adjusted in real time during performance of the operation to improve the result of same.

Figure 4:
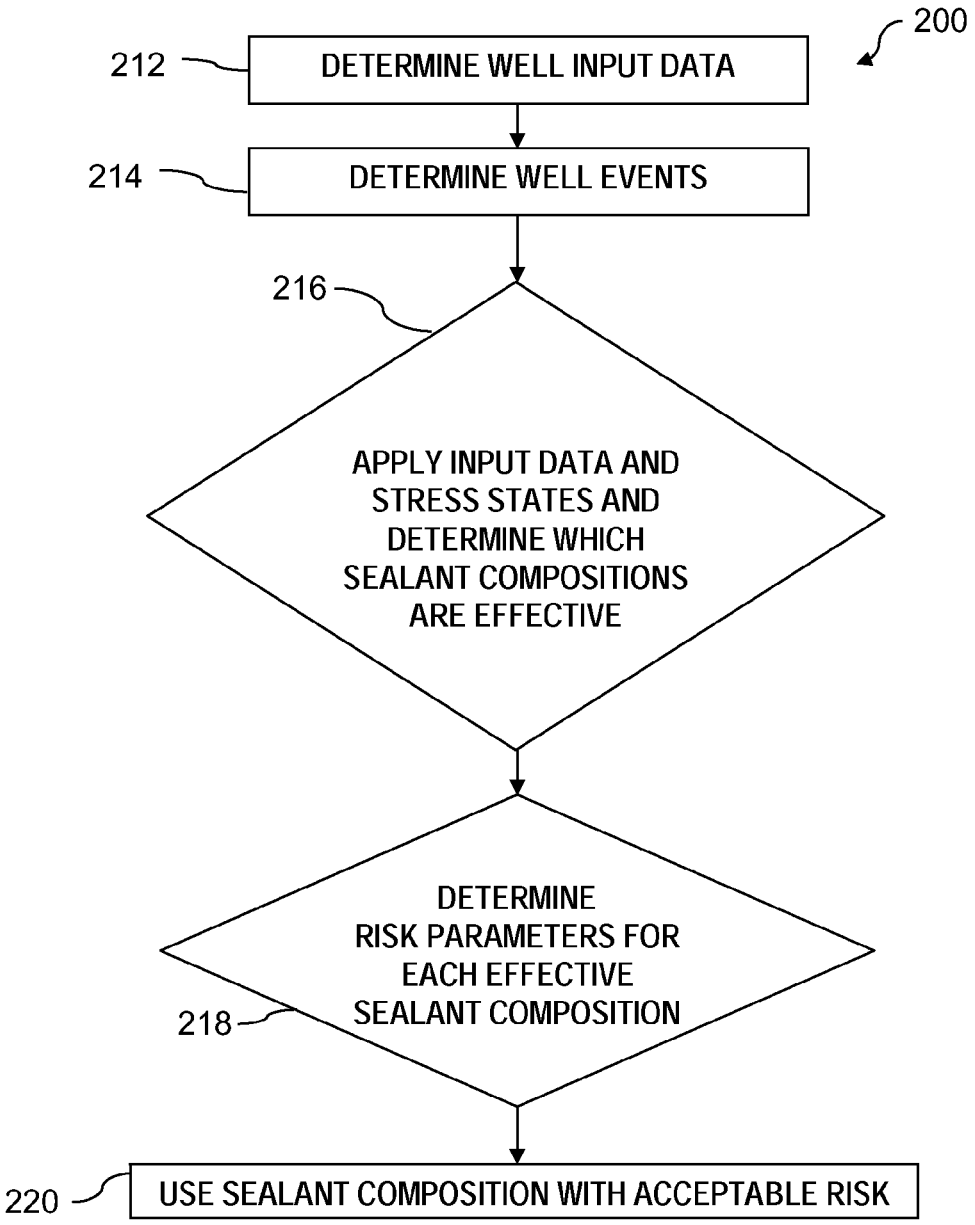
FIG. 4 is a flowchart of a method for selecting between a group of sealant compositions according to one embodiment of the present disclosure.

Referring to FIG. 4, a method 200 for selecting a sealant (e.g., a cementing composition) for sealing a subterranean zone penetrated by a wellbore according to the present embodiment basically comprises determining a group of effective compositions from a group of compositions given estimated conditions experienced during the life of the well, and estimating the risk parameters for each of the group of effective compositions. In an alternative embodiment, actual measured conditions experienced during the life of the well, in addition to or in lieu of the estimated conditions, may be used. Such actual measured conditions may be obtained for example via sealant compositions comprising MEMS sensors as described herein. Effectiveness considerations include concerns that the sealant composition be stable under downhole conditions of pressure and temperature, resist downhole chemicals, and possess the mechanical properties to withstand stresses from various downhole operations to provide zonal isolation for the life of the well.

In step 212, well input data for a particular well is determined and/or specified. Well input data includes routinely measurable or calculable parameters inherent in a well, including vertical depth of the well, overburden gradient, pore pressure, maximum and minimum horizontal stresses, hole size, casing outer diameter, casing inner diameter, density of drilling fluid, desired density of sealant slurry for pumping, density of completion fluid, and top of sealant. As will be discussed in greater detail with reference to step 214, the well can be computer modeled. In modeling, the stress state in the well at the end of drilling, and before the sealant slurry is pumped into the annular space, affects the stress state for the interface boundary between the rock and the sealant composition. Thus, the stress state in the rock with the drilling fluid is evaluated, and properties of the rock such as Young's modulus, Poisson's ratio, and yield parameters are used to analyze the rock stress state. These terms and their methods of determination are well known to those skilled in the art. It is understood that well input data will vary between individual wells. In an alternative embodiment, well input data includes data that is obtained via sealant compositions comprising MEMS sensors as described herein.

In step 214, the well events applicable to the well are determined and/or specified. For example, cement hydration (setting) is a well event. Other well events include pressure testing, well completions, hydraulic fracturing, hydrocarbon production, fluid injection, perforation, subsequent drilling, formation movement as a result of producing hydrocarbons at high rates from unconsolidated formation, and tectonic movement after the sealant composition has been pumped in place. Well events include those events that are certain to happen during the life of the well, such as cement hydration, and those events that are readily predicted to occur during the life of the well, given a particular well's location, rock type, and other factors well known in the art. In an embodiment, well events and data associated therewith may be obtained via sealant compositions comprising MEMS sensors as described herein.

Each well event is associated with a certain type of stress, for example, cement hydration is associated with shrinkage, pressure testing is associated with pressure, well completions, hydraulic fracturing, and hydrocarbon production are associated with pressure and temperature, fluid injection is associated with temperature, formation movement is associated with load, and perforation and subsequent drilling are associated with dynamic load. As can be appreciated, each type of stress can be characterized by an equation for the stress state (collectively "well event stress states"), as described in more detail in U.S. Pat. No. 7,133,778 which is incorporated herein by reference in its entirety.

In step 216, the well input data, the well event stress states, and the sealant data are used to determine the effect of well events on the integrity of the sealant sheath during the life of the well for each of the sealant compositions. The sealant compositions that would be effective for sealing the subterranean zone and their capacity from its elastic limit are determined. In an alternative embodiment, the estimated effects over the life of the well are compared to and/or corrected in comparison to corresponding actual data gathered over the life of the well via sealant compositions comprising MEMS sensors as described herein. Step 216 concludes by determining which sealant compositions would be effective in maintaining the integrity of the resulting cement sheath for the life of the well.

In step 218, parameters for risk of sealant failure for the effective sealant compositions are determined. For example, even though a sealant composition is deemed effective, one sealant composition may be more effective than another. In one embodiment, the risk parameters are calculated as percentages of sealant competency during the determination of effectiveness in step 216. In an alternative embodiment, the risk parameters are compared to and/or corrected in comparison to actual data gathered over the life of the well via sealant compositions comprising MEMS sensors as described herein.

Step 218 provides data that allows a user to perform a cost benefit analysis. Due to the high cost of remedial operations, it is important that an effective sealant composition is selected for the conditions anticipated to be experienced during the life of the well. It is understood that each of the sealant compositions has a readily calculable monetary cost. Under certain conditions, several sealant compositions may be equally efficacious, yet one may have the added virtue of being less expensive. Thus, it should be used to minimize costs. More commonly, one sealant composition will be more efficacious, but also more expensive. Accordingly, in step 220, an effective sealant composition with acceptable risk parameters is selected given the desired cost. Furthermore, the overall results of steps 200-220 can be compared to actual data that is obtained via sealant compositions comprising MEMS sensors as described herein, and such data may be used to modify and/or correct the inputs and/or outputs to the various steps 200-220 to improve the accuracy of same.

As discussed above and with reference to FIG. 2, wipers are often utilized during conventional primary cementing to force cement slurry out of the casing. The wiper plug also serves another purpose: typically, the end of a cementing operation is signaled when the wiper plug contacts a restriction (e.g., casing shoe) inside the casing 20 at the bottom of the string. When the plug contacts the restriction, a sudden pressure increase at pump 30 is registered. In this way, it can be determined when the cement has been displaced from the casing 20 and fluid flow returning to the surface via casing annulus 26 stops.

In reverse circulation cementing, it is also necessary to correctly determine when cement slurry completely fills the annulus 26. Continuing to pump cement into annulus 26 after cement has reached the far end of annulus 26 forces cement into the far end of casing 20, which could incur lost time if cement must be drilled out to continue drilling operations.

The methods disclosed herein may be utilized to determine when cement slurry has been appropriately positioned downhole. Furthermore, as discussed hereinbelow, the methods of the present disclosure may additionally comprise using a MEMS sensor to actuate a valve or other mechanical means to close and prevent cement from entering the casing upon determination of completion of a cementing operation.

Figure 3:
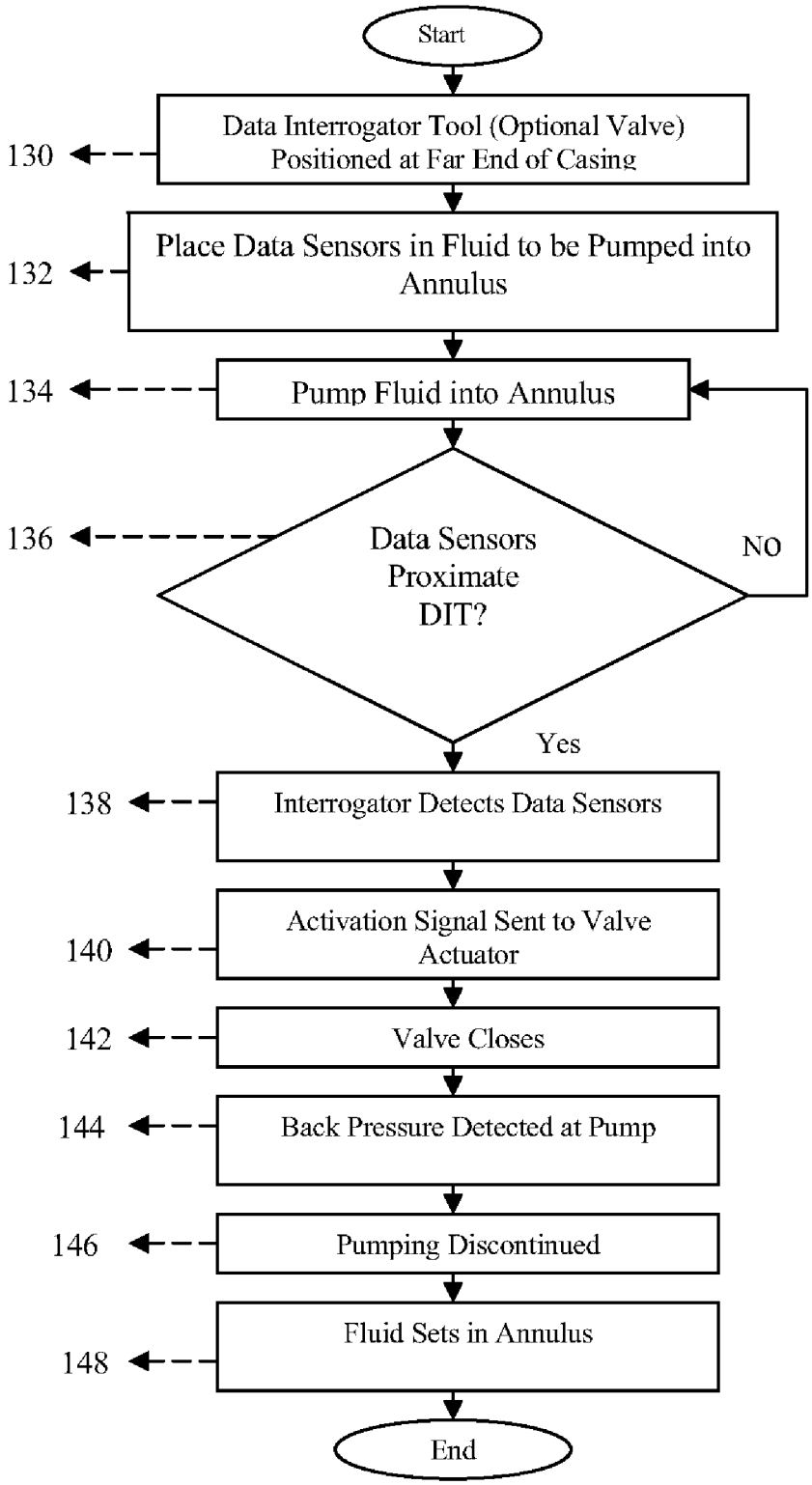
FIG. 3 is a flowchart detailing a method for determining when a reverse cementing operation is complete and for subsequent optional activation of a downhole tool.

The way in which the method of the present disclosure may be used to signal when cement is appropriately positioned within annulus 26 will now be described within the context of a reverse circulation cementing operation. FIG. 3 is a flowchart of a method for determining completion of a cementing operation and optionally further actuating a downhole tool upon completion (or to initiate completion) of the cementing operation. This description will reference the flowchart of FIG. 3, as well as the wellbore depiction of FIG. 2.

At block 130, a data interrogation tool as described hereinabove is positioned at the far end of casing 20. In an embodiment, the data interrogation tool is incorporated with or adjacent to a casing shoe positioned at the bottom end of the casing and in communication with operators at the surface. At block 132, MEMS sensors are added to a fluid (e.g., cement slurry, spacer fluid, displacement fluid, etc.) to be pumped into annulus 26. At block 134, cement slurry is pumped into annulus 26. In an embodiment, MEMS sensors may be placed in substantially all of the cement slurry pumped into the wellbore. In an alternative embodiment, MEMS sensors may be placed in a leading plug or otherwise placed in an initial portion of the cement to indicate a leading edge of the cement slurry. In an embodiment, MEMS sensors are placed in leading and trailing plugs to signal the beginning and end of the cement slurry. While cement is continuously pumped into annulus 26, at decision 136, the data interrogation tool is attempting to detect whether the data sensors are in communicative (e.g., close) proximity with the data interrogation tool. As long as no data sensors are detected, the pumping of additional cement into the annulus continues. When the data interrogation tool detects the sensors at block 138 indicating that the leading edge of the cement has reached the bottom of the casing, the interrogator sends a signal to terminate pumping. The cement in the annulus is allowed to set and form a substantially impermeable mass which physically supports and positions the casing in the wellbore and bonds the casing to the walls of the wellbore in block 148.

If the fluid of block 130 is the cement slurry, MEMS-based data sensors are incorporated within the set cement, and parameters of the cement (e.g., temperature, pressure, ion concentration, stress, strain, etc.) can be monitored during placement and for the duration of the service life of the cement according to methods disclosed hereinabove. Alternatively, the data sensors may be added to an interface fluid (e.g., spacer fluid or other fluid plug) introduced into the annulus prior to and/or after introduction of cement slurry into the annulus.

The method just described for determination of the completion of a primary wellbore cementing operation may further comprise the activation of a downhole tool. For example, at block 130, a valve or other tool may be operably associated with a data interrogation tool at the far end of the casing. This valve may be contained within float shoe 22, for example, as disclosed hereinabove. Again, float shoe 22 may contain an integral data interrogation tool, or may otherwise be coupled to a data interrogation tool. For example, the data interrogation tool may be positioned between casing 20 and float shoe 22. Following the method previously described and blocks 132 to 136, pumping continues as the data interrogation tool detects the presence or absence of data sensors in close proximity to the interrogator tool (dependent upon the specific method cementing method being employed, e.g., reverse circulation, and the positioning of the sensors within the cement flow). Upon detection of a determinative presence or absence of sensors in close proximity indicating the termination of the cement slurry, the data interrogation tool sends a signal to actuate the tool (e.g., valve) at block 140. At block 142, the valve closes, sealing the casing and preventing cement from entering the portion of casing string above the valve in a reverse cementing operation. At block 144, the closing of the valve at 142, causes an increase in back pressure that is detected at the hydraulic pump 30. At block 146, pumping is discontinued, and cement is allowed to set in the annulus at block 148. In embodiments wherein data sensors have been incorporated throughout the cement, parameters of the cement (and thus cement integrity) can additionally be monitored during placement and for the duration of the service life of the cement according to methods disclosed hereinabove.

In embodiments, systems for sensing, communicating and evaluating wellbore parameters may include the wellbore 18; the casing 20 or other workstring, toolstring, production string, tubular, coiled tubing, wireline, or any other physical structure or conveyance extending downhole from the surface; MEMS sensors 52 that may be placed into the wellbore 18 and/or surrounding formation 14, for example, via a wellbore servicing fluid; and a device or plurality of devices for interrogating the MEMS sensors 52 to gather/collect data generated by the MEMS sensors 52, for transmitting the data from the MEMS sensors 52 to the earth's surface 16, for receiving communications and/or data to the earth's surface, for processing the data, or any combination thereof, referred to collectively herein a data interrogation/communication units or in some instances as a data interrogator or data interrogation tool. Unless otherwise specified, it is understood that such devices as disclosed in the various embodiments herein will have MEMS sensor interrogation functionality, communication functionality (e.g., transceiver functionality), or both, as will be apparent from the particular embodiments and associated context disclosed herein. The wellbore servicing fluid comprising the MEMS sensors 52 may comprise a drilling fluid, a spacer fluid, a sealant, a fracturing fluid, a gravel pack fluid, a completion fluid, or any other fluid placed downhole. In addition, the MEMS sensors 52 may be configured to measure physical parameters such as temperature, stress and strain, as well as chemical parameters such as $CO_2$ concentration, $H_2S$ concentration, $CH_4$ concentration, moisture content, pH, $Na^+$ concentration, $K^+$ concentration, and $Cl^-$ concentration. Various embodiments described herein are directed to interrogation/communication units that are dispersed or distributed at intervals along a length of the casing 20 and form a communication network for transmitting and/or receiving communications to/from a location downhole and the surface, with the further understanding that the interrogation/communication units may be otherwise physically supported by a workstring, toolstring, production string, tubular, coiled tubing, wireline, or any other physical structure or conveyance extending downhole from the surface.

Figure 5:
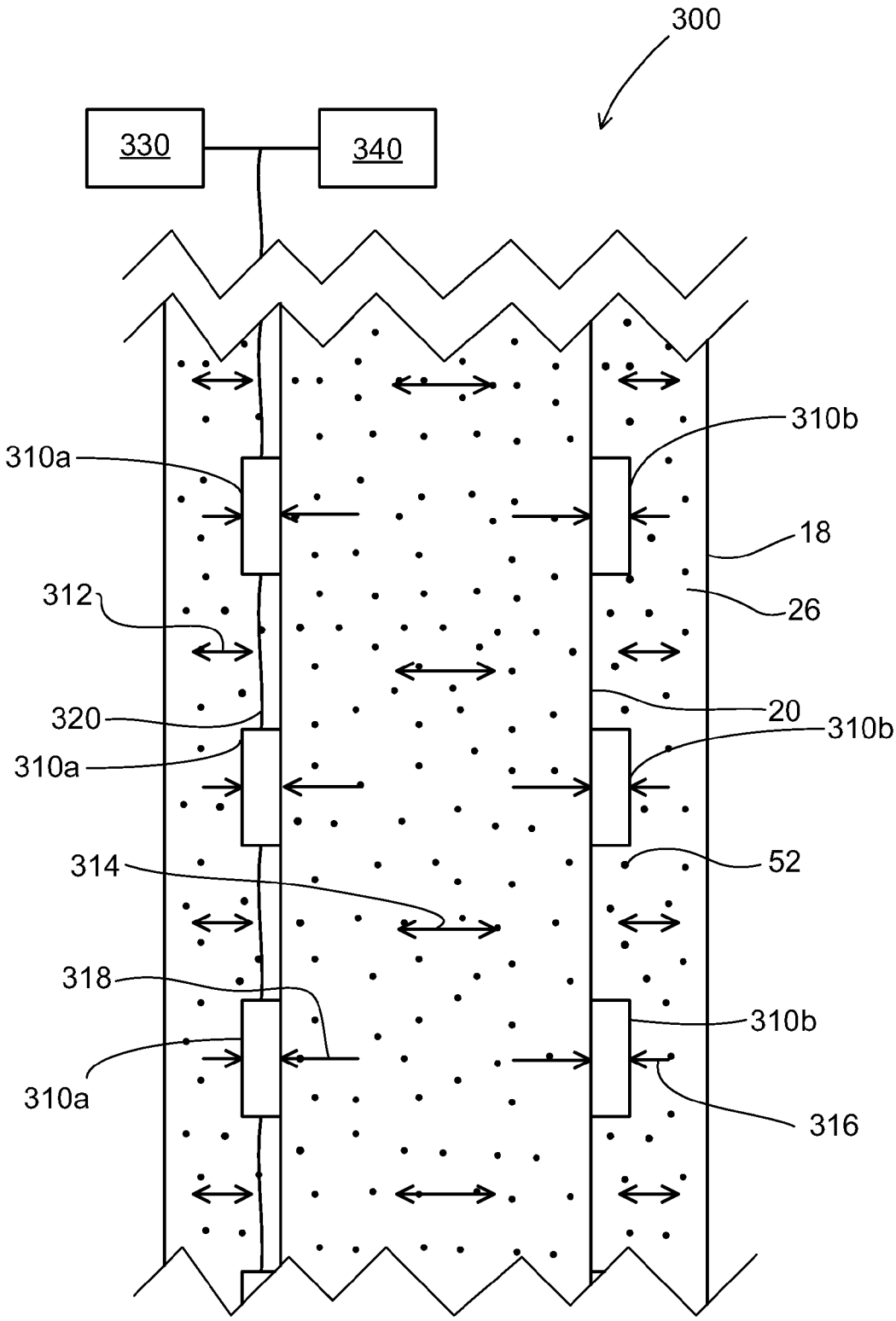
FIGS. 5, 6, 7, 8, 9, 10 are schematic views of embodiments of a wellbore parameter sensing system.

Referring to FIG. 5, a schematic view of a wellbore parameter sensing system 300 is illustrated. The wellbore parameter sensing system 300 may comprise the wellbore 18, inside which the casing 20 is positioned. In an embodiment, the wellbore parameter sensing system 300 may comprise one or more (e.g., a plurality) of data interrogation/communication units 310, which may be situated on the casing 20 and spaced at regular or irregular intervals along the casing 20. In embodiments, the data interrogation/communication units 310 may be situated on or in casing collars that couple casing joints together. For example, the interrogation/communication units 310 may be located in side pocket mandrels or other spaces/voids within the casing collar or casing joint. In addition, the data interrogation/communication units 310 may be situated in an interior of the casing 20, on an exterior of the casing 20, or both. In an embodiment, the data interrogation/communication units 310*a* may be coupled to one another by an electrical cable 320, which may run along an entire length of the casing 20 up to the earth's surface (where they may connect to other components such as a processor 330 and a power source 340), and are configured to transmit data between the data interrogation/communication units 310 and/or the earth's surface (e.g., the processor 330), supply power from the power source 340 to the data interrogation/communication units 310, or both. In alternative embodiments, all or a portion of the interrogation/communication units 310*b* communicate wirelessly with one another.

In an embodiment, the data interrogation/communication units 310 may be configured as regional data interrogation/communication units 310, which may be spaced apart about every 5 m to 15 m along the length of the casing 20, alternatively about every 8 m to 12 m along the length of the casing 20, alternatively about every 10 m along the length of the casing 20. Each regional data interrogation/communication unit 310 may be configured to interrogate, and receive data from, the MEMS sensors 52 in a vicinity of the regional data interrogation/communication unit 310. The vicinity of the regional data interrogation/communication unit 310 may be defined as an approximately cylindrical region extending upward from the regional data interrogation/communication unit 310, up to half a distance from the regional data interrogation/communication unit 310 in question to a regional data interrogation/communication unit 310 immediately uphole from the regional data interrogation/communication unit 310 in question, and extending downward from the regional data interrogation/communication unit 310, up to half a distance from the regional data interrogation/communication unit 310 in question to a regional data interrogation/communication unit 310 immediately downhole from the regional data interrogation/communication unit 310 in question. The approximately cylindrical region may also extend outward from a centerline of the casing 20, past an outer wall of the casing 20, past a wall of the wellbore 18, and about 0.05 m to 0.15 m, alternatively about 0.08 m to 0.12 m, alternatively about 0.1 m, into a formation through which the wellbore 18 passes. All or a portion of the regional data interrogation/communication units 310 may communicate with each other via wired communications (e.g., units 310*a*), wireless communications (e.g., 310*b*), or both.

In an embodiment, each MEMS sensor 52 situated in the casing 20 and/or in the annulus and/or in the formation, as well as in the vicinity of the regional data interrogation/communication unit 310, may transmit data regarding one or more parameters sensed by the MEMS sensor 52 directly to the regional data interrogation/communication unit 310 in response to being interrogated by the regional data interrogation/communication unit 310. In an embodiment, the MEMS sensors 52 in the vicinity of the regional data interrogation/communication unit 310 may form regional networks of MEMS sensors 52 (and in some embodiments, with regional networks of MEMS sensors generally corresponding to and communicating with one or more similarly designated regional data interrogation/communication units 310) and transmit MEMS sensor data inwards and/or outwards and/or upwards and/or downwards through the casing 20 and/or through the annulus 26, to the regional data interrogation/communication unit 310 via the regional networks of MEMS sensors 52. The double arrows 312, 314 signify transmission of sensor data via regional networks of MEMS sensors 52, and the single arrows 316, 318 signify transmission of sensor data directly from one or more MEMS sensors to the regional data interrogation/communication units 310.

In an embodiment, the MEMS sensors 52 (including a network of MEMS sensors) may be passive sensors, i.e., may be powered, for example, by bursts of electromagnetic radiation from the regional data interrogation/communication units 310. In an embodiment, the MEMS sensors 52 (including a network of MEMS sensors) may be active sensors, i.e., powered by a battery or batteries situated in or on the sensor 52. In an embodiment, batteries of the MEMS sensors 52 may be inductively rechargeable by the regional data interrogation/communication units 310.

Figure 6:
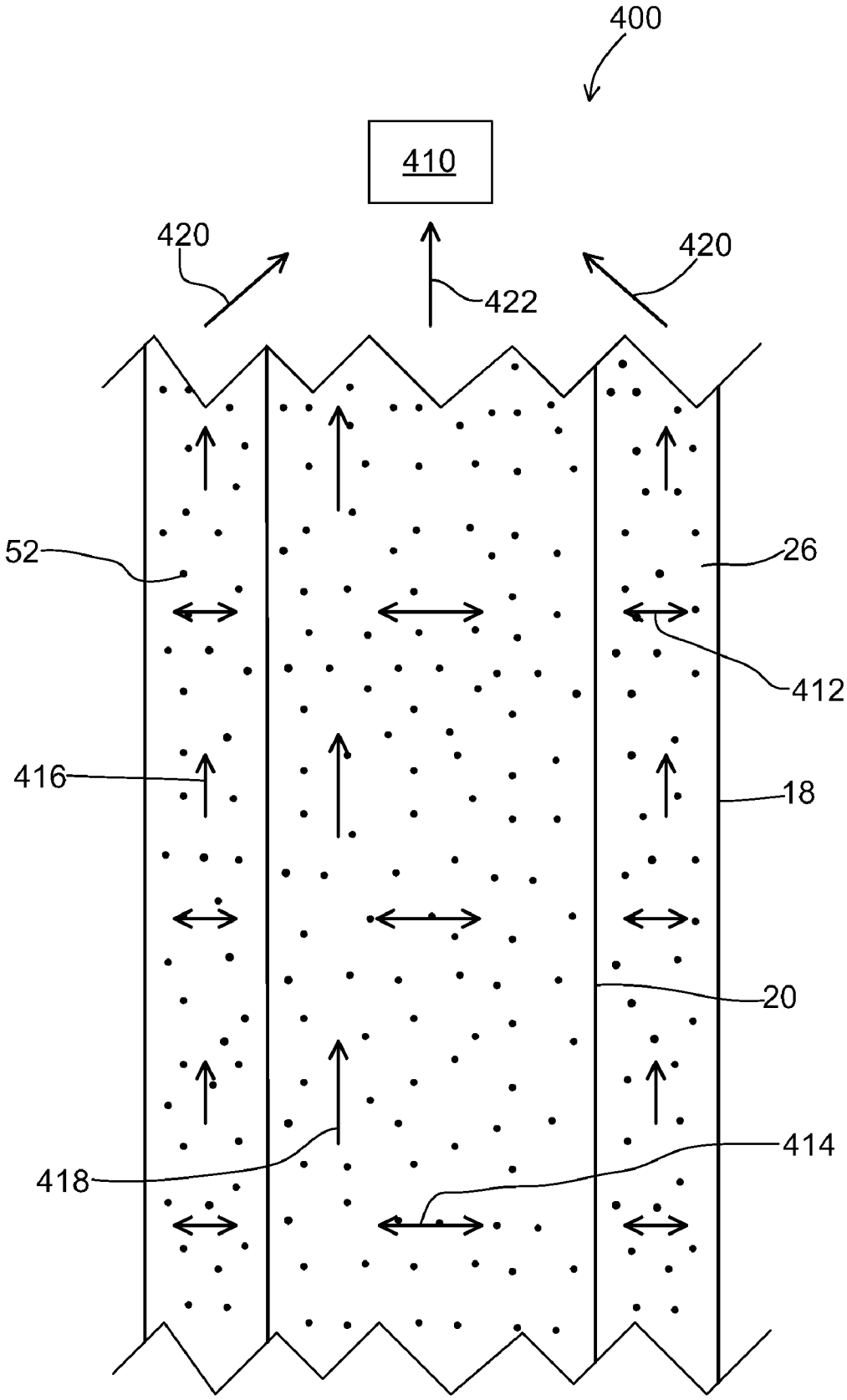

Referring to FIG. 6, a schematic view of a further embodiment of a wellbore parameter sensing system 400 is illustrated. The wellbore parameter sensing system 400 may comprise the wellbore 18, inside which the casing 20 is situated. In an embodiment, the wellbore parameter sensing system 400 further comprises a processor 410 configured to receive and process sensor data from MEMS sensors 52, which are situated in the wellbore 18 and are configured to measure at least one parameter inside the wellbore 18.

The embodiment of wellbore parameter sensing system 400 differs from that of wellbore parameter sensing system 300 illustrated in FIG. 5, in that the wellbore sensing system 400 does not comprise any data interrogation/communication units (or comprises very few, for example one at the end of a casing string such as in a cement shoe and/or a few spaced at lengthy intervals in comparision to FIG. 5) for interrogating, and receiving sensor data from, the MEMS sensors 52. Instead, the MEMS sensors 52, which, in an embodiment, are powered by batteries (or otherwise are powered by a downhole power source such as ambient conditions, e.g., temperature, fluid flow, etc.) situated in the sensors 52, are configured to form a global data transmission network of MEMS sensors 52 (e.g., a "daisy-chain" network) extending along the entire length of the wellbore 18. Accordingly, sensor data generated by MEMS sensors 52 at all elevations of the wellbore 18 may be transmitted to neighboring MEMS sensors 52 and uphole along the entire length of the wellbore 18 to the processor 410. Double arrows 412, 414 denote transmission of sensor data between neighboring MEMS sensors 52. Single arrows 416, 418 denote transmission of sensor data up the wellbore 18 via the global network of MEMS sensors 52, and single arrows 420, 422 denote transmission of sensor data from the annulus 26 and the interior of the casing 20 to the exterior of the wellbore 18, for example to a processor 410 or other data capture, storage, or transmission equipment.

In an embodiment, the MEMS sensors 52 are contained in a wellbore servicing fluid placed in the wellbore 18 and are present in the wellbore servicing fluid at a MEMS sensor loading sufficient for reliable transmission of MEMS sensor data from the interior of the wellbore 18 to the processor 410.

Figure 7:
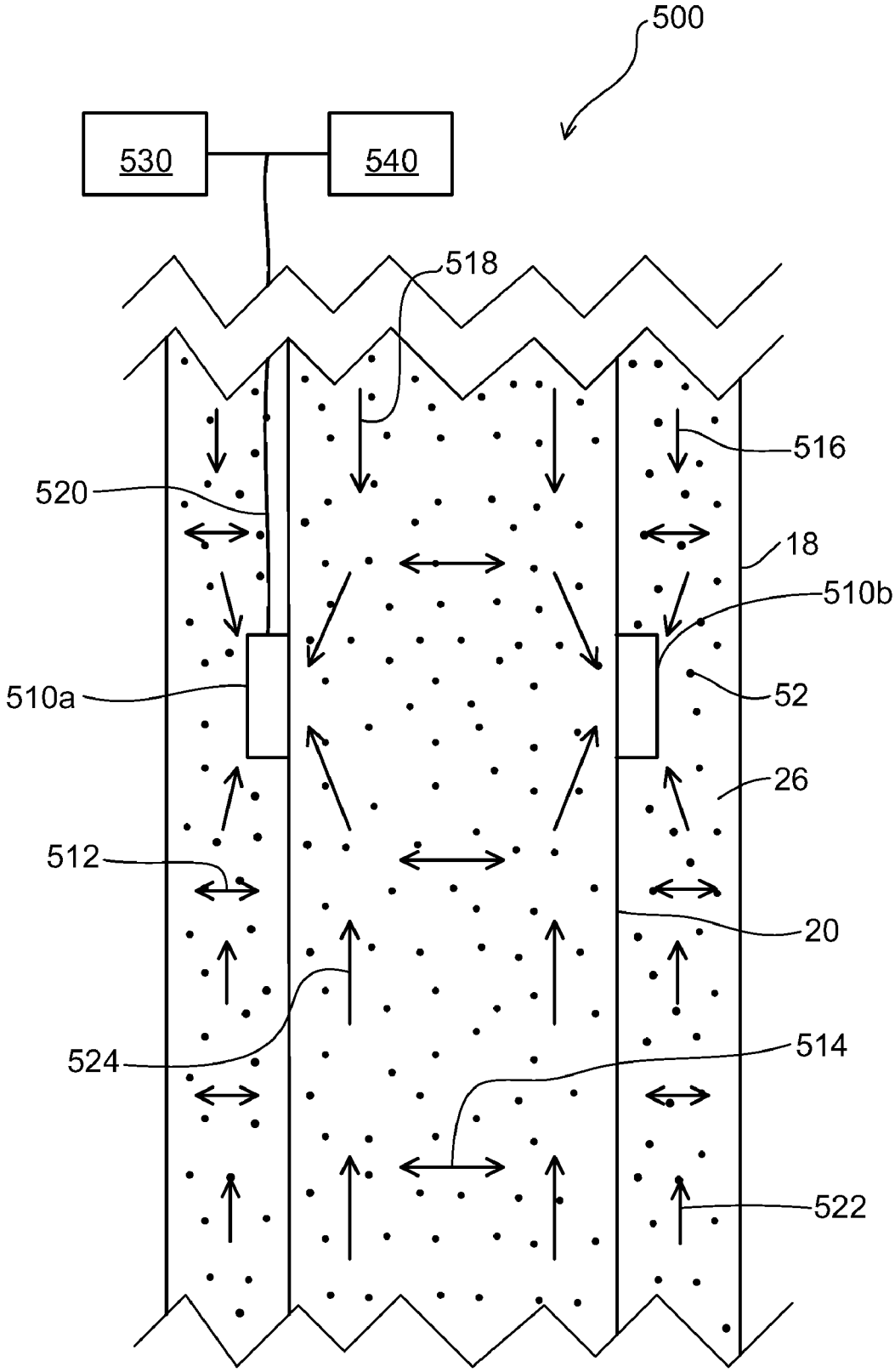

Referring to FIG. 7, a schematic view of an embodiment of a wellbore parameter sensing system 500 is illustrated. The wellbore parameter sensing system 500 may comprise the wellbore 18, inside which the casing 20 is situated. In an embodiment, the wellbore parameter sensing system 500 may comprise one or more data interrogation/communication units 510*a* and/or 510*b*, which may be situated on the casing 20. In embodiments, the data interrogation/communication unit 510 may be situated on or in a casing collar that couples casing joints together, at the end of a casing string such as a casing shoe, or any other suitable support location along a mechanical conveyance extending from the surface into the wellbore. In addition, the data interrogation/communication unit 510 may be situated in an interior of the casing 20, on an exterior of the casing 20, or both. In an embodiment, the data interrogation/communication unit 510 may be situated part way, e.g., about midway, between a downhole end of the wellbore 18 and an uphole end of the wellbore 18.

In an embodiment, the data interrogation/communication unit 510*a* may be powered by a power source 540, which is situated at an exterior of the wellbore 18 and is connected to the data interrogation/communication unit 510*a* by an electrical cable 520. The electrical cable 520 may be situated in the annulus 26 in close proximity to, or in contact with, an outer wall of the casing 20 and run along at least a portion of the length of the casing 20. In an embodiment, the data interrogation/communication unit, e.g., unit 510*b*, is powered and/or communicates wirelessly.

In an embodiment, the wellbore parameter sensing system 500 may further comprise a processor 530, which is connected to the data interrogation/communication unit 510*a* via the electrical cable 520 and is configured to receive MEMS sensor data from the data interrogation/communication unit 510*a* and process the MEMS sensor data. In an embodiment, the wellbore parameter sensing system 500 may further comprise a processor 530, which is wirelessly connected to the data interrogation/communication unit 510*b* and is configured to receive MEMS sensor data from the data interrogation/communication unit 510*b* and process the MEMS sensor data.

In an embodiment, the MEMS sensors 52 may be passive sensors, i.e., may be powered, for example, by bursts of electromagnetic radiation from the data interrogation/communication unit 510. In an embodiment, the MEMS sensors 52 may be active sensors, i.e., powered by a battery or batteries situated in or on the sensor 52 or by other downhole power sources. In an embodiment, batteries of the MEMS sensors 52 may be inductively rechargeable.

In an embodiment, MEMS sensors 52 may be placed inside the wellbore 18 via a wellbore servicing fluid. The MEMS sensors 52 are configured to measure at least one wellbore parameter and transmit sensor data regarding the at least one wellbore parameter to the data interrogation/communication unit 510. As in the case of the embodiment of the wellbore parameter sensing system 400 illustrated in FIG. 6, the MEMS sensors 52 may transmit MEMS sensor data to neighboring MEMS sensors 52, thereby forming data transmission networks of MEMS sensors for the purpose of transmitting MEMS sensor data from MEMS sensors 52 situated away from the data interrogation/communication unit 510 to the data interrogation/communication unit 510. However, in contrast to the embodiment of the wellbore parameter sensing system 400 illustrated in FIG. 6, the MEMS sensors 52 in the embodiment of the wellbore parameter sensing system 500 illustrated in FIG. 7 may, in some instances, not have to transmit MEMS sensor data along the entire length of the wellbore 18, but rather only along a portion of the length of the wellbore 18, for example to reach a given primary or regional data interrogation/communication unit. Horizontal double arrows 512, 514 denote transmission of sensor data between MEMS sensors 52 situated in the annulus 26 and inside the casing 20, downwardly oriented single arrows 516, 518 denote transmission of sensor data downhole to the data interrogation/communication unit 510, and upwardly oriented single arrows 522, 524 denote transmission of sensor data uphole to the data interrogation/communication unit 510.

Figure 8:
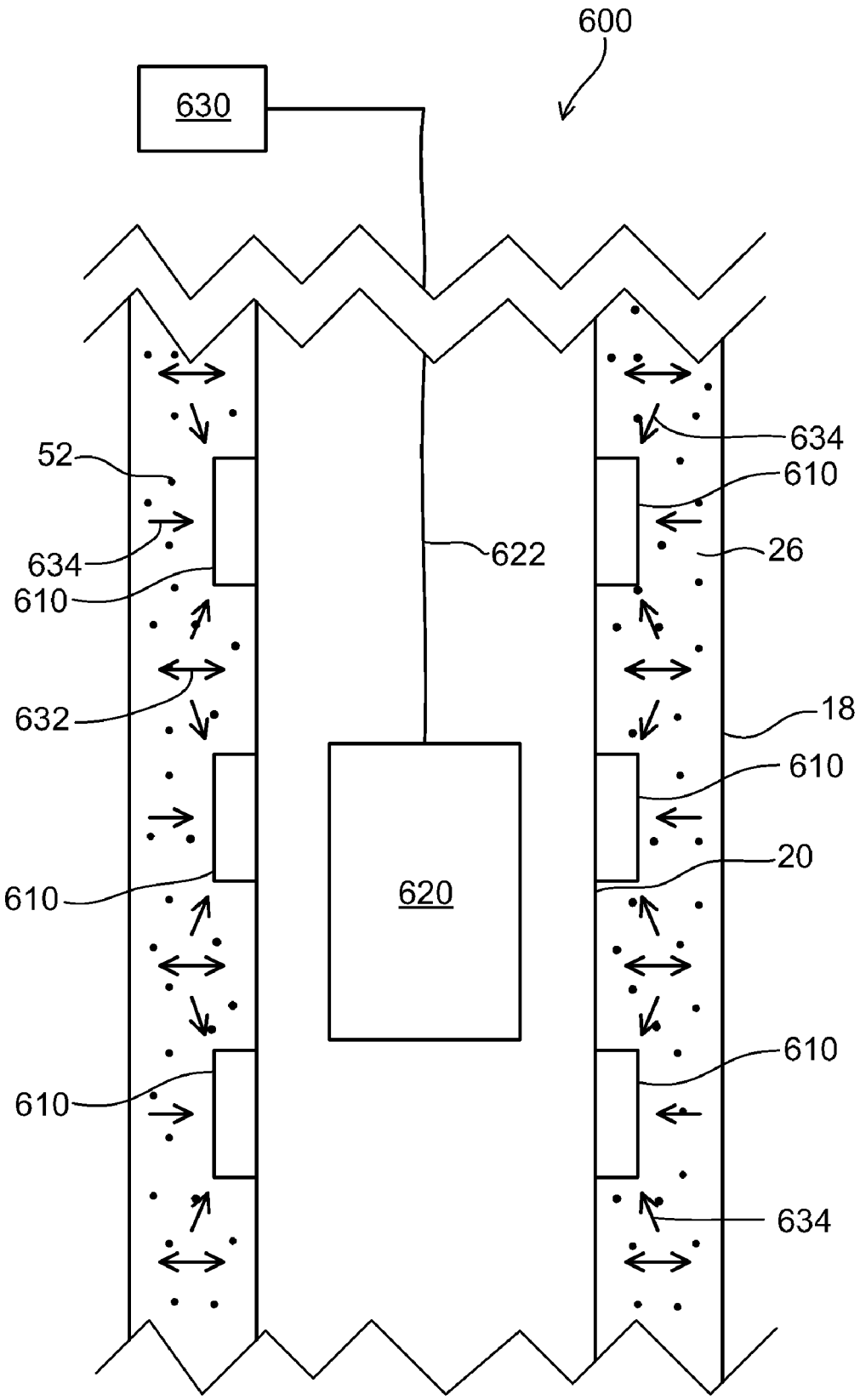

Referring to FIG. 8, a schematic view of an embodiment of a wellbore parameter sensing system 600 is illustrated. The wellbore parameter sensing system 600 may comprise the wellbore 18, inside which the casing 20 is situated. In an embodiment, the wellbore parameter sensing system 600 may further comprise a plurality of regional communication units 610, which may be situated on the casing 20 and spaced at regular or irregular intervals along the casing, e.g., about every 5 m to 15 m along the length of the casing 20, alternatively about every 8 m to 12 m along the length of the casing 20, alternatively about every 10 m along the length of the casing 20. In embodiments, the regional communication units 610 may be situated on or in casing collars that couple casing joints together. In addition, the regional communication units 610 may be situated in an interior of the casing 20, on an exterior of the casing 20, or both. In an embodiment, the wellbore parameter sensing system 600 may further comprise a tool (e.g., a data interrogator 620 or other data collection and/or power-providing device), which may be lowered down into the wellbore 18 on a wireline 622, as well as a processor 630 or other data storage or communication device, which is connected to the data interrogator 620.

In an embodiment, each regional communication unit 610 may be configured to interrogate and/or receive data from, MEMS sensors 52 situated in the annulus 26, in the vicinity of the regional communication unit 610, whereby the vicinity of the regional communication unit 610 is defined as in the above discussion of the wellbore parameter sensing system 300 illustrated in FIG. 5. The MEMS sensors 52 may be configured to transmit MEMS sensor data to neighboring MEMS sensors 52, as denoted by double arrows 632, as well as to transmit MEMS sensor data to the regional communication units 610 in their respective vicinities, as denoted by single arrows 634. In an embodiment, the MEMS sensors 52 may be passive sensors that are powered by bursts of electromagnetic radiation from the regional communication units 610. In a further embodiment, the MEMS sensors 52 may be active sensors that are powered by batteries situated in or on the MEMS sensors 52 or by other downhole power sources.

In contrast with the embodiment of the wellbore parameter sensing system 300 illustrated in FIG. 5, the regional communication units 610 in the present embodiment of the wellbore parameter sensing system 600 are neither wired to one another, nor wired to the processor 630 or other surface equipment. Accordingly, in an embodiment, the regional communication units 610 may be powered by batteries, which enable the regional communication units 610 to interrogate the MEMS sensors 52 in their respective vicinities and/or receive MEMS sensor data from the MEMS sensors 52 in their respective vicinities. The batteries of the regional communication units 610 may be inductively rechargeable by the data interrogator 620 or may be rechargeable by other downhole power sources. In addition, as set forth above, the data interrogator 620 may be lowered into the wellbore 18 for the purpose of interrogating regional communication units 610 and receiving the MEMS sensor data stored in the regional communication units 610. Furthermore, the data interrogator 620 may be configured to transmit the MEMS sensor data to the processor 630, which processes the MEMS sensor data. In an embodiment, a fluid containing MEMS in contained within the wellbore casing (for example, as shown in FIGS. 5, 6, 7, and 10), and the data interrogator 620 is conveyed through such fluid and into communicative proximity with the regional communication units 610. In various embodiments, the data interrogator 620 may communicate with, power up, and/or gather data directly from the various MEMS sensors distributed within the annulus 26 and/or the casing 20, and such direct interaction with the MEMS sensors may be in addition to or in lieu of communication with one or more of the regional communication units 610. For example, if a given regional communication unit 610 experiences an operational failure, the data interrogator 620 may directly communicate with the MEMS within the given region experiencing the failure, and thereby serve as a backup (or secondary/verification) data collection option.

Figure 9:
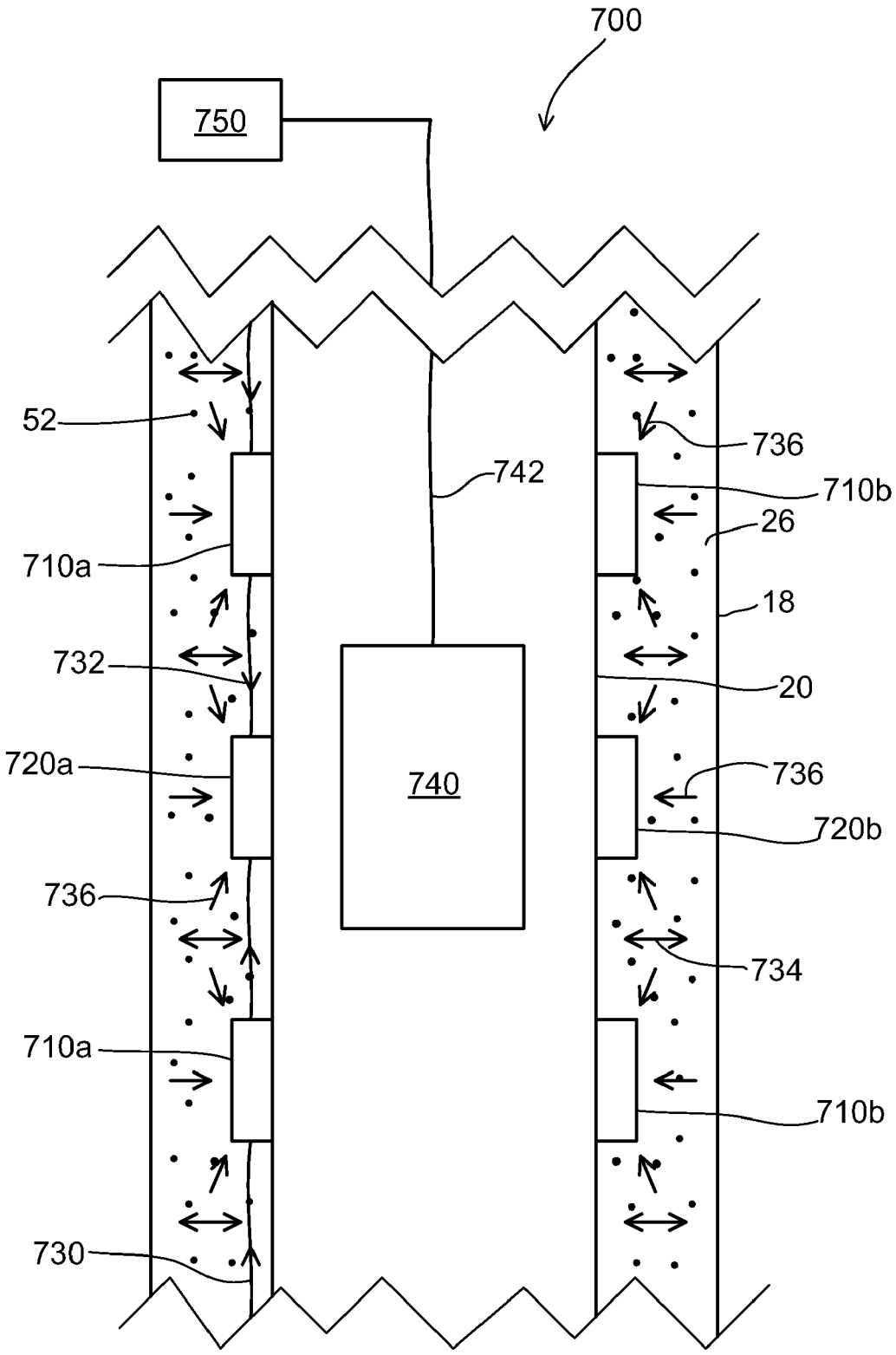

Referring to FIG. 9, a schematic view of an embodiment of a wellbore parameter sensing system 700 is illustrated. As in earlier-described embodiments, the wellbore parameter sensing system 700 comprises the wellbore 18 and the casing 20 that is situated inside the wellbore 18. In addition, as in the case of other embodiments illustrated in the Figures (e.g., FIGS. 5 and 8), the wellbore parameter sensing system 700 comprises a plurality of regional communication units 710, which may be situated on the casing 20 and spaced at regular or irregular intervals along the casing, e.g., about every 5 m to 15 m along the length of the casing 20, alternatively about every 8 m to 12 m along the length of the casing 20, alternatively about every 10 m along the length of the casing 20. In embodiments, the regional communication units 710 may be situated on or in casing collars that couple casing joints together. In addition, the regional communication units 710 may be situated in an interior of the casing 20, on an exterior of the casing 20, or both, or may be otherwise located and supported as described in various embodiments herein.

In contrast to the embodiment of the wellbore parameter sensing system 300 illustrated in FIG. 5, in an embodiment, the wellbore parameter sensing system 700 further comprises one or more primary (or master) communication units 720. The regional communication units 710*a* and the primary communication unit 720*a* may be coupled to one another by a data line 730, which allows sensor data obtained by the regional communication units 710*a* from MEMS sensors 52 situated in the annulus 26 to be transmitted from the regional communication units 710*a* to the primary communication unit 720*a*, as indicated by directional arrows 732.

In an embodiment, the MEMS sensors 52 may sense at least one wellbore parameter and transmit data regarding the at least one wellbore parameter to the regional communication units 710*b*, either via neighboring MEMS sensors 52 as denoted by double arrow 734, or directly to the regional communication units 710 as denoted by single arrows 736. The regional communication units 710*b* may communicate wirelessly with the primary or master communication unit 720*b*, which may in turn communicate wirelessly with equipment located at the surface (or via telemetry such as casing signal telemetry) and/or other regional communication units 720*a* and/or other primary or master communication units 720*a*.

In embodiments, the primary or master communication units 720 gather information from the MEMS sensors and transmit (e.g., wirelessly, via wire, via telemetry such as casing signal telemetry, etc.) such information to equipment (e.g., processor 750) located at the surface.

In an embodiment, the wellbore parameter sensing system 700 further comprises, additionally or alternatively, a data interrogator 740, which may be lowered into the wellbore 18 via a wire line 742, as well as a processor 750, which is connected to the data interrogator 740. In an embodiment, the data interrogator 740 is suspended adjacent to the primary communication unit 720, interrogates the primary communication unit 720, receives MEMS sensor data collected by all of the regional communication units 710 and transmits the MEMS sensor data to the processor 750 for processing. The data interrogator 740 may provide other functions, for example as described with reference to data interrogator 620 of FIG. 8. In various embodiments, the data interrogator 740 (and likewise the data interrogator 620) may communicate directly or indirectly with any one or more of the MEMS sensors (e.g., sensors 52), local or regional data interrogation/communication untits (e.g., units 310, 510, 610, 710), primary or master communication units (e.g., units 720), or any combination thereof.

Figure 10:
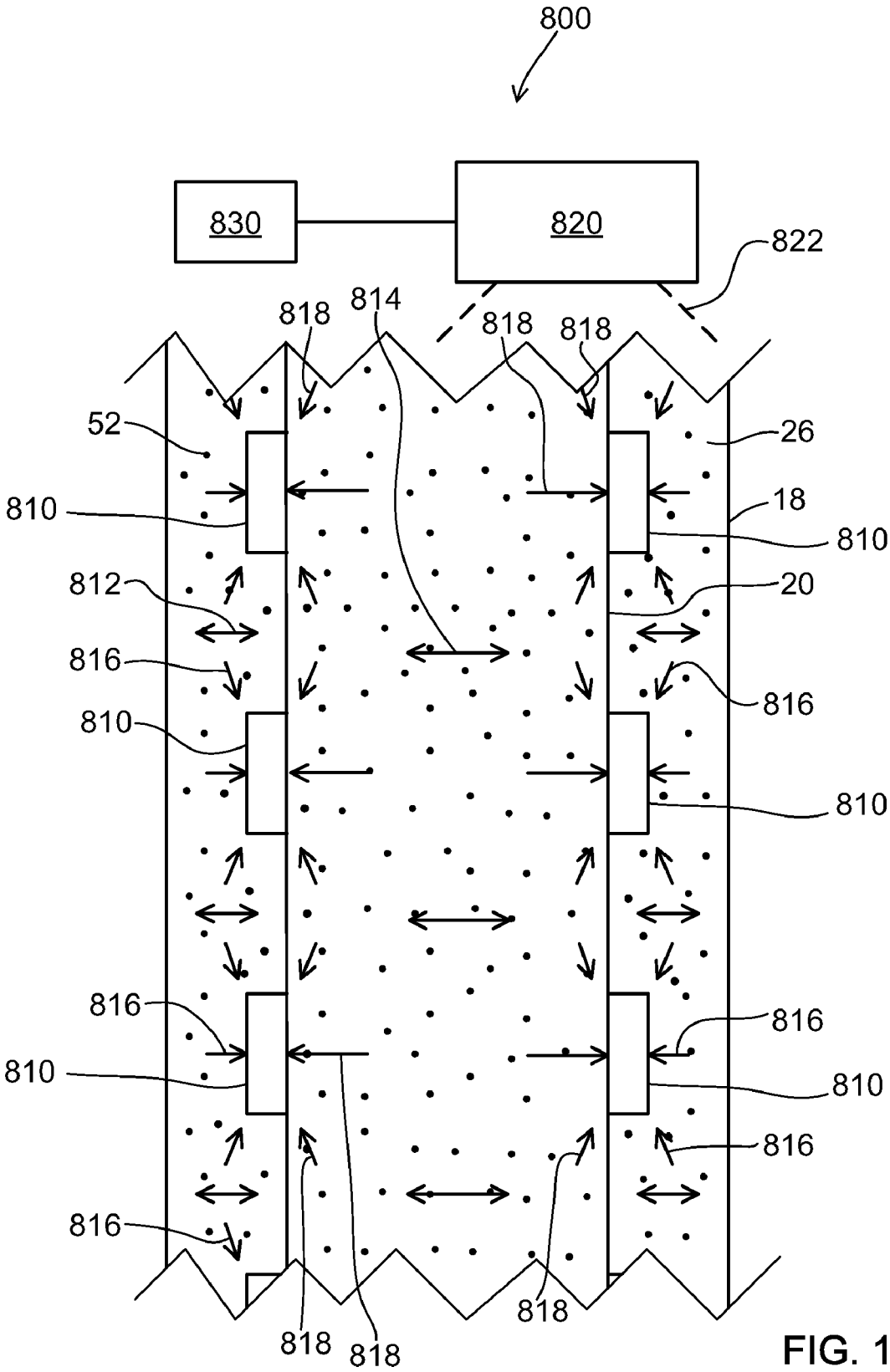

Referring to FIG. 10, a schematic view of an embodiment of a wellbore parameter sensing system 800 is illustrated. As in earlier-described embodiments, the wellbore parameter sensing system 800 comprises the wellbore 18 and the casing 20 that is situated inside the wellbore 18. In addition, as in the case of other embodiments shown in FIGS. 5-9, the wellbore parameter sensing system 800 comprises a plurality of local, regional, and/or primary/master communication units 810, which may be situated on the casing 20 and spaced at regular or irregular intervals along the casing 20, e.g., about every 5 m to 15 m along the length of the casing 20, alternatively about every 8 m to 12 m along the length of the casing 20, alternatively about every 10 m along the length of the casing 20. In embodiments, the communication units 810 may be situated on or in casing collars that couple casing joints together. In addition, the communication units 810 may be situated in an interior of the casing 20, on an exterior of the casing 20, or both, or may be otherwise located and supported as described in various embodiments herein.

In an embodiment, MEMS sensors 52, which are present in a wellbore servicing fluid that has been placed in the wellbore 18, may sense at least one wellbore parameter and transmit data regarding the at least one wellbore parameter to the local, regional, and/or primary/master communication units 810, either via neighboring MEMS sensors 52 as denoted by double arrows 812, 814, or directly to the communication units 810 as denoted by single arrows 816, 818.

In an embodiment, the wellbore parameter sensing system 800 may further comprise a data interrogator 820, which is connected to a processor 830 and is configured to interrogate each of the communication units 810 for MEMS sensor data via a ground penetrating signal 822 and to transmit the MEMS sensor data to the processor 830 for processing.

In a further embodiment, one or more of the communication units 810 may be coupled together by a data line (e.g., wired communications). In this embodiment, the MEMS sensor data collected from the MEMS sensors 52 by the regional communication units 810 may be transmitted via the data line to, for example, the regional communication unit 810 situated furthest uphole. In this case, only one regional communication unit 810 is interrogated by the surface located data interrogator 820. In addition, since the regional communication unit 810 receiving all of the MEMS sensor data is situated uphole from the remainder of the regional communication units 810, an energy and/or parameter (intensity, strength, wavelength, amplitude, frequency, etc.) of the ground penetrating signal 822 may be able to be reduced. In other embodiments, a data interrogator such as unit 620 or 740) may be used in addition to or in lieu of the surface unit 810, for example to serve as a back-up in the event of operation difficulties associated with surface unit 820 and/or to provide or serve as a relay between surface unit 820 and one or more units downhole such as a regional unit 810 located at an upper end of a string of interrogator units.

For sake of clarity, it should be understood that like components as described in any of FIGS. 5-10 may be combined and/or substituted to yield additional embodiments and the functionality of such components in such additional embodiments will be apparent based upon the description of FIGS. 5-10 and the various components therein. For example, in various embodiments disclosed herein (including but not limited to the embodiments of FIGS. 5-10), the local, regional, and/or primary/master communication/data interrogation units (e.g., units 310, 510, 610, 620, 710, 740, and/or 810) may communicate with one another and/or equipment located at the surface via signals passed using a common structural support as the transmission medium (e.g., casing, tubular, production tubing, drill string, etc.), for example by encoding a signal using telemetry technology such as an electrical/mechanical transducer. In various embodiments disclosed herein (including but not limited to the embodiments of FIGS. 5-10), the local, regional, and/or primary/master communication/data interrogation units (e.g., units 310, 510, 610, 620, 710, 740, and/or 810) may communicate with one another and/or equipment located at the surface via signals passed using a network formed by the MEMS sensors (e.g., a daisy-chain network) distributed along the wellbore, for example in the annular space 26 (e.g., in a cement) and/or in a wellbore servicing fluid inside casing 20. In various embodiments disclosed herein (including but not limited to the embodiments of FIGS. 5-10), the local, regional, and/or primary/master communication/data interrogation units (e.g., units 310, 510, 610, 620, 710, 740, and/or 810) may communicate with one another and/or equipment located at the surface via signals passed using a ground penetrating signal produced at the surface, for example being powered up by such a ground-penetrating signal and transmitting a return signal back to the surface via a reflected signal and/or a daisy-chain network of MEMS sensors and/or wired communications and/or telemetry transmitted along a mechanical conveyance/medium. In some embodiments, one or more of), the local, regional, and/or primary/master communication/data interrogation units (e.g., units 310, 510, 610, 620, 710, 740, and/or 810) may serve as a relay or broker of signals/messages containing information/data across a network formed by the units and/or MEMS sensors.

Figure 11:
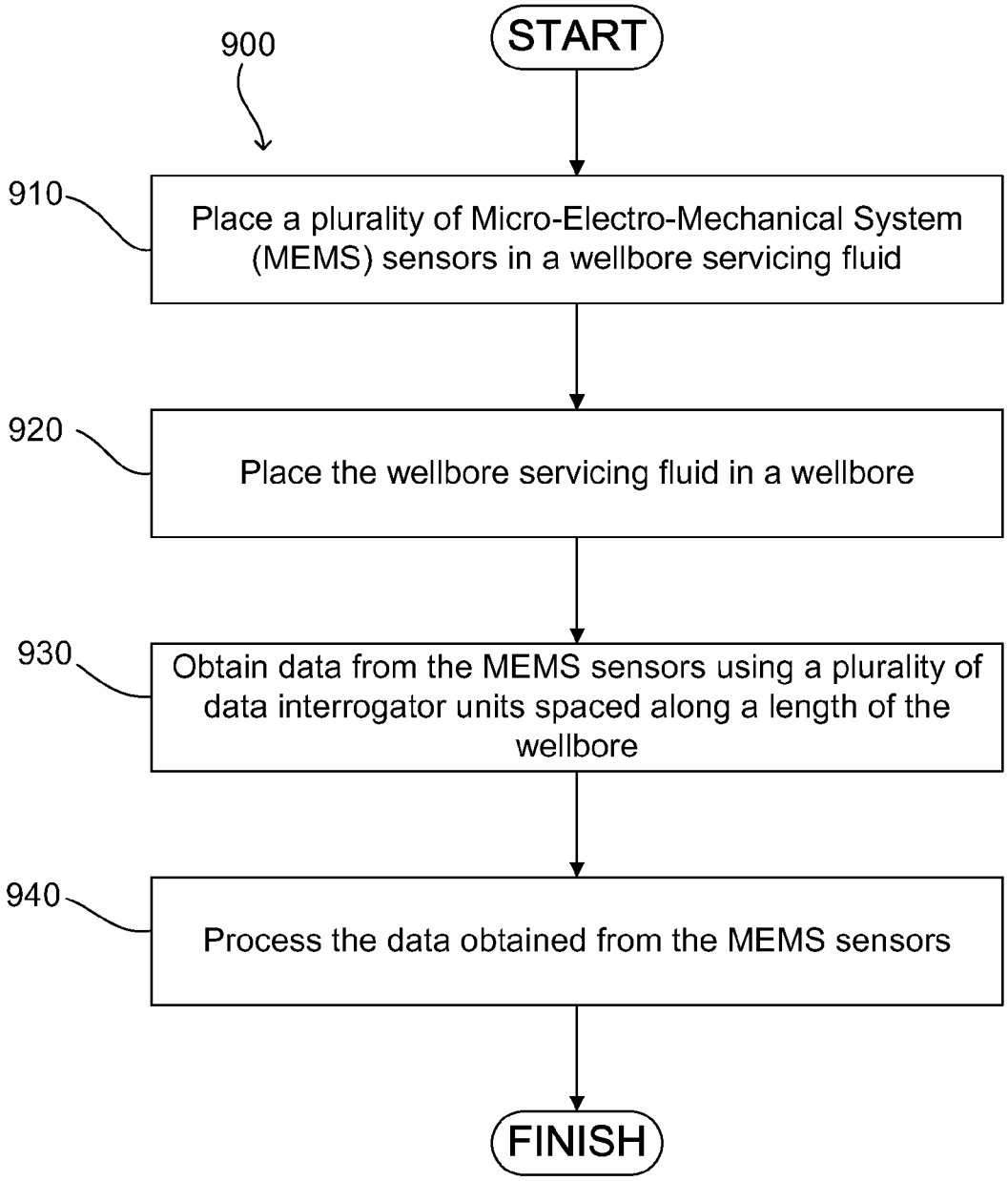
FIGS. 11 and 12 flowcharts of methods for servicing a wellbore.

Referring to FIG. 11, a method 900 of servicing a wellbore is described. At block 910, a plurality of MEMS sensors is placed in a wellbore servicing fluid. At block 920, the wellbore servicing fluid is placed in a wellbore. At block 930, data is obtained from the MEMS sensors, using a plurality of data interrogation units spaced along a length of the wellbore. At block 940, the data obtained from the MEMS sensors is processed.

Figure 12:
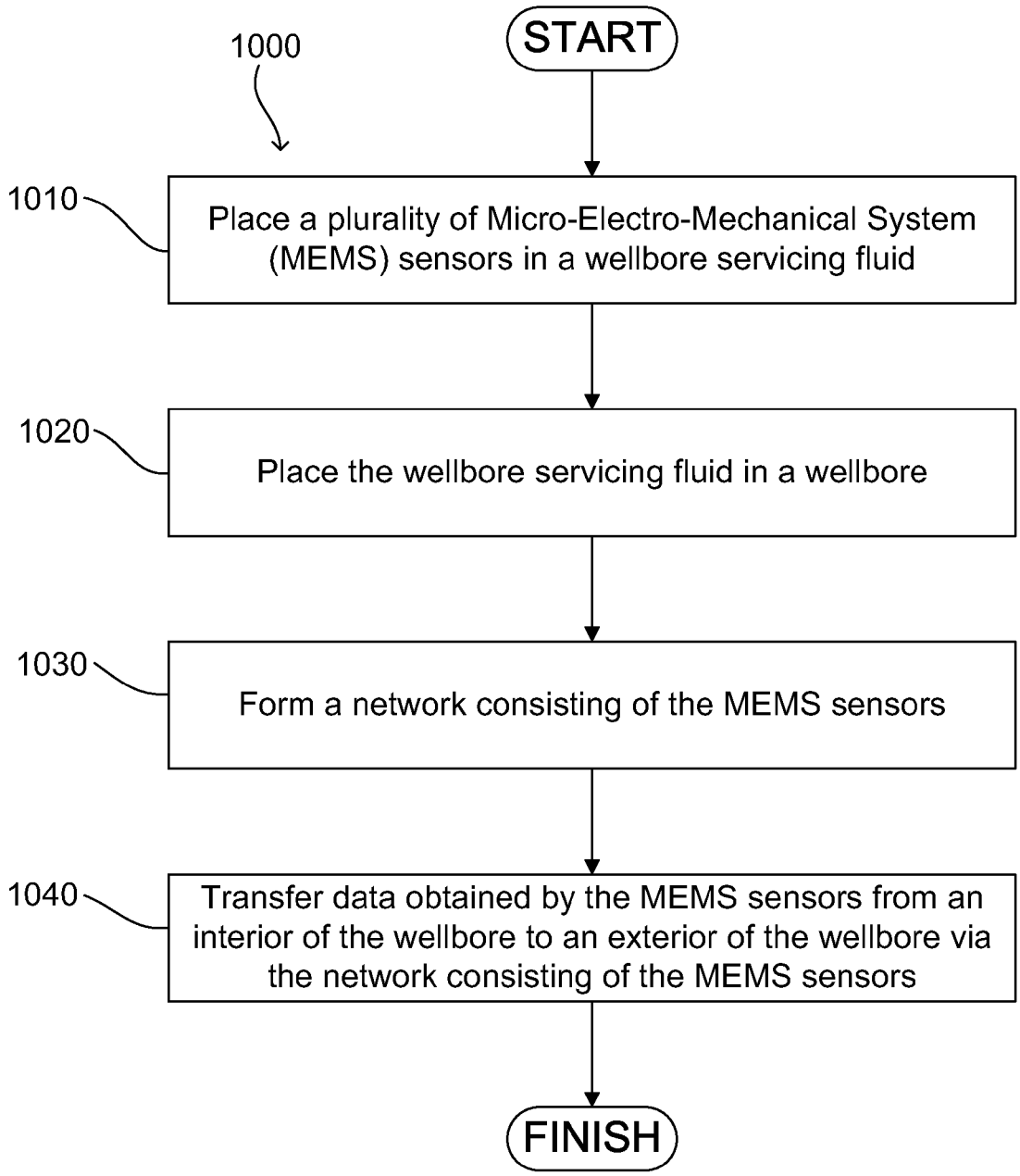

Referring to FIG. 12, a further method 1000 of servicing a wellbore is described. At block 1010, a plurality of MEMS sensors is placed in a wellbore servicing fluid. At block 1020, the wellbore servicing fluid is placed in a wellbore. At block 1030, a network consisting of the MEMS sensors is formed. At block 1040, data obtained by the MEMS sensors is transferred from an interior of the wellbore to an exterior of the wellbore via the network consisting of the MEMS sensors. Any of the embodiments set forth in the Figures described herein, for example, without limitation, FIGS. 5-10, may be used in carrying out the methods as set forth in FIGS. 11 and 12.

In some embodiments, a conduit (e.g., casing 20 or other tubular such as a production tubing, drill string, workstring, or other mechanical conveyance, etc.) in the wellbore 18 may be used as a data transmission medium, or at least as a housing for a data transmission medium, for transmitting MEMS sensor data from the MEMS sensors 52 and/or interrogation/communication units situated in the wellbore 18 to an exterior of the wellbore (e.g., earth's surface 16). Again, it is to be understood that in various embodiments referencing the casing, other physical supports may be used as a data transmission medium such as a workstring, toolstring, production string, tubular, coiled tubing, wireline, jointed pipe, or any other physical structure or conveyance extending downhole from the surface.

Figure 13:
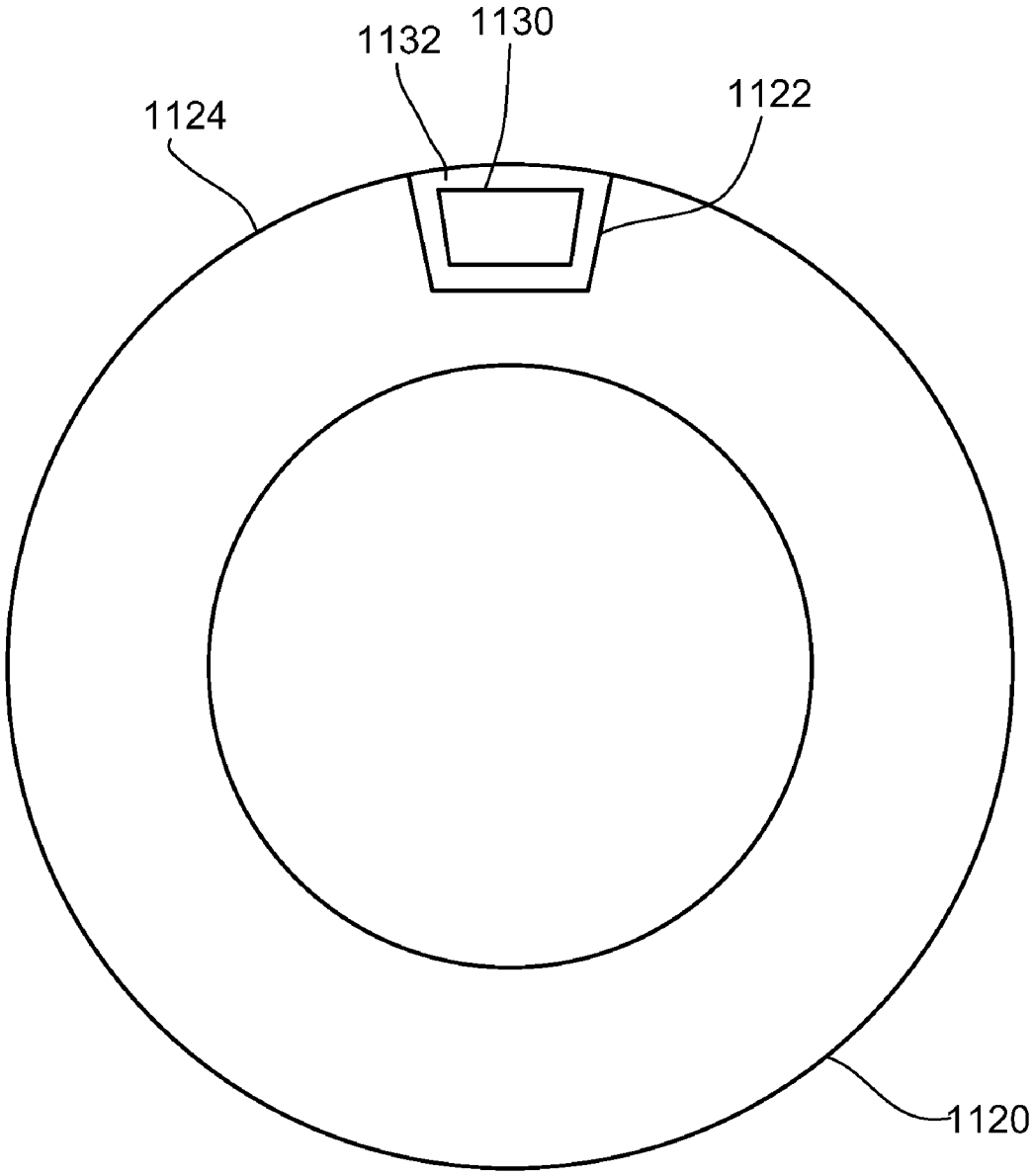
FIG. 13 is a schematic cross-sectional view of an embodiment of a casing.

Referring to FIG. 13, a schematic cross-sectional view of an embodiment of the casing 1120 is illustrated. The casing 1120 may comprise a groove, cavity, or hollow 1122, which runs longitudinally along an outer surface 1124 of the casing, along at least a portion of a length of the 1120 casing. The groove 1122 may be open or may be enclosed, for example with an exterior cover applied over the groove and attached to the casing (e.g., welded) or may be enclosed as an integral portion of the casing body/structure (e.g., a bore running the length of each casing segment). In an embodiment, at least one cable 1130 may be embedded or housed in the groove 1122 and run longitudinally along a length of the groove 1122. The cable 1130 may be insulated (e.g., electrically insulated) from the casing 1120 by insulation 1132. The cable 1130 may be a wire, fiber optic, or other physical medium capable of transmitting signals.

In an embodiment, a plurality of cables 1130 may be situated in groove 1122, for example, one or more insulated electrical lines configured to power pieces of equipment situated in the wellbore 18 and/or one or more data lines configured to carry data signals between downhole devices and an exterior of the wellbore 18. In various embodiments, the cable 1130 may be any suitable electrical, signal, and/or data communication line, and is not limited to metallic conductors such as copper wires but also includes fiber optical cables and the like.

Figure 14:
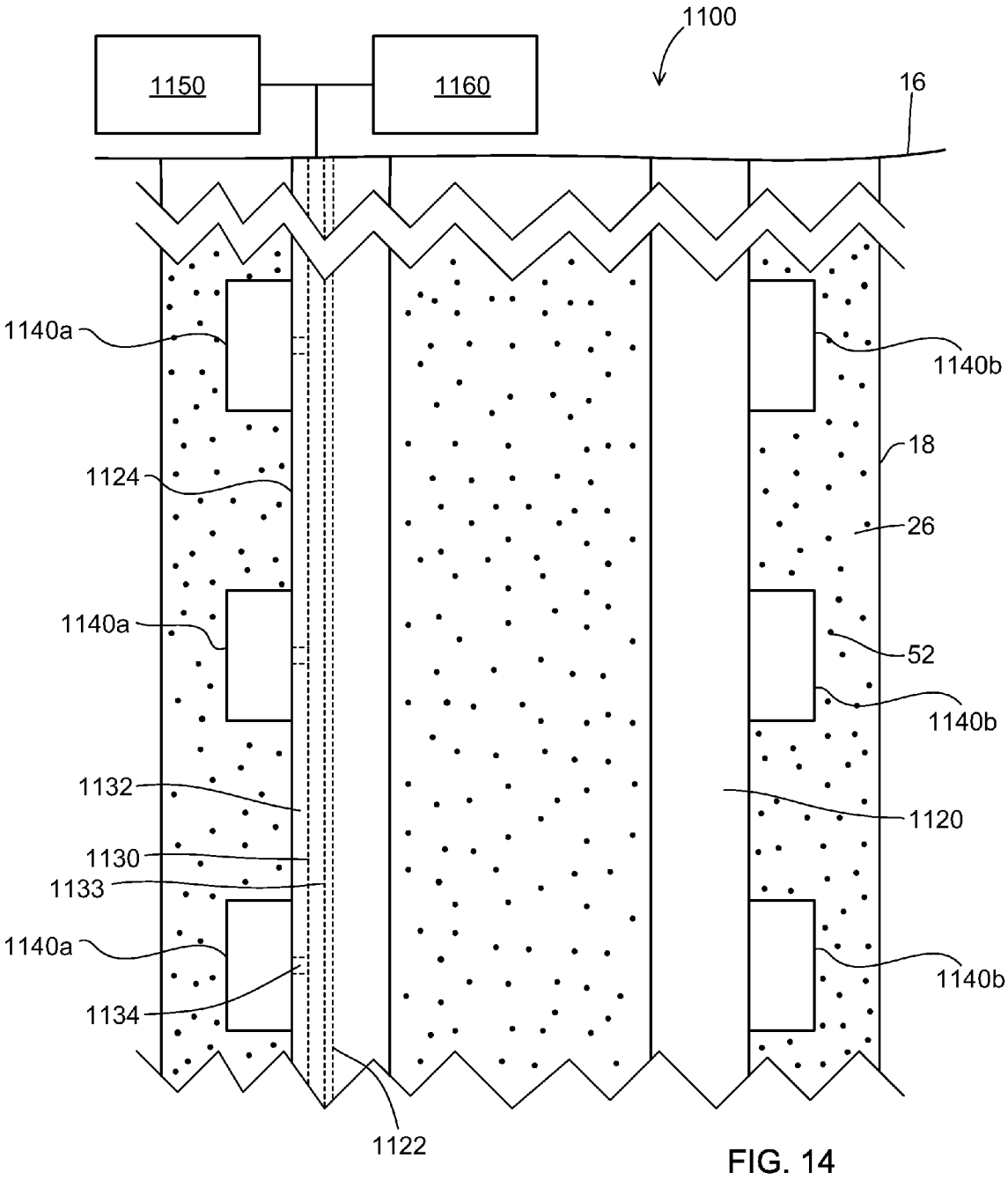
FIGS. 14 and 15 are schematic views of further embodiments of a wellbore parameter sensing system.

FIG. 14 illustrates an embodiment of a wellbore parameter sensing system 1100, comprising the wellbore 18 inside which a wellbore servicing fluid loaded with MEMS sensors 52 is situated; the casing 1120 having a groove 1122; a plurality of data interrogation/communication units 1140 situated on the casing 1120 and spaced along a length of the casing 1120; a processing unit 1150 situated at an exterior of the wellbore 18; and a power supply 1160 situated at the exterior of the wellbore 18.

In embodiments, the data interrogation/communication units 1140 may be situated on or in casing collars that couple casing joints together. In addition or alternatively, the data interrogation/communication units 1140 may be situated in an interior of the casing 1120, on an exterior of the casing 1120, or both. In an embodiment, the data interrogation/communication units 1140*a* may be connected to the cable(s) and/or data line(s) 1130 via through-holes 1134 in the insulation 1132 and/or the casing (e.g., outer surface 1124). The data interrogation/communication units 1140*a* may be connected to the power supply 1160 via cables 1130, as well as to the processor 1150 via data line(s) 1133. The data interrogation/communication units 1140*a* commonly connected to one or more cables 1130 and/or data lines 1133 may function (e.g., collect and communication MEMS sensor data) in accordance with any of the embodiments disclosed herein having wired connections/communications, including but not limited to FIGS. 5, 7, and 9. Furthermore, the wellbore parameter sensing system 1100 may further comprise one or more data interrogation/communication units 1140*b* in wireless communication and may function (e.g., collect and communication MEMS sensor data) in accordance with any of the embodiments disclosed herein having wireless connections/communications, including but not limited to FIGS. 5, 7, 8, 9, and 10.

By way of non-limiting example, the MEMS sensors 52 present in a wellbore servicing fluid situated in an interior of the casing 1120 and/or in the annulus 26 measure at least one wellbore parameter. The data interrogation/communication units 1140 in a vicinity of the MEMS sensors 52 interrogate the sensors 52 at regular intervals and receive data from the sensors 52 regarding the at least one wellbore parameter. The data interrogation/communication units 1140 then transmit the sensor data to the processor 1150, which processes the sensor data.

In an embodiment, the MEMS sensors 52 may be passive sensors, i.e., may be powered, for example, by bursts of electromagnetic radiation from the regional data interrogation/communication units 1140. In a further embodiment, the MEMS sensors 52 may be active sensors, i.e., powered by a battery or batteries situated in or on the sensors 52 or other downhole power source. In an embodiment, batteries of the MEMS sensors 52 may be inductively rechargeable by the regional data interrogation/communication units 1140.

In a further embodiment, the casing 1120 may be used as a conductor for powering the data interrogation/communication units 1140, or as a data line for transmitting MEMS sensor data from the data interrogation/communication units 1140 to the processor 1150.

Figure 15:
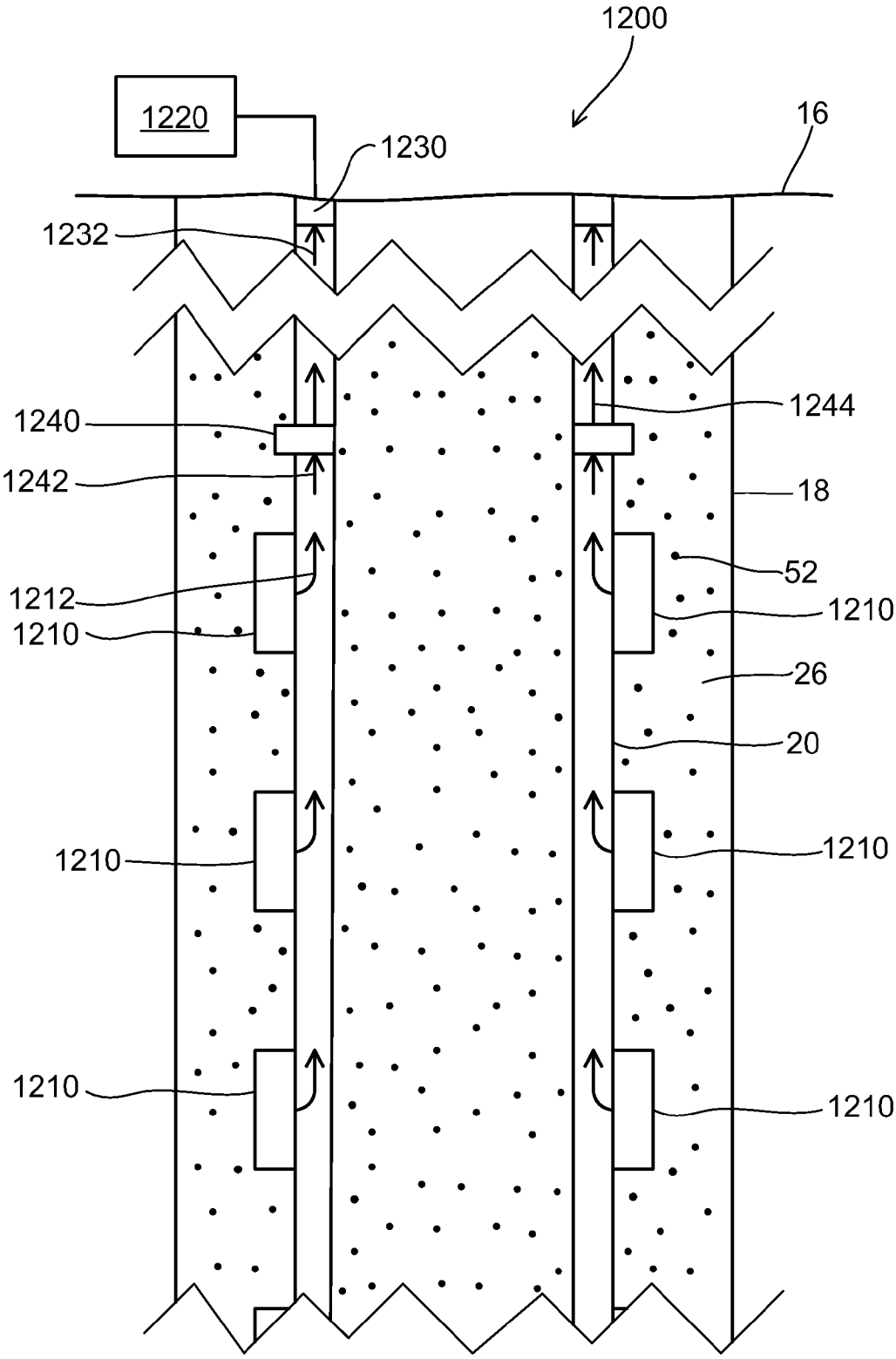

FIG. 15 illustrates an embodiment of a wellbore parameter sensing system 1200, comprising the wellbore 18 inside which a wellbore servicing fluid loaded with MEMS sensors 52 is situated; the casing 20; a plurality of data interrogation/communication units 1210 situated on the casing 20 and spaced along a length of the casing 20; and a processing unit 1220 situated at an exterior of the wellbore 18.

In embodiments, the data interrogation/communication units 1210 may be situated on or in casing collars that couple casing joints together. In addition or alternatively, the data interrogation/communication units 1210 may be situated in an interior of the casing 20, on an exterior of the casing 20, or both. In embodiments, the data interrogation/communication units 1210 may each comprise an acoustic transmitter, which is configured to convert MEMS sensor data received by the data interrogation/communication units 1210 from the MEMS sensors 52 into acoustic signals that take the form of acoustic vibrations in the casing 20, which may be referred to as acoustic telemetry embodiments. In embodiments, the acoustic transmitters may operate, for example, on a piezoelectric or magnetostrictive principle and may produce axial compression waves, torsional waves, radial compression waves or transverse waves that propagate along the casing 20 in an uphole direction denoted by arrows 1212. A discussion of acoustic transmitters as part of an acoustic telemetry system is given in U.S. Patent Application Publication No. 2010/0039898 and U.S. Pat. Nos. 3,930,220; 4,156,229; 4,298,970; and 4,390,975, each of which is hereby incorporated by reference in its entirety. In addition, the data interrogation/communication units 1210 may be powered as described herein in various embodiments, for example by internal batteries that may be inductively rechargeable by a recharging unit run into the wellbore 18 on a wireline or by other downhole power sources.

In embodiments, the wellbore parameter sensing system 1200 further comprises at least one acoustic receiver 1230, which is situated at or near an uphole end of the casing 20, receives acoustic signals generated and transmitted by the acoustic transmitters, converts the acoustic signals into electrical signals and transmits the electrical signals to the processing unit 1220. Arrows 1232 denote the reception of acoustic signals by acoustic receiver 1230. In an embodiment, the acoustic receiver 1230 may be powered by an electrical line running from the processing unit 1220 to the acoustic receiver 1230.

In embodiments, the wellbore parameter sensing system 1200 further comprises a repeater 1240 situated on the casing 20. The repeater 1240 may be configured to receive acoustic signals from the data interrogation/communication units 1210 situated downhole from the repeater 1240, as indicated by arrows 1242. In addition, the repeater 1240 may be configured to retransmit, to the acoustic receiver 1230, acoustic signals regarding the data received by these downhole data interrogation/communication units 1210 from MEMS sensors 52. Arrows 1244 denote the retransmission of acoustic signals by repeater 1240. In further embodiments, the wellbore parameter sensing system 1200 may comprise multiple repeaters 1230 spaced along the casing 20. In various embodiments, the data interrogation/communication units 1210 and/or the repeaters 1230 may contain suitable equipment to encode a data signal into the casing 20 (e.g, electrical/mechanical transducing circuitry and equipment).

In operation, in an embodiment, the MEMS sensors 52 situated in the interior of the casing 20 and/or in the annulus 26 may measure at least one wellbore parameter and then transmit data regarding the at least one wellbore parameter to the data interrogation/communication units 1210 in their respective vicinities in accordance with the various embodiments disclosed herein, including but not limited to FIGS. 5-12. The acoustic transmitters in the data interrogation/communication units 1210 may convert the MEMS sensor data into acoustic signals that propagate up the casing 20. The repeater or repeaters 1240 may receive acoustic signals from the data interrogation/communication units 1210 downhole from the respective repeater 1240 and retransmit acoustic signals further up the casing 20. At or near an uphole end of the casing 20, the acoustic receiver 1230 may receive the acoustic signals propagated up the casing 20, convert the acoustic signals into electrical signals and transmit the electrical signals to the processing unit 1220. The processing unit 1220 then processes the electrical signals. In various embodiments, the acoustic telemetry embodiments and associated equipment may be combined with a network formed by the MEMS sensors and/or data interrogation/communication units (e.g., a point to point or "daisy-chain" network comprising MEMS sensors) to provide back-up or redundant wireless communication network functionality for conveying MEMS data from downhole to the surface. Of course, such wireless communications and networks could be further combines with various wired embodiments disclosed herein for further operational advantages.

Figure 16:
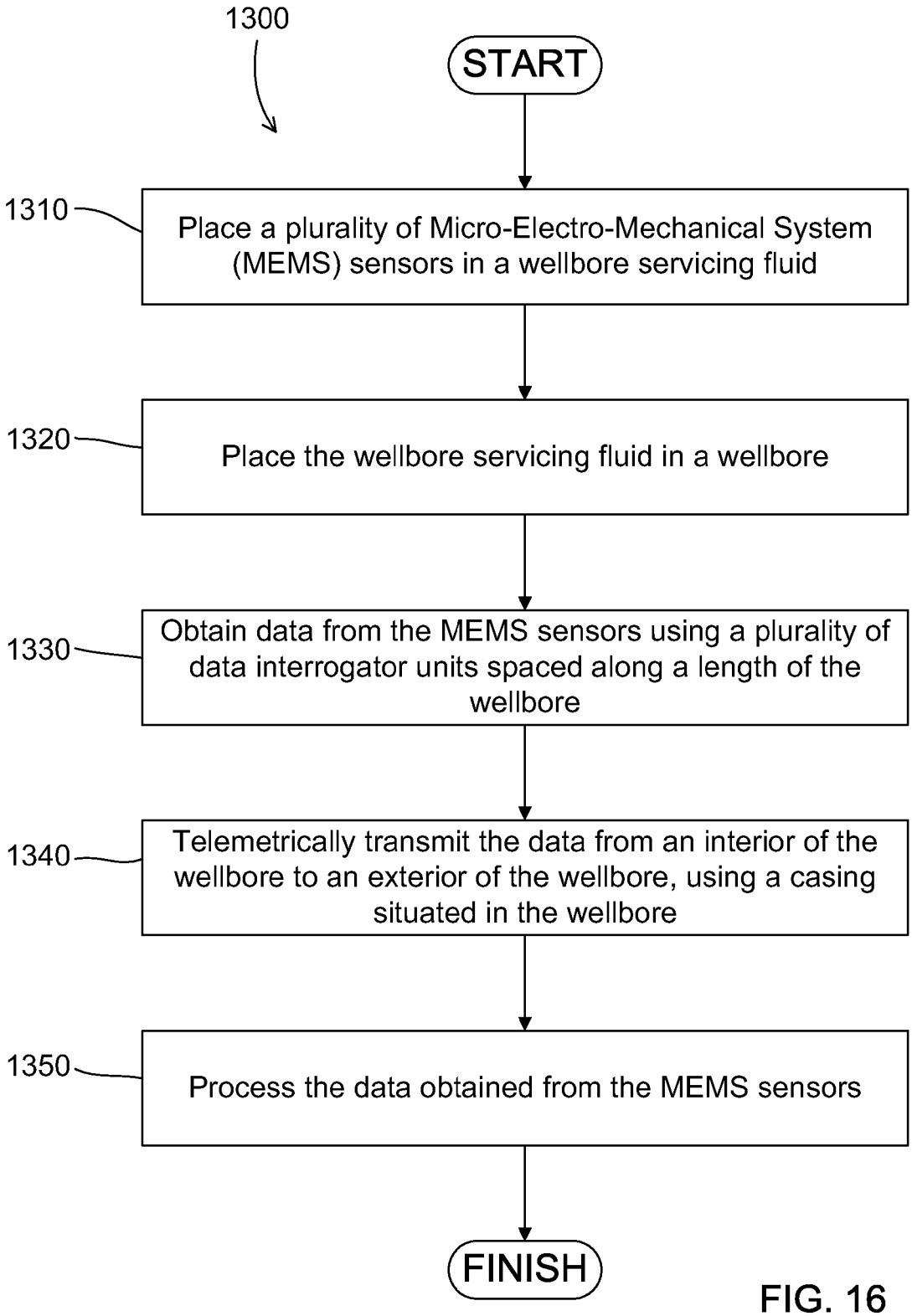
FIG. 16 is a flowchart of a method for servicing a wellbore.

Referring to FIG. 16, a method 1300 of servicing a wellbore is described. At block 1310, a plurality of MEMS sensors is placed in a wellbore servicing fluid. At block 1320, the wellbore servicing fluid is placed in a wellbore. At block 1330, data is obtained from the MEMS sensors, using a plurality of data interrogation units spaced along a length of the wellbore. At block 1340, the data is telemetrically transmitted from an interior of the wellbore to an exterior of the wellbore, using a casing situated in the wellbore (e.g., via acoustic telemetry). At block 1350, the data obtained from the MEMS sensors is processed.

Figure 17:
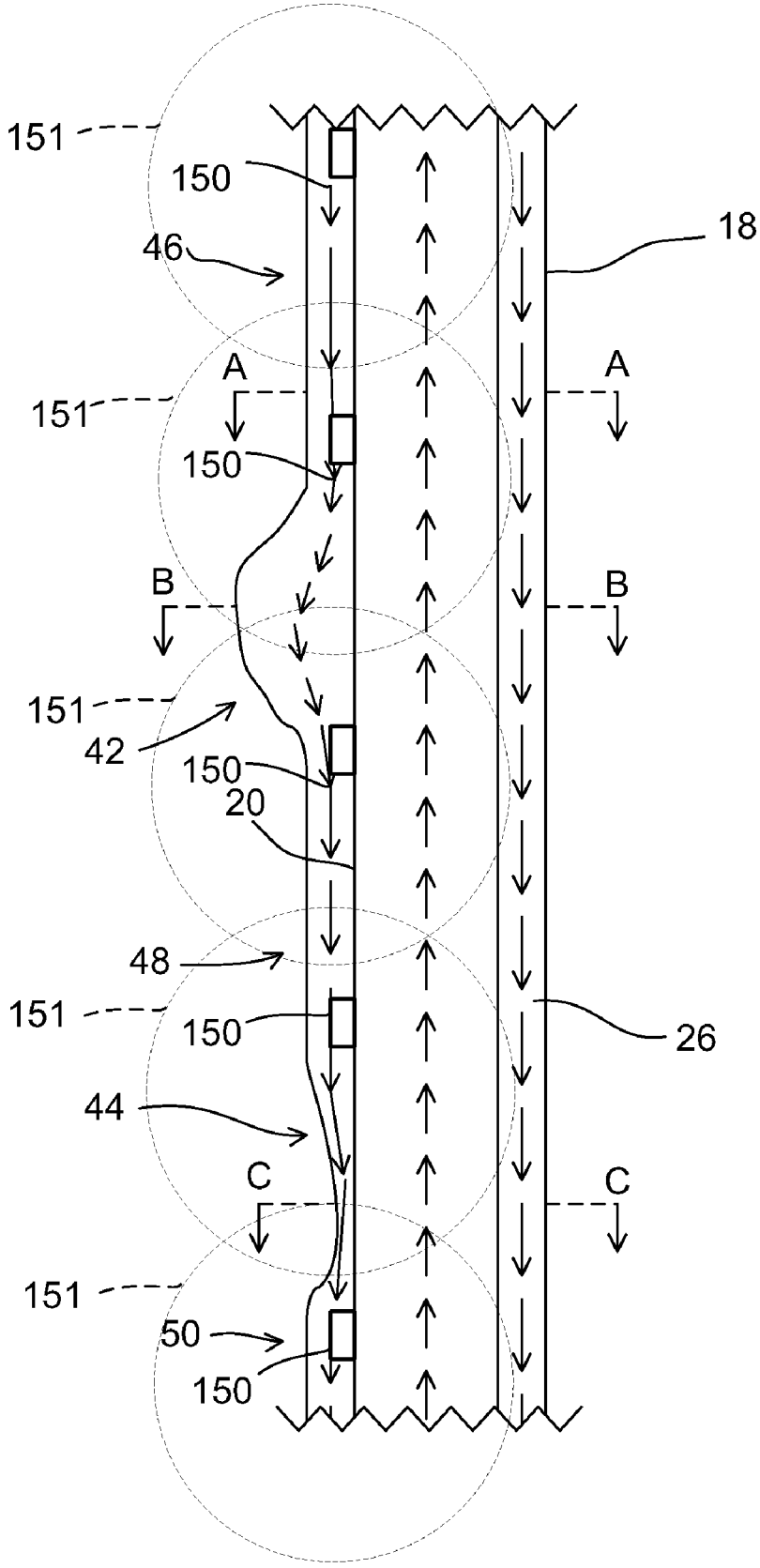
FIG. 17 is a schematic view of a portion of a wellbore.

Referring to FIG. 17, a schematic longitudinal sectional view of a portion of the wellbore 18 is illustrated. As is apparent from the Figure, the wellbore 18 includes at least one washed-out region 42 at which material has broken off or eroded from a wall of the wellbore 18 (or the wellbore has intersected a naturally occurring void space within the formation, e.g., a lost circulation zone), as well as at least one constricted region 44, for example caused by particular inflow from the formation into the wellbore, a partial wellbore collapse, a ledge or build-up of filter cake, or the like may be present. In an embodiment, a wellbore servicing fluid containing MEMS sensors may be pumped down the annulus 26 at a fluid flow rate and up the interior flow bore of casing 20 so as to establish a circulation loop. However, in a further embodiment, wellbore servicing fluid containing MEMS sensors may be pumped down the interior flow bore of casing 20 and up the annulus 26.

In further regard to FIG. 17, a MEMS sensor loading of the wellbore servicing fluid may be approximately constant throughout the fluid. In an embodiment, as the wellbore servicing fluid is pumped down the annulus 26 and up the casing 20, positions and velocities of the MEMS sensors may be determined along the entire length of the wellbore 18 using data interrogation/communication units 150. In some embodiments, the various data interrogation/communication units otherwise shown or described herein may be used to detect the MEMS sensors, determine the velocities thereof and otherwise communicate, store, and/or transfer data (e.g., form various networks), and any suitable configuration or layout of data interrogation/communication units as described herein may be employed to determine velocities, flow rates, concentrations, etc. of MEMS sensors, including but not limited to the embodiments of FIGS. 5-16. For example, any of the data interrogator embodiments shown in FIGS. 5-16 may be used in combination with the data interrogation units of FIGS. 17 and 19. Given the fluid flow rate of the wellbore servicing fluid and an expected clearance between the casing 20 and the wellbore 18 in, for example, regions 46, 48, 50 in which the wellbore 18 is not enlarged or constricted, an approximate expected fluid velocity through these regions 46, 48 and 50 may be calculated. Furthermore, since the MEMS sensors are distributed throughout the wellbore servicing fluid and are carried along with the wellbore servicing fluid as the wellbore servicing fluid moves down the annulus 26, the velocities of the MEMS sensors in a downhole direction will at least approximately correspond to the calculated fluid velocity for regions 46, 48 and 50 of the wellbore 18. Accordingly, if, in a region of the wellbore 18, the downhole velocities of the MEMS sensors are approximately equal to the expected fluid velocity or deviate from the expected fluid velocity by less than a threshold value, it may be concluded that a cross-sectional area of the annulus 26 in this region approximately corresponds to an expected cross-sectional area of the wellbore 18 minus an expected cross-sectional area of the casing 20. Likewise, if the fluid velocity deviates equal to or greater than a threshold value (e.g., higher or lower velocity than expected), such deviation may indicate the present of an undesirable constriction or expansion (e.g., volumetric constriction or expansion) of the wellbore.

In an embodiment, if the wellbore servicing fluid moves through a washed out region of the wellbore 18 such as moving from region 46 to region 42, the fluid velocity of the wellbore servicing fluid will decrease as the wellbore servicing fluid traverses from region 46 to region 42, and then increase again as the wellbore servicing fluid enters regions 48 of the wellbore 18. Accordingly, as the MEMS sensors traverse region 42 of the wellbore 18, the average downhole velocity of the MEMS sensors will decrease in comparison to the average downhole velocity of the MEMS sensors in region 46. In addition, if it is assumed, at least initially, that no or minimal wellbore servicing fluid is being lost to the wellbore 18, and that the fluid flow rate at which the wellbore servicing fluid is being pumped through the wellbore 18 remains approximately constant, then the fluid flow rate through every annular cross-section of the wellbore 18 is approximately constant. Thus, referring to FIG. 18*a*, which is a schematic annular cross-section of the wellbore 18 taken at A-A in region 46 (and is also representative of regions 48 and 50), and FIG. 18*b*, which is a schematic annular cross-section of the wellbore 18 taken at B-B in section 42, the fluid flow rate through these cross-sections remains approximately constant despite the larger annular cross-section of section B-B. If the fluid flow rate, e.g., in $m^3/s$, is referred to as f, the annular cross-sectional area, e.g., in $m^2$, of section A-A is referred to as $A_A$, and the annular cross-sectional area, e.g., in $m^2$, of section B-B is referred to as $A_B$, then the average fluid velocities, e.g., in m/s, in sections A-A and B-B, respectively referred to as $v_A$ and $v_B$, may be calculated as follows:

$$v_A = f/A_A \quad 1)$$

$$v_B = f/A_B. \quad 2)$$

In addition, rearranging terms and noting that f is constant, one obtains:

$$f = v_A A_A = v_B A_B. \quad 3)$$

Figure 18A:
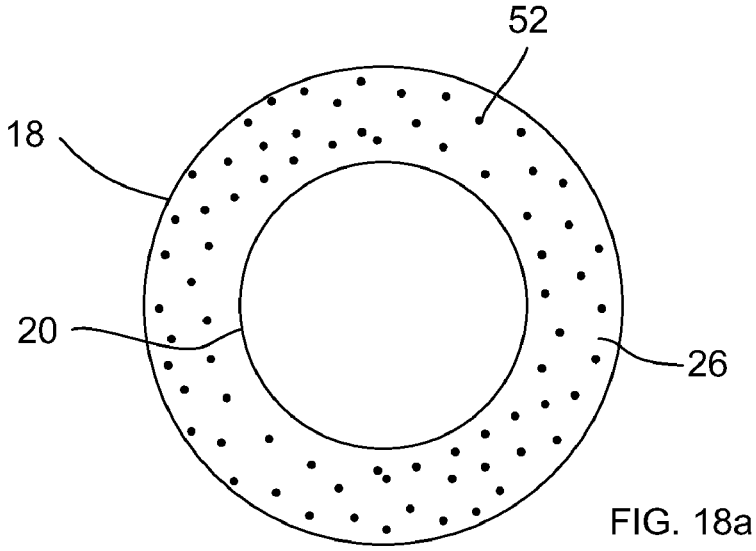
FIGS. 18*a* to 18*c* are schematic cross-sectional views at different elevations of the wellbore of FIG. 17.
Figure 18B:
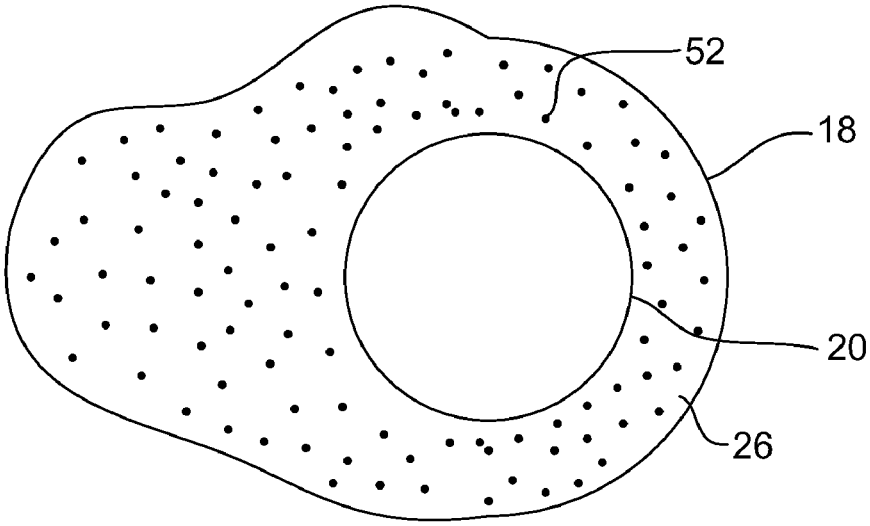

Thus, if cross-sectional area $A_B$ of section B-B in FIG. 18*b* is, e.g., 2 times greater than cross-sectional area $A_A$ of section A-A in FIG. 18*a*, then the average downhole fluid velocity $v_B$ through section B-B will be one half (e.g., 50%) of the average downhole fluid velocity $v_A$ through section A-A. Stated alternatively, a 50% reduction in velocity (e.g., $v_B = \frac{1}{2} v_A$) indicates a 100% increase in cross-sectional area (e.g., $A_B = 2A_A$). Accordingly, the average downhole velocities of MEMS sensors 52 passing through an annular cross-section of the wellbore 18 may be used to determine the cross-sectional area of that annular cross-section, with a decrease in fluid velocity representing an expansion in the wellbore such as a washout, void space, vugular zone, fracture or other space/opening in the wellbore.

Figure 18C:
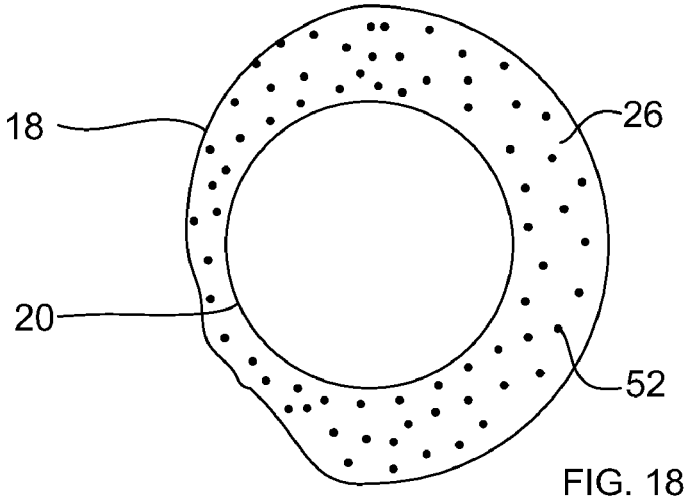

Referring now to FIG. 18*c*, which illustrates a schematic annular cross-section of the wellbore 18 taken at section C-C of region 44 of the wellbore 18, it is apparent that at least a portion of the annulus 26 at section C-C is constricted, for example possibly due to a protruding ledge in the wellbore 18 or a build-up of filter cake or other particulate matter in the wellbore 18. In an embodiment, if the wellbore servicing fluid moves through a constricted region of the wellbore 18 such as region 44, the average fluid velocity of the wellbore servicing fluid will increase as the wellbore servicing fluid traverses from region 48 into region 44, and then decrease again as the wellbore servicing fluid enters region 50 of the wellbore 18. Accordingly, as the MEMS sensors 52 traverse region 44 of the wellbore 18, the average downhole velocity of the MEMS sensors 52 will increase in comparison to the average downhole velocity of the MEMS sensors 52 in region 48. Now, referring back to equation 3) and applying the equation to cross-section C-C in region 44 of the wellbore 18, one obtains:

$$f=v_A A_A=v_C A_C, \quad 4)$$

where $v_C$ is an average downhole fluid velocity through cross-section C-C and $A_C$ is a cross-sectional area of cross-section C-C. Thus, if, for example, the average downhole velocity of the MEMS sensors 52 passing through cross-section C-C in region 44 is 2 times greater than the average downhole velocity of the MEMS sensors 52 passing through cross-section A-A in region 46 (which would be comparable to an annular cross-section taken in region 48), then the cross-sectional area $A_C$ of cross-section C-C is one half (e.g., 50%) of the cross-sectional area of cross-section A-A (or an equivalent cross-section taken in region 48). Accordingly, the average downhole velocities of the MEMS sensors 52 passing through a constricted region of a wellbore 18 may be utilized to determine the cross-sectional area of an annular cross-section taken in that constricted region, with an increase in fluid velocity representing an constriction in the wellbore such as a partial collapse, swelling, particulate buildup or inflow, filter cake buildup, and the like.

Figure 19:
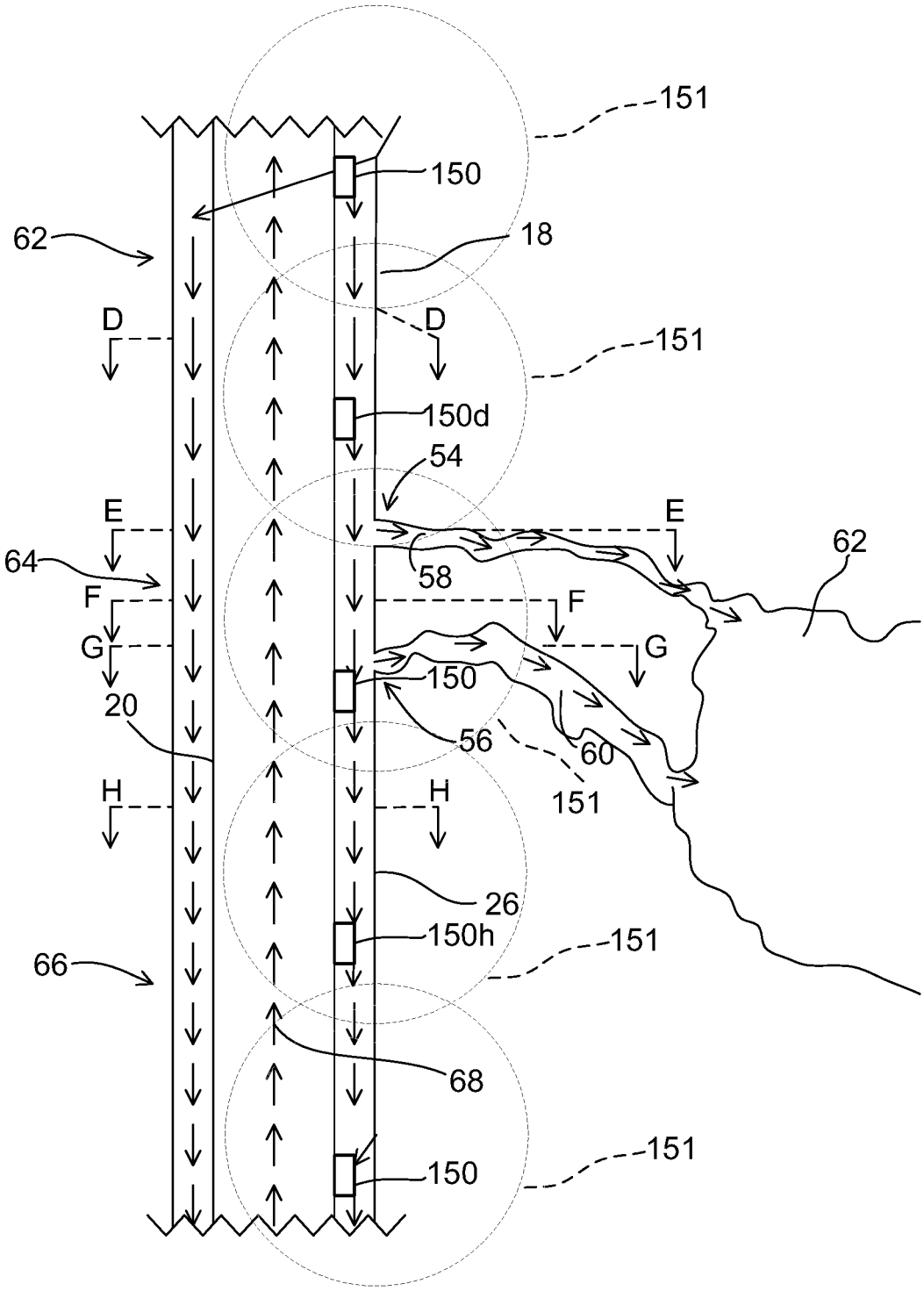
FIG. 19 is a schematic view of a portion of a wellbore.
Figure 20A:
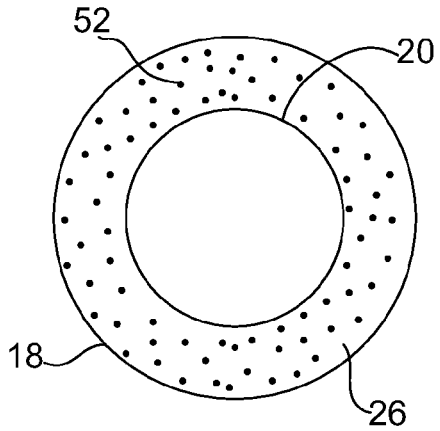
FIGS. 20*a* to 20*e* are schematic cross-sectional views at different elevations of the wellbore of FIG. 19.
Figure 20B:
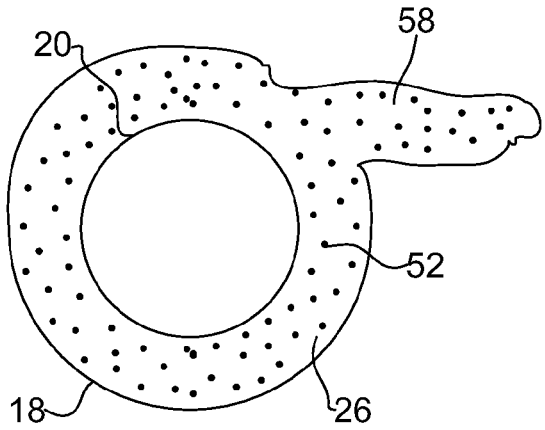
Figure 20C:
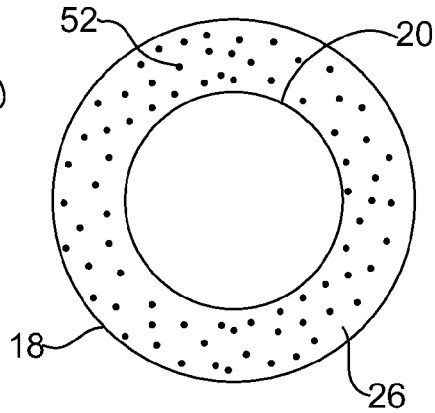
Figure 20D:
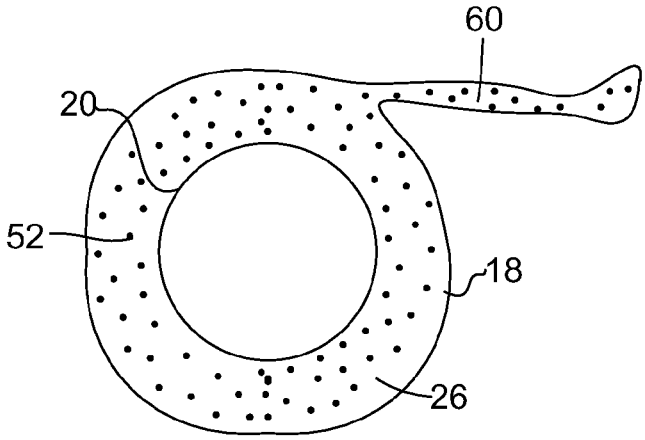

FIG. 19 illustrates a schematic longitudinal sectional view of a portion of the wellbore 18, in which a wellbore servicing fluid containing MEMS sensors 52 is pumped down the annulus 26 at a fluid flow rate and up the casing 20 so as to form a circulation loop, with the understanding that fluid may flow in the opposite direction in some embodiments. In addition, as is apparent from the Figure, the wellbore 18 includes two fluid loss zones 54, 56 at which respective fissures 58, 60 extend outwards from the wellbore 18 and communicate with a hollow or permeable formation 62. Cross-sections of the wellbore 18 taken at lines E-E and G-G in regions 54 and 56 of the wellbore 18 are schematically illustrated in FIGS. 20*b* and 20*d*, respectively.

Figure 20E:
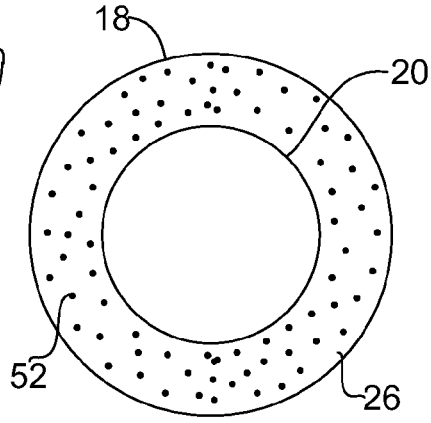

In an embodiment, as the wellbore servicing fluid passes from region 62 through region 54, a portion of the fluid is pressed (e.g., lost) through the fissure 58 and absorbed by formation 62. Such areas where a wellbore composition is lost to the surrounding formation may be referred to as fluid loss zone, loss or lost circulation zones, wash-outs, voids, vugulars, cavities, fissures, fractures, etc. If the fluid flow rate is referred to as f and the flow rate of fluid lost to the formation 62 via fissure 58 is referred to as $f_{L1}$, then the flow rate of fluid passing through annular cross-section D-D, which is situated in a region 62 of the wellbore 18 directly uphole from fissure 58 and is schematically illustrated in FIG. 20*a*, is f, whereas the flow rate of fluid passing through annular cross-section F-F, which is situated in a region 64 of the wellbore 18 directly downhole from fissure 58 and is schematically illustrated in FIG. 20*c*, is $f-f_{L1}$. Similarly, as the wellbore servicing fluid passes from region 64 through region 56, a portion of the fluid is pressed (e.g., lost) through the fissure 60 and absorbed by formation 62. If the flow rate of fluid lost to the formation 62 via fissure 60 is referred to as $f_{L2}$, then the flow rate of fluid passing through annular cross-section H-H, which is situated in a region 66 of the wellbore 18 directly downhole from fissure 60 and is schematically illustrated in FIG. 20*e*, is $f-(f_{L1}+f_{L2})$. Now, considering the relationship between the fluid flow rate and the flow velocity given in equation 3), one obtains:

$$f=v_D A_D \quad 5)$$

$$f-f_{L1}=v_F A_F \quad 6)$$

$$f-(f_{L1}+f_{L2})=v_H A_H \quad 7)$$

where $v_D$, is the downhole flow velocity of the wellbore servicing fluid through annular cross-section D-D, $A_D$ is the cross-sectional area of annular cross-section D-D, $v_F$ is the downhole flow velocity of the wellbore servicing fluid through annular cross-section F-F, $A_F$ is the cross-sectional area of annular cross-section F-F, $v_H$ is the downhole flow velocity of the wellbore servicing fluid through annular cross-section H-H, and $A_H$ is the cross-sectional area of annular cross-section H-H. Assuming that none of regions 62, 64 and 66 includes a washed-out section or a constriction, then $A_D$, $A_F$ and $A_H$ may be considered to be approximately equal to one another and referred to as A:

$$A=A_D=A_F=A_H \quad 8)$$

After combining equation 8) with equations 5), 6) and 7) and rearranging terms, one obtains:

$$v_D=\frac{1}{A}(f) \quad 9)$$

$$v_F=\frac{1}{A}(f-f_{L1}) \quad 10)$$

$$v_H=\frac{1}{A}(f-f_{L1}-f_{L2}) \quad 11)$$

Thus, after a fluid loss zone is traversed by the wellbore servicing fluid, the downhole flow velocity of the wellbore servicing fluid, and thus the average downhole velocity of the MEMS sensors 52 situated in the wellbore servicing fluid, will decrease in proportion with the fluid flow rate. Accordingly, in an embodiment, if a decrease in the average downhole MEMS sensor velocity is detected, then an approximate flow rate of wellbore servicing fluid lost to a formation may be calculated from the decrease in the average downhole MEMS sensor velocity.

It should be noted from the discussion above that an average downhole velocity of MEMS sensors 52 will decrease in both a washed-out region and a fluid loss zone. However, in an embodiment, a washed-out region and a fluid loss zone may be distinguished from one another in that in the case of a washed-out region, after the washed-out region is traversed, the average downhole velocity of the MEMS sensors will return to approximately the average MEMS sensor downhole velocity detected uphole from the washed-out region given that the total flow rate remains constant (i.e., there is no significant loss of fluid to the surrounding formation). In contrast, after the wellbore servicing fluid traverses a fluid loss zone, the average downhole velocity of the MEMS sensors 52 will not return to an average downhole MEMS sensor velocity detected uphole from the fluid loss zone, but will remain at a lower level.

In further regard to FIG. 19, in an embodiment, a return fluid flow rate 68 up the casing 20 to, for example, circulating pumps situated at the rig 12, may be determined from a flow meter situated upstream from the circulating pumps and compared to the original fluid flow rate of wellbore servicing fluid, and the flow rate of wellbore servicing fluid lost to the formation 62 may be calculated and compared to the fluid loss indicated by the decreases in the average downhole MEMS sensor velocities. Upon detecting and/or locating fluid loss to the surrounding formation, remedial actions may be taken such as pumping a lost circulation material downhole to plug the leak, performing a squeeze job (e.g., cement squeeze, gunk squeeze), etc.

In an alternative embodiment, all or a portion of the MEMS sensors are given unique identifiers, for example RFID serial numbers, and the data interrogation units 150 may be used to keep track of all or a portion of the uniquely identified sensors (e.g., a statistic sampling of same). For example, where unit 150*d* records the presence of 100 uniquely identified MEMS sensors within a given sampling period, a failure by one or more downstream units (e.g., unit 150*h*) to detect a representative or threshold number of the same 100 uniquely identified MEMS sensors within an expected sampling time (e.g., the time expected for the sensors to travel the distance between units 150*d* and 150*h* based upon the fluid flow rate) may indicate a loss of said sensors to the surrounding formation, for example via fissures 58 and/or 60, taking into account any normal variance in detection of uniquely identified MEMS sensors between upstream and downstream interrogation units over a given distance. For example, if over a statistically representative sampling period, only 80 of the 100 uniquely identified MEMS sensors for each sampling period are detected at a downstream interrogation unit, such may indicate a 20% fluid loss to the formation (or a fluid loss of 20% minus the normal variance/deviation in MEMS detection).

In addition to or in lieu of (a) estimating a cross-sectional area of an annular cross-section of a wellbore, using a fluid flow rate of a MEMS sensor-loaded wellbore servicing fluid through the wellbore and the velocities of the MEMS sensors during traversal of the annular cross-section, and/or (b) estimating a flow rate of fluid lost to a formation in an annular region of a wellbore, using velocities of the MEMS sensors 52 uphole and downhole from the annular region, in various embodiments, (c) shapes of annular cross-sections of the wellbore 18 may be estimated, using detected positions of the MEMS sensors 52, and any combination of (a), (b), and (c) is contemplated hereby, which may be referred to in some instances as annular mapping via flow rate and/or velocities of MEMS sensors conveyed through a wellbore (e.g., circulated through an annulus) via a wellbore servicing composition. In performing any annular mapping function, e.g., any of (a), (b), and/or (c) of this paragraph, the data interrogation units 150 may be spaced along the wellbore and supported upon the casing or other conveyance or structure in the wellbore. While fixed data interrogators are shown in FIGS. 17 and 19, one or more mobile data interrogators (for example, as shown in FIGS. 2 and 8), may be employed to perform annular mapping functions, for example tripped into the wellbore and intermittently moved up the wellbore while mapping same. The data interrogation units 150 have a sensing or mapping range associated therewith, as represented by circles 151. Within the sensing or mapping range, the data interrogation units 150 are operable to sense the presence of various MEMS sensors in relation to the unit, and thus can create a mathematical representation of MEMS sensor presence, velocity, location, concentration, and/or identity (e.g., a particular sensor or group of sensors having a unique identifier or I.D. number) in relation to the position of a given unit 150. By way of analogy and shown schematically in FIGS. 17 and 19, the data interrogation units 150 constitute an overlapping network of "radar ranges" and thus can track the presence, location, concentration, velocity, and/or identity of the MEMS sensors as they flow through the wellbore with the servicing composition.

Referring back to FIGS. 17 and 18*a* to 18*c*, FIGS. 18*a* to 18*c* schematically and respectively depict annular cross-sections of the wellbore 18 at lines A-A, B-B and C-C in FIG. 17. As is apparent from FIGS. 18*a* to 18*c*, MEMS sensors 52 suspended in the wellbore servicing fluid traverse these cross-sections. In an embodiment, positions of the MEMS sensors 52 in the annular cross-sections, e.g., radial positions (or directional vector) of the MEMS sensors 52 with respect to the data interrogation units 150, may be determined and mapped. In addition, a curve may be drawn through the innermost MEMS sensor positions with respect to the casing 20, as well as through the outermost MEMS sensor positions, in order to approximate an outline of a wall of the wellbore 18 and an outer wall of the casing 20 in each cross-section, and such may be carried out in three dimensions (e.g., x, y, and z coordinates with respect to the data interrogation units 150) to provide a map of the annular geometry and/or surrounding formation. In an embodiment, positions of MEMS sensors 52 in an annular cross-section may be recorded and mapped over a time frame ranging from about 0.5 s to about 10 s, and over a distance (e.g., a distance from any given data interrogation unit location) of 1 ft, 5 ft, 10 ft, or 25 ft, depending on the sensing range (e.g., power) of the data interrogation units and/or the desired accuracy of an annular cross-sectional depiction. Also, annular cross-sections may be taken a longitudinal distances traversing the wellbore of from about 0.25 ft, 0.5 ft, 0.75 ft, 1 ft, 1.5 ft, 2 ft, or any combination thereof. In an embodiment, annular cross-sections may be taken at longitudinal distances and/or intervals traversing the wellbore about equivalent to the distances and/or intervals used in wellbore logging activities, as would be apparent to those of skill in the art. In other embodiments, annular cross-sections may be taken a longitudinal distances and/or intervals traversing the wellbore in accordance with other embodiments disclosed herein (e.g., distances associated with processor 1720).

Referring back to FIG. 19, this Figure schematically depicts regions 54 and 56 of the wellbore 18, at which wellbore servicing fluid loaded with MEMS sensors 52 and pumped into the annulus 26 is partially lost to a formation 62 via respective fissures 58, 60. In addition, FIGS. 20*b* and 20*d* schematically depict cross-sections of the wellbore 18 taken at wellbore-side ends of the fissures 58, 60 at lines E-E and G-G in FIG. 19. In an embodiment, as shown in FIGS. 20*b* and 20*d*, cross-sections of the annulus 26 at the fissures 58, 60 may be mapped by recording positions of MEMS sensors 52 that pass through the annulus 26 and the fissures 58, 60. In addition, in a further embodiment, multiple annular cross-sections along the length of the wellbore 18 and in the vicinity of the fissures 58, 60 may be mapped and combined, in order to form a three dimensional depiction of at least a portion of the fissures 58, 60 and/or the formation 62 and to possibly facilitate the filling and sealing of the fissures 58, 60, e.g., a cement squeeze or plugging a lost circulation zone.

As a result of determining the positions of the MEMS sensors 52, in an embodiment, it may be determined, for example, that annular cross-section A-A in FIG. 18*a* is normal, i.e., the casing 20 is properly centralized in the wellbore 18, and the wall of the wellbore 18 is not enlarged and does not have any debris attached to it; that the wellbore 18 at annular cross-section B-B in FIG. 18*b* is undesirably expanded, e.g., at least partially washed out and/or contains a fluid loss zone (e.g., loss of circulation zone), and thus may require remedial action such as secondary cementing to shore up the wall; and/or that the wellbore 18 at annular cross-section C-C in FIG. 18*c* is undesirably constricted, e.g., includes a ledge and/or attached debris and/or a build-up of filter cake along at least a portion of the wellbore wall and may require more fluid circulation or other remedial action to reduce/remove the build-up, and/or that the casing 20 is not properly centralized in the wellbore 18.

Figure 21:
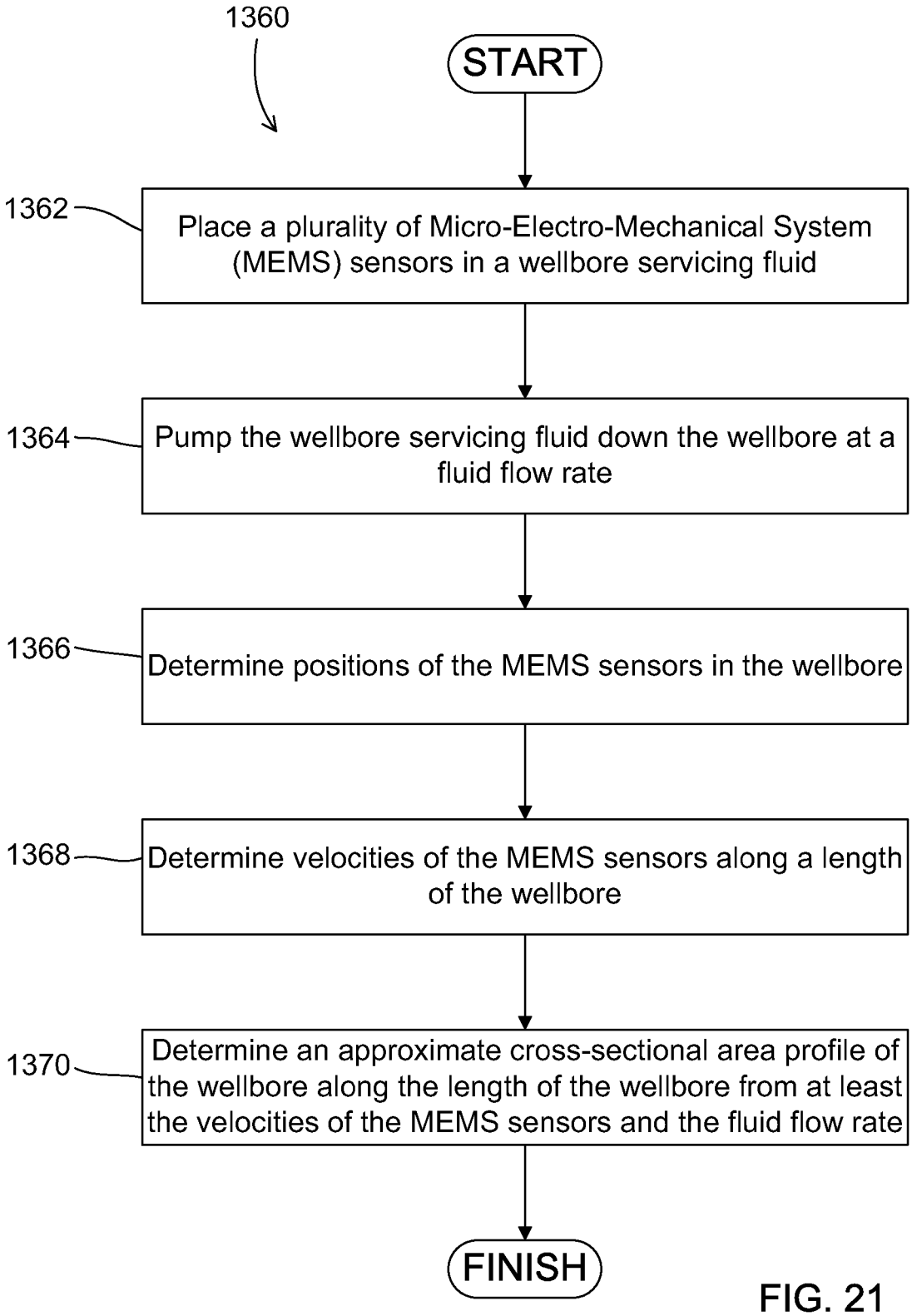
FIG. 21 is a flowchart of a method for servicing a wellbore.

Referring to FIG. 21, a method 1360 of servicing a wellbore is described. At block 1362, a plurality of Micro-Electro-Mechanical System (MEMS) sensors is placed in a wellbore servicing fluid. At block 1364, the wellbore servicing fluid is pumped down the wellbore at a fluid flow rate. At block 1366, positions of the MEMS sensors in the wellbore are determined. At block 1368, velocities of the MEMS sensors along a length of the wellbore are determined. At block 1370, an approximate cross-sectional area profile of the wellbore along the length of the wellbore is determined from at least the velocities and/or positions of the MEMS sensors and the fluid flow rate.

In addition to or in lieu of using MEMS sensor to determine a characteristic or shape of the wellbore and/or surrounding formation, the MEMS sensors may provide information regarding the flow fluid (e.g., flow dynamics and characteristics) in the wellbore and/or surrounding formation. A plurality of MEMS sensors may be placed in a wellbore composition, the wellbore composition flowed (e.g., pumped) into the wellbore and/or surrounding formation (e.g., circulated in the wellbore), and one or more fluid flow properties, characteristics, and/or dynamics of the wellbore composition may be determined by data obtained from the MEMS sensors moving/flowing in the wellbore and/or formation. The data may be obtained from the MEMS sensors according to any of the embodiments disclosed herein (e.g., one or more mobile data interrogators tripped into and out of the wellbore and/or fixed data interrogators positioned within the wellbore), and may be further communicated/transmitted to/from or within the wellbore via any of the embodiments disclosed herein.) For example, areas of laminar and/or turbulent flow the wellbore composition may be determined within the wellbore and/or surrounding formation, and such information may be used to further characterize the wellbore and/or surrounding formation. The velocity and flow rate of the wellbore composition may further be obtained as described herein. In an embodiment, data from the MEMS sensors is used to perform one or more fluid flow dynamics calculations for the flow of the wellbore composition through the wellbore and/or the surrounding formation. For example, data from the MEMS sensors may be used as input to a computational fluid dynamics equation or software. Such information may be used in designing down hole tools, for example designing a down hole tool/device in a manner to reduce drag and/or turbulence associated with the tool/device as the wellbore composition flows through and/or past the tool.

In an embodiment, fluid flow data for the wellbore composition is obtained over at least a portion of the length of the wellbore, thereby providing a fluid flow profile over said length of wellbore. The fluid flow profile may be compared to a theoretical or design standard fluid flow profile, for example in real time during performance of a serving operation wherein the wellbore composition is being placed in the wellbore. Such comparison may be used to determine whether the service is proceeding according to plan and/or to verify one or more characteristics of the wellbore. For example, an area of turbulent flow indicated by the MEMS sensors may correspond to a location of a particular wellbore feature expected to provide turbulence, such as the presence of a tool or device (e.g., casing collar, centralizer, spacer, shoe, etc.) in the wellbore that the fluid is flowing around or through which may be indicated or mapped in the theoretical or design fluid flow profile. Likewise, turbulent or non-turbulent (e.g., laminar) flow may indicate desirable or undesirable characteristics of the fluid itself (e.g., desirable or undesirable mixing, stratification, etc.) and/or the surrounding surface that contacts the fluid (e.g., rough vs. smooth surfaces, etc.).

By performing such comparisons in real time, the wellbore service may be altered or adjusted as needed to improve the outcome of the service. For example, one or more conditions of the wellbore and/or surrounding formation may be altered based upon a MEMS sensor derived indication of the fluid flow characteristics or dynamics. In an embodiment, a build up of a material on an interior surface of the wellbore and/or formation (e.g., gelled mud, filter cake, screen out material, sand, etc.) is reduced or removed via a remedial action such as acidizing, washing, physical scraping/contact, changing a flow rate of the wellbore composition, changing a characteristic of the wellbore composition, placing an additional composition in the wellbore to react with the build up or change a characteristic of the buildup, moving a conduit within the wellbore, placing a tool downhole to physically contact and removing the build up, or any combination thereof. In another embodiment, a fluid flow property or characteristic is an actual time of arrival of at least a portion of the wellbore composition comprising the MEMS sensors. The actual time of arrival may be compared to an expected time of arrival, and such comparison may be indicative of a further condition of the wellbore. For example, an expected time of arrival matching an actual time of arrival may be indicative of normal or expected operations. Alternatively, an actual time of arrival before an expected time of arrival may be indicative of a decreased flow path through the wellbore (e.g., reduced flow bore diameter due to build up such as gelled mud, filter cake or other flow restriction), thus yielding an increased fluid velocity and decreased transit time for the MEMS sensors flowing through the wellbore.

In an embodiment, the wellbore servicing operation comprises placing a plurality of MEMS sensors in at least a portion of a spacer fluid, a sealant composition (e.g., a cement slurry or a non-cementitious sealant), or both, pumping the spacer fluid followed by the sealant composition into the wellbore, and determining one or more fluid flow properties or characteristics of the spacer fluid and/or the cement composition from data provided by the MEMS sensors during the pumping of the spacer fluid and sealant composition into the wellbore. The sealant composition may be pumped down the casing and back up the annular space between the casing and the wellbore (e.g., a conventional cementing job) or may be pumped down the annulus between the casing and the wellbore in a reverse cementing job. The movement of the spacer and/or sealant composition through the wellbore may be monitored via the MEMS sensors, and such movement may be used to determine a characteristic of the wellbore and/or surrounding formation; to evaluate the fluid flow characteristics of the spacer fluid and/or sealant composition as it flows through the wellbore and/or surrounding formation; to determine a location of the spacer fluid and/or sealant composition (e.g., when the sealant has turned the corner at the terminal downhole end of the casing) and to further signal or bring about a halt to the placement (e.g., stop pumping) upon the spacer fluid and/or cement composition reaching a desired location; and to monitor the wellbore for movement of the MEMS sensors within the spacer fluid and/or sealant composition after halting pumping of same and to signal an operator and/or activating at least one device to prevent flow out of the wellbore upon detection of movement of the MEMS sensors after halting the pumping; or any combination thereof.

Figure 22A:
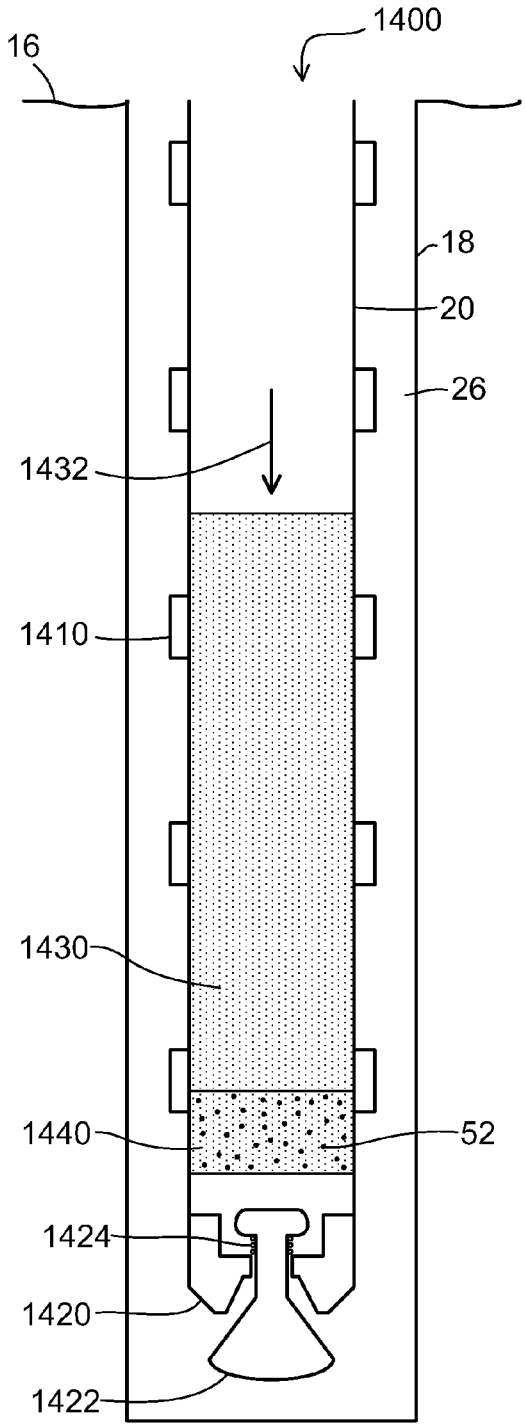
FIGS. 22*a* to 22*c* are schematic views of a further embodiment of a wellbore parameter sensing system.
Figure 22B:
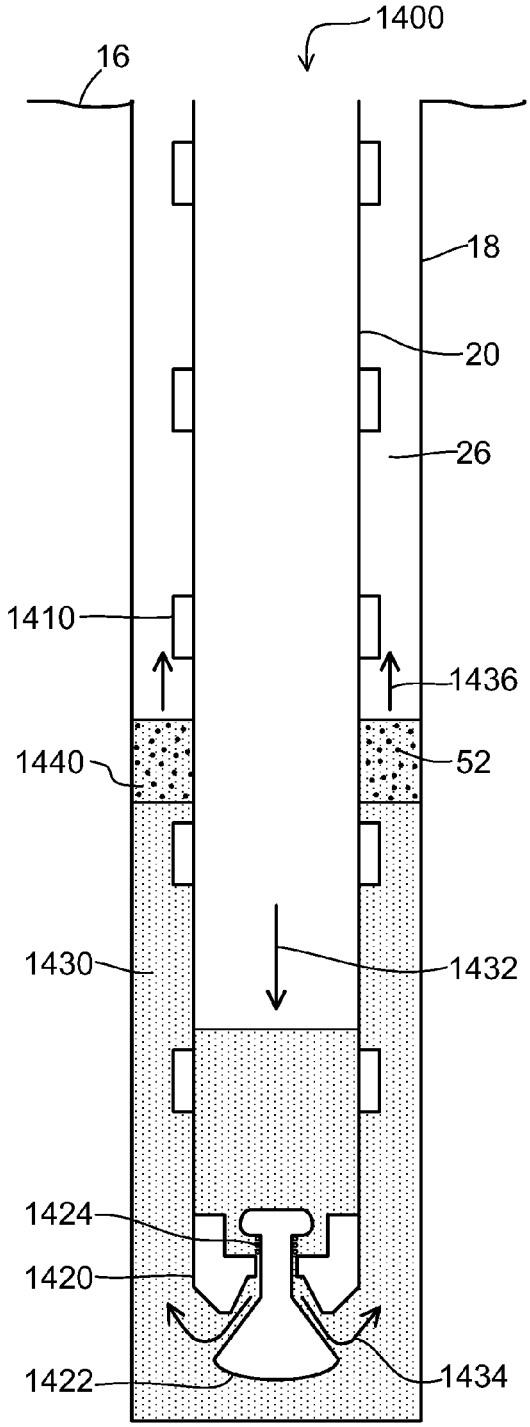
Figure 22C:
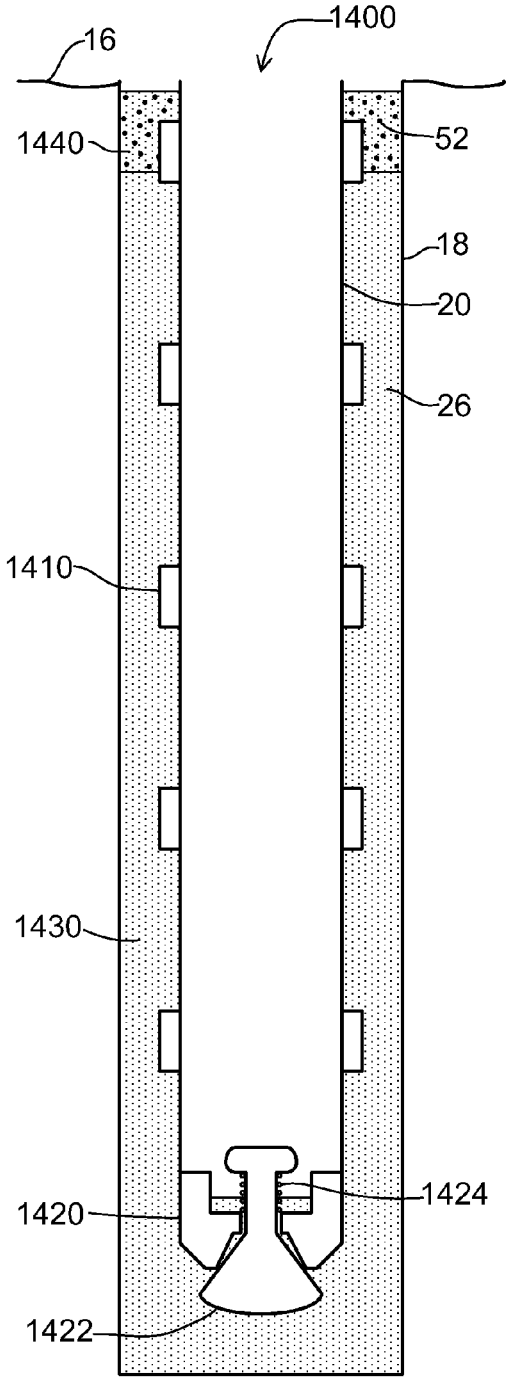

FIGS. 22*a* to 22*c* illustrate a schematic view of an embodiment of a wellbore parameter sensing system 1400, which comprises the wellbore 18, the casing 20 situated in the wellbore 18, a plurality of data interrogation units 1410 spaced along a length of the casing 20, and a float shoe 1420 situated at a downhole end of the casing 20. In an embodiment, the float shoe 1420 comprises a poppet valve 1422, which is biased by a spring 1424 when the valve 1422 is in a neutral state and may be opened if a sufficient differential pressure develops between an interior of the casing 20 and the annulus 26. While a float shoe and poppet value assembly is demonstrated in this embodiment, it is understood that any assembly (e.g., float collar, float shoe, valve assembly, etc.) suitable to terminate the downhole, distal end of the casing string (e.g., to protect and/or direct same into the wellbore) and to selectively open and/or close terminal end of the casing to fluid flow (from either interior to annulus or from annulus to interior) may be employed in the various embodiments disclosed herein, wherein communication with MEMS sensors may be used in determining when to selectively perform said open and/or close and wherein such communication may be with a data interrogation unit located in and/or proximate such distal assembly (e.g., coupled to and/or integral with a float collar, float shoe, valve assembly etc.) and/or located in a moveable member flowing through the wellbore (e.g., a wiper plug, ball, dart, etc.). Thus, detection and/or communication with MEMS sensors by such data interrogation units may signal the opening and/or closing of a valve proximate the distal end of the casing in a conventional or reverse cementing operation, thereby allowing for the selective placement of the cement slurry.

In an embodiment, a cement slurry 1430 may be pumped down the interior of the casing 20 in the direction of arrow 1432, through the float shoe 1420 in the direction of arrows 1434, and up the annulus 26 in the direction of arrows 1436 for the purpose of cementing the casing 20 to a wall of the wellbore 18. The cement slurry 1430 may include a slug 1440 of MEMS sensors 52 that may be situated in a portion of the cement slurry 1430 that is pumped into the wellbore 18 prior to a remainder of the cement slurry 1430, e.g., positioned at a leading edge/portion, face, or head of the slurry. In an embodiment, the MEMS sensors 52 are configured to measure and/or convey at least one parameter of the wellbore 18, e.g., a longitudinal position of the MEMS sensors 52 in the wellbore 18, and transmit data regarding the longitudinal positions of the MEMS sensors 52 in the wellbore 18 to the data interrogation unit 1410 most proximate to the MEMS sensors 52. The data interrogation units 1410 may then transmit the MEMS sensor data to a processing unit situated at an exterior of the wellbore 18, and such transmission may be carried out according to any embodiment disclosed herein (e.g., the embodiments of FIGS. 5-16.

In an embodiment, as the cement slurry 1430 travels through the wellbore 18, a longitudinal position of the slug 1440 of MEMS sensors 52, and hence a longitudinal position of a head of the cement slurry 1430, may be determined in real time via interaction (e.g., communication) of the MEMS sensors 52 with the plurality of data interrogation units 1410 spaced along a length of the casing. For example, where all or a portion of the data interrogation units 1410 correspond with known locations in the wellbore (e.g., casing collars located at a known depth in the wellbore), detection of MEMS sensors by a given data interrogation unit 1410 indicates that the slug of MEMS sensors (and thus the leading edge of the cement slurry) is within the sensing/communication range of that particular data interrogation unit 1410. As the slug of MEMS sensors flows downward in the interior of the casing, the MEMS sensors will be detected in an uphole to downhole sequence by the data interrogation units 1410. In a further embodiment, a data interrogation unit may be incorporated in the float shoe 1420 (or located in close proximity thereto), thereby enabling a determination of when the leading edge of the cement slurry 1430 reaches the end of the casing, "turns the corner," and enters the annulus 26. Upon entering the annulus, the slug of MEMS sensors will flow upward and will be detected in a downhole to uphole sequence by the data interrogation units 1410. In a further embodiment, pumping of the cement slurry 1430 may be controlled (e.g., slowed and/or terminated) when the slug 1440 of MEMS sensors 52 is detected by a data interrogation unit 1410 situated most proximate to the exterior of the wellbore 18, as illustrated in FIG. 22*c*. Additionally or alternatively, a second slug of MEMS sensors may be included at the trailing edge of the cement slurry, thereby enabling a determination of when the trailing edge of the cement slurry 1430 reaches the end of the casing, "turns the corner," and enters the annulus 26. Based upon detection of the first slug by a data interrogation unit (e.g., unit 1440) located a known distance above the float shoe 1420 and/or detection of the second slug by a data interrogation unit integral with and/or proximate to the float shoe 1420, pumping of the cement slurry may be controlled (e.g., slowed and/or stopped) to provide for precise placement of the cement slurry into the annular space while, based upon the design parameters of the well, likewise optionally allowing for a controlled amount of cement to remain in the casing proximate the float collar or optionally allowing for removal of substantially all of the cement from the interior of the casing. In an embodiment, detection of MEMS allows for controlled placement of the cement slurry such that any contaminated cement (e.g., cement contaminated with mud located in front of a cementing/wiper plug) remains in the casing and/or shoe track and is not allowed to turn the corner, exit the casing and reach the annulus, thereby ensuring that all cement placed in the annulus is not contaminated and/or compromised. Thus, MEMS may be used to avoid undesirably pushing a contaminated wellbore servicing fluid into the annulus. In addition, as also illustrated in FIG. 22*c*, when pumping of cement slurry 1430 is terminated, the pressure differential between the interior of the casing 20 and the annulus 26 decreases, thereby causing the valve 1422 to close. As a result, the cement slurry 1430 is prevented from re-entering the casing 20.

Additionally or alternatively, the cement slurry (or other wellbore fluid) may be monitored for movement of the MEMS sensors after pumping has been terminated, as such movement may indicate a problem with the closure of the terminal end of the casing (e.g., closing of a valve such as the float shoe valve) and/or otherwise indicate a potential undesirable inflow and/or outflow into the wellbore and resultant loss of zonal isolation. Such monitoring may be performed in any cementing job (or other wellbore servicing job), including but not limited to primary cementing (either traditional cementing with flow down the casing and up the annulus or reverse cementing with flow down the annulus) and/or secondary cementing (e.g., remedial cementing, squeeze jobs, etc.). For example, if a data interrogation unit located proximate the terminal end of the casing being cemented (either convention or reverse cementing) detects movement of MEMS sensors, such movement may be associated with fluid flow into or out of the casing, which may indicate that a valve associated with the terminal end of the casing has not properly closed, i.e., the valve did not close properly at the conclusion of cement pumping. Additionally or alternatively, such movement may indicate an undesirable or problematic movement of a wellbore fluid (e.g., cement slurry, drilling fluid, isolation fluid, displacement fluid, production fluids, etc.), for example due to loss into the formation and/or flow of the fluid back up the wellbore (for example in response to downhole pressure build-up, and thus indicating the potential for a loss of zonal isolation or potentially a blowout). In an embodiment, where undesirable movement of the wellbore fluid is detected via movement of MEMS sensors, a signal may be generated to trigger an alarm and/or activate one or more safety devices such as downhole safety valves, blowout preventers, etc. In summary, if MEMS sensors are detected as moving uphole when they shouldn't be, then automatically and/or manually trigger one or more safety devices to shut in the well. Detection of MEMS sensor movement may be used in combination with other MEMS sensed parameters (e.g., detection of gas entering the wellbore) to provide further cross-checking and/or redundancy to trigger alarms and/or safety systems.

Figure 23A:
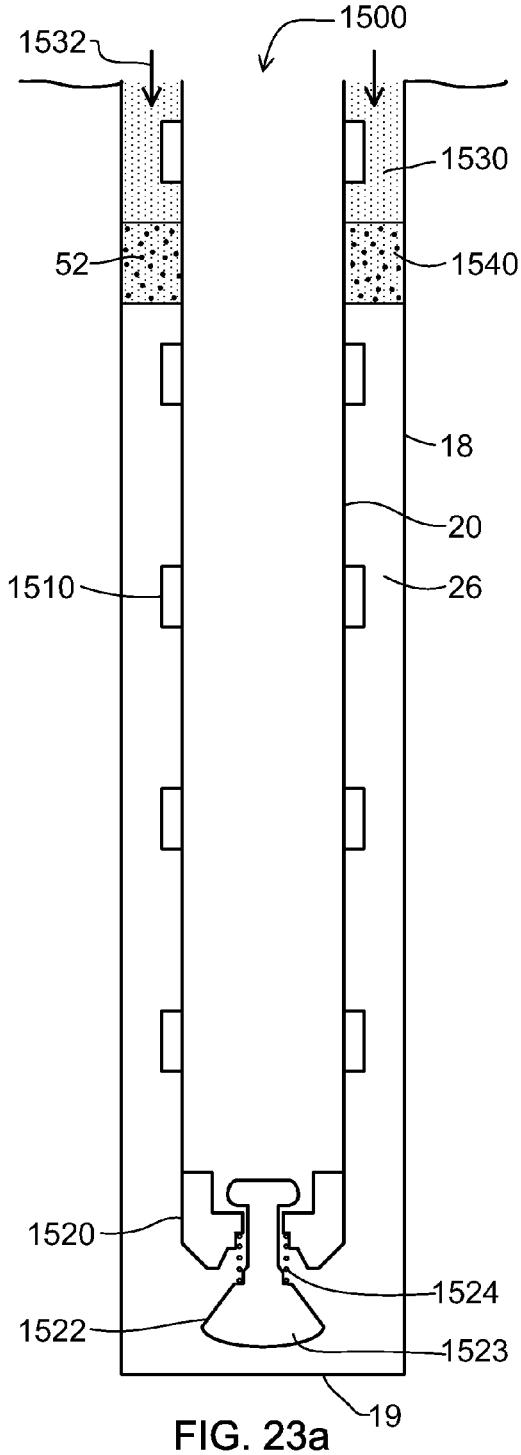
FIGS. 23*a* to 23*c* are schematic views of a further embodiment of a wellbore parameter sensing system.
Figure 23B:
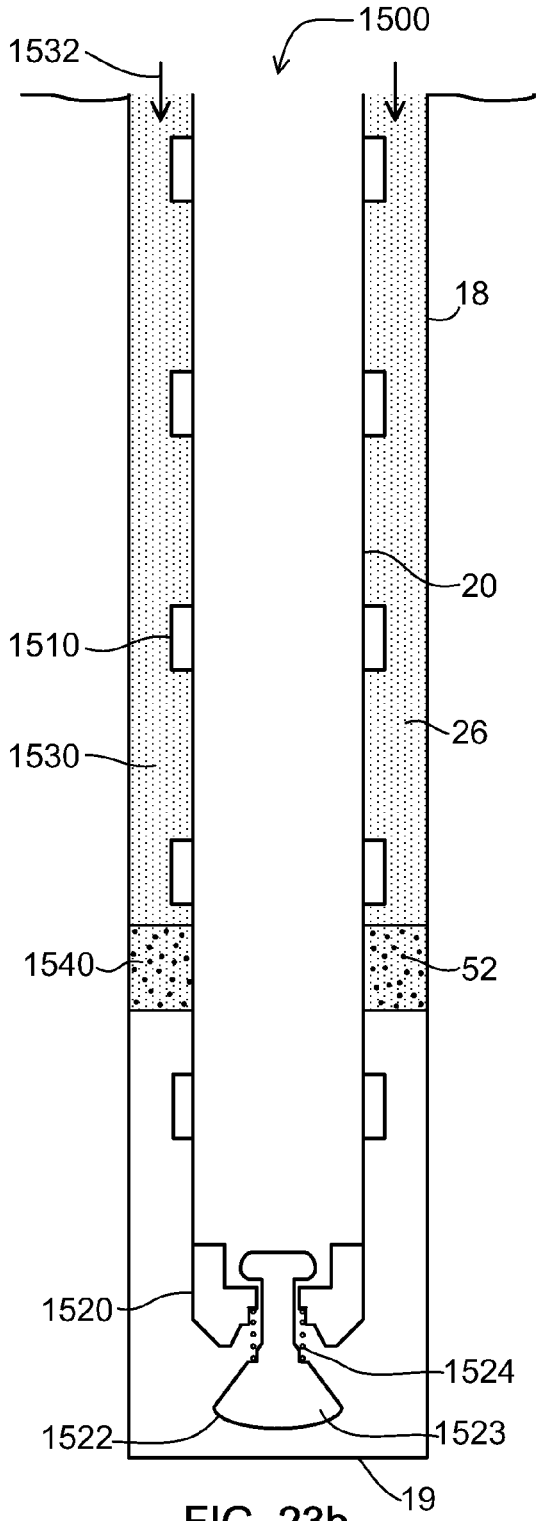
Figure 23C:
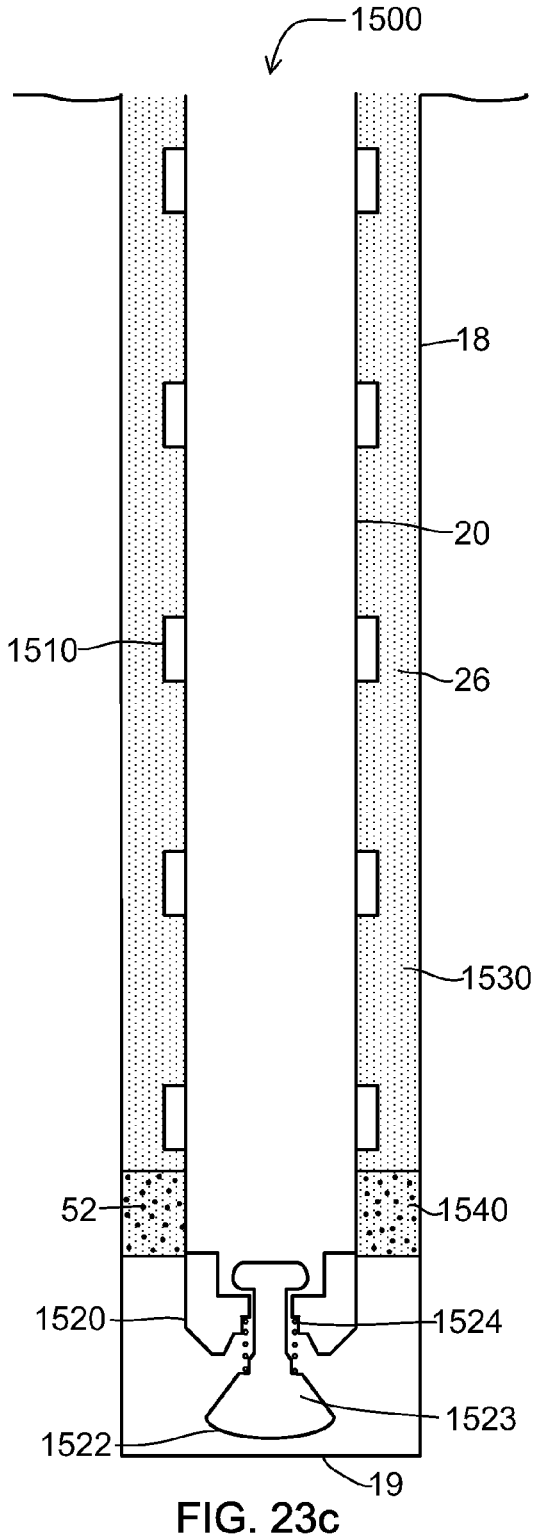

FIGS. 23*a* to 23*c* illustrate a schematic view of an embodiment of a wellbore parameter sensing system 1500, which comprises the wellbore 18, the casing 20 situated in the wellbore 18, a plurality of data interrogation units 1510 spaced along a length of the casing 20, and a casing shoe 1520 situated at a downhole end of the casing 20. In an embodiment, the casing shoe 1520 comprises a poppet valve 1522, which is biased open by a spring 1524 when the valve 1522 is in a neutral state and may be closed as the casing 20 is lowered into the wellbore 18. While a float shoe and poppet value assembly is demonstrated in this embodiment, it is understood that any assembly (e.g., float collar, float shoe, valve assembly, etc.) suitable to terminate the downhole, distal end of the casing string (e.g., to protect and/or direct same into the wellbore) and to selectively open and/or close terminal end of the casing to fluid flow (from either interior to annulus or from annulus to interior) may be employed in the various embodiments disclosed herein, wherein communication with MEMS sensors may be used in determining when to selectively perform said open and/or close and wherein such communication may be with a data interrogation unit located in and/or proximate such distal assembly (e.g., coupled to and/or integral with a float collar, float shoe, valve assembly etc.) and/or located in a moveable member flowing through the wellbore (e.g., a wiper plug, ball, dart, etc.). Thus, detection and/or communication with MEMS sensors by such data interrogation units may signal the opening and/or closing of a valve proximate the distal end of the casing in a conventional or reverse cementing operation, thereby allowing for the selective placement of the cement slurry.

In an embodiment, a cement slurry 1530 may be pumped down the annulus 26 in the direction of arrows 1532 for the purpose of cementing the casing 20 to a wall of the wellbore 18. FIG. 23*a* illustrates the wellbore 18 at the beginning of the pumping of the cement slurry 1530, FIG. 23*b* illustrates the wellbore 18 when the cement slurry 1530 is partway down the wellbore 18, and FIG. 23*c* illustrates the wellbore 18 when the cement slurry 1530 has arrived at or near a downhole end of the wellbore 18.

In an embodiment, the cement slurry 1530 may include a slug 1540 of MEMS sensors 52 that may be situated in a portion of the cement slurry 1530 that is pumped into the wellbore 18 prior to a remainder of the cement slurry 1530, e.g., positioned at a leading edge/portion, face, or head of the slurry. In an embodiment, the MEMS sensors 52 are configured to measure and/or convey at least one parameter of the wellbore 18, e.g., a longitudinal position of the MEMS sensors 52 in the wellbore 18, and transmit data regarding the longitudinal positions of the MEMS sensors 52 in the wellbore 18 to the data interrogation unit 1510 most proximate to the MEMS sensors 52. The data interrogation units 1510 may then transmit the MEMS sensor data to a processing unit situated at an exterior of the wellbore 18, and such transmission may be carried out according to any embodiment disclosed herein (e.g., the embodiments of FIGS. 5-16).

In an embodiment, as the cement slurry 1530 travels down the annulus 26, a longitudinal position of the slug 1540 of MEMS sensors 52, and hence a longitudinal position of a head of the cement slurry 1530, may be determined in real time via interaction of the MEMS sensors 52 with the plurality of the data interrogation units 1510 spaced along the length of the casing as described herein (e.g., as described with reference to FIGS. 22*a-c*). In a further embodiment, a data interrogation unit may be incorporated in the casing shoe 1520 (or located in close proximity thereto), thereby enabling a determination of when the cement slurry 1530 arrives at or near a downhole end of the annulus 26, as illustrated in FIG. 23*c*. In an embodiment, pumping of the cement slurry 1530 may be controlled (e.g., slowed and/or terminated) when the data interrogator incorporated in and/or positioned in close proximity to the casing shoe 1520 detects the slug 1540 of MEMS sensors 52, thereby providing for precise placement of the cement slurry into the annular space while, based upon the design parameters of the well, likewise optionally allowing for a controlled amount of cement to be pumped through the float shoe and into the interior of the casing (or conversely preventing cement from entering into the interior of the casing). In an embodiment, reverse cementing may be carried out in accordance with embodiments described in U.S. Pat. No. 7,357,181, which is hereby incorporated by reference herein in its entirety.

In an embodiment, after the pumping of the cement slurry 1530 is terminated, the casing 20 may be lowered in the wellbore 18 until a head 1523 of the valve 1522 makes physical contact with the bottom 19 of the wellbore 18. The casing 20 may then be lowered further in opposition to a force of spring 1524 until the valve head 1523 is seated on a downhole end of the casing shoe 1520. In this manner, cement slurry 1530 is prevented from further entering the interior of the casing 20.

Figure 23D:
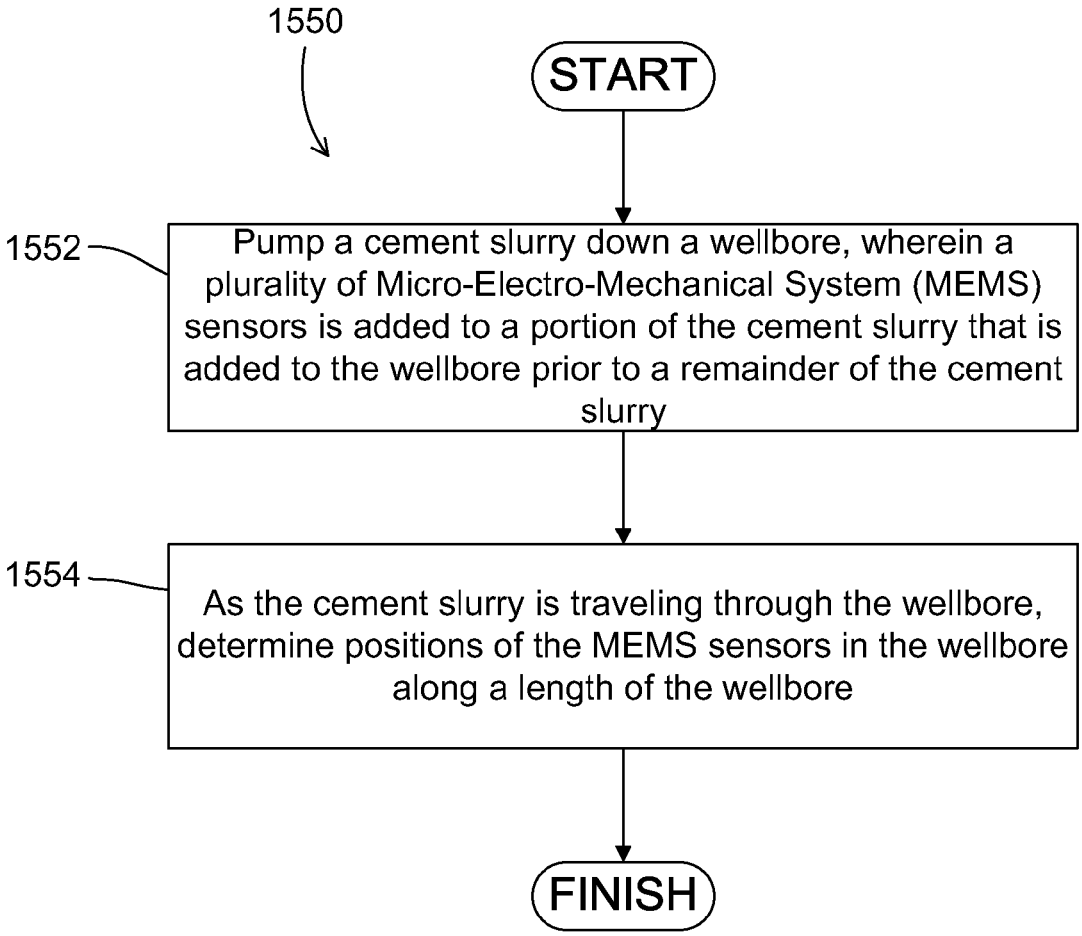
FIGS. 23*d* to 23*f* are flowcharts of methods for servicing a wellbore.

Referring to FIG. 23*d*, a method 1550 of servicing a wellbore is described. At block 1552, a cement slurry is pumped down the wellbore. A plurality of Micro-Electro-Mechanical System (MEMS) sensors is added to a portion of the cement slurry, for example a slug of MEMS sensors added to a leading edge of the slurry that is added to the wellbore prior to a remainder of the cement slurry and/or a slug of MEMS sensors added to a trailing edge of the slurry. At block 1554, as the cement slurry is traveling through the wellbore, positions of the MEMS sensors in the wellbore are determined along a length of the wellbore, thereby providing a determination of a corresponding location (e.g., leading and/or trailing edge) of the cement slurry.

In embodiments, MEMS sensors having one or more identifiers associated therewith may be included in the wellbore servicing composition. By way of non-limiting example, one or more types of RFID tags, e.g., comprising an RFID chip and antenna, may be added to wellbore servicing fluids. The RFID tag allows the RFID chip on the MEMS sensor to power up in response to exposure to RF waves of a narrow frequency band and modulate and re-radiate these RF waves, thereby providing information such as a group identifier, sensor type identifier, and/or unique identifier/serial number for the MEMS sensors and/or data collected by the MEMS sensors, for example any combination of the various sensed parameters disclosed herein. If a data interrogation unit in a vicinity of the MEMS sensor generates an electromagnetic field in the narrow frequency band of the RFID tag, then the MEMS sensor can transmit sensor data to the data interrogator, and the data interrogator can determine that a MEMS sensor having a specific RFID tag is in the vicinity of the data interrogator. Again, while various RFID embodiments are disclosed herein, any suitable technology compatible with and integrated into the MEMS sensors may be employed to allow the MEMS sensors to convey information, e.g., one or more identifiers and/or sensed parameters, to one or more interrogation units.

In embodiments, MEMS sensors having a first identifier (e.g., a first type of RFID tag, for example tags exhibiting an "A" signature) may be added to/suspended in all or a portion of a first wellbore servicing fluid, and MEMS sensors having a second identifier (e.g., a second type of RFID tag, for example tags exhibiting a "B" signature) may be added to/suspended in all or a portion of a second wellbore servicing fluid. The first and second wellbore servicing fluids may be added consecutively to a wellbore in which a casing having regularly longitudinally spaced data interrogation units attached thereto is situated. As the first and second wellbore servicing fluids travel through the wellbore, the data interrogation units interrogate the respective MEMS sensors of the fluids, thereby obtaining data regarding the indentifier associated with the MEMS sensor (e.g., the type of RFID tag) and/or at least one wellbore parameter such as a position of the MEMS sensors in the wellbore or other sensed parameter (e.g., temperature, pressure, etc.). For example, the data interrogation units may interact with the MEMS sensor as described in relation to FIGS. 22*a-c* and 23*a-d*. As a result, in an embodiment, the positions of the different types of MEMS sensor (e.g., different types of RFID tags such as "A" tags and "B" tags) suspended in the two wellbore servicing fluids may be determined. In addition, using the aggregated positions of the MEMS sensors having the same and/or different type of RFID tag, a volume occupied by the first and/or second wellbore servicing fluids in the wellbore at a specific time and/or location in the wellbore may be determined.

In an embodiment, the first and second wellbore servicing fluids may be substantially the same compositionally, and for example two or more different types of tags may be used to indicate different volumetic portions of the same fluid (e.g., a first 100 barrels having "A" tags followed by 500 barrels of "B" tags), thereby aiding in downhole identification, metering, measuring, and/or placement of fluids. In an alternative embodiment, the first and second wellbore servicing fluid may be compositionally different, and for example different types of tags may be used to indicate the different types of fluids (e.g., a first fluid such as cement having "A" tags followed by a second type of fluid such as a drilling fluid having "B" tags), thereby aiding in downhole identification, metering, measuring, and/or placement of fluids. Such embodiments may be further combined, for example a first fluid having two different types of identifiers ("A" and "B" tags to denote different volumetric portions), followed by a second, different fluid having a third type of identifier (e.g., "C" tags) to denote the different composition or fluid type.

In an embodiment, MEMS sensors having a third identifier (e.g., a third type of RFID tag, for example exhibiting a "C" signature) may be added to/suspended in a third wellbore servicing fluid and placed in the wellbore. For example, a third wellbore servicing fluid comprising "C" tags may be placed in the wellbore prior to, intermittent with, or subsequent to placement of first and second wellbore servicing fluids into the wellbore, having "A" and "B" tags, respectively. In an embodiment, the identifier (e.g., RFID tag) of the sensors in the third wellbore servicing fluid may be the same as the identifier (e.g., RFID tag) of the sensors in the first wellbore servicing fluid (for example a first fluid having "A" tags followed by a second fluid having "B" tags followed by a third fluid having "A" tags, wherein the first, second, and third fluids may be compositionally the same or different) or may be different from the identifier (e.g., RFID tag) of the sensors in the first wellbore servicing fluid (for example, a first fluid having "A" tags followed by a second fluid having "B" tags followed by a third fluid having "C" tags, wherein the first, second, and third fluids may be compositionally the same or different).

The MEMS sensors may employ any suitable power source and/or transmission technology to convey an associated identifier to the interrogation units. In an embodiment, the MEMS sensors may be powered by the data interrogation units. In an alternative embodiment, the MEMS sensors may be powered by batteries disposed in the MEMS sensors.

In an embodiment, instead of adding the MEMS sensors to the entire first and second wellbore servicing fluids, the MEMS sensors having the first identifier (e.g., first type of RFID tag) may be added as a slug to a portion of the first wellbore servicing fluid added to the wellbore prior to a remainder of the first wellbore servicing fluid; and the MEMS sensors having the second identifier (e.g., a second type of RFID) tag may be added as a slug to a portion of the second wellbore servicing fluid added to the wellbore prior to a remainder of the second wellbore servicing fluid. As the wellbore servicing fluids travel through the wellbore, the positions and MEMS sensors (e.g., RFID tags) in each slug, and therefore the positions of heads of the wellbore servicing fluids, may be determined by the data interrogation units. In an embodiment, the positions of the MEMS sensors having the second identifier (e.g., second type of RFID tag) may be used to determine an interface of the first and second wellbore servicing fluids in the wellbore. While examples of first, second, and/or third wellbore servicing fluids and associated first, second and/or third identifiers have been described, it should be understood that any desirable number of wellbore servicing fluids and associated identifiers (including more than one identifier type in a given wellbore servicing fluid type or composition) may be used to carryout the embodiments disclosed herein.

Figure 23E:
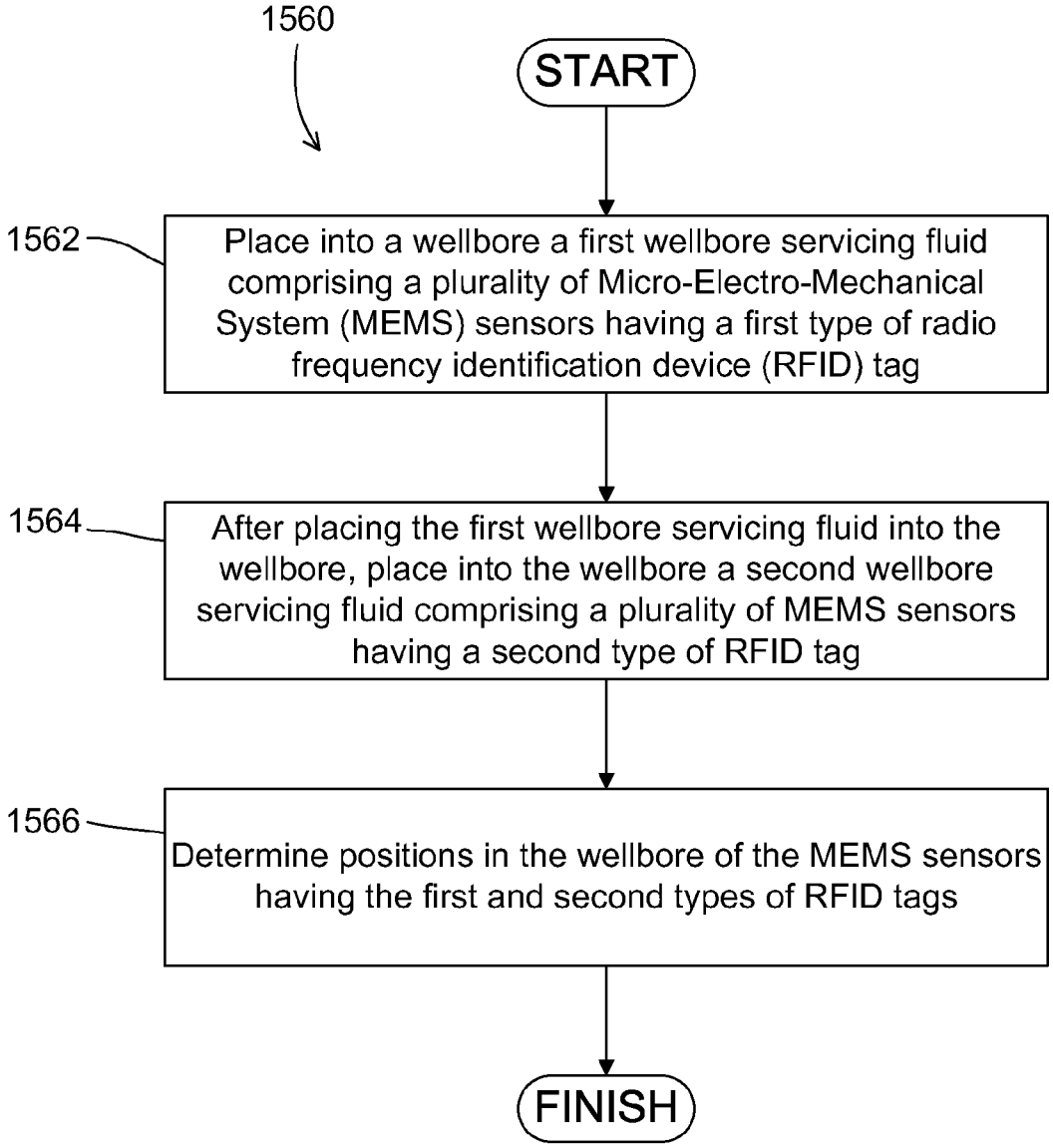

Referring to FIG. 23*e*, a method 1560 of servicing a wellbore is described. At block 1562, a first wellbore servicing fluid comprising a plurality of Micro-Electro-Mechanical System (MEMS) sensors having a first identifier (e.g., a first type of radio frequency identification device (RFID) tag) is placed into the wellbore. At block 1564, after placing the first wellbore servicing fluid into the wellbore, a second wellbore servicing fluid comprising a plurality of MEMS sensors having a second identifier (e.g., a second type of RFID tag) is placed into the wellbore. At block 1566, positions in the wellbore of the MEMS sensors having the first and second identifiers (e.g., first and second types of RFID tags) are determined along a length of the wellbore, thereby providing a determination of a corresponding location (e.g., leading and/or trailing edge) of the first and/or second fluids. The MEMS sensors comprising the first and second identifiers may be added to all or a portion (e.g., leading and/or trailing edge slug) of the first and second wellbore servicing fluids, respectively. In embodiments, the first and second wellbore servicing fluids may be compositionally the same or different.

In an embodiment, MEMS sensors having a common or same identifier (e.g., a common or same type of RFID tag such as an "A" tag) may be added as slugs to portions of two or more wellbore servicing fluids added to a wellbore prior to remainders of the respective two or more wellbore servicing fluids. In embodiments, the two or more wellbore servicing fluids may be compositionally the same or compositionally different. In an embodiment, the MEMS sensor slugs of the respective wellbore servicing fluids may be of different fluid volumes and/or of different MEMS sensor loadings/concentrations. As the wellbore servicing fluids travel through the wellbore, the positions of the MEMS sensors in each slug may be determined in real time by data interrogation units spaced at regular intervals along a casing of the wellbore, thereby providing a determination of a corresponding location (e.g., a leading and/or trailing edge) of the wellbore servicing fluids. In addition, in an embodiment, the different volumes and/or different MEMS sensor loadings of each slug may be detectable as unique signals by the data interrogation units. Accordingly, positions (e.g., heads or leading/trailing edges) of each of the wellbore servicing fluids in the wellbore may be identified using MEMS sensors having only one identifier (e.g., one type of RFID tag such as "A" tags). In an embodiment, volumes in the wellbore occupied by all but the last added wellbore servicing fluid may be determined using the positions of each MEMS sensor slug in the wellbore. Furthermore, in an embodiment, three wellbore servicing fluids may be added to the wellbore in succession, whereby the first and third wellbore servicing fluids are compositionally the same and the second wellbore servicing fluid is a spacer fluid.

Figure 23F:
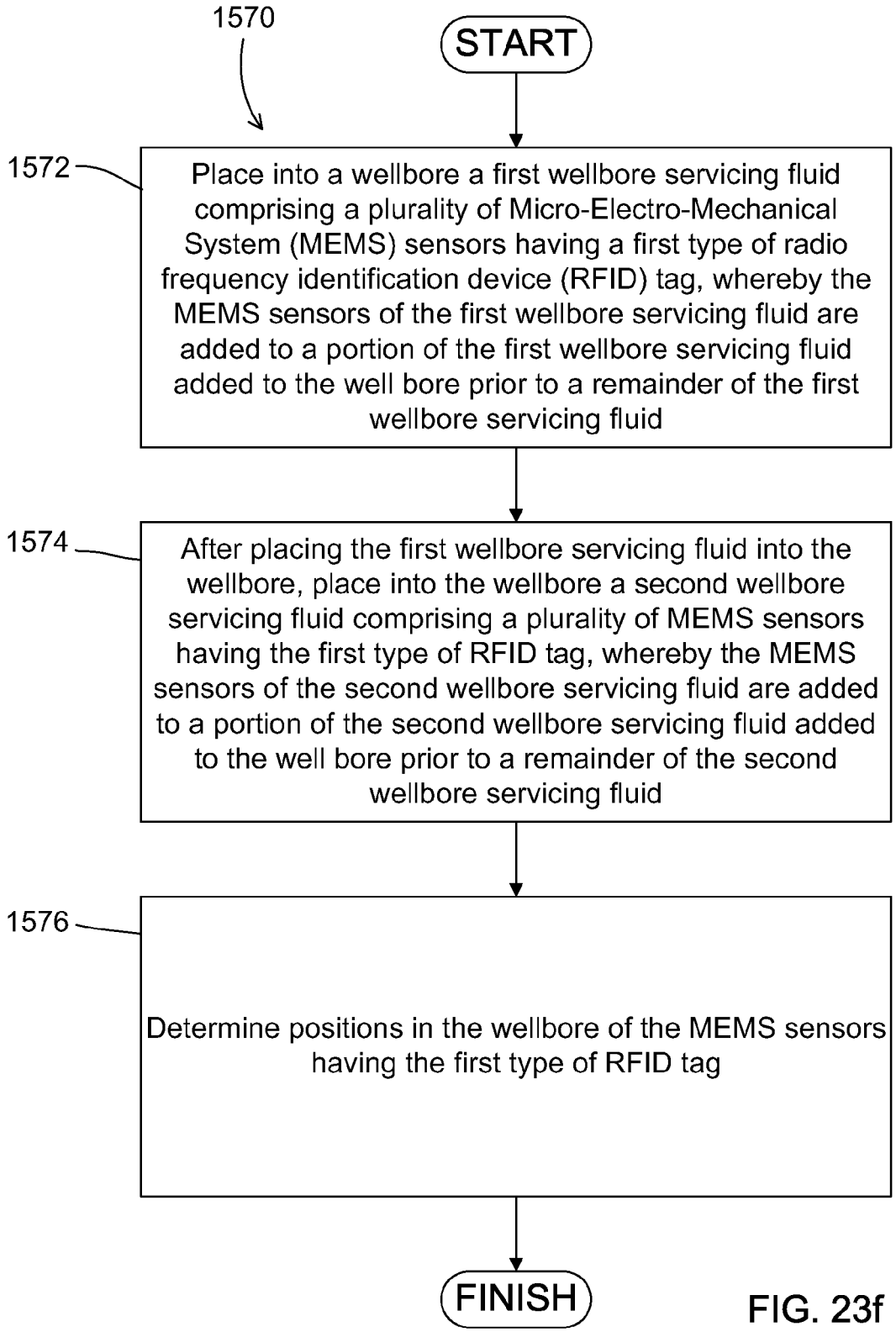

Referring to FIG. 23*f*, a method 1570 of servicing a wellbore is described. At block 1572, a first wellbore servicing fluid comprising a plurality of Micro-Electro-Mechanical System (MEMS) sensors having a first identifier (e.g., a first type of radio frequency identification device (RFID) tag) is placed into the wellbore. The MEMS sensors are added to all or a portion of the first wellbore servicing fluid (e.g., a leading and/or trailing edge slug of the first wellbore servicing fluid added to the well bore prior to a remainder of the first wellbore servicing fluid). At block 1574, after placing the first wellbore servicing fluid into the wellbore, a second wellbore servicing fluid comprising a plurality of MEMS sensors having the first identifier (e.g., the first type of RFID tag is placed into the wellbore). The MEMS sensors are added to all or a portion of the second wellbore servicing fluid (e.g., a leading and/or trailing edge of the second wellbore servicing fluid added to the well bore prior to a remainder of the second wellbore servicing fluid). In embodiments, the concentration of the first identifier in the first fluid is different from the concentration of the first identifier in the second fluid. In embodiments, the first and second wellbore servicing fluids may be compositionally the same or different. At block 1576, positions in the wellbore of the MEMS sensors having the first identifier (e.g., first type of RFID tag) are determined along a length of the wellbore, thereby providing a determination of a corresponding location (e.g., leading and/or trailing edge) of the first and/or second fluids.

Figure 24A:
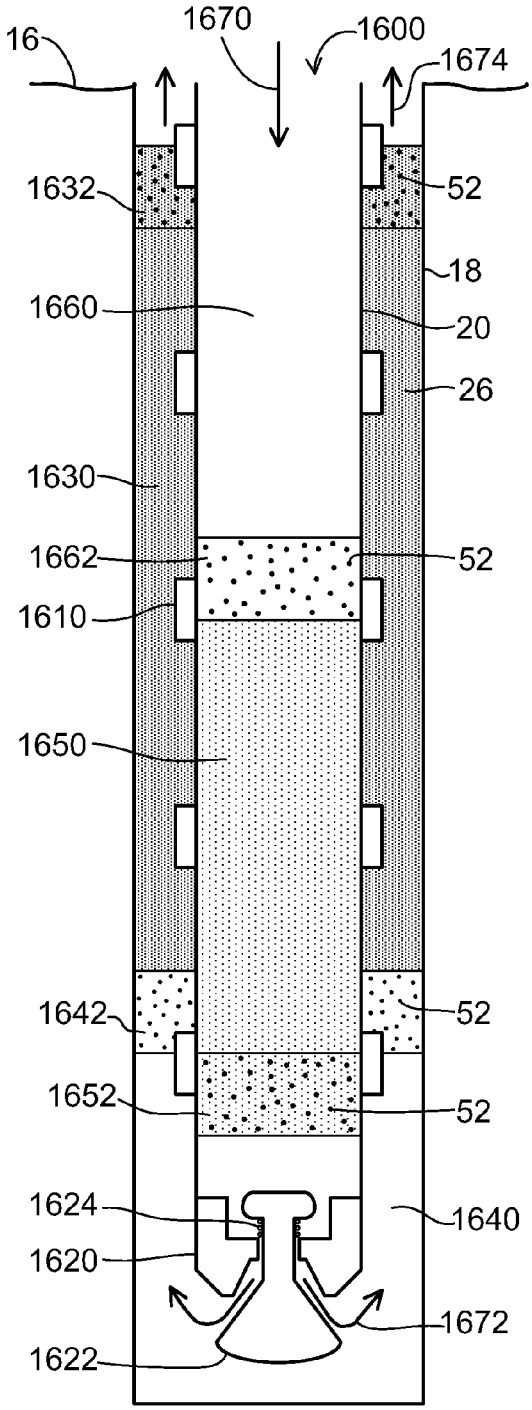
FIGS. 24*a* to 24*c* are schematic views of embodiments of a wellbore parameter sensing system.
Figure 24B:
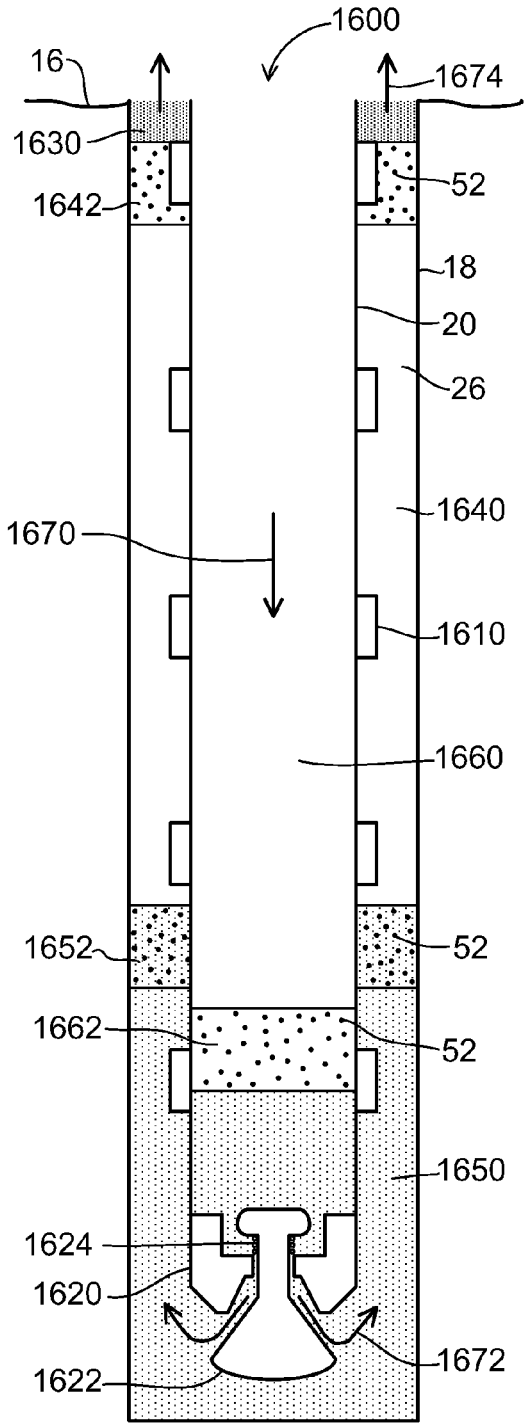
Figure 24C:
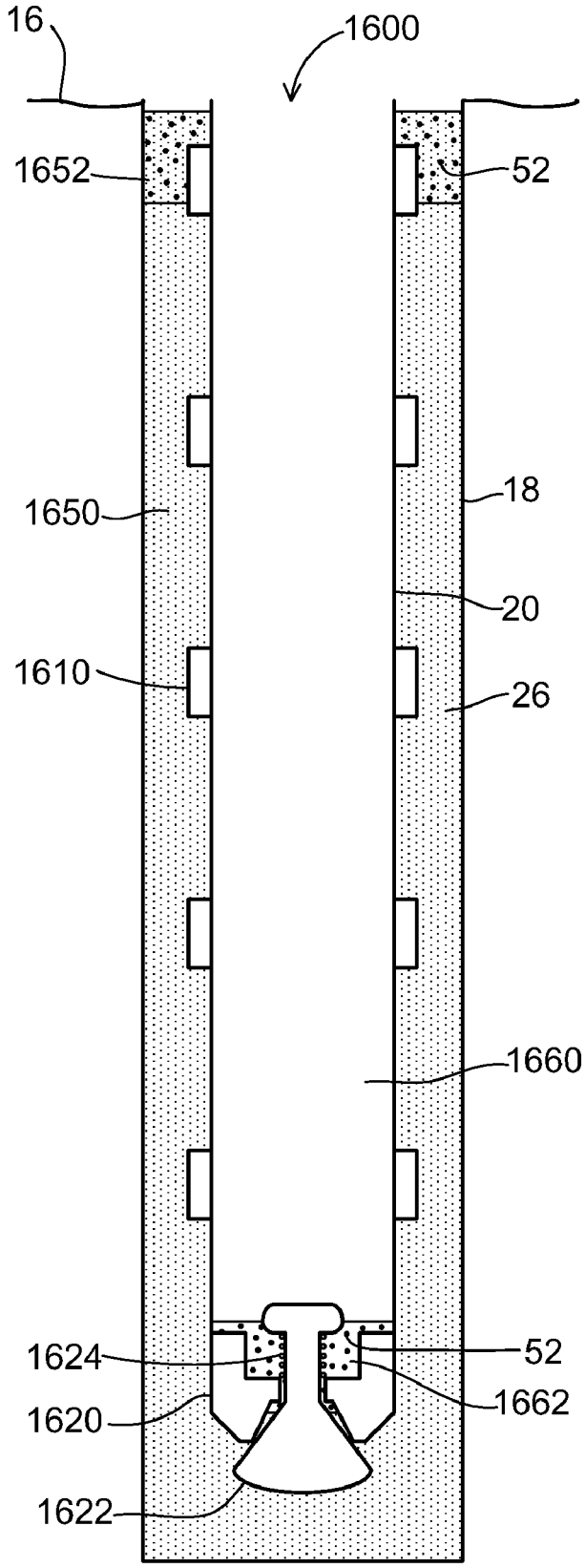

FIGS. 24*a* to 24*c* illustrate a schematic cross-sectional view of an embodiment of a wellbore parameter sensing system 1600, which comprises the wellbore 18, the casing 20 situated in the wellbore 18, a plurality of data interrogation units 1610 spaced at regular or irregular intervals along a length of the casing 20, a float shoe 1620 situated at a downhole end of the casing 20, and four wellbore servicing fluids added to the wellbore 18 in succession, namely, a drilling fluid 1630, a spacer fluid 1640, a cement slurry 1650 and a displacement fluid 1660. In an embodiment, the float shoe 1620 comprises a poppet valve 1622, which, in a neutral state, is biased closed by a spring 1624. In addition, the poppet valve 1622 may be opened in opposition to a force applied by spring 1624 when a differential pressure between an interior of the casing 20 and the annulus 26 is sufficiently high.

In an embodiment, the drilling fluid 1630, the spacer fluid 1640, the cement slurry 1650 and the displacement fluid 1660 are added to the wellbore within the context of cementing the casing 20 to the wellbore 18. In an embodiment, the drilling fluid 1630 comprises a slug 1632 of MEMS sensors 52 added to the wellbore 18 prior to a remainder of the drilling fluid 1630, the spacer fluid 1640 comprises a slug 1642 of MEMS sensors 52 added to the wellbore 18 prior to a remainder of the spacer fluid 1640, the cement slurry 1650 comprises a slug 1652 of MEMS sensors 52 added to the wellbore 18 prior to a remainder of the cement slurry 1650, and the displacement fluid 1660 comprises a slug 1662 of MEMS sensors 52 added to the wellbore 18 prior to a remainder of the displacement fluid 1660. However, in other embodiments, the MEMS sensors 52 may be mixed and suspended in entire volumes of one or more of the wellbore servicing fluids added to the wellbore 18. In alternative embodiments, slugs of MEMS sensors may be added to the trailing edges of one or more of the fluids 1630, 1640, 1650, and 1660 in lieu of or in addition to the slugs at the leading edges of the fluids. In addition, in the present embodiment, the MEMS sensors 52 in all of the slugs 1632, 1642, 1652, 1662 comprise a same identifier (e.g., a same type of RFID tag such as an "A" tag). However, in alternative embodiments, the slugs 1632, 1642, 1652, 1662 may comprise MEMS sensors 52 having two or more different types of identifiers (e.g., two or more different types of RFID tags such as "A", "B", "C", and "D" tags.). Furthermore, in the present embodiment, the slugs 1632, 1642, 1652, 1662 are all of approximately the same volume and MEMS sensor loading. However, in alternative embodiments, the slugs 1632, 1642, 1652, 1662 may be of different volumes and/or different MEMS sensor loadings so as to further identify and distinguish between the heads and interfaces of the wellbore servicing fluids 1630, 1640, 1650, 1660 added to the wellbore 18.

In an embodiment, the drilling fluid 1630, spacer fluid 1640, cement slurry 1650 and displacement fluid 1660 are pumped down the interior of the casing 20 in succession, in the direction of arrow 1670. In some embodiments, one or more plugs may be pumped along with the fluids, for example plugs at the interface of two of the fluids and providing an additional physical barrier between said fluid at the interface. For example, a wiper plug may be pumped behind the cement slurry 1650 and in front of the spacer fluid 1640 (e.g., the wiper plug positioned proximate ahead of the MEMS sensor slug 1662). As each wellbore servicing fluid 1630, 1640, 1650, 1660 travels down the casing 20, the data interrogators 1610 in a vicinity/proximity of the respective MEMS sensor slugs 1632, 1642, 1652, 1662 are able to detect the MEMS sensors 52 in the slugs 1632, 1642, 1652, 1662 and thus identify heads and interfaces of the wellbore servicing fluids 1630, 1640, 1650, 1660 in the casing 20.

In an embodiment, as a pressure in the casing 20 increases due to the pumping of the wellbore servicing fluids 1630, 1640, 1650, 1660 down the casing 20, a pressure differential between the casing interior and the annulus 26 increases sufficiently to overcome the force applied by spring 1624 to the poppet valve 1622 and force the valve 1622 open. The drilling fluid 1630 may then pass through the poppet valve 1622 of the float shoe 1620 in the direction of arrows 1672 and travel up the annulus 26 in the direction of arrows 1674, followed by spacer fluid 1640, as shown in FIG. 24*a*. As the drilling fluid 1630 and the spacer fluid 1640 travel up the annulus 26, the data interrogation units 1610 in the vicinity of the slugs 1632 and 1642 detect the MEMS sensors 52 in the slugs 1632, 1642 and thus determine the location of the heads and the interface of the drilling fluid 1630 and the spacer fluid 1640 in the annulus 26.

Referring to FIG. 24*b*, the displacement fluid 1660 has been pumped partway down the casing 20, the cement slurry 1650 is partially in the casing 20 and partially in the annulus 26, the spacer fluid 1640 is completely in the annulus 26 and most of the drilling fluid 1630 has exited the annulus 26. As the spacer fluid 1640 and cement slurry 1650 travel up the annulus 26, the data interrogation units 1610 detect the location of their respective heads and their interface via the MEMS sensors located in slugs 1642 and 1652. Similarly, as the displacement fluid 1660 travels down the casing 20, the data interrogation units 1610 detect a location of the head of the displacement fluid 1660 via the MEMS sensors located in slug 1662.

Referring now to FIG. 24*c*, the spacer fluid 1640 has been pumped out of the annulus 26, the cement slurry 1650 has been pumped nearly all the way up the annulus 26, and the displacement fluid 1660 has been pumped nearly all the way down the casing 20, such that the MEMS sensor slug 1662 at the head of the displacement fluid 1660 is situated proximate to the float shoe 1620. In an embodiment, a data interrogation unit may be incorporated/integral with and/or located proximate to the float shoe 1620 for the purpose of detecting the MEMS sensor slug 1662 at the head of the displacement fluid 1660. However, in an alternative embodiment, the data interrogation unit may be incorporated in a float collar situated proximate uphole from the float shoe 1620. When the sensor slug 1662 is detected at or near the float shoe 1620, pumping of the wellbore servicing fluids may be controlled (e.g., slowed and/or terminated) to provide for precise placement of the cement slurry into the annular space while, based upon the design parameters of the well, likewise optionally allowing for a controlled amount of cement to remain in the casing proximate the float collar or optionally allowing for removal of substantially all of the cement from the interior of the casing. In an embodiment, pumping is controlled so as to prevent the displacement fluid from entering the annulus 26 and possibly degrading the cement slurry 1650 near a base of the annulus 26. When pumping ceases, the pressure in the interior of the casing 20 decreases, thereby allowing the valve 1622 to close. Additionally or alternatively, in an embodiment, when a data interrogation unit 1610 located at a desired/known position uphole (e.g., the position most proximate to the earth's surface 16) detects the MEMS sensor slug 1652 at the head of the cement slurry 1650, then an operator may conclude that the cement slurry 1650 has filled most or all of the annulus 26 and may be allowed to cure.

In an embodiment, MEMS sensors may be added to a hydraulic fracturing fluid comprising one or more proppants. The fracturing fluid may be introduced into the wellbore and into one or more fractures situated in the wellbore and extending outward into the formation. At least a portion of the MEMS sensors may be deposited, along with the proppant or proppants, into the fracture or fractures and remain therein. In an embodiment, the MEMS sensors situated in the fracture or fractures may measure at least one parameter associated with the fracture or fractures, such as a temperature, pressure, a stress, a strain, a $CO_2$ concentration, an $H_2S$ concentration, a $CH_4$ concentration, a moisture content, a pH, an $Na^+$ concentration, a $K^+$ concentration or a $Cl^-$ concentration. In an embodiment, the presence of MEMS sensors deposited in one or more fractures facilitates the mapping of the fracture. For example, referring to FIG. 19, a fracturing fluid containing MEMS sensors may be pumped into fractures such as represented by fissures 58 and 60 extending into formation 62 and the MEMS sensors deposited therein. Data interrogation units 150 may then provide a map of the fracture complexity in a manner similar to mapping the geometry of the wellbore (e.g., locating constrictions, expansions, etc.) as disclosed herein, for example in reference annular mapping embodiment of FIGS. 17-21. Furthermore, mobile data interrogation units may be used in addition to or in lieu of the fixed data interrogation units 150 shown in FIG. 19. e.g., a data interrogation unit located on a fracturing service workstring, for example located proximate an end of a coiled tubing workstring employed in a fracturing operation.

In an embodiment, the MEMS sensors in a fracture measure moisture content. When the moisture content exceeds a threshold value, it may be concluded that the fracture is producing water, and the fracture may be plugged or treated so as to no longer produce water. In an embodiment, the MEMS sensors in a fracture measure $CH_4$ concentration. If the $CH_4$ concentration exceeds a threshold value, it may be concluded that the fracture is producing methane. In an embodiment, the MEMS sensors in a fracture measure a stress or mechanical force. If the stress or mechanical force exceeds a threshold value, it may be concluded that the fracture is producing sand, and the fracture may be treated so as to no longer produce sand.

Figure 24D:
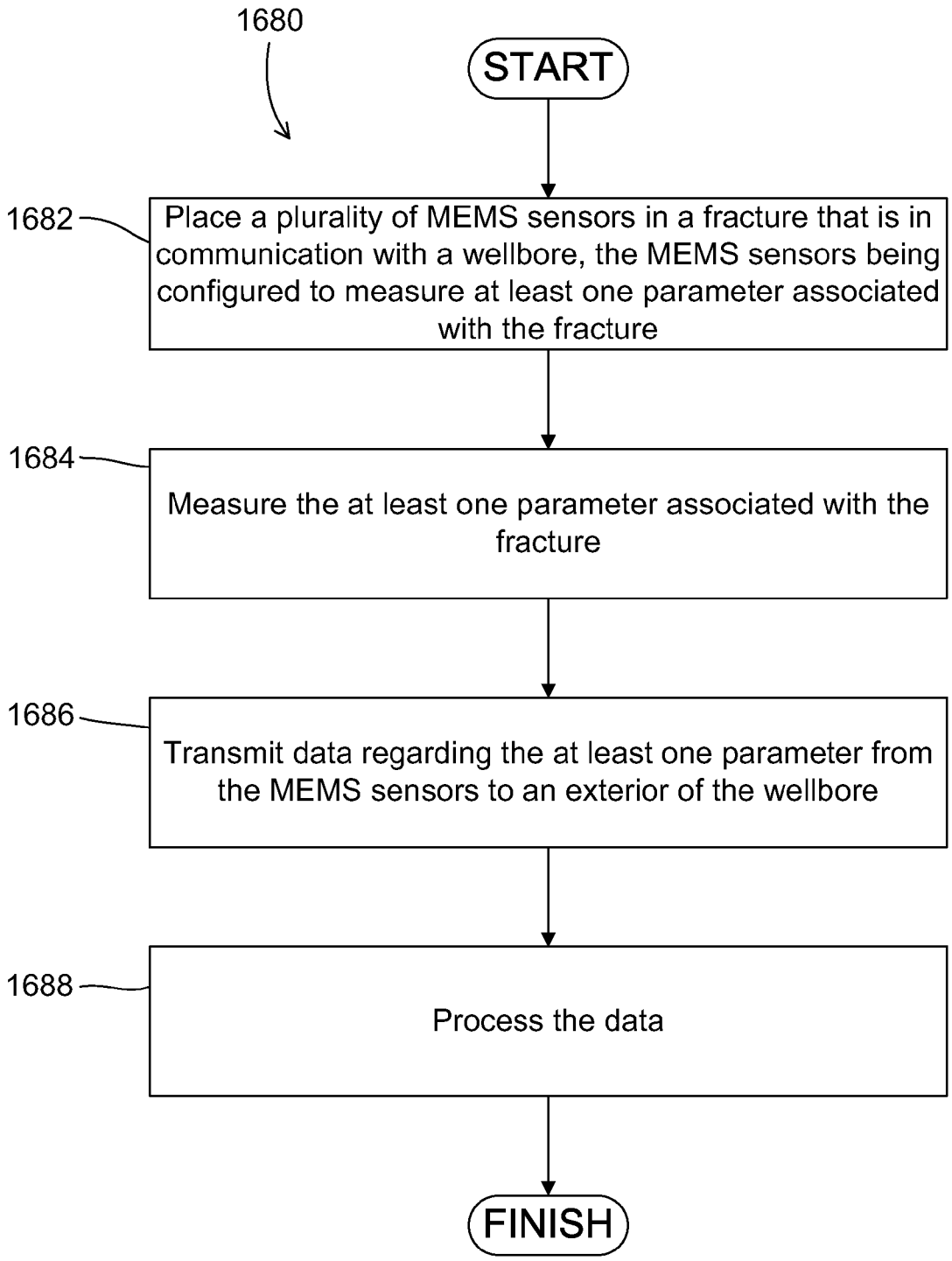
FIG. 24*d* is a flowchart of a method for servicing a wellbore.

Referring to FIG. 24*d*, a method 1680 of servicing a wellbore is described. At block 1682, a plurality of MEMS sensors is placed in a fracture that is in communication with the wellbore, for example via pumping a fracturing fluid comprising MEMS sensors into the fracture, reducing pressure, and allowing the MEMS sensors (along with proppant) to be deposited in the formation. The MEMS sensors are configured to measure at least one parameter associated with the fracture, and at block 1684, the at least one parameter associated with the fracture is measured. In an embodiment, the MEMS sensors provide positional data with respect to one or more data interrogation units located at a known position (e.g., located at casing collars at known depths within the wellbore), and thereby provide information about the geometry and layout of fractures within the formation. For example, within the sensing or mapping range, the data interrogation units are operable to sense the presence of various MEMS sensors in relation to the unit, and thus can create a mathematical representation of MEMS sensor presence, velocity, location, concentration, and/or identity (e.g., a particular sensor or group of sensors having a unique identifier or I.D. number) in relation to the position of a given unit 150, along with other parameters such as moisture content, $CH_4$ concentration, mechanical measurements (stress, strain, forces, etc.), ion concentration, acidity, pH, temperature, pressure, etc. Such information can be provided in real time, and an ongoing fracturing job may be adjusted in response to information provided by the MEMS sensors located in the fracture. For example, the MEMS sensors may provide a real time snapshot of fracture development, complexity, orientation, lengths, etc. that may be analyzed and used to further control the fracturing operation. At block 1686, data regarding the at least one parameter associated with the wellbore, formation, and/or fracture is transmitted from the MEMS sensors to an exterior of the wellbore in accordance with any embodiment disclosed herein, e.g., FIGS. 5-16. At block 1688, the data is processed.

In an alternative embodiment, the detection of MEMS sensors in one or more fractures is used to control a wellbore servicing operation when fracturing is not desired. For example, in certain wellbore servicing operations, such as during drilling and/or cementing, fracturing may be undesirable as leading to detrimental loss of fluids into the formation. As described above, MEMS sensors can be added to a wellbore servicing fluid (e.g., drilling fluid and/or cement slurry) to detect movement and/or placement of the MEMS into the formation via movement of the fluid, and where such movement of the fluid into the formation is undesirable, one or more process parameters (e.g., flow rate, pressure, etc.) may be controlled (e.g., in real time) to alter the servicing treatment and reduce, stop, or eliminate the undesirable formation of fractures and resultant loss of servicing fluid to the formation. Thus, MEMS sensors may be used in a variety of wellbore servicing fluid to control fracturing of the surrounding formation, to desirably induce/promote and/or inhibit/prevent formation of fractures as appropriate for a given service type.

In an embodiment, a plurality of Micro-Electro-Mechanical System (MEMS) sensors are placed in a wellbore composition, the wellbore composition is placed in a wellbore, and the MEMS sensors are used to monitor and detect movement in the wellbore and/or the surrounding formation. The data may be obtained from the MEMS sensors according to any of the embodiments disclosed herein (e.g., one or more mobile data interrogators tripped into and out of the wellbore and/or fixed data interrogators positioned within the wellbore), and may be further communicated/transmitted to/from or within the wellbore via any of the embodiments disclosed herein.) For example, the MEMS sensors may be in a sealant composition that is placed within an annular casing space in the wellbore and wherein the movement comprises a relative movement between the sealant composition and the adjacent casing and/or wellbore wall. In other words, the MEMS sensors detect slippage or shifting of the cement sheath, the casing, and/or the wellbore wall/formation relative to one another. Additionally or alternatively, at least a portion of the wellbore composition comprising the MEMS flows into the surrounding formation and movement in the formation is monitored/detected. For example, cracks, fissures, shifts, collapses, etc. of the formation may be detected over the life of the wellbore via the MEMS sensors. Such movement may be detected via the motion and/or orientation sensing capabilities (e.g., accelerometers, x-y-z axis orientation, etc.) of the MEMS sensors as described herein. In particular, data collected from the MEMS sensors may be compared over successive monitoring or surveying intervals to detect movement and associated patterns. In particular, such movement may be correlated with production rates over the life of the well to help in optimizing production from the well both in terms of rate of production as well as total production over the life of the well. For example, in response to the detection of motion in the formation (e.g., a shift in the formation), one or more operating parameters of the wellbore may be adjusted, for example the production rate of the wellbore (e.g., the rate of production of hydrocarbons from the wellbore), and such adjustments may extend an expected operating life of the wellbore.

In an embodiment, MEMS sensors may be mixed into a sealant composition (e.g. cement slurry) that is placed into the annulus 26 between a wall of the wellbore 18 and the casing 20. In embodiments, the sealant composition may be pumped down the drillstring/casing and up the annulus in a conventional cementing service, or alternatively the sealant composition may be pumped down the annulus in a reverse cementing job. The MEMS sensors may be used to monitor the sealant composition and/or the annular space for the presence and/or concentration of gas, water, or both, including but not limited to monitoring for the presence of corrosive materials, such as corrosive gas (e.g., acid gases such as hydrogen sulfide, carbon dioxide, etc.) and/or corrosive liquids (e.g., acid). Accordingly, the MEMS sensors may be configured to measure a concentration of a water and/or gas in the cement slurry, such as $CH_4$, $H_2S$, or $CO_2$, prior to the cement setting. A degree of gas and/or water influx into the cement slurry may be determined using the gas and/or water concentration measured by the MEMS sensors. In particular, the presence of MEMS in the cement slurry may aid in identification of any undesirable inflow or channeling formed by gas migrating or flowing into the cement slurry prior to setting of the cement, as such gas and/or water inflow may be adverse to the integrity of and zonal isolation provided by the annular sheath of set cement. Furthermore, MEMS sensors fixed in the set cement may also further aid in the detection of any such flow channels or other defects via annular mapping of the cement sheath as described herein. The presence and/or movement of annular water and/or gas as detected by MEMS distributed along a portion of the set cement sheath may be indicative of a loss or potential loss of zonal isolation, and remedial actions such as a squeeze job may be required to restore zonal isolation and prevent further gas migration within the wellbore.

In a further embodiment, the above-mentioned cement slurry comprising MEMS sensors is allowed to cure so as to form a cement sheath. The MEMS sensors, which are distributed throughout the cross section of the cement sheath, may be configured and/or operable to measure a water and/or gas presence and/or concentration in the cement sheath. Again, the MEMS sensors may be used to monitor the set sealant composition and/or the annular space, for example at periodic monitoring or service intervals over an expected service life of the wellbore, for the presence and/or concentration of gas, water, or both, including but not limited to monitoring for the presence of corrosive materials, such as corrosive gas (e.g., acid gases such as hydrogen sulfide, carbon dioxide, etc.) and/or corrosive liquids (e.g., acid). If a water and/or gas is present in the wellbore in a vicinity of a region of the cement sheath, MEMS sensors situated in the region of the cement sheath, for example in an interior of the cement sheath and/or at an interface of the cement sheath and the wellbore, may measure the presence/concentration of the water and/or gas at corresponding locations in the interior of the cement sheath and/or at the cement sheath/wellbore interface. In an embodiment, an integrity (e.g., structural integrity as effective to provide/maintain zonal isolation) of the region of the cement sheath may be determined using the presence/concentration of the water and/or gas measured by the MEMS sensors in the interior of the cement sheath. The region of the cement sheath may be determined to be integral (e.g., uncompromised and of acceptable structural integrity) if the concentration of the water and/or gas measured by the MEMS sensors in the interior of the cement sheath is less than a threshold value, for example less than a concentration of gas measured at the cement sheath/wellbore interface, which indicates that water and/or gas is not penetrating from an exterior surface of the cement sheath into an interior location.

In embodiments, the MEMS sensors in the unset sealant composition (e.g., cement slurry) and/or in the a set sealant composition (e.g., set cement forming a sheath) the MEMS sensors may be interrogated by running an interrogator into the wellbore, for example during and/or immediately after the cementing operation and/or at service interval over the life of the wellbore. In alternative embodiments, the MEMS sensors are interrogated via data interrogators permanently located in the wellbore.

In embodiments, the MEMS sensors in the unset sealant composition (e.g., cement slurry) and/or in the a set sealant composition (e.g., set cement forming a sheath) detect the presence and/or concentration of water, gas, or both, including but not limited to monitoring for the presence of corrosive materials, such as corrosive gas (e.g., acid gases such as hydrogen sulfide, carbon dioxide, etc.) and/or corrosive liquids (e.g., acid). In such embodiments, an operator of a wellbore servicing operation, an field operator, or other person responsible for monitoring the wellbore may be signaled as to the detected gas and/or water (e.g., an alarm or alert may be signaled or activated). The MEMS sensors may be used to provide a location in the wellbore corresponding to the detection of gas and/or water. In an embodiment (for example, an emergency or urgent response), at least one device is activated to prevent fluid flow out of the well in response to the detection of gas and/or water, and in particular during a cementing operation where the cement has not yet hardened and set. Such devices may include emergency shut off valves (e.g., sub-surface safety valves), blow out preventers, and the like. The activation of such devices may be automatic and/or manual in response to the detection signal and/or alarm. Upon establishing and/or confirming control of the wellbore (e.g., the wellbore is safely contained and/or shut in), one or more remedial actions may be performed in response to the detection of gas and/or water. For example, a tool may be lowered into the wellbore proximate the location of the detected gas and/or water, and the surrounding area may be surveyed for damage such as cracks in the cement sheath, corrosion of the casing, etc. to determine the integrity thereof. Upon assessing the nature and extent of damage, remedial services may be performed. For example, the area may be patched by placing additional sealant composition into the damaged area (e.g., squeezing cement into damaged areas such as flow channel, cracks, etc.). Additionally or alternatively, a section of damaged casing may be replaced or repaired, for example by cutting out and replacing the damaged section or placing a reinforcing casing or liner within the damaged portion. Such remedial actions may extend the expected service life of the wellbore.

In alternative embodiments, the MEMS sensors in the a set sealant composition (e.g., set cement forming a sheath) detect the presence and/or concentration of water, gas, or both, including but not limited to monitoring for the presence of corrosive materials, such as corrosive gas (e.g., acid gases such as hydrogen sulfide, carbon dioxide, etc.) and/or corrosive liquids (e.g., acid), and in response one or more operating parameters of the wellbore are adjusted, for example the production rate of the wellbore (e.g., the rate of production of hydrocarbons from the wellbore). Example of operating conditions or parameters further include temperature, pressure, production rate, length of service interval, or any combination thereof. Adjusting one or more operating conditions of the wellbore, in addition to or in lieu of one or more remedial actions, may extend the expected service life of the wellbore.

In an embodiment, the MEMS sensors may be mixed into a sealant composition (e.g. cement slurry) that is placed into the annulus 26 between a wall of the wellbore 18 and the casing 20 in a wellbore associated with carbon dioxide injection, for example a carbon dioxide injection well used to sequester carbon dioxide. The MEMS sensors may be used to detect leaks in such wells. For example, the detection of carbon dioxide in an annular space in the wellbore may indicate that the carbon dioxide injection well has lost zonal integrity or otherwise is leaking. Accordingly, remedial actions may be taken as described above to repair the leaks and restore integrity. Additionally or alternatively, such remedial actions may be taken to work-over pre-existing wells, for example to retrofit older wells that may no longer be economically viable for hydrocarbon production, and thereby render such wells suitable for carbon dioxide injection. Such wells would be useful for sequestering carbon dioxide from large scale commercial sources for green house gas reduction purposes.

Figure 25:
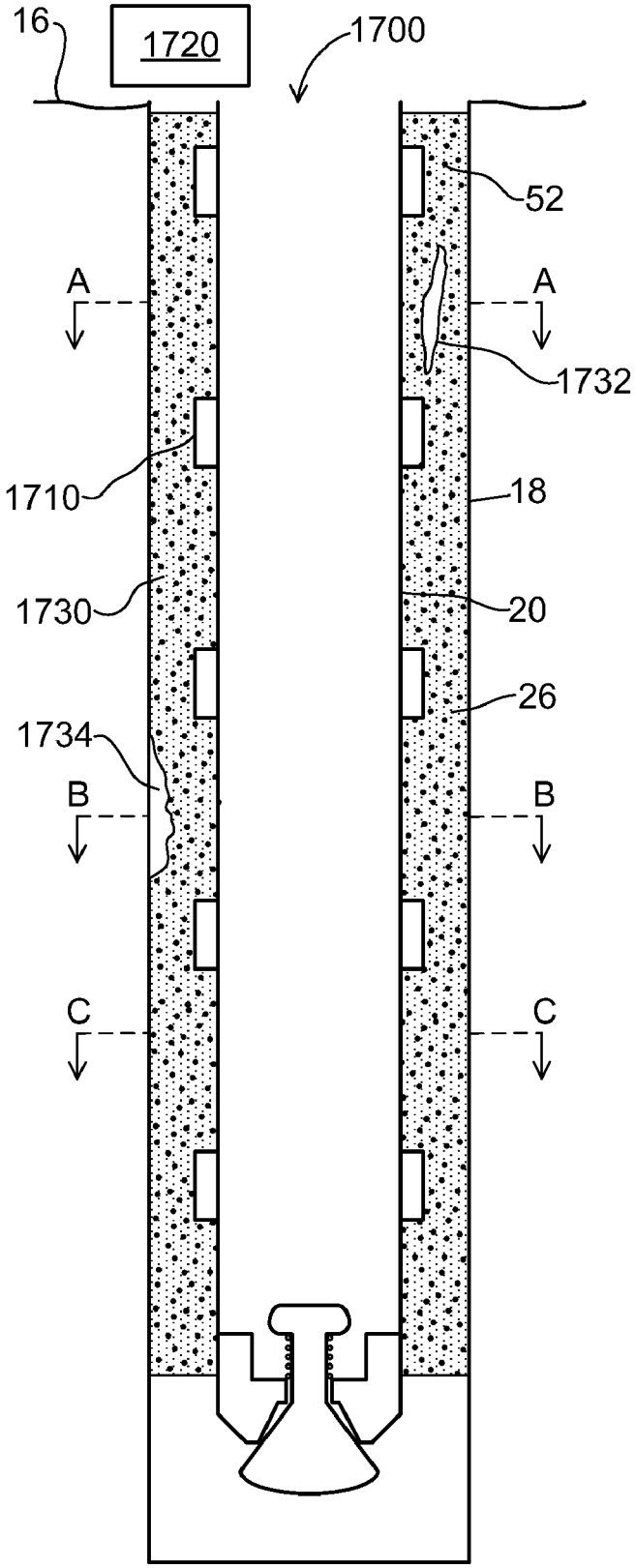
FIG. 25 is a schematic view of a further embodiment of a wellbore parameter sensing system.

FIG. 25 illustrates an embodiment of a wellbore parameter sensing system 1700 comprising the wellbore 18, the casing 20 situated in the wellbore 18, a plurality of data interrogation units 1710 spaced along a length of the casing 20, a processing unit 1720 situated at an exterior of the wellbore 18, and a cement slurry placed into the annulus 26 between the wellbore 18 and the casing 20 and allowed to cure to form a cement sheath 1730. In an embodiment, the data interrogation units 1710 may be powered by rechargeable batteries or a power supply situated at the exterior of the wellbore 18, or otherwise as disclosed in various embodiments herein.

In an embodiment, the cement sheath 1730 comprises MEMS sensors 52, which are configured to measure at least one wellbore parameter, e.g., a spatial position of the MEMS sensors 52 with respect to the various data interrogation units 1710 and/or the casing 20 (e;g., data interrogation units mounted at known locations such as casing collars). The MEMS sensors 52 may be suspended in, and distributed throughout, the cement slurry and the cured cement sheath 1730. The MEMS sensors 52 may be passive sensors, i.e., powered by electromagnetic pulses emitted by the data interrogation units 1710, or active sensors, i.e., powered by batteries situated inside the MEMS sensors 52 or otherwise powered by a downhole power source. In an embodiment, the data interrogation units 1710 may interrogate the MEMS sensors 52 and receive from the MEMS sensors 52 data regarding, e.g., the spatial position of the MEMS sensors 52, and transmit the data to the processing unit 1720 for processing. In an embodiment, the data interrogation units 1710 may transmit the sensor data to the processing unit 1720 via a data line that runs along the casing, for example as shown in FIGS. 5, 7, and 9. In an alternative embodiment, the data interrogation units 1710 may transmit the sensor data wirelessly to neighboring data interrogation units 1710 and up the casing 20 to the processing unit 1720, for example as shown in FIGS. 6, 8, and 10. While fixed data interrogation units 1710 are shown, it should be understood that a mobile data interrogation units (for example, for examples unit 40 of FIG. 2, unit 620 of FIG. 8, and unit 740 of FIG. 9) may be disposed and moved within the wellbore to further aid in obtaining and/or processing data associated with cross-sectional views of the annulus, cement sheath, and/or formation.

In an embodiment, the processor 1720 may be configured to divide the wellbore 18 into a plurality of cross-sectional slices of a specified width that are situated along a length of the wellbore 18. The width of each slice may be about 0.1 cm to 10 cm, alternatively about 0.5 cm to 5 cm, alternatively 0.5 cm to 1 cm. In an embodiment, the processor 1720 is configured to aggregate planar coordinates of the positions of the MEMS sensors 52 in each cross-sectional slice and plot the planar coordinates of the positions of the MEMS sensors 52 in each cross-sectional slice so as to approximate cross-sections of the cement sheath 1730 in the annulus 26, along the length of the casing 20. In an embodiment, the planar coordinates may comprise Cartesian coordinates, in which a center of a casing cross-section serves as an origin. In a further embodiment the planar coordinates may comprise polar coordinates, in which a center of a casing cross-section serves as an origin.

In embodiments, the cross-sectional slices of the wellbore may be used to determine an integrity of the cement sheath 1730 along the length of the casing 20. As the MEMS sensors 52 are distributed throughout the cement sheath 1730, the cross-sectional slices may be used to determine an extent of cement coverage in the annulus 26 and/or a cross-sectional shape of the annulus 26. In an embodiment, in cross-sectional slices in which no MEMS sensors 52 are situated in specific regions outside of the casing 20, the presence of a void in the cement sheath 1730 and/or a constriction in the annulus 26 may be determined. In an embodiment, in cross-sectional slices in which MEMS sensor coordinates extend beyond a boundary at which a wall of the wellbore 18 is thought to be situated, it may be concluded that the wellbore 18 is washed out and/or contains a significant fracture or fractures or permeable regions through which cement has migrated. In some embodiments, the MEMS sensors may extend from the wellbore into the formation, and likewise the cross-sectional slices may provide information regarding the formation, for example cross-sectional shapes of fractures/fissures such as shown in FIGS. 19 and 20. For example, a cemented wellbore may be perforated, a fluid (e.g., fracturing fluid) comprising MEMS sensors may be pumped into the formation (e.g., via the perforations and/or fractures), and cross-sectional slices taken of the treated portion of the wellbore. In a further embodiment, in cross-sectional slices in which the mapped planar coordinates of the MEMS sensors 52 form an approximately annular shape without voids, it may be concluded that the cement sheath 1730 is in good condition in regions corresponding to these cross-sectional slices.

Figure 26A:
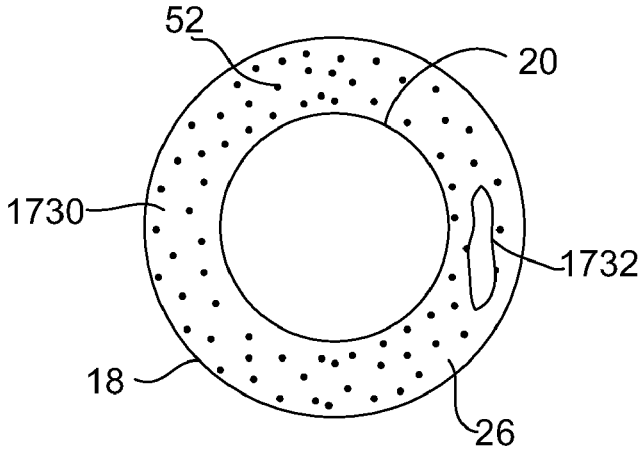
FIGS. 26*a* to 26*c* are schematic cross-sectional views at different elevations of the wellbore of FIG. 25.
Figure 26B:
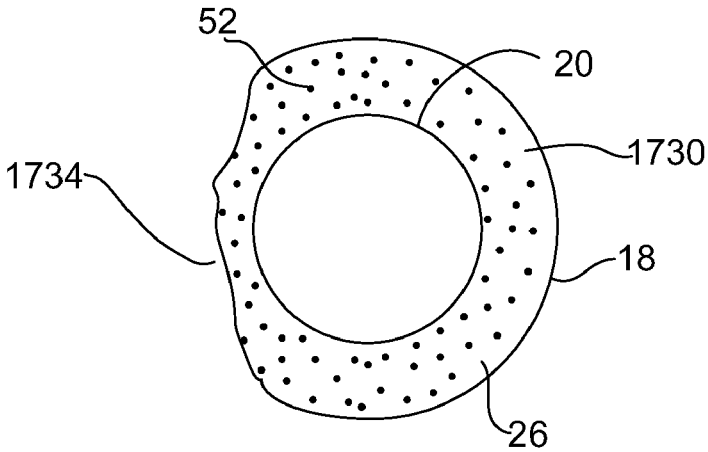
Figure 26C:
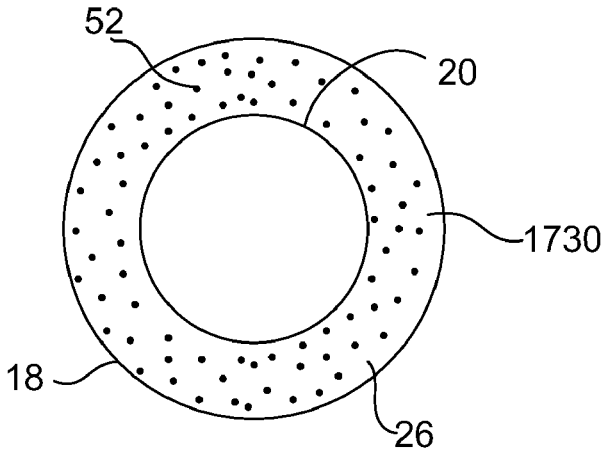

FIG. 26*a*, FIG. 26*b* and FIG. 26*c* illustrate schematic cross-sectional views of the wellbore 18 taken at lines A-A, B-B and C-C, respectively. As is apparent from FIG. 26*a*, the cement sheath 1730 contains a void 1732 at which a strength or structural integrity of the cement sheath 1730 may be compromised. Accordingly, remedial action such as secondary cementing may be required to eliminate the void 1732. In addition, as is apparent from FIG. 26*b*, a region of the annulus 26 through which line B-B travels is devoid of cement. In this instance, the presence of drill cuttings and/or a ledge and/or a build-up of filter cake may be concluded, and, if necessary, appropriate remedial action may be undertaken. Furthermore, as is apparent from FIG. 26*c*, the cross-sectional slice of the wellbore 18 taken at line C-C has a smooth, unbroken annular shape. Accordingly, it may be concluded that the cement sheath 1730 is in good condition at this cross-sectional slice. Accordingly, the use of MEMS sensors in a wellbore servicing fluid, including but not limited to a cement composition, may aid in an assessment of the wellbore, including providing information regarding annular condition/shapes (e.g., FIG. 18), formation condition/shapes (e.g., FIG. 20), cement sheath condition/shapes (e.g., FIG. 26), and other downhole regions or conditions as would be apparent based upon the disclosure herein.

Figure 26D:
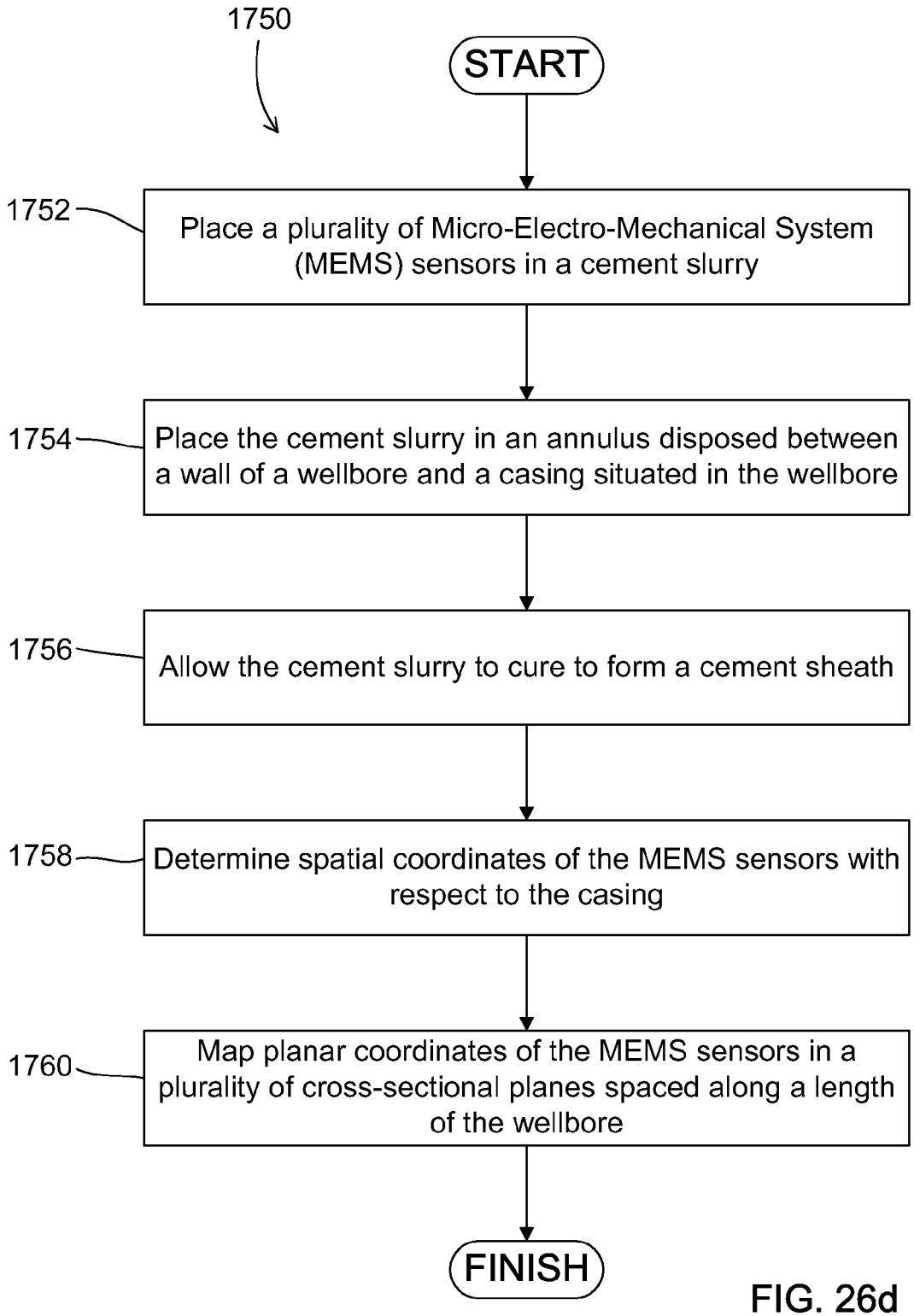
FIG. 26*d* is a flowchart of a method for servicing a wellbore.

Referring to FIG. 26*d*, a method 1750 of servicing a wellbore is described. At block 1752, a plurality of Micro-Electro-Mechanical System (MEMS) sensors is placed in a cement slurry. At block 1754, the cement slurry is placed in an annulus disposed between a wall of the wellbore and a casing situated in the wellbore. At block 1756, the cement slurry is allowed to cure to form a cement sheath. At block 1758, spatial coordinates of the MEMS sensors with respect to one or more known locations in the wellbore are determined (e.g., with respect to data interrogators spaced along the casing, for example at casing collars). At block 1760, planar coordinates of the MEMS sensors are mapped in a plurality of cross-sectional planes spaced along a length of the wellbore. Furthermore, one or more downhole conditions (e.g., a health or maintenance condition/state of the wellbore, formation, cement sheath, etc.) may be determined based upon the mapped cross-sectional planes (e.g., cross-sectional representations of the wellbore, formation, cement sheath, etc.). If appropriate, one or more remedial actions (e.g., servicing operations such as squeeze jobs, etc.) may be carried out in the area or region of the wellbore displaying a need there for based upon analysis of the cross-sectional representations. In embodiments, the cross-sectional analysis is performed in accordance with a service or inspection interval of the wellbore, and may further more comprise one or more mobile interrogation units (in addition to or in lieu of the fixed data interrogation units 1710 placed into the wellbore (e.g., via wireline or coiled tubing) during such services or inspections.

In embodiments, for the purpose of measuring wellbore parameters, MEMS sensors may not only be mixed with and suspended in wellbore servicing fluids (for example, as disclosed in the embodiments of FIGS. 5-26), but may also be integral with wellbore servicing equipment and tools using, for example, contained or housed within the tool and/or molded or formed as a part of the tool formed of plastic or a composite resin material. In an embodiment, the tool houses a fluid (e.g., a hydraulic fluid) within space located in the tool (e.g., a fluid reservoir), and the fluid further comprises MEMS sensors. In addition or alternatively, data interrogation units may be molded onto wellbore servicing equipment and tools using, for example, a composite resin material. In embodiments, the composite resin material may comprise an epoxy resin. In further embodiments, the composite resin material may comprise at least one ceramic material. For example, the composite material may comprise a ceramic based resin including, but not limited to, the types disclosed in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007. For example, in some embodiments, the resin material may include bonding agents such as an adhesive or other curable components. In some embodiments, components to be mixed with the resin material may include a hardener, an accelerator, or a curing initiator. Further, in some embodiments, a ceramic based resin composite material may comprise a catalyst to initiate curing of the ceramic based resin composite material. The catalyst may be thermally activated. Alternatively, the mixed materials of the composite material may be chemically activated by a curing initiator. More specifically, in some embodiments, the composite material may comprise a curable resin and ceramic particulate filler materials, optionally including chopped carbon fiber materials. In some embodiments, a compound of resins may be characterized by a high mechanical resistance, a high degree of surface adhesion and resistance to abrasion by friction.

In embodiments, wellbore servicing equipment or tools have MEMS sensors integrated therein may be formed from one or more composite materials. A composite material comprises a heterogeneous combination of two or more components that differ in form or composition on a macroscopic scale. While the composite material may exhibit characteristics that neither component possesses alone, the components retain their unique physical and chemical identities within the composite. Composite materials may include a reinforcing agent and a matrix material. In a fiber-based composite, fibers may act as the reinforcing agent. The matrix material may act to keep the fibers in a desired location and orientation and also serve as a load-transfer medium between fibers within the composite.

The matrix material may comprise a resin component, which may be used to form a resin matrix. Suitable resin matrix materials that may be used in the composite materials described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyarylates, liquid crystalline polyester, and any combinations thereof.

In an embodiment, the matrix material may comprise a two-component resin composition. Suitable two-component resin materials may include a hardenable resin and a hardening agent that, when combined, react to form a cured resin matrix material. Suitable hardenable resins that may be used include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and any combinations thereof. Suitable hardening agents that can be used include, but are not limited to, cyclo-aliphatic amines; aromatic amines; aliphatic amines; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; 2-ethyl-4-methyl imidazole; and any combinations thereof.

The fibers may lend their characteristic properties, including their strength-related properties, to the composite. Fibers useful in the composite materials used to form a collar and/or one or more bow springs may include, but are not limited to, glass fibers (e.g., e-glass, A-glass, E-CR-glass, C-glass, D-glass, R-glass, and/or S-glass), cellulosic fibers (e.g., viscose rayon, cotton, etc.), carbon fibers, graphite fibers, metal fibers (e.g., steel, aluminum, etc.), ceramic fibers, metallic-ceramic fibers, aramid fibers, and any combinations thereof.

Figure 27A:
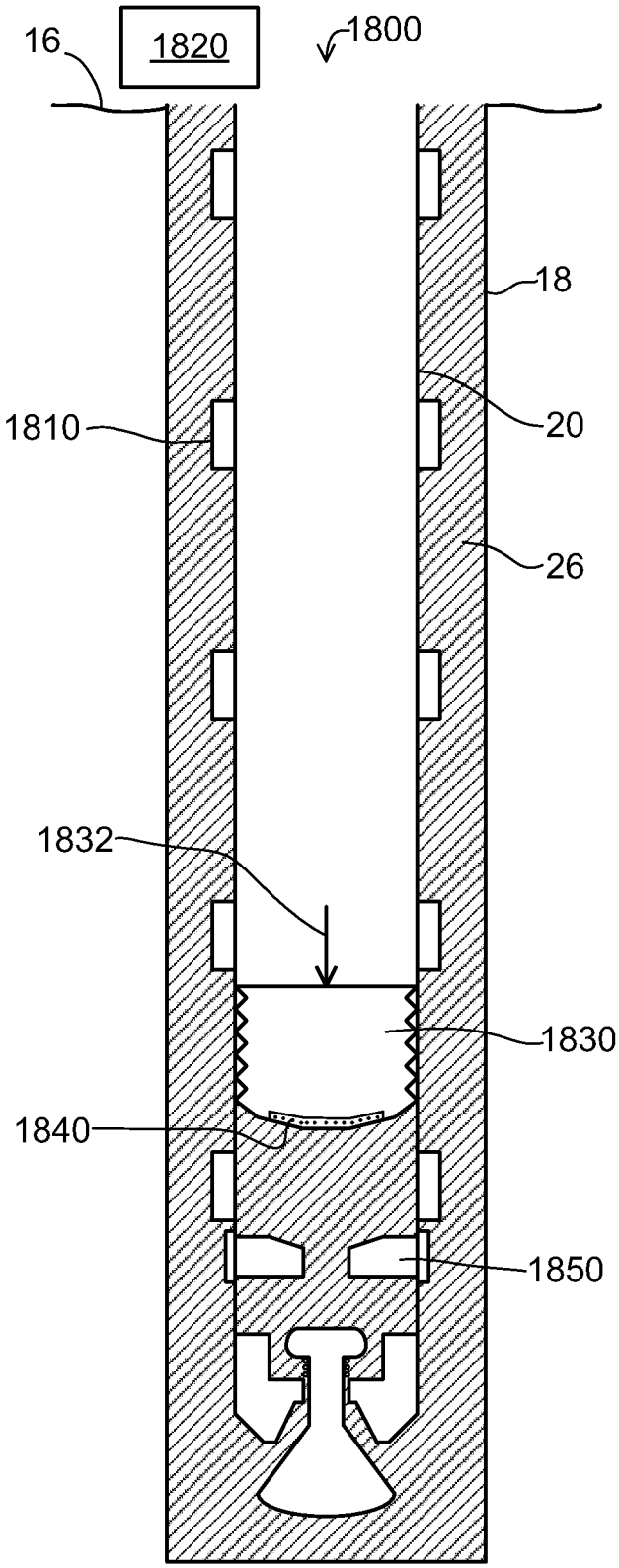
FIGS. 27*a*, 28*a*, 29*a*, 30*a*, and 31 are schematic views of embodiments of a wellbore parameter sensing system.

FIG. 27*a* illustrates an embodiment of a wellbore parameter sensing system 1800, which comprises the wellbore 18, the casing 20 situated in the wellbore 18, a plurality of data interrogation units 1810 attached to the casing 20 and spaced along a length of the casing 20, a processing unit 1820 situated at an exterior of the wellbore 18, and a plug 1830. In an embodiment, the plug 1830 is a wiper plug configured to be pumped down the casing 20 for the purpose of removing residues of a wellbore servicing fluid from an inner wall of the casing 20, typically employed in a wellbore cementing operation wherein wiper plugs are deployed in front of and/or behind a cement slurry that is pumped downhole. While various embodiments herein refer to wiper plugs, it is to be understood that other types of plugs or pumpable members may be combined with MEMS sensors, for example balls, darts, etc., and employed in various other wellbore servicing operations or functions such as operating valves, sleeves, etc., where the MEMS sensors may be used to verify the location of the plug or pumpable member (e.g., to verify that if/when it has landed or seated properly). In an embodiment, the data interrogation units 1810 may be powered by rechargeable batteries or a power supply situated at the exterior of the wellbore 18 or by any other downhole power supply.

In an embodiment, the plug 1830 may comprise MEMS sensors 1840, which are configured to measure at least a vertical position of the MEMS sensors 1840 (and correspondingly the location of the plug 1830) in the casing 20 and a pressure exerted on the MEMS sensors 1840 (and correspondingly a pressure exerted on the plug 1830). In an embodiment, the MEMS sensors 1840 may be molded onto a downhole end (e.g., nose) of the plug 1830, for example a wiper plug that is configured to mate with a float collar 1850 situated near a downhole end of the casing 20. In an alternative embodiment, the MEMS sensors 1840 may be incorporated in a material of which the plug 1830 is made and situated at the downhole end of the plug 1830 such that the MEMS sensors are in proximity to a seat or other member that receives or mechanically interacts with the plug 1830. In other embodiments, the MEMS sensors 1840 may be housed by, coupled to, or otherwise integral with the plug 1830.

In operation, in an embodiment, the plug 1830 (e.g., a wiper plug) may be pumped down the casing 20 in the direction of arrow 1832 by pumping a displacement fluid down the casing 20, directly in back of the plug 1830. As the plug 1830 travels down the casing 20, data interrogation units 1810 nearest to the MEMS sensors 1840 in the plug 1830 interrogate the MEMS sensors 1840. In response to being interrogated, the MEMS sensors 1840 may transmit to the data interrogation units 1810 data regarding at least the vertical position of the MEMS sensors 1840 in the casing 20 and the pressure exerted on the MEMS sensors 1840. In an embodiment, the data interrogation units 1810 may then transmit the sensor data to the processing unit 1820 via a data line that runs along the casing or by other communication means or networks (e.g., wireless networks and/or telemetry) as disclosed herein. For example, the data interrogation units 1810 may transmit the sensor data wirelessly to neighboring data interrogation units 1810 (and/or via a MEMS sensor network where one or more wellbore servicing fluids, e.g., a cement composition, comprises MEMS sensors and/or up the casing 20) to the processing unit 1820.

In an embodiment, when the plug 1830 (e.g., a wiper plug) lands on a seat or receptacle such as the float collar 1850, the pressure exerted on the MEMS sensors 1840 situated at the downhole end of the wiper plug 1830 will increase sharply due to a reaction force applied to the wiper plug 1830 by the float collar 1850. In response to the pressure increase detected by the MEMS sensors and communicated to the surface, pumping of the displacement fluid behind the wiper plug 1830 may be controlled (e.g., slowed or terminated). In an embodiment, the pumping of the displacement fluid may be terminated when the pressure exerted on the MEMS sensors 1840 reaches a threshold value of about 200 psi to about 3000 psi depending upon depth of the well.

Figure 27B:
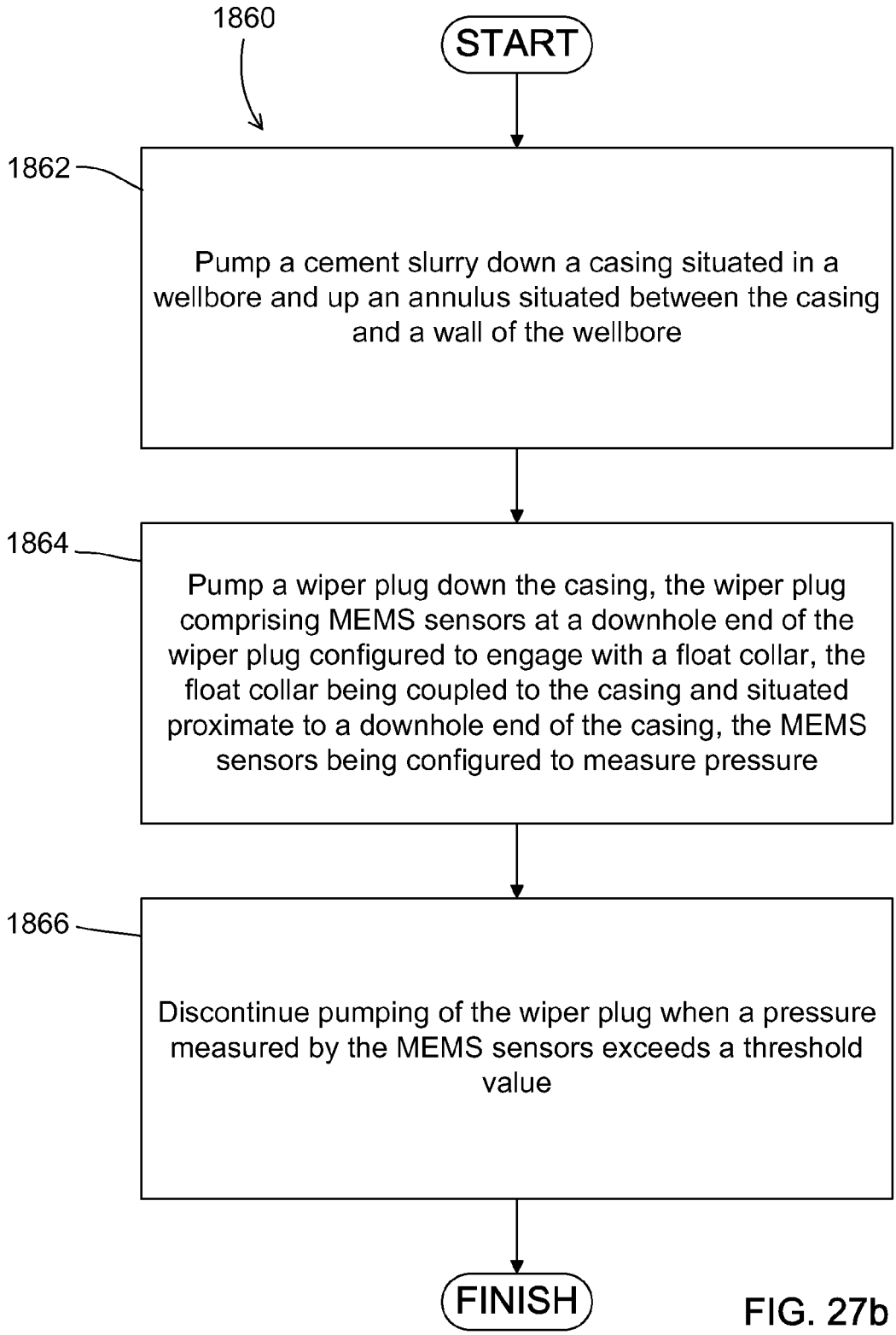
FIGS. 27*b*, 28*b*, 29*b*, and 30*b* are flowcharts of methods for servicing a wellbore.

Referring to FIG. 27*b*, a method 1860 of servicing a wellbore is described. At block 1862, a wellbore servicing fluid is placed downhole. For example, a cement slurry is pumped down a casing situated in the wellbore and up an annulus situated between the casing and a wall of the wellbore. At block 1864, a plug comprising MEMS sensors is placed downhole. For example, a wiper plug comprising MEMS sensors is pumped down the casing. In an embodiment, the wiper plug comprises MEMS sensors at a downhole end of the wiper plug configured to engage with a float collar that is coupled to the casing and situated proximate to a downhole end of the casing. The MEMS sensors are configured to measure pressure and/or location/position within the wellbore, and correspondingly provide pressure and/or location information for the plug. At block 1866, pumping of the plug is discontinued when a pressure measured by the MEMS sensors exceeds a threshold value, for example as a result of the plug coming into contact with or engaging a seat (e.g., the wiper plug seating on the float collar).

Figure 28A:
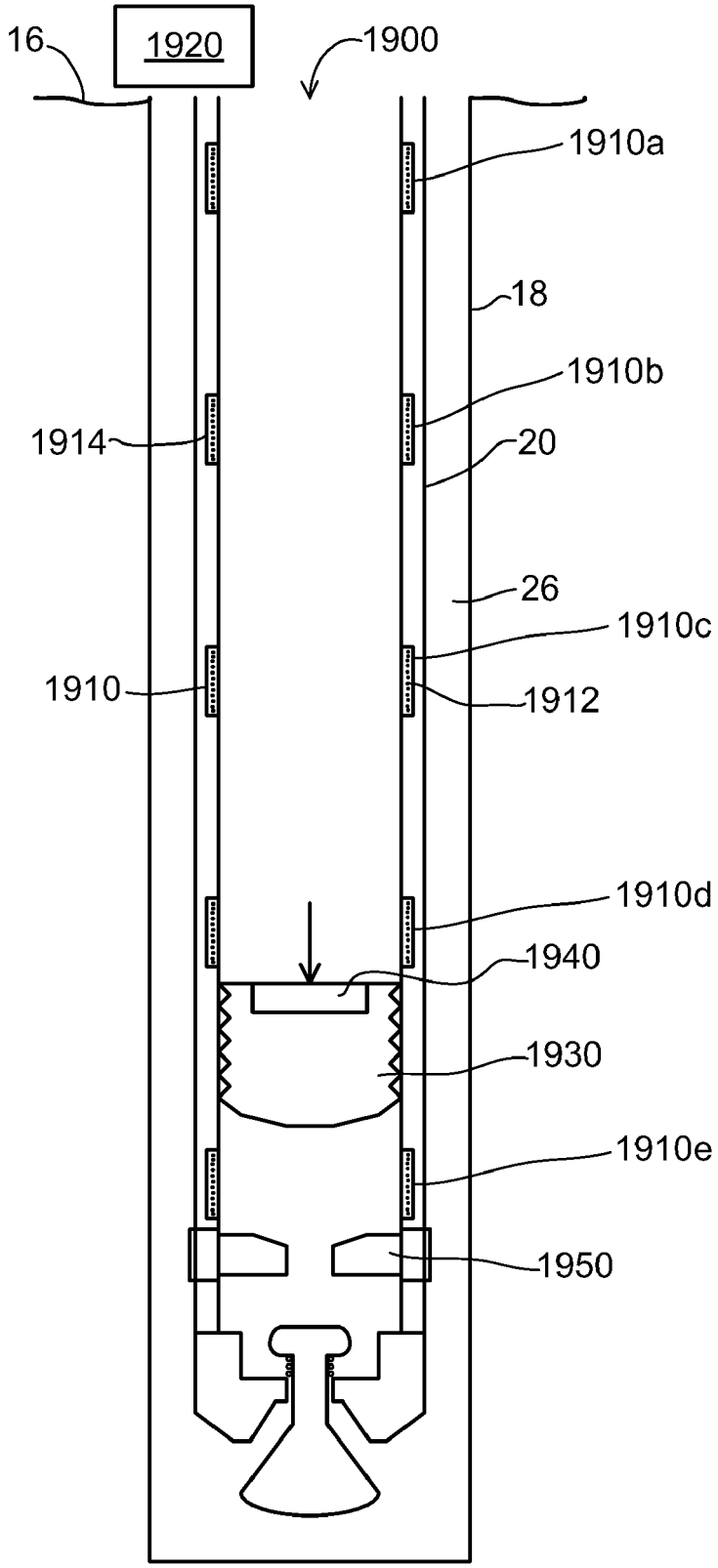

FIG. 28*a* illustrates an embodiment of a wellbore parameter sensing system 1900, which comprises the wellbore 18, the casing 20 situated in the wellbore 18, a plurality of MEMS sensor strips 1910 attached to and/or housed within the casing 20 and spaced along a length of the casing 20, a processing unit 1920 situated at an exterior of the casing, and a plug 1930 situated inside of the casing 20. In an embodiment, the MEMS sensor strips 1910 comprise a composite resin material, with which MEMS sensors 1912 are mixed, and which may be molded to the casing 20, for example to an interior and/or outer wall of the casing or within a hollow or void space defined by the casing or a component thereof (e.g., a pocket or void space within a casing collar). In an embodiment, the MEMS sensor strips 1910 are located in grooves, recessions, scallops, channels or the like on the interior wall of the casing and form a flush interface with the interior wall of the casing such that the interior diameter of the casing is not adversely affected (e.g., roughened, restricted, etc.) by the presence of the MEMS sensor strips 1910. In an embodiment as shown in FIG. 28*a*, the MEMS sensor strips 1910 may be embedded in grooves 1914 in the inner wall of the casing 20 so as not to protrude from the inner wall of the casing 20. In an embodiment, the MEMS sensor strips 1910 may be mounted flush with the inner wall of the casing 20. In a further embodiment, the MEMS sensor strips 1910 may be attached to casing collars. The MEMS sensors 1912 may be passive sensors or active sensors and may be configured to measure at least one wellbore parameter, e.g., a vertical position of the MEMS sensors 1912 along the casing 20 or an ambient condition (e.g., environmental condition) within the wellbore.

In an embodiment, a plug 1930 (e.g., a wiper plug) may comprise a data interrogation unit 1940, which is configured to interrogate MEMS sensors 1912 in a vicinity of the data interrogation unit 1940. The data interrogation unit 1940 may be molded to the wiper plug 1930 using a composite resin material or may be otherwise housed by, coupled to, or integral with the plug 1930. In an embodiment, the data interrogation unit 1940 may be powered by a rechargeable battery, for example a lithium ion battery. The battery may be charged prior to and/or after placement of the data interrogation unit into the wellbore. For example, a battery charger (e.g., inductive charger) may be lowered into the wellbore periodically to charge batteries associated with the data interrogation units and/or the MEMS sensors (e.g., active sensors). In an embodiment, the battery is capable of powering the data interrogation units for at least 1, 2, 3, or 4 weeks. In an embodiment, the data interrogation unit 1940 is powered by transport of the plug 1930 though the wellbore, for example via fluid flow through the plug driving a power generator. In a further embodiment, the data interrogation unit 1940 may be powered by a wireline run between the data interrogation unit 1940 and a power supply situated at the exterior of the wellbore.

In operation, the plug 1930 may be pumped down the casing by pumping a displacement fluid into and down the casing 20 directly in back of the plug 1930. As the plug 1930 nears and passes the MEMS sensor strips 1910, the data interrogation unit 1940 interrogates the MEMS sensors 1912 in the respective strips 1910 and receives data from the MEMS sensors 1912 regarding at least the vertical position of the MEMS sensors 1912 in the casing 20, and correspondingly the position of the plug 1930 in the wellbore. For example, as the plug 1930 passes through the wellbore, the data interrogation unit may successively identify the presence of the MEMS sensor strips 1910, and the position of the plug 1930 may be determined for example by counting the number of strips 1910 passed (e.g., where a location of one or more strips is known and/or the distance between strips is known) and/or by employing one or more unique identifiers with the MEMS sensors (e.g., strips 1910*a, b, c, d*, and *e* have corresponding unique identifies A, B, C, D, and E, and the location of a strip having a given identifier is known). The data interrogation unit 1940 may then transmit the sensor data to the processing unit 1920 for further processing, for example look-up or correlation of MEMS sensor identifiers with known locations in the wellbore. When the data interrogation unit 1940 reaches the MEMS sensor strip 1910 proximate to and/or integral with a seat such as a float collar 1950 positioned in the casing 20, the data regarding the vertical position of the MEMS sensors 1912 in this MEMS sensor strip 1910 may be transmitted to the data interrogation unit 1940 and the processor 1920 and give the processor 1920 an indication that the plug 1930 has engaged/seated (e.g., the wiper plug as landed on the float collar 1950 or is very close to landing on the float collar 1950). In response to receiving this data, the processor 1920 may cause pumping of the displacement fluid to be controlled (e.g., slowed and/or terminated).

In an embodiment, the data interrogation unit 1940 may transmit sensor data to the processor 1920 via a data line that is attached to the data interrogation unit 1940 and the processor 1920 and follows the data interrogation unit 1940 into the wellbore 18. In a further embodiment, the data interrogation unit 1940 may transmit sensor data to the processor 1920 via regional communication boxes attached to the casing and spaced along a length of the casing. In alternative embodiments, the data interrogation unit may employ wireless communication, for example a MEMS sensor network where MEMS sensors are located in a wellbore servicing fluid proximate the plug (e.g., in a cement slurry located in front of the plug) and/or via telemetry induced via contact with the casing (e.g., during pumping and/or upon seating in the float collar).

In an embodiment, the MEMS sensors 1912 in the MEMS sensor strips 1910 may be configured to measure a concentration of a gas in the casing 20 along the length of the casing 20 and transmit data regarding the gas concentration to the processor 1920 via communication boxes attached to the casing and spaced along a length of the casing or any other communication means disclosed herein. The gas may comprise, for example, $CH_4$, $H_2S$ and/or $CO_2$. In an embodiment, from measured methane concentrations along the length of the casing 20, the MEMS sensors 1912 may provide an indication, for example, that methane is advancing rapidly up the casing 20, so that necessary emergency actions may be taken, e.g., signaling for the closing of one or more emergency or safety valves or blowout preventors.

In a further embodiment, a wellbore servicing fluid (e.g., cement composition) comprising a plurality of MEMS sensors may be placed into the casing. The MEMS sensors may be suspended in and distributed throughout the wellbore servicing fluid (e.g., cement slurry and/or set cement forming a cement sheath). The MEMS sensors (e.g., in strips 1910 and/or in the wellbore servicing composition) may measure at least one wellbore parameter and transmit data regarding the wellbore parameter to the processor 1920 via a network consisting of the MEMS sensors in the wellbore servicing fluid and/or the MEMS sensors 1912 situated in the MEMS sensor strips 1910.

Figure 28B:
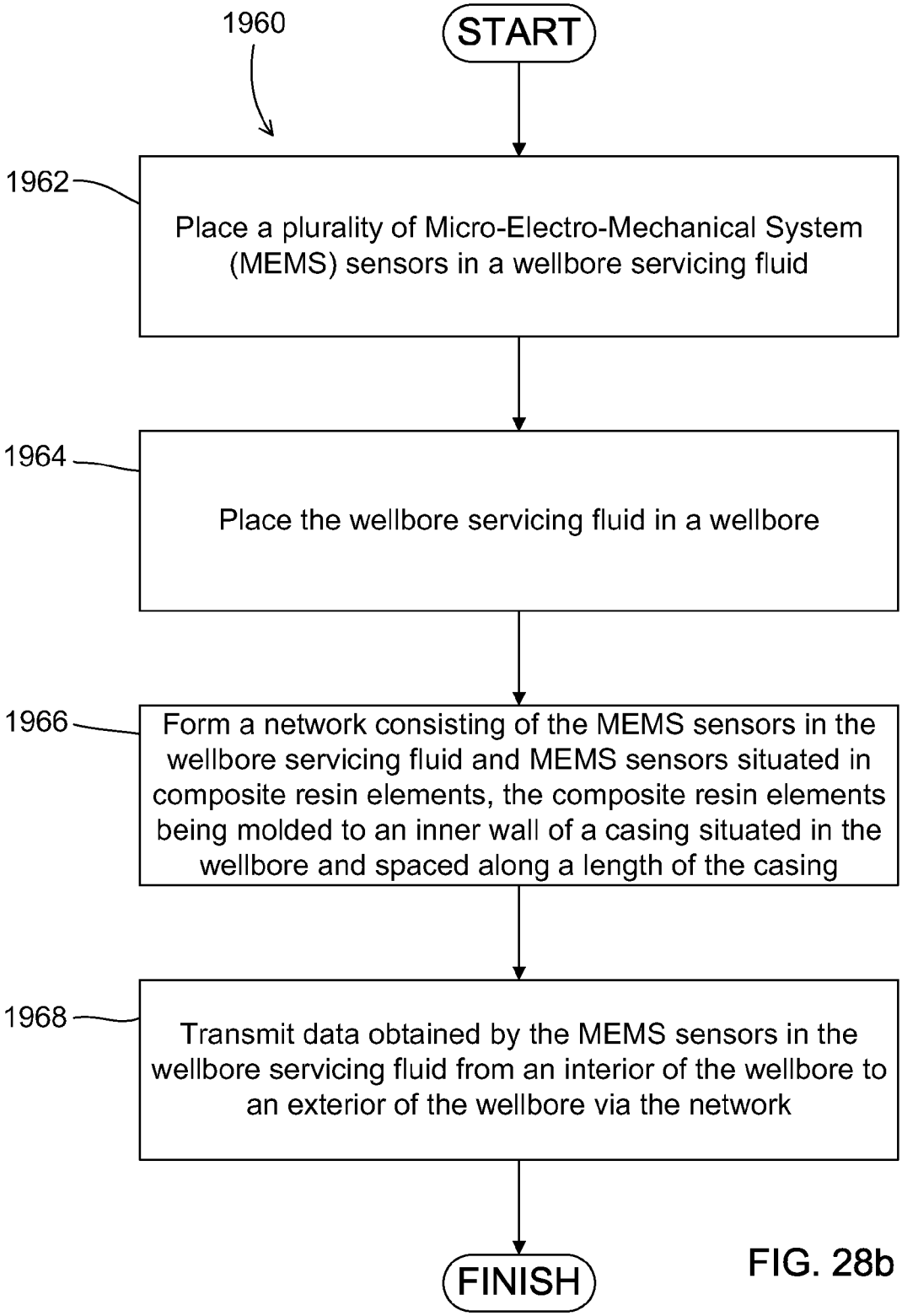

Referring to FIG. 28*b*, a method 1960 of servicing a wellbore is described. At block 1962, a plurality of Micro-Electro-Mechanical System (MEMS) sensors is optionally placed in a wellbore servicing fluid, e.g., a cement composition. At block 1964, the wellbore servicing fluid is placed in the wellbore. In addition to or in lieu of MEMS sensors in the wellbore servicing fluid, the wellbore further comprises MEMS sensors disposed in one or more composite resin or composite elements. For example, the composite resin elements may be molded to an inner wall of a casing situated in the wellbore and spaced along a length of the casing. At block 1966, a network consisting of the MEMS sensors in the wellbore is formed (e.g., network of MEMS sensors in the wellbore servicing fluid and/or contained within one or more resin or composite elements. At block 1968, data obtained by the MEMS sensors in the wellbore is transmitted from an interior of the wellbore to an exterior of the wellbore via the network. In embodiments, the data may be obtained from the MEMS sensors via one or more data interrogators present in a wellbore servicing tool run into the wellbore prior to, concurrent with, and/or subsequent to the wellbore servicing operation. In an embodiment, the one or more data interrogation units is integral with a wiper plug pumped behind a cement slurry.

In an embodiment, a cement composition is pumped into a wellbore, followed by a wiper plug having a data interrogation unit integral therewith, and a float collar having MEMS sensors integral therewith is located at a terminal end of the casing, wherein engagement of the wiper plug with the float collar is signaled from downhole to the surface (e.g., via various communication means/networks as described herein) by the MEMS sensors interacting with the interrogation unit such that pumping of the cement composition may be controlled in response to the position of the wiper plug conveyed from downhole to the surface.

Figure 29A:
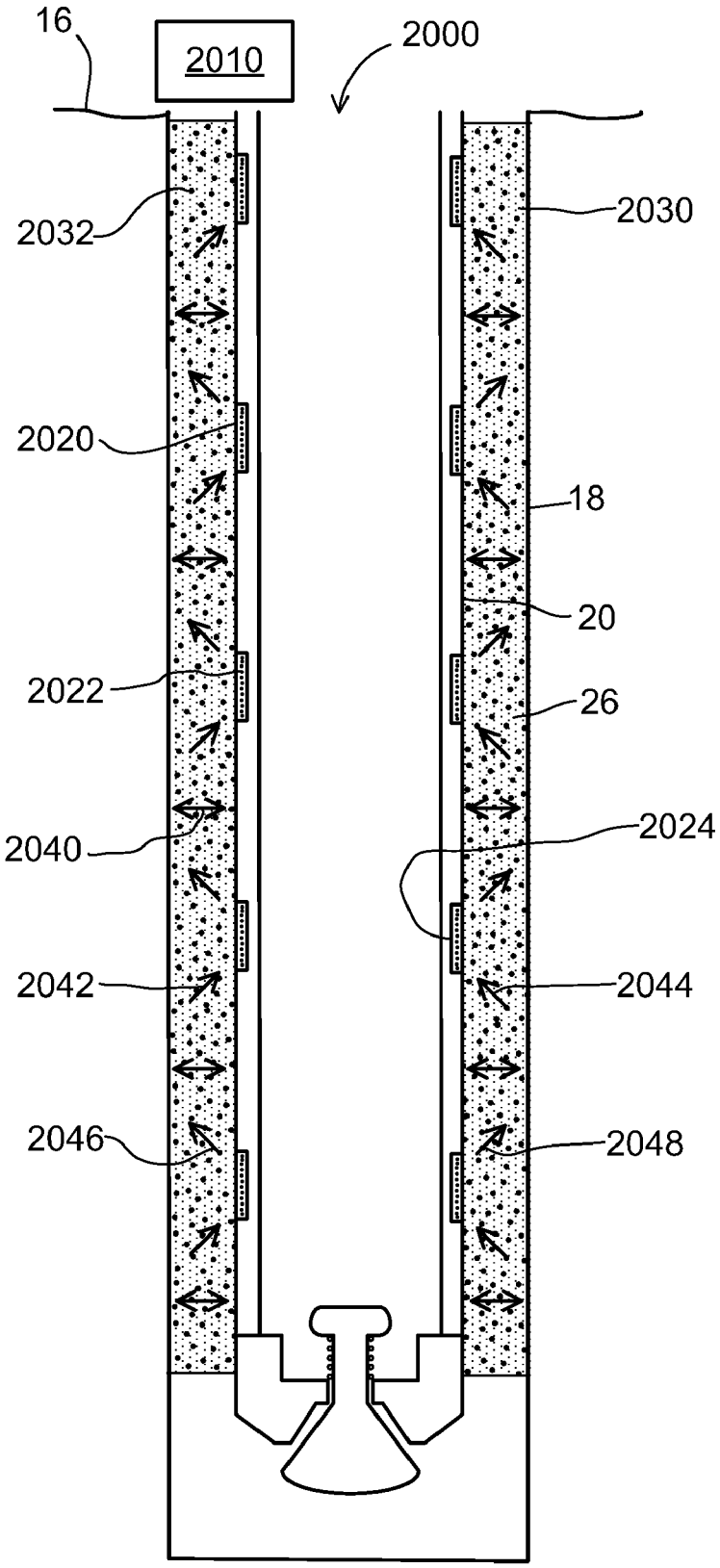

FIG. 29*a* is a schematic view of an embodiment of a wellbore parameter sensing system 2000, which comprises the wellbore 18, the casing 20 situated in the wellbore 18, a processing unit 2010 situated at an exterior of the wellbore 18 and a plurality of MEMS sensor strips 2020 attached to the casing 20 and spaced along a length of the casing 20. In an embodiment, the MEMS sensor strips 2020 comprise a composite resin material, in which MEMS sensors 2022 are mixed and distributed, and which may be molded to the casing 20. As shown in FIG. 29*a*, the sensor strips 2022 may be located on an exterior wall or surface of the casing 20 (e.g., a side facing or adjacent the wellbore wall). The sensor strips 2022 may be disposed with in the casing wall (e.g., outer surface) in accordance with sensor strips 1910 of FIG. 28*a*, which are shown by way of non-limiting example on an interior surface or wall of casing 20. In an embodiment, the MEMS sensor strips 2020 may be embedded in grooves 2024 in the outer wall of the casing 20 so as not to protrude from the outer wall of the casing 20. In an embodiment, the MEMS sensor strips 2020 may be mounted flush with the outer wall of the casing 20. In a further embodiment, the MEMS sensor strips 2020 may be attached to casing collars. In an embodiment, a wellbore servicing fluid, e.g., a cement slurry comprising MEMS sensors 2032 mixed and distributed in the cement slurry, may be placed into the annulus 26 and, in the case of the cement slurry, allowed to cure to form a cement sheath 2030.

The MEMS sensors 2022 and/or 2032 may be active sensors, e.g., powered by batteries situated in the MEMS sensors. The batteries in the MEMS sensors may be inductively rechargeable by a recharging unit lowered into the casing 20 via a wireline. In embodiments, the MEMS sensors are powered and/or queried/interrogated by one or more interrogation units in the wellbore (fixed units and/or mobile units) as described in various embodiments herein. In addition, the MEMS sensors 2022 and/or 2032 may be configured to measure at least one wellbore parameter, e.g., a concentration of a gas such as $CH_4$, $H_2S$ or $CO_2$ in the annulus 26. Such gas detecting capability may be further used to monitor a cement composition placed in the annulus, for example monitoring for gas inflow/channeling while the slurry is being placed and/or monitoring for the presence of annular gas over the life of the wellbore (which may indicate cracks, delamination, etc. of the cement sheath thus requiring remedial servicing). In an embodiment, from measured methane concentrations in the annulus 26 along a length of the casing 20, the MEMS sensors 2022 and/or 2032 may provide an indication, for example, that methane is advancing rapidly up the annulus 26, so that necessary emergency actions may be taken.

In operation, in an embodiment, the MEMS sensors 2032 in the cement sheath 2030 and/or the MEMS sensors in strips 2020 may measure the at least one wellbore parameter and transmit data regarding the at least one wellbore parameter up the annulus 26 to the processing unit 2010 via a network consisting of the MEMS sensors 2032 and/or the MEMS sensors 2022. For example, the MEMS sensors may be powered up and/or interrogated by a mobile interrogation unit run into the wellbore, for example via a plug pumped into the wellbore (e.g., a wiper plug) and/or an interrogation tool deployed by wireline or coiled tubing. Double arrows 2040 indicate transmission of sensor data between neighboring MEMS sensors 2032, arrows 2042, 2044 indicate transmission of sensor data up the annulus 26 from MEMS sensors 2032 to MEMS sensors 2022, and arrows 2046, 2048 indicate transmission of sensor data up the annulus 26 from MEMS sensors 2022 to MEMS sensors 2032.

Figure 29B:
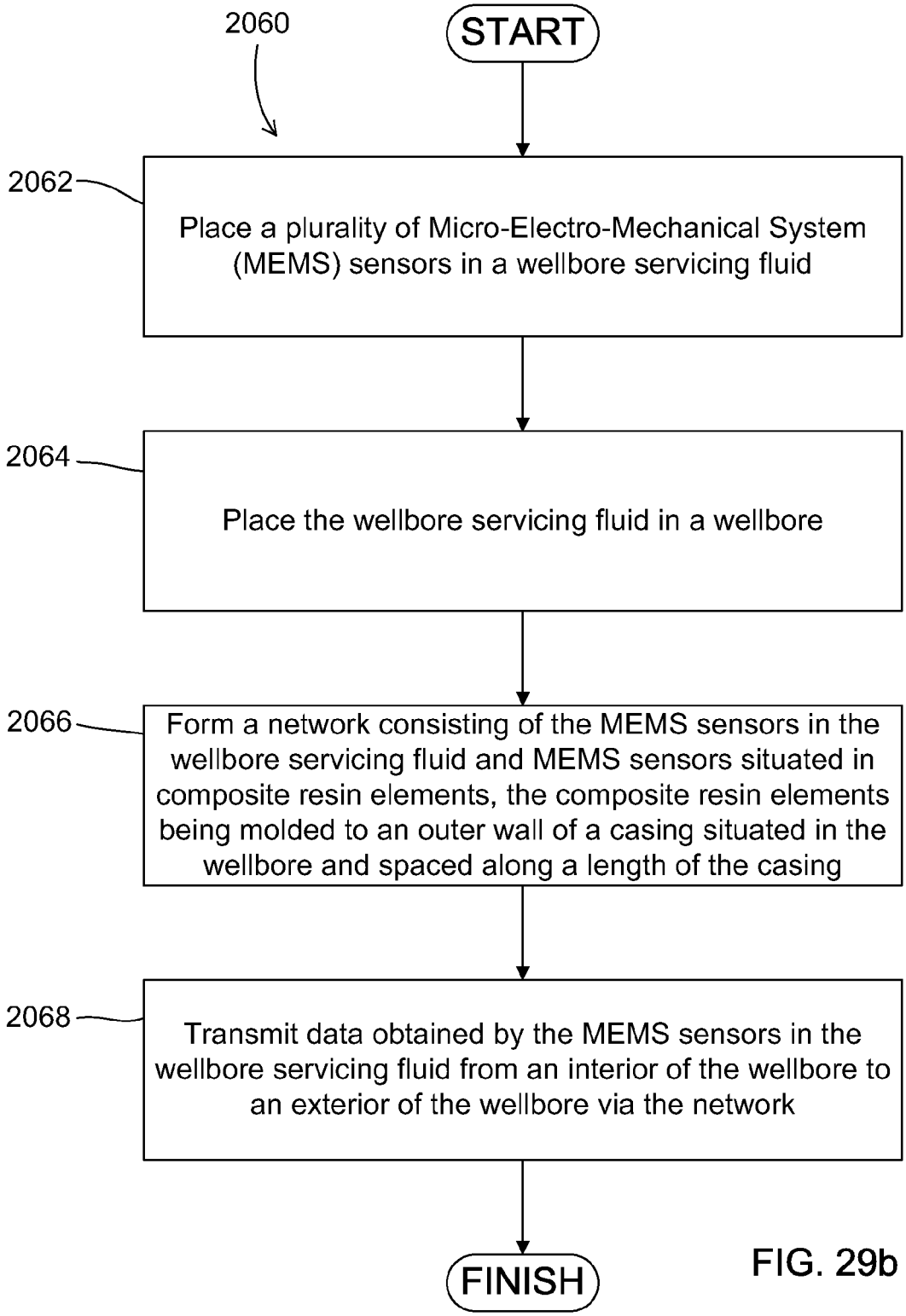

Referring to FIG. 29*b*, a method 2060 of servicing a wellbore is described. At block 2062, a plurality of Micro-Electro-Mechanical System (MEMS) sensors is placed in a wellbore servicing fluid and/or within one or more resin/composite elements disposed in the wellbore. At block 2064, the wellbore servicing fluid is placed in the wellbore. At block 2066, a network consisting of the MEMS sensors in the wellbore servicing fluid and/or MEMS sensors situated in composite resin elements is formed. In an embodiment, the composite resin elements are molded to an inner and/or outer wall of a casing situated in the wellbore and spaced along a length of the casing. At block 2068, data is obtained from the MEMS sensors in the wellbore servicing fluid and/or resin/composite elements via one or more data interrogation units in the wellbore and is transmitted from an interior of the wellbore to an exterior of the wellbore via the network. In an alternative embodiment, MEMS sensor data is collected and stored by a mobile data interrogation unit that traverses the wellbore and is retrieved to the surface, which may be used in addition to or in lieu of the MEMS sensor network to transmit sensor data to the surface.

Figure 30A:
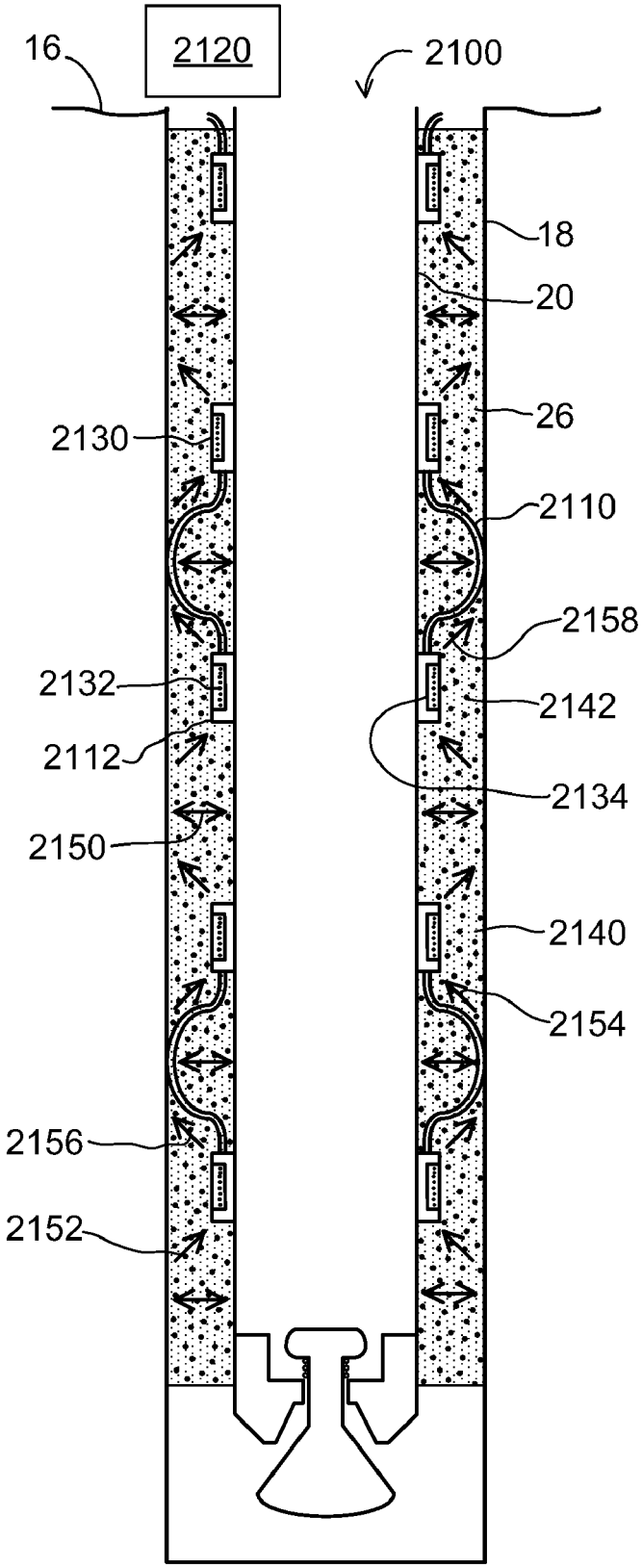

FIG. 30*a* is a schematic view of an embodiment of a wellbore parameter sensing system 2100, which comprises the wellbore 18, the casing 20 situated in the wellbore 18, a plurality of centralizers 2110 situated between the casing 20 and the wellbore 18 and spaced along a length of the casing 20, and a processing unit 2120 situated at an exterior of the wellbore 18. In an embodiment, the centralizers are bow-spring type centralizers comprising a plurality of bows extending between upper and lower collars. In an embodiment, the centralizers 2110 may comprise MEMS sensor strips 2130, which for example are attached to at least one component (e.g., collar 2112) of each centralizer 2110. The MEMS sensor strips 2130 may comprise a composite resin material, in which MEMS sensors 2132 are mixed and distributed, and which may be molded to and/or integral with the collars 2112. In an embodiment, the MEMS sensor strips 2130 may be embedded in channels or grooves 2134 in the collars 2112 so as not to protrude from the collars 2112. In an embodiment, the MEMS sensor strips 2130 may be mounted flush with the collars 2112. In an embodiment, a wellbore servicing fluid, e.g., a cement slurry comprising MEMS sensors 2142 mixed and distributed in the cement slurry, may be placed into the annulus 26 and, in the case of the cement slurry, allowed to cure to form a cement sheath 2140. While FIG. 30*a* shows the use of a centralizer in conjunction with casing, it should be understood that centralizers containing MEMS and/or data interrogation units as described herein may be used to position any type of downhole tool or servicing string (e.g., production tubing, etc.), and may be used in cased and/or uncased wellbores.

In an embodiment, the MEMS sensors 2132 may be active sensors, e.g., powered by batteries situated in the MEMS sensors 2132. The batteries in the MEMS sensors 2132 may be inductively rechargeable by a recharging unit lowered into the casing 20 via a wireline. In embodiments, the MEMS sensors are powered and/or queried/interrogated by one or more interrogation units in the wellbore (fixed units and/or mobile units) as described in various embodiments herein. The MEMS sensors 2142 situated in the cement slurry 2140 and/or the MEMS sensors 2132 in the centralizers may be configured to measure at least one wellbore parameter, e.g., a stress or strain and/or a moisture content and/or a $CH_4$, $H_2S$ or $CO_2$ concentration and/or a $Cl^-$ concentration and/or a temperature. In an embodiment, the MEMS sensors 2132 and/or 2142 may be configured to measure a concentration of a gas such as $CH_4$, $H_2S$ or $CO_2$ in the annulus 26. Such gas detecting capability may be further used to monitor a cement composition placed in the annulus, for example monitoring for gas inflow/channeling while the slurry is being placed and/or monitoring for the presence of annular gas over the life of the wellbore (which may indicate cracks, delamination, etc. of the cement sheath thus requiring remedial servicing). In an embodiment, from measured methane concentrations in the annulus 26 along a length of the casing 20, the MEMS sensors 2132 and/or 2142 may provide an indication, for example, that methane is advancing rapidly up the annulus 26, so that necessary emergency actions may be taken.

In operation, in an embodiment, the MEMS sensors 2142 in the cement sheath 2140 and/or the MEMS sensors 2132 in the centralizers may measure the at least one wellbore parameter and transmit data regarding the at least one wellbore parameter up the annulus 26 to the processing unit 2120 via a network consisting of the MEMS sensors 2142 and/or the MEMS sensors 2132. For example, the MEMS sensors may be powered up and/or interrogated by a mobile interrogation unit run into the wellbore, for example via a plug pumped into the wellbore (e.g., a wiper plug) and/or an interrogation tool deployed by wireline or coiled tubing. Double arrows 2150 indicate transmission of sensor data between neighboring MEMS sensors 2142, arrows 2152, 2154 indicate transmission of sensor data up the annulus 26 from MEMS sensors 2142 to MEMS sensors 2132, and arrows 2156, 2158 indicate transmission of sensor data up the annulus 26 from MEMS sensors 2132 to MEMS sensors 2142.

Figure 30B:
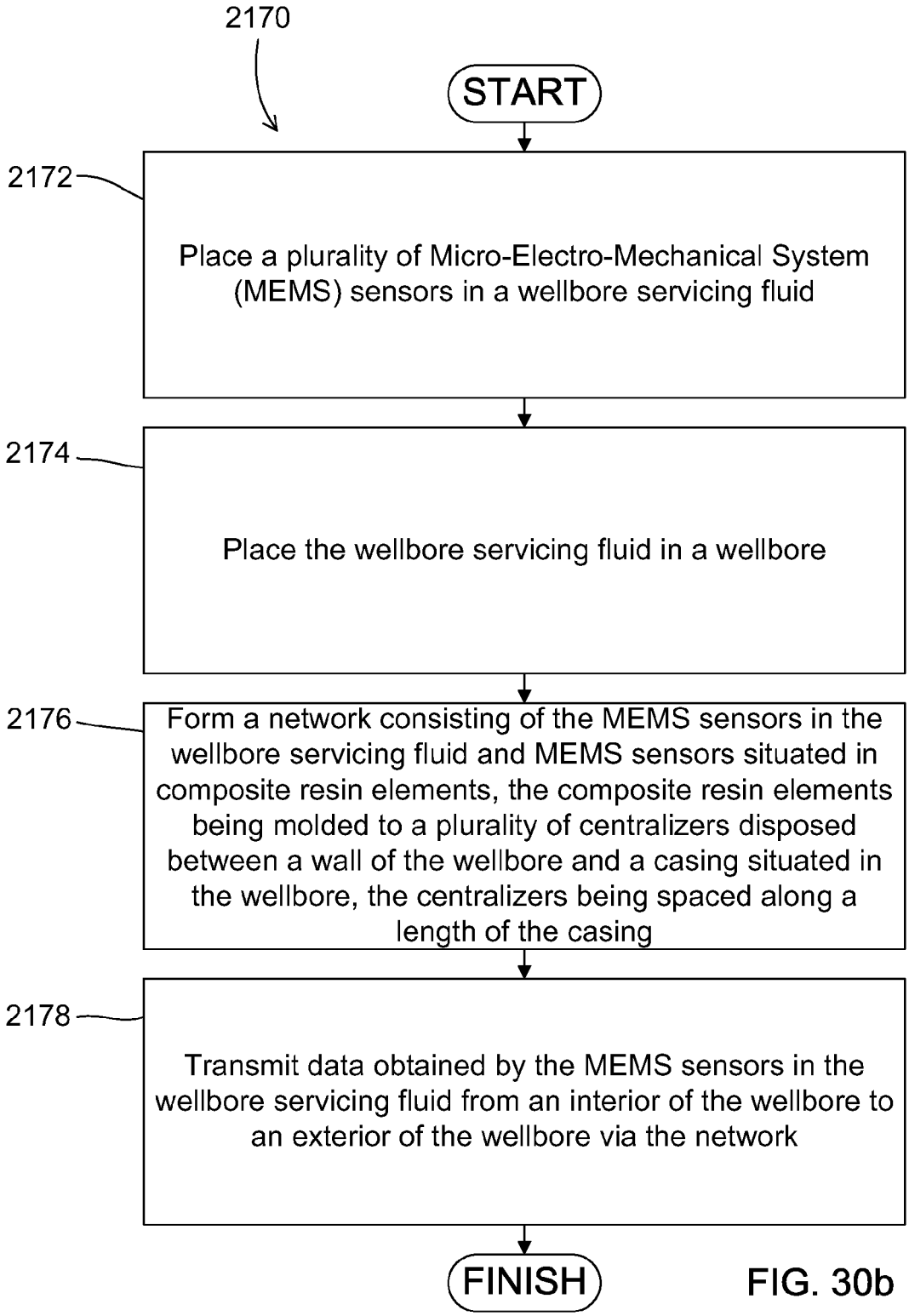

Referring to FIG. 30*b*, a method 2170 of servicing a wellbore is described. At block 2172, a plurality of Micro-Electro-Mechanical System (MEMS) sensors is placed in a wellbore servicing fluid and/or within one or more centralizers disposed in the wellbore. At block 2174, the wellbore servicing fluid is placed in the wellbore. At block 2176, a network consisting of the MEMS sensors in the wellbore servicing fluid and/or MEMS sensors situated in one or more centralizers is formed. For example, one or more composite resin elements are molded to or otherwise formed integral with (e.g., molded with) a plurality of centralizers disposed between a wall of the wellbore and a casing situated in the wellbore. The centralizers are spaced along a length of the casing. At block 2178, data obtained from the MEMS sensors in the wellbore servicing fluid and/or in the centralizers via one or more data interrogation units in the wellbore and is transmitted from an interior of the wellbore to an exterior of the wellbore via the network. In an alternative embodiment, MEMS sensor data is collected and stored by a mobile data interrogation unit that traverses the wellbore and is retrieved to the surface, which may be used in addition to or in lieu of the MEMS sensor network to transmit sensor data to the surface.

Figure 31:
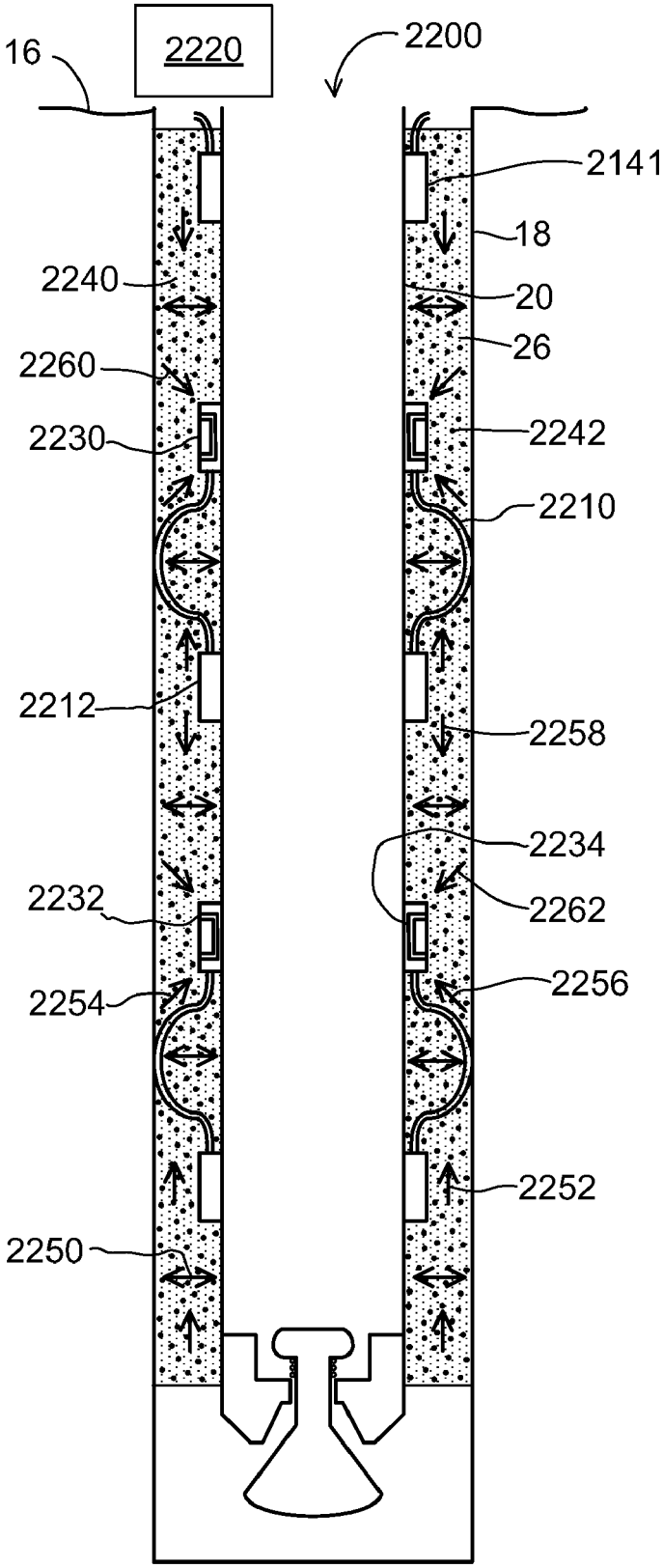

FIG. 31 is a schematic view of an embodiment of a wellbore parameter sensing system 2200, which comprises the wellbore 18, the casing 20 situated in the wellbore 18, a plurality of centralizers 2210 situated between the casing 20 and the wellbore 18 and spaced along a length of the casing 20, and a processing unit 2220. In an embodiment, the centralizers 2210 may comprise data interrogation units 2230, which for example are attached to at least one component (e.g., collar 2212) of each centralizer 2210. In an embodiment, the data interrogation units 2230 may be molded to the collars 2212, using a composite resin material 2232. The data interrogation units 2230 may be embedded in channels or grooves 2234 in the collars 2212 so as to not protrude from the collars 2212. In an embodiment, the data interrogation units 2230 may be mounted flush with the collars 2212. In an embodiment, a wellbore servicing fluid, e.g., a cement slurry comprising MEMS sensors 2242 mixed and distributed in the cement slurry, may be placed into the annulus 26 and, in the case of the cement slurry, allowed to cure to form a cement sheath 2240. In an embodiment, data interrogation units 2230 are used to capture MEMS sensor data for use in fluid flow dynamic analysis as described herein (e.g., measuring turbulence of flow around/through the centralizers 2210).

In an embodiment, the data interrogation units 2230 may be powered by an electrical line that may run along an outer wall of the casing 20 and couples each data interrogation unit 2230 with a power supply at an exterior of the wellbore 18. In an alternative embodiment, the electrical line may run inside a longitudinal groove in the casing 20. In a further embodiment, the data interrogation units 2230 may be powered by batteries. The batteries may be inductively rechargeable via a recharging unit that is lowered down the casing 20 on a wire line. In other embodiments, the data interrogation units 2230 may be powered by one or more downhole power sources (e.g., fluid flow, heat, etc.).

In an embodiment, the data interrogation units 2230 may wirelessly communicate with each other and with the processing unit 2220. In an alternative embodiment, the data interrogation units 2230 may communicate with each other and with the processing unit 2220 via a data line that may run along the casing 20, outside of the casing 20, and couples each data interrogation unit 2230 with the processing unit 2220. In a further embodiment, the data interrogation units 2230 may communicate with each other and with the processing unit 2220 via a data line that runs inside a groove in the casing and couples the data interrogation units 2230 with each other and the processing unit 2220. The data interrogation units may further communicate with each other via various networks disclosed herein, for example a network of MEMS sensors 2242, a network of data interrogation units 2230, and/or via one or more regional data interrogation units/or communication hubs such as unit 2141 (which may communicate wirelessly downhole and via wire to the surface). In embodiments, the data interrogation units 2230 may operate (e.g., gather and/or communicate data) via one or more means or modes as described with respect to FIGS. 5-16.

In an embodiment, the MEMS sensors 2242 may be active sensors, e.g., powered by batteries situated in the MEMS sensors 2242. The batteries in the MEMS sensors 2242 may be inductively rechargeable by a recharging unit lowered into the casing 20 via a wireline. In embodiments, the MEMS sensors are powered and/or queried/interrogated by one or more interrogation units in the wellbore (fixed units 2230 and/or mobile units) as described in various embodiments herein. The MEMS sensors 2242 situated in the cement slurry 2240 may be configured to measure at least one wellbore parameter, e.g., a stress or strain and/or a moisture content and/or a $CH_4$, $H_2S$ or $CO_2$ concentration and/or a $Cl^-$ concentration and/or a temperature. In an embodiment, the MEMS sensors 2240 may be configured to measure a concentration of a gas such as $CH_4$, $H_2S$ or $CO_2$ in the annulus 26. Such gas detecting capability may be further used to monitor a cement composition placed in the annulus, for example monitoring for gas inflow/channeling while the slurry is being placed and/or monitoring for the presence of annular gas over the life of the wellbore (which may indicate cracks, delamination, etc. of the cement sheath thus requiring remedial servicing). In an embodiment, from measured methane concentrations in the annulus 26 along a length of the casing 20, the MEMS sensors 2240 may provide an indication, for example, that methane is advancing rapidly up the annulus 26, so that necessary emergency actions may be taken.

In operation, in an embodiment, the MEMS sensors 2242 in the cement sheath 2240 may measure the at least one wellbore parameter and transmit data regarding the at least one wellbore parameter directly and/or indirectly (e.g., via one or more adjacent MEMS sensors, e.g., daisy-chain) to data interrogation units 2230 situated in a vicinity of the MEMS sensors 2242. The data interrogation units 2230 may then transmit the sensor data wirelessly and/or via wire to the surface. In an embodiment the data interrogation units 2230 transmit the sensor data to neighboring data interrogation units 2230 (e.g., daisy-chain) and up the wellbore 18 to the processing unit and/or or transmit the sensor data through the data line, up the wellbore 18 and to the processing unit 2220. The processing unit may then process the sensor data. Double arrows 2250 indicate transmission of sensor data between neighboring MEMS sensors 2242; arrows 2254, 2256 indicate transmission of sensor data uphole from MEMS sensors 2242 to closest data interrogation units 2230; arrows 2260, 2262 indicate transmission of sensor data downhole from MEMS sensors 2242 to closest data interrogation units 2230; and arrows 2252, 2258 represent the transmission of data up and down the wellbore, for example via a network of interrogation units 2230 and/or MEMS sensors 2242.

In an embodiment, MEMS sensors and/or one or more data interrogation units may be molded into a casing shoe, e.g., a guide shoe or a float shoe, and used to measure at least one parameter of a wellbore in which the casing shoe is situated. The casing shoe may be made of a homogeneous material, for example, a plastic such as a thermoplastic material or a thermoset material. In addition, the casing shoe may be formed by injection molding, thermal casting, thermal molding, extrusion molding, or any combination of these methods. Examples of thermoplastic and thermoset materials suitable for forming the casing shoe may be found in U.S. Pat. No. 7,617,879, which is hereby incorporated by reference herein in its entirety.

In an embodiment, the MEMS sensors and/or data interrogation units may be molded into the thermoplastic or thermoset material of the casing shoe such that at least a portion of the MEMS sensors are situated at or immediately proximate to an outer surface of the casing shoe and are able to measure a parameter of the wellbore, e.g., a stress or strain and/or a moisture content and/or a $CH_4$, $H_2S$ or $CO_2$ concentration and/or a $Cl^-$ concentration and/or a temperature.

It should be noted that any of the embodiments of FIGS. 27-31 may be combined with embodiments where MEMS sensors are contained in one or more wellbore servicing fluids or compositions, for example the embodiments of FIGS. 5-26. Where MEMS sensors are employed in at least one wellbore servicing fluid or composition in combination with MEMS sensors combined into one or more wellbore servicing equipment or tools, the MEMS sensors may be the same or different (e.g., Type "A", "B", etc.), and such combinations of same and/or different sensor may be used to provide different or distinct signals to the data interrogators, for example as described in relation to the embodiments of FIGS. 22-24, and such different or distinct signals may further facilitate action (e.g., changing, controlling, receiving, monitoring, etc.) with respect to one or more operational parameters or conditions of the downhole equipment and/or servicing operation.

In embodiments, one or more acoustic sensors may be used in combination with MEMS sensors and/or data interrogation units placed in the wellbore. For example, one or more acoustic sensors may be incorporated into data interrogation and communication units for MEMS sensors, in order to measure further wellbore parameters and/or provide further options for transmitting sensor data from an interior of a wellbore to an exterior of the wellbore.

Figure 32:
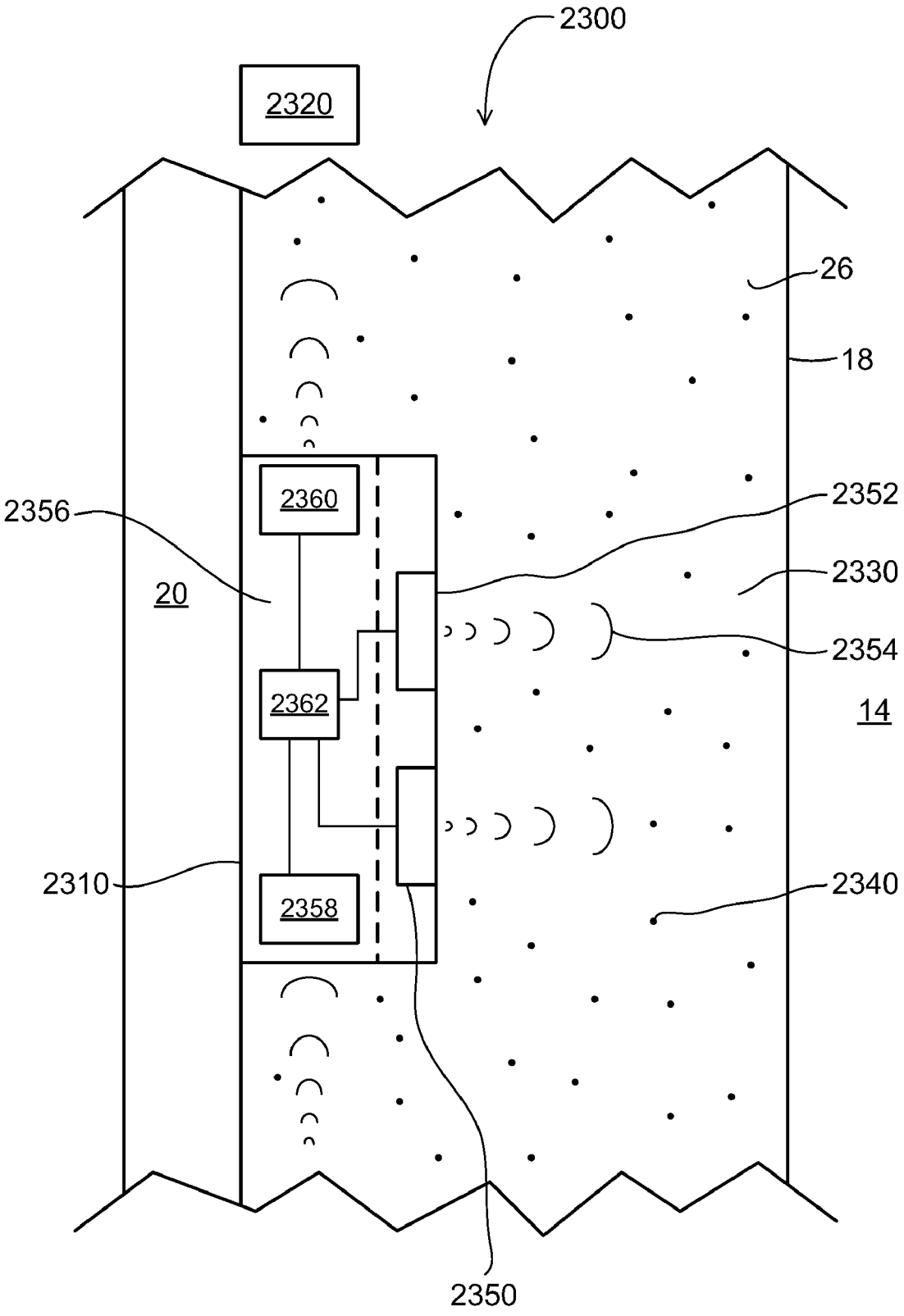
FIGS. 32 and 35 are schematic views of embodiments of a downhole interrogation/communication unit.

FIG. 32 illustrates an embodiment of a portion of a wellbore parameter sensing system 2300. The wellbore parameter sensing system 2300 comprises the wellbore 18, the casing 20 situated in the wellbore 18, a plurality of interrogation/communication units 2310 attached to the casing 20 and spaced along a length of the casing 20, a processing unit 2320 situated at an exterior of the wellbore and communicatively linked to the units 2310, and a wellbore servicing fluid 2330 situated in the wellbore 18. The wellbore servicing fluid 2330 may comprise a plurality of MEMS sensors 2340, which are configured to measure at least one wellbore parameter. In an embodiment, FIG. 32 represents an interrogation/communication unit 2310 located on an exterior of the casing 20 in annular space 26 and surrounded by a cement composition comprising MEMS sensors. The unit 2310 may further comprise a power source, for example a battery (e.g., lithium battery) or power generator. In embodiments, the components of unit 2310 are powered by any of the embodiments of FIGS. 33, 34, and 35 described herein.

In an embodiment, the unit 2310 may comprise an interrogation unit 2350, which is configured to interrogate the MEMS sensors 2340 and receive data regarding the at least one wellbore parameter from the MEMS sensors 2340. In an embodiment, the unit 2310 may also comprise at least one acoustic sensor 2352, which is configured to input ultrasonic waves 2354 into the wellbore servicing fluid 2330 and/or into the oil or gas formation 14 proximate to the wellbore 18 and receive ultrasonic waves reflected by the wellbore servicing fluid 2330 and/or the oil or gas formation 14. In an embodiment, the at least one acoustic sensor 2352 may transmit and receive ultrasonic waves using a pulse-echo method or pitch-catch method of ultrasonic sampling/testing. A discussion of the pulse-echo and pitch-catch methods of ultrasonic sampling/testing may be found in the NASA preferred reliability practice no. PT-TE-1422, "Ultrasonic Testing of Aerospace Materials," which is incorporated by reference herein in its entirety. In alternative embodiments, ultrasonic waves and/or acoustic sensors may be provided via the unit 2310 in accordance with one or more embodiments disclosed in U.S. Pat. Nos. 5,995,477; 6,041,861; or 6,712,138, each of which is incorporated herein in its entirety.

In an embodiment, the at least one acoustic sensor 2352 may be able to detect a presence and a position in the wellbore 18 of a liquid phase and/or a solid phase of the wellbore servicing fluid 2330. In addition, the at least one acoustic sensor 2352 may be able to detect a presence of cracks and/or voids and/or inclusions in a solid phase of the wellbore servicing fluid 2330, e.g., in a partially cured cement slurry or a fully cured cement sheath. In a further embodiment, the acoustic sensor 2352 may be able to determine a porosity of the oil or gas formation 14. In a further embodiment, the acoustic sensor 2352 may be configured to detect a presence of the MEMS sensors 2340 in the wellbore servicing fluid 2330. In particular, the acoustic sensor may scan for the physical presence of MEMS sensors proximate thereto, and may thereby be used to verify data derived from the MEMS sensors. For example, where acoustic sensor 2352 does not detect the presence of MEMS sensors, such lack of detection may provide a further indication that a wellbore servicing fluid has not yet arrived at that location (for example, has not entered the annulus). Likewise, where acoustic sensor 2352 does detect the presence of MEMS sensors, such presence may be further verified by interrogation on the MEMS sensors. Furthermore, a failed attempt to interrogate the MEMS sensors where acoustic sensor 2352 indicates their presence may be used to trouble-shoot or otherwise indicate that a problem may exist with the MEMS sensor system (e.g., a fix data interrogation unit may be faulty thereby requiring repair and/or deployment of a mobile unit into the wellbore). In various embodiments, the acoustic sensor 2352 may perform any combination of the listed functions.

In an embodiment, the acoustic sensor 2352 may be a piezoelectric-type sensor comprising at least one piezoelectric transducer for inputting ultrasonic waves into the wellbore servicing fluid 2330. A discussion of acoustic sensors comprising piezoelectric composite transducers may be found in U.S. Pat. No. 7,036,363, which is hereby incorporated by reference herein in its entirety.

In an embodiment, the interrogation/communication unit 2310 may further comprise an acoustic transceiver 2356. The acoustic transceiver 2356 may comprise an acoustic receiver 2358, an acoustic transmitter 2360 and a microprocessor 2362. The microprocessor 2362 may be configured to receive MEMS sensor data from the interrogation unit 2350 and/or acoustic sensor data from the at least one acoustic sensor 2352 and convert the sensor data into a form that may be transmitted by the acoustic transmitter 2360.

In an embodiment, the acoustic transmitter 2360 may be configured to transmit the sensor data from the MEMS sensors 2340 and/or the acoustic sensor 2352 to an interrogation/communication unit situated uphole (e.g., the next unit directly uphole) from the unit 2310 shown in FIG. 32. The acoustic transmitter 2360 may comprise a plurality of piezoelectric plate elements in one or more plate assemblies configured to input ultrasonic waves into the casing 20 and/or the wellbore servicing fluid 2330 in the form of acoustic signals (for example to provide acoustic telemetry communications/signals as described in various embodiments herein). Examples of acoustic transmitters comprising piezoelectric plate elements are given in U.S. Patent Application Publication No. 2009/0022011, which is hereby incorporated by reference herein in its entirety.

In an embodiment, the acoustic receiver 2358 may be configured to receive sensor data in the form of acoustic signals from one or more acoustic transmitters disposed in one or more interrogation/communication units situated uphole and/or downhole from the unit 2310 shown in FIG. 32. In addition, the acoustic receiver 2358 may be configured to transmit the sensor data to the microprocessor 2362. In embodiments, a microprocessor or digital signal processor may be used to process sensor data, interrogate sensors and/or interrogation/communication units and communicate with devices situated at an exterior of a wellbore. For example, the microprocessor 2362 may then route/convey/retransmit the received data (and additionally/optionally convert or process the received data) to the interrogation/communication unit situated directly uphole and/or downhole from the unit 2310 shown in FIG. 32. Alternatively, the received sensor data may be passed along to the next interrogation/communication unit without undergoing any transformation or further processing by microprocessor 2362. In this manner, sensor data acquired by interrogators 2350 and acoustic sensors 2352 situated in units 2310 disposed along at least a portion of the length of the casing 20 may be transmitted up or down the wellbore 18 to the processing unit 2320, which is configured to process the sensor data.

Figure 33:
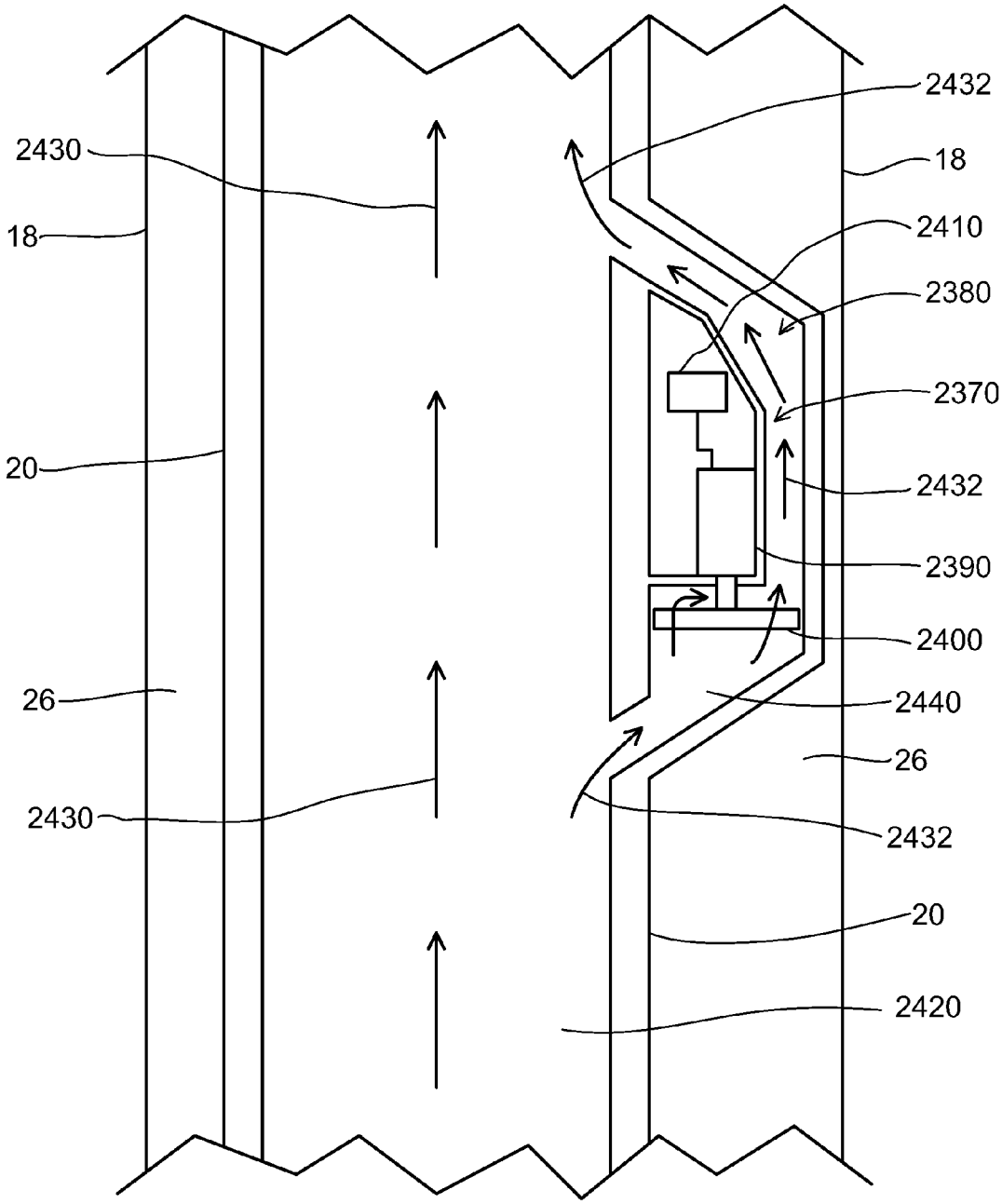
FIGS. 33 and 34 are schematic views of embodiment of a downhole power generator.
Figure 34:
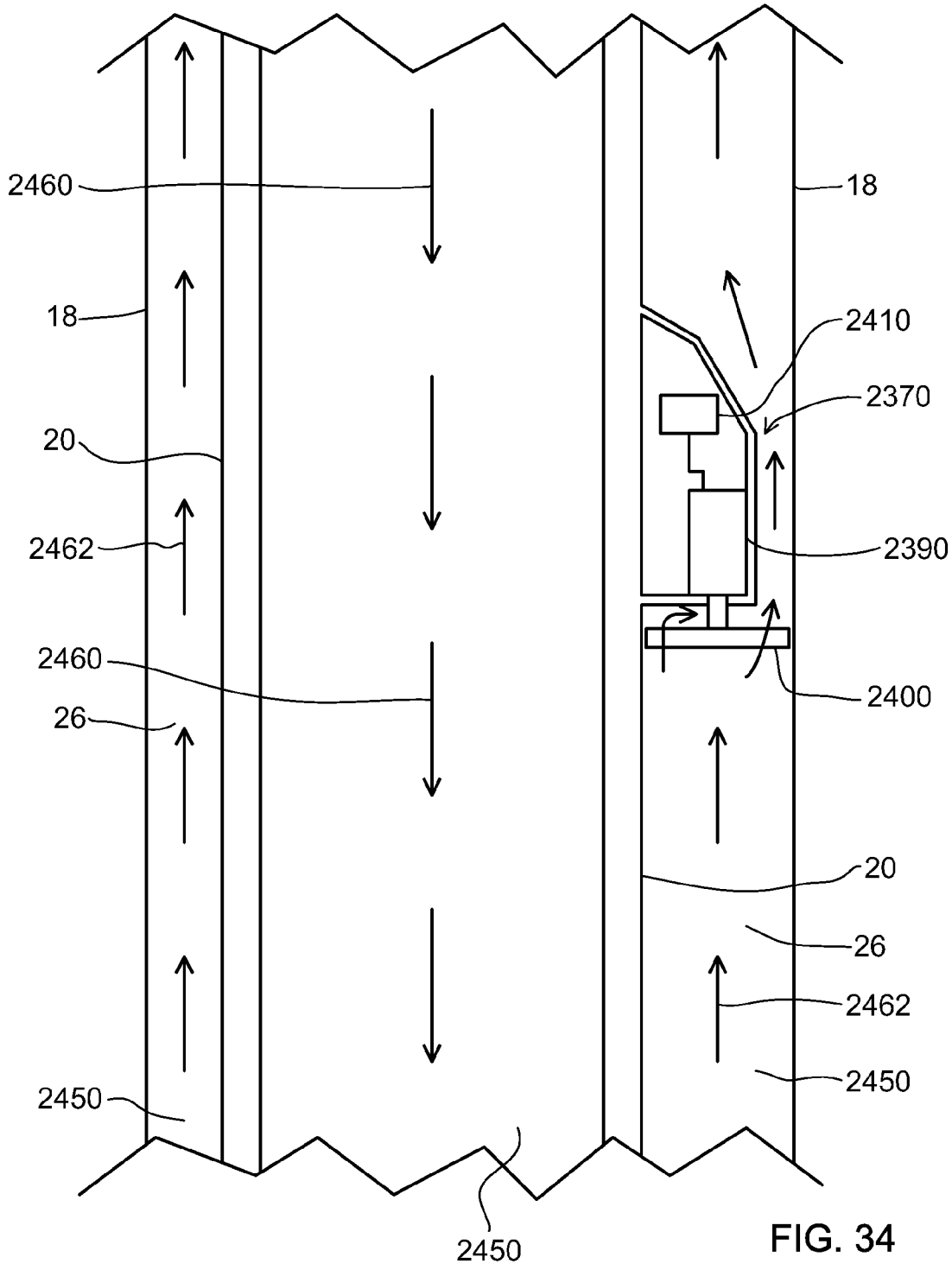
Figure 35:
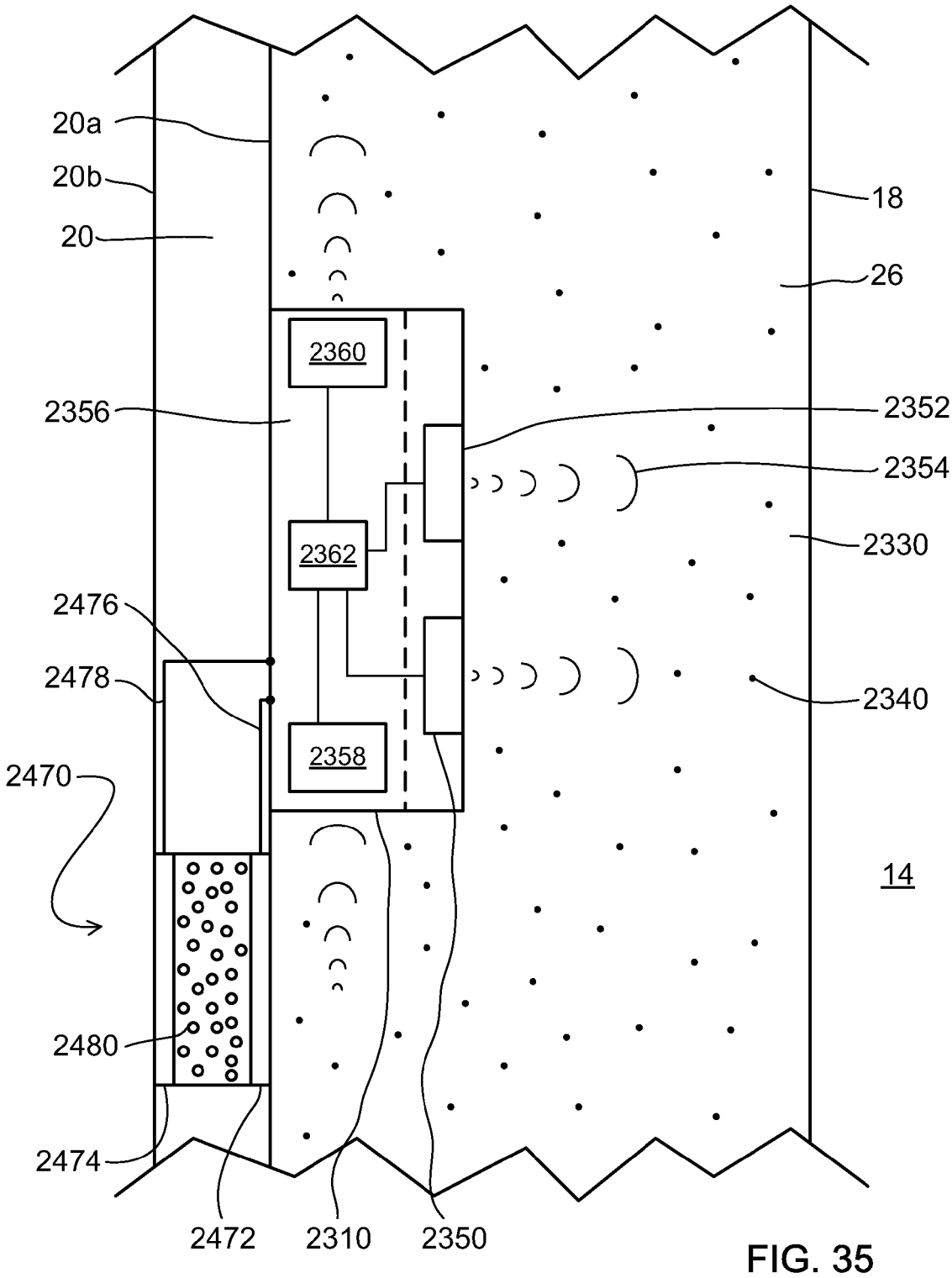

In embodiments, sensors, processing electronics, communication devices and power sources, e.g., a lithium battery, may be integrated inside a housing (e.g., a composite attachment or housing) that may, for example, be attached to an outer surface of a casing. In an embodiment, the housing may comprise a composite resin material. In embodiments, the composite resin material may comprise an epoxy resin. In further embodiments, the composite resin material may comprise at least one ceramic material. In further embodiments, housing of unit 2310 (e.g., composite housing) may extend from the casing and thereby serving additional functions such as a centralizer for the casing. In alternative embodiments, the housing of unit 2310 (e.g., composite housing) may be contained within a recess in the casing and by mounted flush with a wall of the casing. Alternative configurations and locations for the unit 2310 (e.g., a composite housing) are shown in FIGS. 33-35 as described herein. Any of the composite materials described herein may be used in embodiments to form a housing for unit 2310.

In embodiments, sensors (e.g., the acoustic sensors 2352 and/or the MEMS sensors 2340) may measure parameters of a wellbore servicing material in an annulus situated between a casing and an oil or gas formation. The wellbore servicing material may comprise a fluid, a cement slurry, a partially cured cement slurry, a cement sheath, or other materials. Parameters of the wellbore and/or servicing material may be acquired and transmitted continuously or in discrete time, depending on demands. In embodiments, parameters measured by the sensors include velocity of ultrasonic waves, Poisson's ratio, material phases, temperature, flow, compactness, pressure and other parameters described herein. In embodiments, the unit 2310 may contain a plurality of sensor types used for measuring the parameters, and may include lead zirconate titanate (PZT) acoustic transceivers, electromagnetic transceivers, pressure sensors, temperature sensors and other sensors.

In embodiments, unit 2310 may be used, for example, to monitor parameters during a curing process of cement situated in the annulus. In further embodiments, flow of production fluid through production tubing and/or the casing may be monitored. In embodiments an interrogation/communication unit (e.g., unit 2310) may be utilized for collecting data from sensors, processing data, storing information, and/or sending and receiving data. Different types of sensors, including electromagnetic and acoustic sensors as well as MEMS sensors, may be utilized for measuring various properties of a material and determining and/or confirming an actual state of the material. In an embodiment, data to be processed in the interrogation/communication unit may include data from acoustic sensors, e.g., liquid/solid phase, annulus width, homogeneity/heterogeneity of a medium, velocity of acoustic waves through a medium and impedance, as well as data from MEMS sensors, which in embodiments include passive RFID tags and are interrogated electromagnetically. In an embodiment, each interrogation/communication unit may process data pertaining to a vicinity or region of the wellbore associated to the unit.

In a further embodiment, the interrogation/communication unit may further comprise a memory device configured to store data acquired from sensors. The sensor data may be tagged with time of acquisition, sensor type and/or identification information pertaining to the interrogation/communication unit where the data is collected. In an embodiment, raw and/or processed sensor data may be sent to an exterior of a wellbore for further processing or analysis, for example via any of the communication means, methods, or networks disclosed herein.

In an embodiment, data acquired by the interrogation/communication units may be transmitted acoustically from unit to unit and to an exterior of the wellbore, using the casing as an acoustic transmission medium. In a further embodiment, sensor data from each interrogation/communication unit may be transmitted to an exterior of the wellbore, using a very low frequency electromagnetic wave. Alternatively, sensor data from each interrogation/communication unit may be transmitted via a daisy-chain to an exterior of the wellbore, using a very low frequency electromagnetic wave to pass the data along the chain. In a further embodiment, a wire and/or fiber optic line coupled to each of the interrogation/communication units may be used to transmit sensor data from each unit to an exterior of the wellbore, and also used to power the units.

In an embodiment, a circumferential acoustic scanning tool comprising an acoustic transceiver may be lowered into a casing, along which the interrogation/communication units are spaced. The acoustic transceiver in the circumferential acoustic scanning tool may be configured to interrogate corresponding acoustic transceivers in the interrogation/communication units, by transmitting an acoustic signal through the casing to the acoustic transceiver in the unit. In an embodiment, the memory devices in each interrogation/communication unit may be able to store, for example, two weeks worth of sensor data before being interrogated by the circumferential acoustic scanning tool. The acoustic transceiver in the circumferential acoustic scanning tool may further comprise a MEMS sensor interrogation unit, and thereby interrogate and collect data from MEMS sensors.

In embodiments, data interrogation/communication units or tools of the various embodiments disclosed herein may be powered by devices configured to generate electricity while the units are located in the wellbore, for example turbo generator units and/or quantum thermoelectric generator units. The electricity generated by the devices may be used directly by components in the interrogation/communication units or may be stored in a battery or batteries for later use.

FIG. 33 illustrates an embodiment of a turbo generator unit 2370 situated in a side compartment 2380 (e.g., side pocket mandrel) of the casing 20. The turbo generator unit 2370 may comprise a generator 2390 driven by a turbine 2400. The turbo generator unit 2370 may also comprise a battery 2410 for storing electricity generated by the generator 2390.

In an embodiment, a portion of a wellbore servicing fluid 2420 flowing through casing 20 in the direction of arrows 2430 may be diverted in a direction of arrows 2432, into a flow channel 2440 of side compartment 2380, and past turbine 2400. A force of the wellbore servicing fluid 2420 flowing past turbine 2400 causes the turbine 2400 to rotate and drive the generator 2390. In an embodiment, electricity generated by the generator 2390 may power components in one or more interrogation/communication units directly and/or may be stored in battery 2410 for later use by components in one or more interrogation/communication units. In a further embodiment, the turbo generator unit 2370 may also comprise a controller for regulating current flow into the battery 2410 and/or current flow into components of the interrogation/communication units. In an embodiment, the turbo generator unit 2370 is proximate to and/or integral with a unit powered thereby.

FIG. 34 illustrates a further embodiment of the turbo generator unit 2370 shown in FIG. 33. In this embodiment, the turbo generator unit 2370 is situated in the annulus 26 between the wellbore 18 and the casing 20. In addition, the turbo generator unit 2370 is oriented in the annulus 26 such that a wellbore servicing fluid 2450 pumped down an interior of the casing 20 in the direction of arrows 2460 and up the annulus 26 in the direction of arrows 2462 forces the turbine 2400 to rotate and drive generator 2390. As in the embodiment illustrated in FIG. 33, electricity generated by generator 2390 may be stored in battery 2410 or used directly by components situated in an interrogation/communication unit. In addition to or in lieu of the flow of a wellbore servicing fluid as driving the turbo generator unit 2370, a flow of fluid from the formation and/or up the wellbore (e.g., the recovery of hydrocarbons from the well) may provide the fluid flow that powers the turbo generator unit.

In further embodiments, the turbo generator unit 2370 may be oriented in the interior of the casing 20 or in the annulus 26 such that a wellbore servicing fluid flowing in a downhole direction can drive the generator 2390. In other embodiments, the turbo generator unit 2370 may be attached to production tubing instead of the casing 20, and the production of formation fluids may power the turbo generator. An example of a generator attached to production tubing is described in U.S. Pat. No. 5,839,508, which is hereby incorporated by reference herein in its entirety.

In embodiments, thermoelectricity, which may be generally defined as the conversion of temperature differences to electricity, may be used for generating electricity in a wellbore via a thermoelectric generator. In one example of thermoelectricity, electrons in a first material that is at a higher temperature than a second material may quantum-mechanically tunnel from the first material to the second material when a distance between the two materials is sufficiently small. The quantum-mechanical tunneling of the electrons may generate a current that may be used to power downhole devices, e.g., interrogation/communication units and/or MEMS sensors. Examples of utilizing thermoelectricity for powering downhole devices may be found in U.S. Pat. No. 7,647,979, which is hereby incorporated by reference herein in its entirety.

FIG. 35 illustrates an embodiment of a quantum thermoelectric generator 2470, which is disposed in the casing 20 situated in wellbore 18 and is electrically coupled to the interrogation/communication unit 2310. The quantum electric generator 2470 may comprise an emitter electrode 2472, a collector electrode 2474 and leads 2476, 2478 that couple electrodes 2472, 2474 to the unit 2310.

In an embodiment, the wellbore servicing fluid 2330 situated in annulus 26 may comprise a cement slurry, which has been pumped down an interior of the casing 20 and up the annulus 26 and is allowed to cure to form a cement sheath. As the cement cures, exothermic hydration reactions may raise the temperature of the curing slurry, thereby heating an outer wall 20*a* of the casing 20 and creating a temperature gradient in the casing between the outer wall 20*a* and an inner wall 20*b* of the casing 20. In an embodiment, the inner wall 20*b* may be in contact with a displacement fluid, which may have a conductivity and a heat capacity sufficient to maintain the temperature gradient. In an embodiment, in response to a difference in temperature between the emitter electrode 2472 and the collector electrode 2474, electrons 2480 may flow from the emitter electrode 2472 to the collector electrode 2474, thereby generating a current that flows through leads 2476, 2478. In an embodiment, the current generated by quantum thermoelectric generator 2470 may be used to power components in the interrogation/communication unit 2310 and may be fed to the components directly or stored in a battery.

In embodiments, the quantum thermoelectric generator 2470 may be situated in production tubing instead of the casing 20. In other embodiments, heat from other wellbore servicing fluids such as drilling mud may be used to generate a current in the quantum thermoelectric generator 2470. In further embodiments, heat from the oil or gas formation 14 adjacent to the wellbore 18, e.g., from fluids such as hydrocarbons recovered from the formation, may be used to generate a current in the quantum thermoelectric generator 2470.

Disclosed herein is a method of servicing a wellbore, comprising placing a plurality of Micro-Electro-Mechanical System (MEMS) sensors in a wellbore servicing fluid, pumping the wellbore servicing fluid down the wellbore at a fluid flow rate, determining positions of the MEMS sensors in the wellbore, determining velocities of the MEMS sensors along a length of the wellbore, and determining an approximate cross-sectional area profile of the wellbore along the length of the wellbore from at least the velocities of the MEMS sensors and the fluid flow rate. In an embodiment, a constriction in the wellbore is determined in a volumetric region of the wellbore in which average velocities of the MEMS sensors exceed a threshold average velocity determined using the fluid flow rate of the wellbore servicing fluid. In an embodiment, the average velocities of the MEMS sensors fall below the threshold average velocity after the MEMS sensors traverse the constriction. In an embodiment, a washout in the wellbore is determined in a volumetric region of the wellbore in which average velocities of the MEMS sensors fall below a threshold average velocity determined using the fluid flow rate of the wellbore servicing fluid. In an embodiment, the average velocities of the MEMS sensors exceed the threshold average velocity after the MEMS sensors traverse the washout. In an embodiment, a fluid loss zone is determined in a volumetric region of the wellbore in which average velocities of the MEMS sensors fall below, and remain below, a threshold average velocity determined using the fluid flow rate of the wellbore servicing fluid. In an embodiment, the method further comprises determining a return fluid flow rate of the wellbore servicing fluid up the wellbore, wherein the fluid loss zone is additionally determined using the return fluid flow rate of the wellbore servicing fluid. In an embodiment, the positions of the MEMS sensors in the wellbore, the velocities of the MEMS sensors along the length of the wellbore, and the approximate cross-sectional area profile of the wellbore are determined at least approximately in real time. In an embodiment, the positions of the MEMS sensors in the wellbore are determined using a plurality of data interrogation units spaced along the length of the wellbore. In an embodiment, the positions of the MEMS sensors are sensed by the MEMS sensors and are transmittable by a network consisting of the MEMS sensors from an interior of the wellbore to an exterior of the wellbore. In an embodiment, the MEMS sensors are powered by a plurality of power sources spaced along the length of the wellbore. In an embodiment, the MEMS sensors are self-powered. In an embodiment, the MEMS sensors comprise radio frequency identification device (RFID) tags. In an embodiment, the method further comprises determining shapes of wellbore cross-sections along the length of the wellbore, using positions of the MEMS sensors detected as the MEMS sensors traverse the wellbore cross-sections.

Disclosed herein is a method of servicing a wellbore, comprising placing a plurality of Micro-Electro-Mechanical System (MEMS) sensors in a wellbore servicing fluid, placing the wellbore servicing fluid in the wellbore, obtaining data from the MEMS sensors using a plurality of data interrogation units spaced along a length of the wellbore, and processing the data obtained from the MEMS sensors. In an embodiment, the wellbore servicing fluid comprises a drilling fluid, a spacer fluid, a sealant, a fracturing fluid, a gravel pack fluid or a completion fluid. In an embodiment, the MEMS sensors determine one or more parameters. In an embodiment, the one or more parameters comprises at least one physical parameter. In an embodiment, the one or more parameters comprises at least one chemical parameter. In an embodiment, the at least one physical parameter comprises at least one of a temperature, a stress or a strain. In an embodiment, the at least one chemical parameter comprises at least one of a $CO_2$ concentration, an $H_2S$ concentration, a $CH_4$ concentration, a moisture content, a pH, an $Na^+$ concentration, a $K^+$ concentration and a $Cl^-$ concentration. In an embodiment, the data interrogation units are powered via a power line running between the data interrogation units and a power source situated at an exterior of the wellbore. In an embodiment, the data interrogation units are powered by at least one turbogenerator situated in the wellbore. In an embodiment, a turbine in the turbogenerator is driven by at least one of the wellbore servicing fluid and a production fluid flowing through the wellbore. In an embodiment, the data interrogation units are powered by at least one quantum thermoelectric generator situated in the wellbore. In an embodiment, the at least one quantum thermoelectric generator is situated in a casing disposed in the wellbore. In an embodiment, the at least one quantum thermoelectric generator is situated in production tubing disposed in the wellbore. In an embodiment, the MEMS sensors comprise radio frequency identification device (RFID) tags. In an embodiment, the MEMS sensors are powered by the data interrogators. In an embodiment, the MEMS sensors are self-powered. In an embodiment, the wellbore servicing fluid is a cement slurry, wherein the cement slurry is placed in an annulus situated between a wall of the wellbore and an outer wall of a casing situated in the wellbore, wherein the cement slurry is allowed to cure so as to form a cement sheath, and wherein the MEMS sensors are configured to measure at least one of a temperature in the cement sheath, a gas concentration in the cement sheath, a moisture content in the cement sheath, a pH in the cement sheath, a chloride ion concentration in the cement sheath and a mechanical stress of the cement sheath. In an embodiment, the MEMS sensors are configured to measure a gas concentration in the cement slurry, wherein a degree of gas influx into the cement slurry is determined using the gas concentration in the cement slurry. In an embodiment, the method further comprises determining an integrity of the cement sheath using the data obtained from the MEMS sensors. In an embodiment, the MEMS sensors are configured to measure a gas concentration in the cement sheath, wherein a region of the cement sheath is considered to be integral if the gas concentration measured by MEMS sensors situated in an interior of the cement sheath in the region of the cement sheath is less than a threshold value. In an embodiment, the data interrogation units or the MEMS sensors may be activated by a ground-penetrating signal generated by a transmitter situated at an exterior of the wellbore.

Disclosed herein is a method of servicing a wellbore, comprising placing a plurality of Micro-Electro-Mechanical System (MEMS) sensors in a wellbore servicing fluid, placing the wellbore servicing fluid in the wellbore, forming a network comprising the MEMS sensors, and transferring data obtained by the MEMS sensors from an interior of the wellbore to an exterior of the wellbore via the network. In an embodiment, the MEMS sensors are powered by a plurality of power sources spaced along a length of the wellbore. In an embodiment, the MEMS sensors are self-powered. In an embodiment, the wellbore servicing fluid comprises a drilling fluid, a spacer fluid, a sealant, a fracturing fluid, a gravel pack fluid or a completion fluid. In an embodiment, the MEMS sensors determine one or more parameters. In an embodiment, the one or more parameters comprises at least one physical parameter. In an embodiment, the one or more parameters comprises at least one chemical parameter. In an embodiment, the at least one physical parameter comprises at least one of a temperature, a stress or a strain. In an embodiment, the at least one chemical parameter comprises at least one of a $CO_2$ concentration, an $H_2S$ concentration, a $CH_4$ concentration, a moisture content, a pH, an $Na^+$ concentration, a $K^+$ concentration and a $Cl^-$ concentration. In an embodiment, the MEMS sensors comprise radio frequency identification device (RFID) tags.

Disclosed herein is a system, comprising a wellbore, a wellbore servicing fluid situated in the wellbore, the wellbore servicing fluid comprising a plurality of Micro-Electro-Mechanical System (MEMS) sensors, a plurality of data interrogation units spaced along a length of the wellbore and adapted to obtain data from the MEMS sensors, and a processing unit adapted to receive the data from the data interrogation units and process the data. In an embodiment, the wellbore servicing fluid comprises a drilling fluid, a spacer fluid, a sealant, a fracturing fluid, a gravel pack fluid or a completion fluid. In an embodiment, the MEMS sensors are configured to determine one or more parameters. In an embodiment, the one or more parameters comprises at least one physical parameter. In an embodiment, the one or more parameters comprises at least one chemical parameter. In an embodiment, the at least one physical parameter comprises at least one of a temperature, a stress and a strain. In an embodiment, the at least one chemical parameter comprises at least one of a $CO_2$ concentration, an $H_2S$ concentration, a $CH_4$ concentration, a moisture content, a pH, an $Na^+$ concentration, a $K^+$ concentration and a $Cl^-$ concentration. In an embodiment, the data interrogation units are powered via a power line running between the data interrogation units and a power source situated at an exterior of the wellbore. In an embodiment, the data interrogation units are powered by at least one turbogenerator situated in the wellbore. In an embodiment, a turbine in the turbogenerator is driven by at least one of the wellbore servicing fluid and a production fluid flowing through the wellbore. In an embodiment, the data interrogation units are powered by at least one quantum thermoelectric generator situated in the wellbore. In an embodiment, the at least one quantum thermoelectric generator is situated in a casing disposed in the wellbore. In an embodiment, the at least one quantum thermoelectric generator is situated in production tubing disposed in the wellbore. In an embodiment, the MEMS sensors comprise radio frequency identification device (RFID) tags. In an embodiment, the MEMS sensors are powered by the data interrogators. In an embodiment, the MEMS sensors are self-powered. In an embodiment, the data interrogation units or the MEMS sensors may be activated by a ground-penetrating signal generated by a transmitter situated at an exterior of the wellbore.

Disclosed herein is a system, comprising a wellbore, a wellbore servicing fluid situated in the wellbore, the wellbore servicing fluid comprising a plurality of Micro-Electro-Mechanical System (MEMS) sensors, wherein the MEMS sensors are configured to measure at least one parameter and transmit data associated with the at least one parameter from an interior of the wellbore to an exterior of the wellbore via a data transfer network consisting of the MEMS sensors, and a processing unit adapted to receive the data from the MEMS sensors and process the data. In an embodiment, the wellbore servicing fluid comprises a drilling fluid, a spacer fluid, a sealant, a fracturing fluid, a gravel pack fluid or a completion fluid. In an embodiment, the MEMS sensors are configured to determine one or more parameters. In an embodiment, the MEMS sensors are powered by a plurality of power sources spaced along a length of the wellbore. In an embodiment, the MEMS sensors comprise radio frequency identification device (RFID) tags. In an embodiment, the MEMS sensors are self-powered. In an embodiment, the MEMS sensors may be activated by a ground-penetrating signal generated by a transmitter situated at an exterior of the wellbore.

Disclosed herein is a method of servicing a wellbore, comprising placing a plurality of Micro-Electro-Mechanical System (MEMS) sensors in a wellbore servicing fluid, placing the wellbore servicing fluid in the wellbore, obtaining data from the MEMS sensors using a plurality of data interrogation units spaced along a length of the wellbore, telemetrically transmitting the data from an interior of the wellbore to an exterior of the wellbore, using a casing situated in the wellbore, and processing the data obtained from the MEMS sensors. In an embodiment, the wellbore servicing fluid comprises a drilling fluid, a spacer fluid, a sealant, a fracturing fluid, a gravel pack fluid or a completion fluid. In an embodiment, the MEMS sensors determine one or more parameters. In an embodiment, the one or more parameters comprises at least one physical parameter. In an embodiment, the one or more parameters comprises at least one chemical parameter. In an embodiment, the at least one physical parameter comprises at least one of a temperature, a stress or a strain. In an embodiment, the at least one chemical parameter comprises at least one of a $CO_2$ concentration, an $H_2S$ concentration, a $CH_4$ concentration, a moisture content, a pH, an $Na^+$ concentration, a $K^+$ concentration and a $Cl^-$ concentration. In an embodiment, the data interrogation units are powered via a power line running between the data interrogation units and a power source situated at the exterior of the wellbore. In an embodiment, the data interrogation units are powered by at least one turbogenerator situated in the wellbore. In an embodiment, a turbine in the turbogenerator is driven by at least one of the wellbore servicing fluid and a production fluid flowing through the wellbore. In an embodiment, the data interrogation units are powered by at least one quantum thermoelectric generator situated in the wellbore. In an embodiment, the at least one quantum thermoelectric generator is situated in the casing. In an embodiment, the at least one quantum thermoelectric generator is situated in production tubing disposed in the wellbore. In an embodiment, the MEMS sensors comprise radio frequency identification device (RFID) tags. In an embodiment, the MEMS sensors are powered by the data interrogators. In an embodiment, telemetrically transmitting the data from an interior of the wellbore to an exterior of the wellbore comprises transmitting the data on at least one insulated cable embedded in a longitudinal groove in the casing. In an embodiment, telemetrically transmitting the data from an interior of the wellbore to an exterior of the wellbore comprises transmitting the data on the casing, using the casing as an electrically conductive medium for transmission. In an embodiment, telemetrically transmitting the data from an interior of the wellbore to an exterior of the wellbore comprises converting the data into acoustic vibrations of the casing.

Disclosed herein is a system, comprising a wellbore, a casing situated in the wellbore, a wellbore servicing fluid situated in the wellbore, the wellbore servicing fluid comprising a plurality of Micro-Electro-Mechanical System (MEMS) sensors, a plurality of data interrogation units spaced along a length of the wellbore and adapted to obtain data from the MEMS sensors and telemetrically transmit the data from an interior of the wellbore to an entrance of the wellbore via the casing, and a processing unit adapted to receive the data from the data interrogation units and process the data. In an embodiment, the wellbore servicing fluid comprises a drilling fluid, a spacer fluid, a sealant, a fracturing fluid, a gravel pack fluid or a completion fluid. In an embodiment, the MEMS sensors are configured to determine one or more parameters. In an embodiment, the MEMS sensors comprise radio frequency identification device (RFID) tags. In an embodiment, the MEMS sensors are self-powered. In an embodiment, the MEMS sensors are powered by the data interrogators. In an embodiment, the data interrogation units or the MEMS sensors may be activated by a ground-penetrating signal generated by a transmitter situated at an exterior of the wellbore. In an embodiment, the casing comprises at least one cable embedded in a groove that runs longitudinally along at least part of a length of the casing. In an embodiment, the at least one cable is electrically insulated from a remainder of the casing. In an embodiment, the at least one cable comprises a plurality of cables. In an embodiment, the data interrogation units are electrically connected to the at least one cable. In an embodiment, the at least one cable is configured to at least one of a) supply power to the data interrogation units; and b) transmit the data from the data interrogation units to the processing unit. In an embodiment, the casing is configured to at least one of a) supply power to the data interrogation units; and b) transmit the data from the data interrogation units to the processing unit. In an embodiment, the data interrogation units are powered by at least one turbogenerator situated in the wellbore. In an embodiment, a turbine in the turbogenerator is driven by at least one of the wellbore servicing fluid and a production fluid flowing through the wellbore. In an embodiment, the data interrogation units are powered by at least one quantum thermoelectric generator situated in the wellbore. In an embodiment, the at least one quantum thermoelectric generator is situated in the casing. In an embodiment, the at least one quantum thermoelectric generator is situated in production tubing disposed in the wellbore. In an embodiment, the system further comprises at least one acoustic transmitter configured to transmit the data from the MEMS sensors to the processing unit as telemetry signals in the form of acoustic vibrations in the casing. In an embodiment, the system further comprises an acoustic receiver configured to receive the telemetry signals transmitted by the at least one acoustic transmitter. In an embodiment, the system further comprises at least one repeater configured to receive and retransmit the telemetry signals. In an embodiment, each data interrogation unit comprises an acoustic transmitter.

Disclosed herein is a method of servicing a wellbore, comprising pumping a cement slurry down the wellbore, wherein a plurality of Micro-Electro-Mechanical System (MEMS) sensors is added to a portion of the cement slurry that is added to the wellbore prior to a remainder of the cement slurry, and as the cement slurry is traveling through the wellbore, determining positions of the MEMS sensors in the wellbore along a length of the wellbore. In an embodiment, the cement slurry is pumped down a casing situated in the wellbore and up an annulus bounded by the casing and the wellbore. In an embodiment, the cement slurry is pumped down an annulus bounded by a casing situated in the wellbore and the wellbore. In an embodiment, the positions of the MEMS sensors in the wellbore are determined using a plurality of data interrogation units spaced along the length of the wellbore. In an embodiment, entry of the cement slurry into a downhole end of the annulus is determined when at least a portion of the MEMS sensors are detected by a data interrogation unit situated proximate to the downhole end of the annulus. In an embodiment, the pumping is discontinued when at least a portion of the MEMS sensors are detected by a data interrogation unit situated proximate to an uphole end of the annulus. In an embodiment, the pumping is discontinued when at least a portion of the MEMS sensors are detected by a data interrogation unit situated proximate to a downhole end of the annulus. In an embodiment, the MEMS sensors are powered by a plurality of power sources spaced along the length of the wellbore. In an embodiment, the MEMS sensors are self-powered. In an embodiment, the MEMS sensors comprise radio frequency identification device (RFID) tags.

Disclosed herein is a method of servicing a wellbore, comprising placing into a wellbore a first wellbore servicing fluid comprising a plurality of Micro-Electro-Mechanical System (MEMS) sensors having a first type of radio frequency identification device (RFID) tag, after placing the first wellbore servicing fluid into the wellbore, placing into the wellbore a second wellbore servicing fluid comprising a plurality of MEMS sensors having a second type of RFID tag, and determining positions in the wellbore of the MEMS sensors having the first and second types of RFID tags. In an embodiment, the method further comprises determining volumetric regions in the wellbore occupied by the first and second wellbore servicing fluids, using the positions in the wellbore of the MEMS sensors having the first and second types of RFID tags. In an embodiment, the MEMS sensors having the first type of RFID tag are added to a portion of the first wellbore servicing fluid added to the well bore prior to a remainder of the first wellbore servicing fluid, and the MEMS sensors having the second type of RFID tag are added to a portion of the second wellbore servicing fluid added to the well bore prior to a remainder of the second wellbore servicing fluid. In an embodiment, the method further comprises determining an interface of the first wellbore servicing fluid and the second wellbore servicing fluid based on the positions in the wellbore of at least a portion of the MEMS sensors having the second type of RFID tag. In an embodiment, the method further comprises after placing the second wellbore servicing fluid into the wellbore, placing into the wellbore at least one third wellbore servicing fluid comprising a plurality of MEMS sensors having a type of RFID tag different from the RFID tag of the MEMS sensors of the second wellbore servicing fluid. In an embodiment, the RFID tags of the MEMS sensors of the at least one third wellbore servicing fluid are of the same type as the RFID tags of the MEMS sensors of the first wellbore servicing fluid. In an embodiment, the positions of the MEMS sensors in the wellbore are determined using a plurality of data interrogation units spaced along a length of the wellbore. In an embodiment, the MEMS sensors are powered by a plurality of power sources spaced along a length of the wellbore. In an embodiment, the MEMS sensors are self-powered. In an embodiment, apart from the RFID tags, the first and second wellbore servicing fluids are substantially the same compositionally. In an embodiment, irrespective of the RFID tags, the first and second wellbore servicing fluids are compositionally different.

Disclosed herein is a method of servicing a wellbore, comprising placing into a wellbore a first wellbore servicing fluid comprising a plurality of Micro-Electro-Mechanical System (MEMS) sensors having a first type of radio frequency identification device (RFID) tag, after placing the first wellbore servicing fluid into the wellbore, placing into the wellbore a second wellbore servicing fluid comprising a plurality of MEMS sensors having the first type of RFID tag, and determining positions in the wellbore of the MEMS sensors having the first type of RFID tag, wherein the MEMS sensors of the first wellbore servicing fluid are added to a portion of the first wellbore servicing fluid added to the well bore prior to a remainder of the first wellbore servicing fluid, and the MEMS sensors of the second wellbore servicing fluid are added to a portion of the second wellbore servicing fluid added to the well bore prior to a remainder of the second wellbore servicing fluid. In an embodiment, the portions of the first and second wellbore servicing fluids are at least one of (a) of different volumes and (b) of different MEMS sensor loadings. In an embodiment, the at least one of the different volumes and the different sensor loadings of the portions of the first and second wellbore servicing fluids is detectable as a signal by a plurality of data interrogation units spaced along a length of the wellbore and transmittable from the data interrogation units to a processing unit situated at an exterior of the wellbore. In an embodiment, the method further comprises determining at least one of a volumetric region of the wellbore occupied by a wellbore servicing fluid and an interface of the wellbore servicing fluids, using the at least one of the different volumes and the different sensor loadings of the portions of the first and second wellbore servicing fluids. In an embodiment, the method further comprises after placing the second wellbore servicing fluid into the wellbore, placing into the wellbore at least one third wellbore servicing fluid comprising a plurality of MEMS sensors having the first type of RFID tag, wherein the MEMS sensors of the at least one third wellbore servicing fluid are added to a portion of the at least one third wellbore servicing fluid added to the well bore prior to a remainder of the at least one third wellbore servicing fluid. In an embodiment, the first, second and at least one third wellbore servicing fluids are substantially the same compositionally. In an embodiment, the first, second and at least one third wellbore servicing fluids are compositionally different. In an embodiment, the first and at least one third wellbore servicing fluids are substantially the same compositionally, and the second wellbore servicing fluid comprises a spacer fluid. In an embodiment, the first, second and at least one third wellbore servicing fluids comprise a drilling fluid, a spacer fluid and a cement slurry, respectively. In an embodiment, the method further comprises after placing the at least one third wellbore servicing fluid into the wellbore, placing into the wellbore a fourth wellbore servicing fluid comprising a plurality of MEMS sensors having the first type of RFID tag, wherein the MEMS sensors of the fourth wellbore servicing fluid are added to a portion of the fourth wellbore servicing fluid added to the well bore prior to a remainder of the fourth wellbore servicing fluid, wherein the fourth wellbore servicing fluid comprises a displacement fluid. In an embodiment, the first, second, at least one third and fourth wellbore servicing fluids are pumped down a casing of the wellbore; wherein after reaching a downhole end of the wellbore, the first, second and at least one third wellbore servicing fluids are displaced into an annulus bounded by the wellbore and the casing, wherein when the fourth wellbore servicing fluid reaches the downhole end of the wellbore, pumping of the wellbore servicing fluids is discontinued so as to prevent the fourth wellbore servicing fluid from entering the annulus. In an embodiment, the positions of the MEMS sensors in the wellbore are determined using a plurality of data interrogation units spaced along a length of the wellbore. In an embodiment, the MEMS sensors are powered by a plurality of power sources spaced along a length of the wellbore. In an embodiment, the MEMS sensors are self-powered.

Disclosed herein is a method of servicing a wellbore, comprising placing a plurality of MEMS sensors in a fracture that is in communication with the wellbore, the MEMS sensors being configured to measure at least one parameter associated with the fracture, measuring the at least one parameter associated with the fracture, transmitting data regarding the at least one parameter from the MEMS sensors to an exterior of the wellbore, and processing the data. In an embodiment, the at least one parameter comprises a temperature, a stress, a strain, a $CO_2$ concentration, an $H_2S$ concentration, a $CH_4$ concentration, a moisture content, a pH, an $Na^+$ concentration, a $K^+$ concentration or a $Cl^-$ concentration. In an embodiment, the data regarding the at least one parameter is transmitted from the MEMS sensors to the exterior of the wellbore via a plurality of data interrogation units spaced along a length of the wellbore. In an embodiment, the MEMS sensors are powered by a plurality of power sources spaced along a length of the wellbore. In an embodiment, the MEMS sensors are self-powered.

Disclosed herein is a method of servicing a wellbore, comprising placing a plurality of Micro-Electro-Mechanical System (MEMS) sensors in a cement slurry, placing the cement slurry in an annulus disposed between a wall of the wellbore and a casing situated in the wellbore, allowing the cement slurry to cure to form a cement sheath, determining spatial coordinates of the MEMS sensors with respect to the casing, mapping planar coordinates of the MEMS sensors in a plurality of cross-sectional planes spaced along a length of the wellbore.

Disclosed herein is a system, comprising a wellbore, a wellbore servicing fluid situated in the wellbore, the wellbore servicing fluid comprising a plurality of Micro-Electro-Mechanical System (MEMS) sensors, a casing situated in the wellbore, a plurality of centralizers disposed between a wall of the wellbore and the casing, and spaced along a length of the casing, a plurality of data interrogation units, each data interrogation unit being coupled to a separate centralizer, the data interrogation units being adapted to obtain data from the MEMS sensors, and a processing unit situated at an exterior of the wellbore and adapted to receive the data from the data interrogation units and process the data. In an embodiment, the data interrogation units are molded to the centralizers. In an embodiment, the data interrogation units are molded to the centralizers, using a composite resin material. In an embodiment, the data interrogation units are powered by at least one turbogenerator situated in the wellbore. In an embodiment, a turbine in the turbogenerator is driven by at least one of the wellbore servicing fluid and a production fluid flowing through the wellbore. In an embodiment, the data interrogation units are powered by at least one quantum thermoelectric generator situated in the wellbore. In an embodiment, the at least one quantum thermoelectric generator is situated in the casing. In an embodiment, the at least one quantum thermoelectric generator is situated in production tubing disposed in the wellbore.

Disclosed herein is a system, comprising a wellbore, a casing situated in the wellbore, a float collar coupled to the casing proximate to a downhole end of the casing, and a wiper plug comprising MEMS sensors attached to a downhole end of the wiper plug, the wiper plug being configured to engage with the float collar, the MEMS sensors being configured to measure pressure. In an embodiment, the MEMS sensors are molded to the wiper plug, using a composite resin material. In an embodiment, the system further comprises a plurality of data interrogation units attached to an inner wall of the casing and spaced along a length of the casing. In an embodiment, the data interrogation units are molded to the casing, using a composite resin material.

Disclosed herein is a system, comprising a wellbore, a casing situated in the wellbore, a wiper plug, and a float collar coupled to the casing proximate to a downhole end of the casing, the float collar comprising MEMS sensors attached to an uphole end of the float collar, the uphole end of the float collar being configured to engage with the wiper plug, the MEMS sensors being configured to measure pressure. In an embodiment, the MEMS sensors are molded to the float collar, using a composite resin material.

Disclosed herein is a method of servicing a wellbore, comprising pumping a cement slurry down a casing situated in the wellbore and up an annulus situated between the casing and a wall of the wellbore, pumping a wiper plug down the casing, the wiper plug comprising MEMS sensors at a downhole end of the wiper plug configured to engage with a float collar, the float collar being coupled to the casing and situated proximate to a downhole end of the casing, the MEMS sensors being configured to measure pressure, discontinuing pumping of the wiper plug when a pressure measured by the MEMS sensors exceeds a threshold value. In an embodiment, the MEMS sensors are molded to the wiper plug, using a composite resin material. In an embodiment, pumping the wiper plug down the casing comprises pumping a displacement fluid down the casing in back of the wiper plug, wherein discontinuing pumping of the wiper plug comprises terminating pumping of the displacement fluid. In an embodiment, the method further comprises determining a position of the wiper plug along a length of the casing as the wiper plug is pumped down the casing. In an embodiment, determining the position of the wiper plug along the length of the casing comprises interrogating the MEMS sensors using data interrogation units attached to an inner wall of the casing and spaced along the length of the casing.

Disclosed herein is a system, comprising a wellbore, a casing situated in the wellbore, and a plurality of composite resin elements molded to an inner wall of the casing and spaced along a length of the casing, the composite resin elements comprising Micro-Electro-Mechanical System (MEMS) sensors. In an embodiment, the system further comprises a wiper plug situated in the casing, the wiper plug comprising a data interrogation unit configured to interrogate MEMS sensors in a vicinity of the wiper plug. In an embodiment, the MEMS sensors are configured to measure a $CH_4$ concentration in the casing. In an embodiment, the system further comprises a wellbore servicing fluid situated in the wellbore, the wellbore servicing fluid comprising a plurality of MEMS sensors, wherein the MEMS sensors in the wellbore servicing fluid are configured to measure at least one parameter and transmit data associated with the at least one parameter from an interior of the wellbore to an exterior of the wellbore via a data transfer network consisting of the MEMS sensors in the wellbore servicing fluid and the MEMS sensors in the composite resin elements, and a processing unit situated at an exterior of the wellbore and adapted to receive the data from the MEMS sensors and process the data. In an embodiment, the composite resin elements are embedded in grooves in the casing. In an embodiment, the composite resin elements are not raised with respect to the inner wall of the casing. In an embodiment, the composite resin elements are mounted flush with the inner wall of the casing. In an embodiment, the composite resin elements are situated on casing collars.

Disclosed herein is a system, comprising a wellbore, a casing situated in the wellbore, and a plurality of composite resin elements molded to an outer wall of the casing and spaced along a length of the casing, the composite resin elements comprising Micro-Electro-Mechanical System (MEMS) sensors. In an embodiment, the MEMS sensors are configured to measure at least one of a $CH_4$ concentration, a $CO_2$ concentration and an $H_2S$ concentration in an annulus situated between the casing and a wall of the wellbore. In an embodiment, the system further comprises a wellbore servicing fluid situated in the wellbore, the wellbore servicing fluid comprising a plurality of MEMS sensors, wherein the MEMS sensors in the wellbore servicing fluid are configured to measure at least one parameter and transmit data associated with the at least one parameter from an interior of the wellbore to an exterior of the wellbore via a data transfer network consisting of the MEMS sensors in the wellbore servicing fluid and the MEMS sensors in the composite resin elements, and a processing unit situated at an exterior of the wellbore and adapted to receive the data from the MEMS sensors and process the data. In an embodiment, the composite resin elements are embedded in grooves in the casing. In an embodiment, the composite resin elements are not raised with respect to the outer wall of the casing. In an embodiment, the composite resin elements are mounted flush with the outer wall of the casing. In an embodiment, the composite resin elements are situated on casing collars.

Disclosed herein is a method of servicing a wellbore, comprising placing a plurality of Micro-Electro-Mechanical System (MEMS) sensors in a wellbore servicing fluid, placing the wellbore servicing fluid in the wellbore, forming a network consisting of the MEMS sensors in the wellbore servicing fluid and MEMS sensors situated in composite resin elements, the composite resin elements being molded to an inner wall of a casing situated in the wellbore and spaced along a length of the casing, and transmitting data obtained by the MEMS sensors in the wellbore servicing fluid from an interior of the wellbore to an exterior of the wellbore via the network.

Disclosed herein is a method of servicing a wellbore, comprising placing a plurality of Micro-Electro-Mechanical System (MEMS) sensors in a wellbore servicing fluid, placing the wellbore servicing fluid in the wellbore, forming a network consisting of the MEMS sensors in the wellbore servicing fluid and MEMS sensors situated in composite resin elements, the composite resin elements being molded to an outer wall of a casing situated in the wellbore and spaced along a length of the casing, and transmitting data obtained by the MEMS sensors in the wellbore servicing fluid from an interior of the wellbore to an exterior of the wellbore via the network.

Disclosed herein is a system, comprising a wellbore, a casing situated in the wellbore, a plurality of centralizers disposed between a wall of the wellbore and the casing and spaced along a length of the casing, a plurality of composite resin elements molded to the centralizers, the composite resin elements comprising Micro-Electro-Mechanical System (MEMS) sensors. In an embodiment, the MEMS sensors are configured to measure at least one of a $CH_4$ concentration, a $CO_2$ concentration and an $H_2S$ concentration in an annulus situated between the casing and a wall of the wellbore. In an embodiment, the system further comprises a wellbore servicing fluid situated in the wellbore, the wellbore servicing fluid comprising a plurality of MEMS sensors, wherein the MEMS sensors in the wellbore servicing fluid are configured to measure at least one parameter and transmit data associated with the at least one parameter from an interior of the wellbore to an exterior of the wellbore via a data transfer network consisting of the MEMS sensors in the wellbore servicing fluid and the MEMS sensors in the composite resin elements, and a processing unit situated at an exterior of the wellbore and adapted to receive the data from the MEMS sensors and process the data.

Disclosed herein is a method of servicing a wellbore, comprising placing a plurality of Micro-Electro-Mechanical System (MEMS) sensors in a wellbore servicing fluid, placing the wellbore servicing fluid in the wellbore, forming a network consisting of the MEMS sensors in the wellbore servicing fluid and MEMS sensors situated in composite resin elements, the composite resin elements being molded to a plurality of centralizers disposed between a wall of the wellbore and a casing situated in the wellbore, the centralizers being spaced along a length of the casing, and transmitting data obtained by the MEMS sensors in the wellbore servicing fluid from an interior of the wellbore to an exterior of the wellbore via the network.

Disclosed herein is a system, comprising a wellbore, a casing situated in the wellbore, and a plastic casing shoe comprising Micro-Electro-Mechanical System (MEMS) sensors. In an embodiment, the casing shoe comprises a guide shoe. In an embodiment, the casing shoe comprises a float shoe.

Disclosed herein is a system, comprising a wellbore, a casing situated in the wellbore, a wellbore servicing fluid situated in the wellbore, the wellbore servicing fluid comprising a plurality of Micro-Electro-Mechanical System (MEMS) sensors, a plurality of interrogation/communication units spaced along a length of the wellbore, wherein each interrogation/communication unit comprises a radio frequency (RF) transceiver configured to interrogate the MEMS sensors and receive data from the MEMS sensors regarding at least one wellbore parameter measured by the MEMS sensors, at least one acoustic sensor configured to measure at least one further wellbore parameter, an acoustic transceiver configured to receive the MEMS sensor data from the RF transceiver and data from the acoustic sensor regarding the at least one further wellbore parameter and convert the MEMS sensor data and the acoustic sensor data into acoustic signals, the acoustic transceiver comprising an acoustic transmitter configured to transmit the acoustic signals representing the MEMS sensor data and the acoustic sensor data on and up the casing to a neighboring interrogation/communication unit situated uphole from the acoustic transmitter, and an acoustic receiver configured to receive acoustic signals representing the MEMS sensor data and the acoustic sensor data from a neighboring interrogation/communication unit situated downhole from the acoustic receiver and to send the acoustic signals representing the MEMS sensor data and the acoustic sensor data to the acoustic transmitter for further transmission up the casing, and a processing unit situated at an exterior of the wellbore, the processing unit being configured to receive the acoustic signals representing the MEMS sensor data and the acoustic sensor data and to process the MEMS sensor data and the acoustic sensor data. In an embodiment, the interrogation/communication units are powered via a power line running between the units and a power source situated at an exterior of the wellbore. In an embodiment, the interrogation/communication units are powered by at least one turbogenerator situated in the wellbore. In an embodiment, a turbine in the turbogenerator is driven by at least one of the wellbore servicing fluid and a production fluid flowing through the wellbore. In an embodiment, the interrogation/communication units are powered by at least one quantum thermoelectric generator situated in the wellbore. In an embodiment, the at least one quantum thermoelectric generator is situated in the casing. In an embodiment, the at least one quantum thermoelectric generator is situated in production tubing disposed in the wellbore. In an embodiment, the MEMS sensors comprise radio frequency identification device (RFID) tags.

Disclosed herein is a method of servicing a wellbore, comprising placing a wellbore servicing fluid comprising a plurality of Micro-Electro-Mechanical System (MEMS) sensors in the wellbore, placing a plurality of acoustic sensors in the wellbore, obtaining data from the MEMS sensors and data from the acoustic sensors using a plurality of data interrogation and communication units spaced along a length of the wellbore, transmitting the data obtained from the MEMS sensors and the acoustic sensors from an interior of the wellbore to an exterior of the wellbore using the casing as an acoustic transmission medium, and processing the data obtained from the MEMS sensors and the acoustic sensors. In an embodiment, the method further comprises determining a presence of a liquid phase and a solid phase of a cement slurry situated in the wellbore, using the acoustic sensors. In an embodiment, the method further comprises determining a presence of at least one of cracks and voids in a cement sheath situated in the wellbore, using the acoustic sensors. In an embodiment, the method further comprises detecting a presence of MEMS sensors in the wellbore servicing fluid, using the acoustic sensors. In an embodiment, the method further comprises determining a porosity in a formation adjacent to the wellbore, using the acoustic sensors.

Disclosed herein is a method of servicing a wellbore, comprising placing a plurality of Micro-Electro-Mechanical System (MEMS) sensors in a wellbore composition, flowing the wellbore composition in the wellbore, and determining one or more fluid flow properties or characteristics of the wellbore composition from data provided by the MEMS sensors during the flowing of the wellbore composition, wherein the fluid flow properties or characteristics include an indication of laminar and/or turbulent flow of the wellbore composition, wherein the fluid flow properties or characteristics include velocity and/or flow rate of the wellbore composition, and wherein the wellbore composition is circulated in the wellbore and a fluid flow profile is determined over at least a portion of the length of the wellbore. In an embodiment, the method further comprises comparing the fluid flow profile to a theoretical or design standard for the fluid flow profile, wherein the comparing is carried out in real-time during the servicing of the wellbore. In an embodiment, the method further comprises altering or adjusting one or more operational parameters of the servicing of the wellbore in response to the comparing in real time, wherein the altering or adjusting is effective to change a condition of the wellbore, wherein the condition of the wellbore is a build up of material on an interior of the wellbore and the altering or adjusting includes remedial action to reduce an amount of the build up, wherein the wellbore composition is a drilling fluid and the build up is a gelled mud or filter cake, wherein the wellbore is treated to remove at least a portion of the build up, wherein the treatment to remove at least a portion of the build up comprises changing a flow rate of the wellbore composition, changing a characteristic of the wellbore composition, placing an additional composition in the wellbore to react with the build up or change a characteristic of the buildup, moving a conduit within the wellbore, placing a tool downhole to physically contact and removing the build up, or any combination thereof, wherein the fluid flow property or characteristic is an actual time of arrival of at least a portion of the wellbore composition comprising the MEMS sensors, wherein the actual time of arrival is compared to an expected time of arrival to determine a condition of the wellbore, wherein where the actual time of arrival is before the expected time of arrival indicates a decreased flow path through the wellbore, wherein the decreased flow path through the wellbore is attributable at least in part to a build up of gelled mud or filter cake on an interior of the wellbore, and wherein the flow profile identifies a location of one or more areas of restricted flow in the wellbore. In an embodiment, the method further comprises comparing the location of one or more areas of restricted flow in the wellbore to a theoretical or design standard for the wellbore, wherein the one or more areas of restricted fluid flow correspond to an expected location of a downhole tool or component based upon the theoretical or design standard for the wellbore, wherein the downhole tool or component is a casing collar, centralizer, or spacer. Also disclosed herein is a method of servicing a wellbore, comprising placing a plurality of Micro-Electro-Mechanical System (MEMS) sensors in at least a portion of a spacer fluid, a sealant composition, or both, pumping the spacer fluid followed by the sealant composition into the wellbore, and determining one or more fluid flow properties or characteristics of the spacer fluid and/or the cement composition from data provided by the MEMS sensors during the pumping of the spacer fluid and sealant composition into the wellbore, wherein the wellbore comprises a casing forming an annulus with the wellbore wall, wherein the sealant composition is a cement slurry, and wherein the cement slurry is pumped down the annulus in a reverse cementing service. In an embodiment, the method further halts the pumping of the cement slurry in the wellbore in response to detection of MEMS sensors at a given location in the wellbore. In an embodiment, the method further comprises monitoring the wellbore for movement of the MEMS sensors after the halting of the pumping. In an embodiment, the method further comprises signaling an operator upon detection of movement of the MEMS sensors after the halting of the pumping. In an embodiment, the method further comprises activating at least one device to prevent flow out of the well upon detection of movement of the MEMS sensors after the halting of the pumping.

Disclosed herein is a method of servicing a wellbore, comprising placing a plurality of Micro-Electro-Mechanical System (MEMS) sensors in at least a portion of a sealant composition, placing the sealant composition in an annular space formed between a casing and the wellbore wall, and monitoring, via the MEMS sensors, the sealant composition and/or the annular space for a presence of gas, water, or both, wherein the sealant composition is a cement slurry and wherein the monitoring is carried out prior to setting of the cement slurry. In an embodiment, the method further comprises signaling an operator upon detection of gas and/or water. In an embodiment, the method further comprises providing a location in the wellbore corresponding a detection of gas and/or water. In an embodiment, the method further comprises applying pressure to the well upon detection of gas and/or water. In an embodiment, the method further comprises activating at least one device to prevent flow out of the well upon detection gas and/or water, wherein the cement slurry is pumped down the annulus in a reverse cementing service, wherein the cement slurry is pumped down the casing and up the annulus in a conventional cementing service, wherein the sealant composition is a cement slurry and wherein the monitoring is carried out after setting of the cement slurry, and wherein the monitoring is carried out by running an interrogator tool into the wellbore at one or more service intervals over the operating life of the well. In an embodiment, the method further comprises providing a location in the wellbore corresponding a detection of gas and/or water. In an embodiment, the method further comprises assessing the integrity of the casing and/or the cement proximate the location where gas and/or water is detected. In an embodiment, the method further comprises performing a remedial action on the casing and/or the cement proximate the location where gas and/or water is detected, wherein the remedial action comprises placing additional sealant composition proximate the location where gas and/or water is detected, wherein the remedial action comprises replacing and/or reinforcing the casing proximate the location where gas and/or water is detected. In an embodiment, the method further comprises upon detection of gas and/or water, adjusting an operating condition of the well, wherein the operating condition comprises temperature, pressure, production rate, length of service interval, or any combination thereof, wherein adjusting the operating condition extends an expected service life of the wellbore. Also disclosed herein is a method of servicing a wellbore, comprising placing a plurality of Micro-Electro-Mechanical System (MEMS) sensors in a wellbore composition, placing the wellbore composition in the wellbore, and monitoring, via the MEMS sensors, the wellbore and/or the surrounding formation for movement, wherein the MEMS sensors are in a sealant composition placed within an annular casing space in the wellbore and wherein the movement comprises a relative movement between the sealant composition and the adjacent casing and/or wellbore wall, wherein at least a portion of the wellbore composition comprising the MEMS flows into the surrounding formation and wherein the movement comprises a movement in the formation. In an embodiment, the method further comprises upon detection of the movement in the formation, adjusting an operating condition of the well, wherein the operating condition comprises a production rate of the wellbore, wherein adjusting the production rate extends an expected service life of the wellbore, wherein the gas comprises carbon dioxide, hydrogen sulfide, or combinations thereof, wherein a corrosive gas is detected, wherein the integrity of the casing and/or cement is compromised via corrosion and further comprising performing a remedial action on the casing and/or the cement proximate the location where corrosion is present, wherein the wellbore is associated with a carbon dioxide injection system and wherein the monitoring an undesirable leak or loss of zonal isolation in the wellbore. In an embodiment, the method further comprises performing a remedial action on the casing and/or the cement proximate a location where the leak or loss of zonal isolation is detected. In an embodiment, the method further comprises placing carbon dioxide into the wellbore and surrounding formation to sequester the carbon dioxide.

Improved methods of monitoring wellbore and/or surround formation parameters and conditions (e.g., sealant condition) from inception (e.g., drilling and completion) through the service lifetime of the wellbore as disclosed herein provide a number of advantages. Such methods are capable of detecting changes in parameters in wellbore and/or surrounding formation such as moisture content, temperature, pH, the concentration of ions (e.g., chloride, sodium, and potassium ions), the presence of gas, etc. Such methods provide this data for monitoring the condition of the wellbore and/or formation from the initial quality control period (e.g., during drilling and/or completion of the wellbore, for example during cementing of the wellbore), through the well's useful service life, and through its period of deterioration and/or repair. Such methods are cost efficient and allow determination of real-time data using sensors capable of functioning without the need for a direct power source (i.e., passive rather than active sensors), such that sensor size be minimal to avoid an operational limitations (for example, small MEMS sensors to maintain sealant strength and sealant slurry pumpability). The use of MEMS sensors for determining wellbore and/or formation characteristics or parameters may also be utilized in methods of pricing a well servicing treatment, selecting a treatment for the well servicing operation, and/or monitoring a well servicing treatment during real-time performance thereof, for example, as described in U.S. Pat. Pub. No. 2006/0047527 A1, which is incorporated by reference herein in its entirety.

While embodiments of the methods have been shown and described, modifications thereof can be made by one skilled in the art without departing from the spirit and teachings of the present disclosure. The embodiments described herein are exemplary only, and are not intended to be limiting. Many variations and modifications of the methods disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of servicing a wellbore, comprising:

placing a wellbore composition comprising a plurality of Micro-Electro-Mechanical System (MEMS) sensors in the wellbore, wherein the wellbore composition comprises a drilling fluid, a spacer fluid, a sealant, a fracturing fluid, a gravel pack fluid, or a completion fluid;

placing a plurality of acoustic sensors in the wellbore;

obtaining data from the MEMS sensors and data from the acoustic sensors using a plurality of data interrogation units spaced along a length of the wellbore; and transmitting the data obtained from the MEMS sensors and the acoustic sensors from an interior of the wellbore to an exterior of the wellbore.

2. The method of claim 1, wherein the wellbore composition comprises a cement composition and further comprising determining a presence of a liquid phase or a solid phase of the cement composition based upon the data from the MEMS sensors and/or data from the acoustic sensors.

3. The method of claim 1, wherein the wellbore composition comprises a cement composition and further comprising determining a presence of a crack or void in the cement composition based upon the data from the MEMS sensors and/or data from the acoustic sensors.

4. The method of claim 1, further comprising determining a porosity or geometric characteristic in a formation adjacent to the wellbore based upon the data from the MEMS sensors and/or data from the acoustic sensors.

5. The method of claim 1, further comprising detecting a presence of MEMS sensors in the wellbore composition using the acoustic sensors.

6. The method of claim 1, wherein the data from the MEMS sensors and/or data from the acoustic sensors is transmitted from downhole to the surface via an acoustic transmission medium.

7. The method of claim 1, wherein one or more of the plurality of data interrogation units is powered by a turbogenerator located in the wellbore.

8. The method of claim 1, wherein one or more of the plurality of data interrogation units is powered by a thermoelectric generator located in the wellbore.

9. The method of claim 1, wherein one or more of the data interrogation units are powered by a battery.

10. A system, comprising:

a wellbore;

a casing positioned in the wellbore;

a wellbore composition positioned in the wellbore, the wellbore composition comprising a plurality of Micro-Electro-Mechanical System (MEMS) sensors;

a plurality of data interrogation units spaced along a length of the wellbore, wherein one or more of the data interrogation units comprises:

a radio frequency (RF) transceiver configured to interrogate the MEMS sensors and receive data from the MEMS sensors regarding at least one wellbore parameter measured by the MEMS sensors, wherein the MEMS sensors comprise radio frequency identification device (RFID) tags; and at least one acoustic sensor configured to measure at least one further wellbore parameter.

11. The system of claim 10, wherein one or more of the data interrogation units are powered via a power line running between the data interrogation units and a power source positioned at an exterior of the wellbore.

12. The system of claim 10, wherein one or more of the data interrogation units are powered by at least one thermoelectric generator positioned in the wellbore.

13. The system of claim 12, wherein the at least one thermoelectric generator is positioned in the casing.

14. The system of claim 12, wherein the at least one thermoelectric generator is positioned in production tubing disposed in the wellbore.

15. A system, comprising:

a wellbore;

a casing positioned in the wellbore;

a wellbore composition positioned in the wellbore, the wellbore composition comprising a plurality of Micro-Electro-Mechanical System (MEMS) sensors;

a plurality of data interrogation units spaced along a length of the wellbore, wherein one or more of the data interrogation units comprises:

a radio frequency (RF) transceiver configured to interrogate the MEMS sensors and receive data from the MEMS sensors regarding at least one wellbore parameter measured by the MEMS sensors;

at least one acoustic sensor configured to measure at least one further wellbore parameter; and an acoustic transceiver configured to receive the MEMS sensor data from the RF transceiver and data from the acoustic sensor regarding the at least one further wellbore parameter and convert the MEMS sensor data and the acoustic sensor data into acoustic signals.

16. The system of claim 15, wherein the acoustic transceiver comprises:

an acoustic transmitter configured to transmit the acoustic signals representing the MEMS sensor data and the acoustic sensor data up the casing to a neighboring communication box positioned uphole from the acoustic transmitter; and an acoustic receiver configured to receive acoustic signals representing the MEMS sensor data and the acoustic sensor data from a neighboring communication box positioned downhole from the acoustic receiver and to send the acoustic signals representing the MEMS sensor data and the acoustic sensor data to the acoustic transmitter for further transmission up the casing.

17. The system of claim 16, further comprising a processing unit positioned at an exterior of the wellbore, the processing unit being configured to receive the acoustic signals representing the MEMS sensor data and the acoustic sensor data and to process the MEMS sensor data and the acoustic sensor data.

18. A system, comprising:

a wellbore;

a casing positioned in the wellbore;

a wellbore composition positioned in the wellbore, composition comprising a plurality of Micro-Electro-Mechanical System (MEMS) sensors;

a plurality of data interrogation units spaced along a length of the wellbore, wherein one or more of the data interrogation units comprises:

a radio frequency (RF) transceiver configured to interrogate the MEMS sensors and receive data from the MEMS sensors regarding at least one wellbore parameter measured by the MEMS sensors; and at least one acoustic sensor configured to measure at least one further wellbore parameter, wherein one or more of the data interrogation units are powered by at least one turbogenerator positioned in the wellbore.

19. The system of claim 18, wherein a turbine in the turbogenerator is driven by at least one of the wellbore composition and a production fluid flowing through the wellbore.

* * * * *